US008418272B2

(12) United States Patent
Nishimura et al.

(10) Patent No.: US 8,418,272 B2
(45) Date of Patent: Apr. 16, 2013

(54) TOILET SEAT APPARATUS

(75) Inventors: Makoto Nishimura, Osaka (JP); Shigeru Shirai, Nara (JP); Hideki Ohno, Nara (JP); Yoshiharu Shimada, Nara (JP); Tomoko Ishida, Nara (JP); Yuji Yamamoto, Nara (JP); Shinji Fujii, Shiga (JP); Yoshiko Kurimoto, Osaka (JP); Kazuya Kondoh, Osaka (JP); Masahiro Inoue, Nara (JP); Toru Ueno, Nara (JP)

(73) Assignee: Panasonic Corporation, Osaka (JP)

( * ) Notice: Subject to any disclaimer, the term of this patent is extended or adjusted under 35 U.S.C. 154(b) by 281 days.

(21) Appl. No.: 12/530,678

(22) PCT Filed: Mar. 11, 2008

(86) PCT No.: PCT/JP2008/000534

§ 371 (c)(1),
(2), (4) Date: Sep. 10, 2009

(87) PCT Pub. No.: WO2008/120450

PCT Pub. Date: Oct. 9, 2008

(65) Prior Publication Data

US 2010/0095443 A1 Apr. 22, 2010

(30) Foreign Application Priority Data

Mar. 12, 2007 (JP) ..... 2007-062675
Aug. 30, 2007 (JP) ..... 2007-224901

(51) Int. Cl.
*A47K 13/00* (2006.01)

(52) U.S. Cl.
USPC ..... 4/237; 4/DIG. 6; 219/217

(58) Field of Classification Search ..... 4/237, DIG. 6; 297/180.12; 219/217, 522, 536, 542, 544, 219/546–548
See application file for complete search history.

(56) References Cited

U.S. PATENT DOCUMENTS 4,901,994 A 2/1990 Ishiguro et al.
RE34,460 E 11/1993 Ishiguro et al.
(Continued)

FOREIGN PATENT DOCUMENTS

JP 56-22100 2/1981
JP 60-143584 7/1985
(Continued)

OTHER PUBLICATIONS

A partial English language translation of paragraphs [0008]-[0014] and Figs. 1-3 of JP 2005-110838.

(Continued)

*Primary Examiner* — Gregory Huson
*Assistant Examiner* — Janie Christiansen
(74) *Attorney, Agent, or Firm* — Greenblum & Bernstein P.L.C.

(57) ABSTRACT

A linear heater is formed of an enamel wire composed of a heating wire and an enamel layer. The heating wire is made of a copper alloy containing silver, for example. The enamel layer is made of polyester imide (PEI), polyimide (PI) or polyamide imide (PAI), for example. The enamel layer is coated with an insulating coating layer. The insulating coating layer is made of fluororesin such as perfluoroalkoxy mixture (PFA), polyimide (PI), or polyamide imide (PAI). The linear heater is bonded to the lower surface of an upper toilet seat casing such that it is sandwiched between a metal foil and a metal foil made of aluminum, for example.

15 Claims, 84 Drawing Sheets

U.S. PATENT DOCUMENTS

| | | | | |
|---|---|---|---|---|
| 5,606,152 | A | 2/1997 | Higashiura et al. | |
| 5,725,953 | A | 3/1998 | Onishi et al. | |
| 5,940,895 | A * | 8/1999 | Wilson et al. | 4/237 |
| 6,294,770 | B1 | 9/2001 | Hasegawa et al. | |
| 6,849,838 | B2 * | 2/2005 | Shimizu et al. | 219/635 |
| 7,500,536 | B2 * | 3/2009 | Bulgajewski et al. | 180/273 |

FOREIGN PATENT DOCUMENTS

| | | | |
|---|---|---|---|
| JP | 61-47087 | A | 3/1986 |
| JP | 61-103426 | A | 5/1986 |
| JP | 62-161897 | | 10/1987 |
| JP | 63-109492 | U | 7/1988 |
| JP | 64-32827 | A | 2/1989 |
| JP | 64-53989 | | 3/1989 |
| JP | 3-75027 | | 3/1991 |
| JP | 6-206436 | | 7/1994 |
| JP | 6-223634 | | 8/1994 |
| JP | 6-283259 | | 10/1994 |
| JP | 6-283259 | A | 10/1994 |
| JP | 7-9198 | U | 2/1995 |
| JP | 7-31563 | | 2/1995 |
| JP | 7-336876 | | 12/1995 |
| JP | 8-315647 | | 11/1996 |
| JP | 2000-83860 | | 3/2000 |
| JP | 2000-210230 | | 8/2000 |
| JP | 2001-110555 | A | 4/2001 |
| JP | 2002-006654 | | 1/2002 |
| JP | 2002-6654 | | 1/2002 |
| JP | 2003-119439 | | 4/2003 |
| JP | 2003-310485 | | 11/2003 |
| JP | 2003-310485 | A | 11/2003 |
| JP | 2004-303648 | | 10/2004 |
| JP | 2005-005075 | | 1/2005 |
| JP | 2005-110838 | | 4/2005 |
| JP | 2005-158616 | | 6/2005 |
| JP | 2005-158616 | A | 6/2005 |
| JP | 2005-192896 | | 7/2005 |
| JP | 2005-222716 | | 8/2005 |
| JP | 2006-204449 | A | 8/2006 |

OTHER PUBLICATIONS

A partial English language translation of paragraph [0006] of JP 2002-6654.
English language Abstract of JP 2005-110838, Apr. 28, 2005.
English language Abstract of JP 6-283259, Oct. 7, 1994.
English language Abstract of JP 2005-158616, Jun. 16, 2005.
English language Abstract of JP 2005-222716, Aug. 18, 2005.
English language Abstract of JP 2002-6654, Jan. 11, 2002.
English language Abstract of JP 2003-310485, Nov. 5, 2003.
English language Abstract of JP 2000-210230, Aug. 2, 2000.
English language translation of JP 2005-222716.
Japan Office action, mail date is Jan. 29, 2013.

* cited by examiner (a)

(b)

(a)

(b)

(a) FIRST-SIDE SHEATHED HEATER (b) SECOND-SIDE SHEATHED HEATER (a) FIRST-SIDE SHEATHED HEATER (b) SECOND-SIDE SHEATHED HEATER (a) FIRST-SIDE SHEATHED HEATER (b) SECOND-SIDE SHEATHED HEATER (a) FIRST-SIDE SHEATHED HEATER (b) SECOND-SIDE SHEATHED HEATER (a) FIRST-SIDE SHEATHED HEATER (b) SECOND-SIDE SHEATHED HEATER (a) FIRST-SIDE SHEATHED HEATER (b) SECOND-SIDE SHEATHED HEATER (a)

(b)

(a)

(b)

(c)

TOILET SEAT APPARATUS

TECHNICAL FIELD

The present invention relates to a toilet seat apparatus.

BACKGROUND ART

In the field of sanitary washing apparatuses that wash the local areas of human bodies, apparatuses having various functions have been devised in order to avoid discomfort of human bodies, including, for example, heater apparatuses that adjust the washing water to proper temperatures, toilet seat apparatuses that properly adjust the temperature of the area where the human body contacts, and so on. Among them, a toilet seat apparatus as mentioned above allows the user to sit on the toilet seat without feeling discomfort even when temperature is low, as in winter (for example, see Patent Document 1).

In the sanitary washing apparatus of Patent Document 1, a linear heater is provided in a toilet seat casing made of magnesium alloy. The linear heater is composed of a core wire, a heating wire wound around the core wire, and a coating tube that coats the core wire and heating wire. The linear heater is arranged in a serpentine manner all over the back surface of the toilet seat casing, and power-supply circuitry is connected to both ends of the heating wire.

In such a structure, a voltage is applied from the power-supply circuitry to the heating wire to cause the heating wire to generate heat. Then, the heat is conducted to the toilet seat casing through the coating tube. Thus, the temperature of the toilet seat casing rises and the user can sit on the toilet seat comfortably.

[Patent Document 1] JP 2003-310485 A

DISCLOSURE OF THE INVENTION

Problems to be Solved by the Invention

By the way, in the conventional sanitary washing apparatus as described above, the coating tube made of, e.g. silicone rubber or vinyl chloride, is used to insulate the heating wire and the toilet seat casing. In this case, the thickness of the coating tube has to be large because of manufacturing factors and in order to ensure electrical insulation.

However, when the coating tube is thick, the heat transfer efficiency from the heating wire to the toilet seat casing deteriorates, and the temperature of the toilet seat casing cannot be quickly raised.

An object of the present invention is to provide a toilet seat apparatus that is capable of quickly raising the temperature of the toilet seat while certainly insulating the toilet seat and a heating wire.

Means for Solving the Problems (1) According to an aspect of the present invention, a toilet seat apparatus includes: a toilet seat having a seat surface and including metal material, a heating wire provided on a back side of the seat surface of the toilet seat, an enamel layer provided to coat a periphery of the heating wire, and an insulating layer provided between the toilet seat and the enamel layer.

In the toilet seat apparatus, the heat generated in the heating wire is transferred to the toilet seat through the enamel layer and the insulating layer. The temperature of the toilet seat thus rises.

The enamel layer has sufficient electrical insulating properties. Accordingly, the heating wire and the toilet seat can be sufficiently insulated even when the thickness of the enamel layer is small. Also, this allows the insulating layer to be formed thinner.

Thus, in the toilet seat apparatus, it is possible to reduce the thicknesses of the enamel layer and the insulating layer, while certainly insulating the heating wire and the toilet seat. In this case, the heat capacities of the enamel layer and the insulating layer can be smaller, so that the heat generated in the heating wire can be quickly and efficiently transferred to the toilet seat.

Also, in this toilet seat apparatus, metal material is used for the toilet seat. Accordingly, the heat generated in the heating wire can be further efficiently transferred to the toilet seat.

Because of these factors, it is possible to quickly raise the temperature of the toilet seat while certainly insulating the heating wire and the toilet seat.

Also, because the heat of the heating wire can be efficiently transferred to the toilet seat, the amount of heat generation of the heating wire can be reduced. This improves the durabilities of the enamel layer and the insulating layer. This improves the reliability of the toilet seat apparatus.

Also, because the thickness of the layers for insulating the heating wire and the toilet seat can be smaller, the weight of the toilet seat apparatus can be reduced.

Also, because the enamel layer having sufficient heat resistance is provided on the periphery of the heating wire, material with lower heat resistance can be used as the insulating layer. This certainly reduces the product costs of the toilet seat apparatus.

(2) The enamel layer may contain at least one of polyester imide and polyamide imide.

In this case, polyester imide and polyamide imide have excellent electric insulating properties and excellent heat resisting properties, making it possible to quickly raise the temperature of the toilet seat while more certainly insulating the heating wire and the toilet seat.

(3) The total of a thickness of the enamel layer and a thickness of the insulating layer may be not more than 0.4 mm. In this case, it is possible to more quickly raise the temperature of the toilet seat while certainly insulating the heating wire and the toilet seat.

(4) The total of the thickness of the enamel layer and the thickness of the insulating layer may be not more than 0.2 mm. In this case, the temperature of the toilet seat can be further quickly raised.

(5) The insulating layer may be made of material that has lower heat resistance than the enamel layer. In this case, the product costs of the toilet seat apparatus can be sufficiently reduced.

(6) The insulating layer may include an insulating coating layer that is provided to coat a periphery of the enamel layer. In this case, the heating wire can be certainly insulated from the toilet seat and other components of the toilet seat apparatus.

(7) The insulating coating layer may include fluororesin. In this case, the heating wire and the toilet seat can be more certainly insulated, and the durability of the insulating coating layer is improved. This improves the reliability of the toilet seat apparatus.

(8) The insulating coating layer may include polyimide. In this case, the durability of the insulating coating layer is improved. This improves the reliability of the toilet seat apparatus.

(9) The toilet seat apparatus may further include first and second metal foils provided on the back side of the toilet seat, and one side of the first metal foil may be bonded to the back side of the toilet seat, and one side of the second metal foil may be bonded to the other side of the first metal foil such that the heating wire, the enamel layer, and the insulating coating layer are sandwiched between the first metal foil and the second metal foil.

In the toilet seat apparatus, the heating wire, the enamel layer, and the insulating coating layer are sandwiched between the first and second metal foils, so that the heat generated in the heating wire is efficiently transferred to the first and second metal foils. Also, one side of the first metal foil is bonded to the back side of the toilet seat, and one side of the second metal foil is bonded to the other side of the first metal foil. Accordingly, the heat transferred from the heating wire to the first and second metal foils can be efficiently transmitted to the entire back surface of the toilet seat. This makes it possible to uniformly raise the temperature in the entire seat surface of the toilet seat.

(10) The first and second metal foils may be made of aluminum. In this case, the heat generated in the heating wire can be further quickly transferred to the toilet seat.

(11) The insulating layer may include a heat resisting insulating layer provided between the first metal foil on the back side of the toilet seat and the insulating coating layer. In this case, the heat resisting insulating layer more certainly insulates the heating wire and the toilet seat.

(12) The toilet seat apparatus may further include a lead wire connected to the heating wire, and a connection between the lead wire and the heating wire may be provided between the first metal foil and the second metal foil.

In this case, the heat generated in the connection between the lead wire and the heating wire is transferred to the first and second metal foils, and the temperature of the toilet seat can be further quickly raised.

(13) The connection may be coated with an insulator. In this case, the connection and the toilet seat can be certainly insulated.

(14) The connection may be coated with resin material. In this case, the connection can be certainly waterproofed.

(15) The heating wire may be made of alloy material. In this case, it is possible to reduce the diameter of the heating wire while ensuring the strength of the heating wire. This allows the long heating wire to be densely arranged in a small space. This improves the rate of temperature rise of the toilet seat.

(16) The alloy material may include silver and copper. In this case, it is possible to reduce the diameter of the heating wire while sufficiently ensuring the strength of the heating wire. This allows the long heating wire to be densely arranged in a small space. This improves the rate of temperature rise of the toilet seat. For example, when the alloy material contains 4 weight percent of silver, the strength of the heating wire can be certainly improved.

(17) The toilet seat may be made of material including at least one of aluminum, copper, stainless, aluminum plated steel and zinc aluminum plated steel. In this case, the heat generated in the heating wire can be further efficiently transferred to the toilet seat.

Effects of the Invention

According to the present invention, it is possible to provide a toilet seat apparatus that can quickly raise the temperature of the toilet seat while certainly insulating the toilet seat and a heating wire.

BEST MODE FOR CARRYING OUT THE INVENTION

Figure 1:
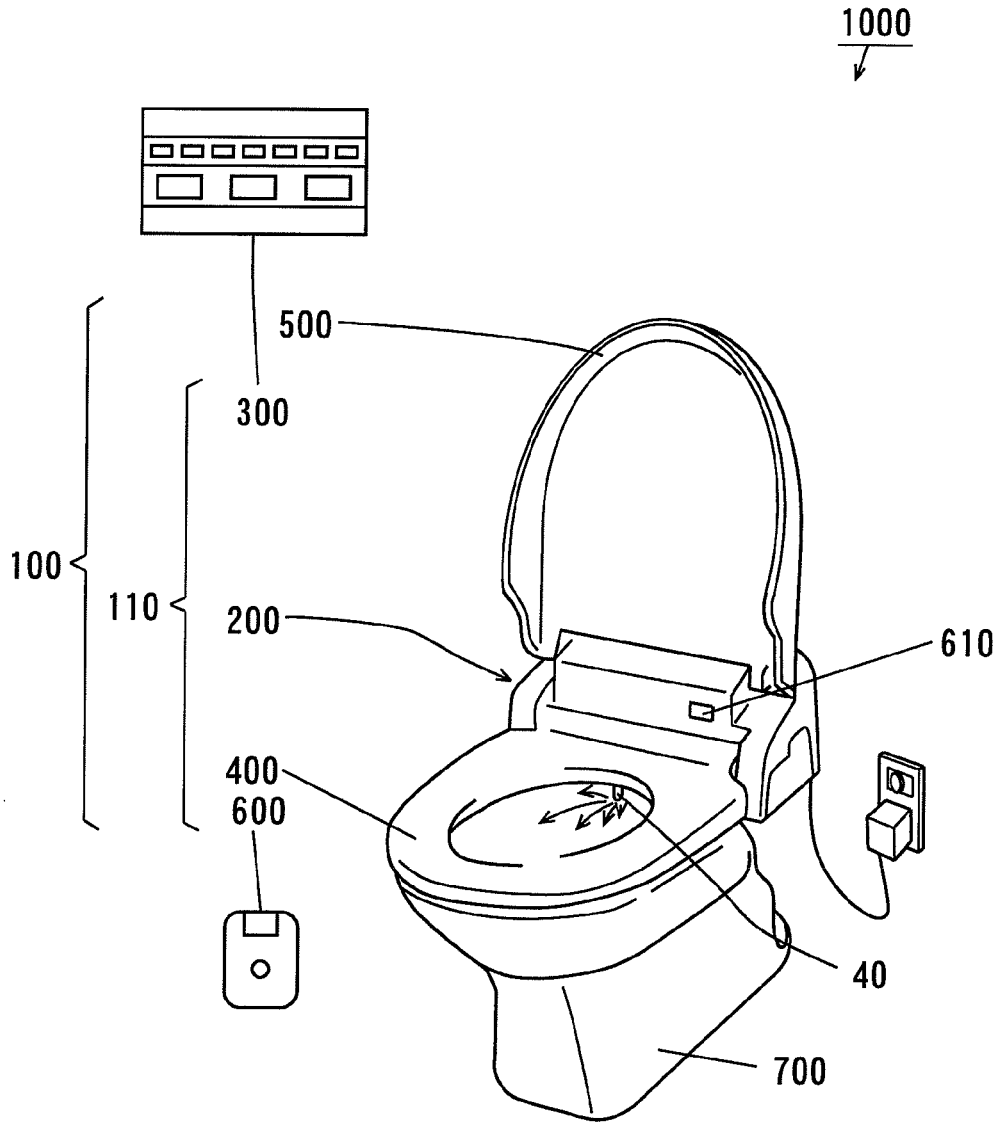
FIG. 1 is a perspective view illustrating the appearance of a sanitary washing apparatus according to one embodiment of the present invention and a toilet apparatus having the same.

<1> Appearance of Sanitary Washing Apparatus and Toilet Apparatus Having the Same FIG. 1 is a perspective view illustrating the appearance of a sanitary washing apparatus of one embodiment of the present invention and a toilet apparatus having the same. A toilet apparatus 1000 is installed in a lavatory.

In the toilet apparatus 1000, a sanitary washing apparatus 100 is attached to a toilet 700. The sanitary washing apparatus 100 includes a main body 200, a remote controller 300, a toilet seat 400, and a lid 500. The components of the sanitary washing apparatus 100 except the lid 500 constitute a toilet seat apparatus 110 described below.

Figure 3:
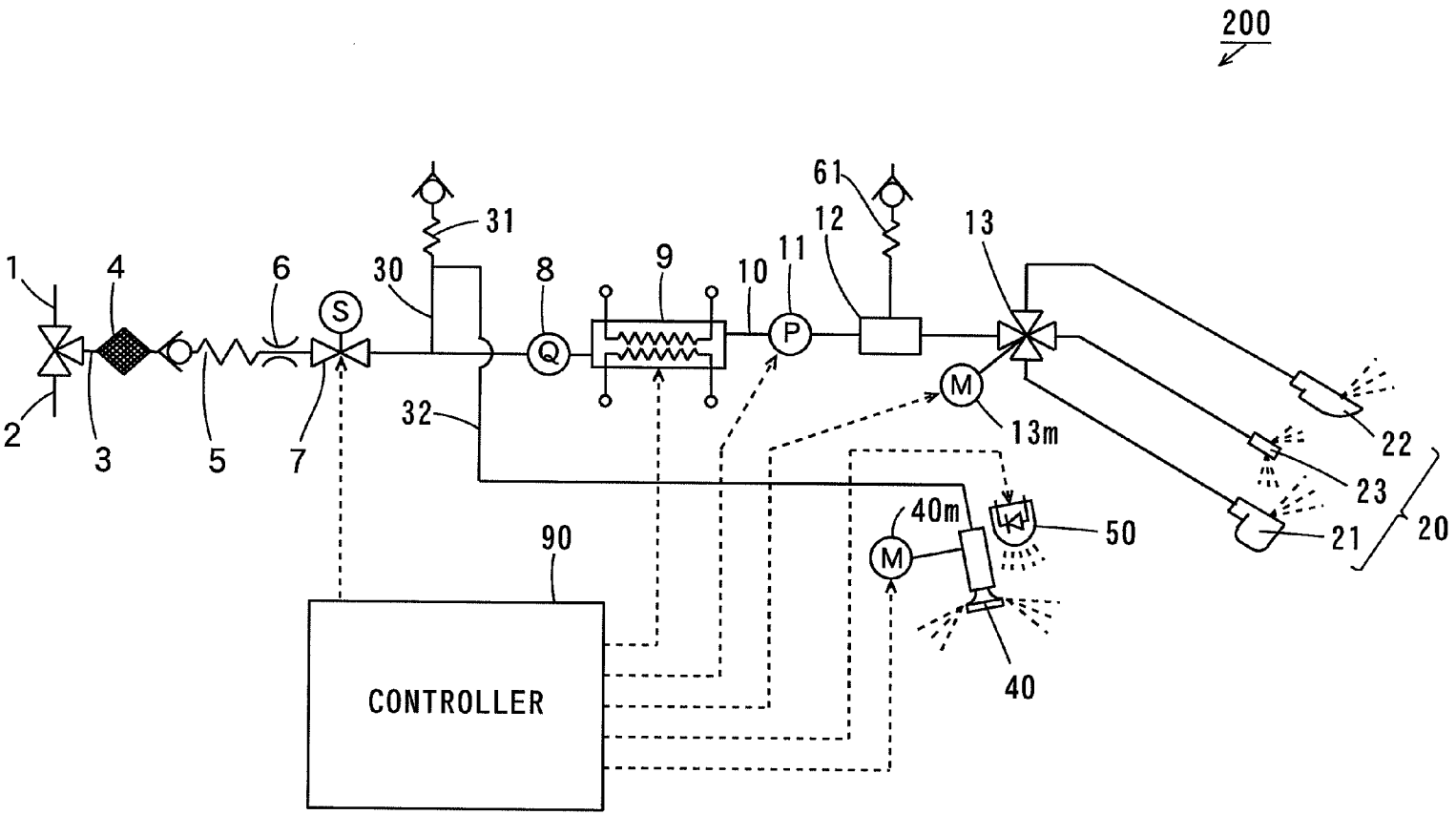
FIG. 3 is a schematic diagram illustrating the configuration of a main body.

The toilet seat 400 and the lid 500 are attached to the main body 200 such that they can be opened and closed. Also, the main body 200 is equipped with a washing water supply mechanism not shown, and it also contains a controller 90 described later (FIG. 3).

FIG. 1 shows a sitting sensor 610 provided in an upper part of the front side of the main body 200. This sitting sensor 610 is a reflection-type infrared ray sensor, for example. In this case, the sitting sensor 610 detects infrared rays reflected from a human body to detect the presence of a user on the toilet seat 400.

Also, in FIG. 1, a toilet nozzle 400 is provided in a lower part of the front side of the main body 200 and projects inside the toilet 700. This toilet nozzle 40 is connected to the above-mentioned washing water supply mechanism.

The washing water supply mechanism is connected to water service piping not shown. The washing water supply mechanism thus supplies washing water supplied from the water service piping to the toilet nozzle 40. Thus, the toilet nozzle 40 releases washing water to a large area of the inner surface of the toilet 700 (toilet pre-wash). Also, the toilet nozzle 40 releases washing water to the rear side of the inner surface of the toilet 700 (toilet rear wash). They will be fully described later.

The washing water supply mechanism is also connected to a nozzle unit 20 described later (FIG. 3). Thus, the washing water supply mechanism supplies washing water supplied from the water service piping to the nozzle unit 20. Then, the nozzle unit 20 releases washing water to the local areas of the user.

The remote controller 300 has a plurality of switches. The remote controller 300 is attached in a place where the user sitting on the toilet seat 400 can operate it, for example.

An entrance detecting sensor 600 is attached at the entry of the lavatory, for example. The entrance detecting sensor 600 is a reflection-type infrared ray sensor, for example. In this case, the entrance detecting sensor 600 detects infrared rays reflected from a human body to detect the entrance of a user in the lavatory.

The controller 90 (FIG. 3) of the main body 200 controls the operations of components of the sanitary washing apparatus 100 on the basis of signals transmitted from the remote controller 300, the entrance detecting sensor 600, and the sitting sensor 610.

<2> Structure of Remote Controller

Figure 2:
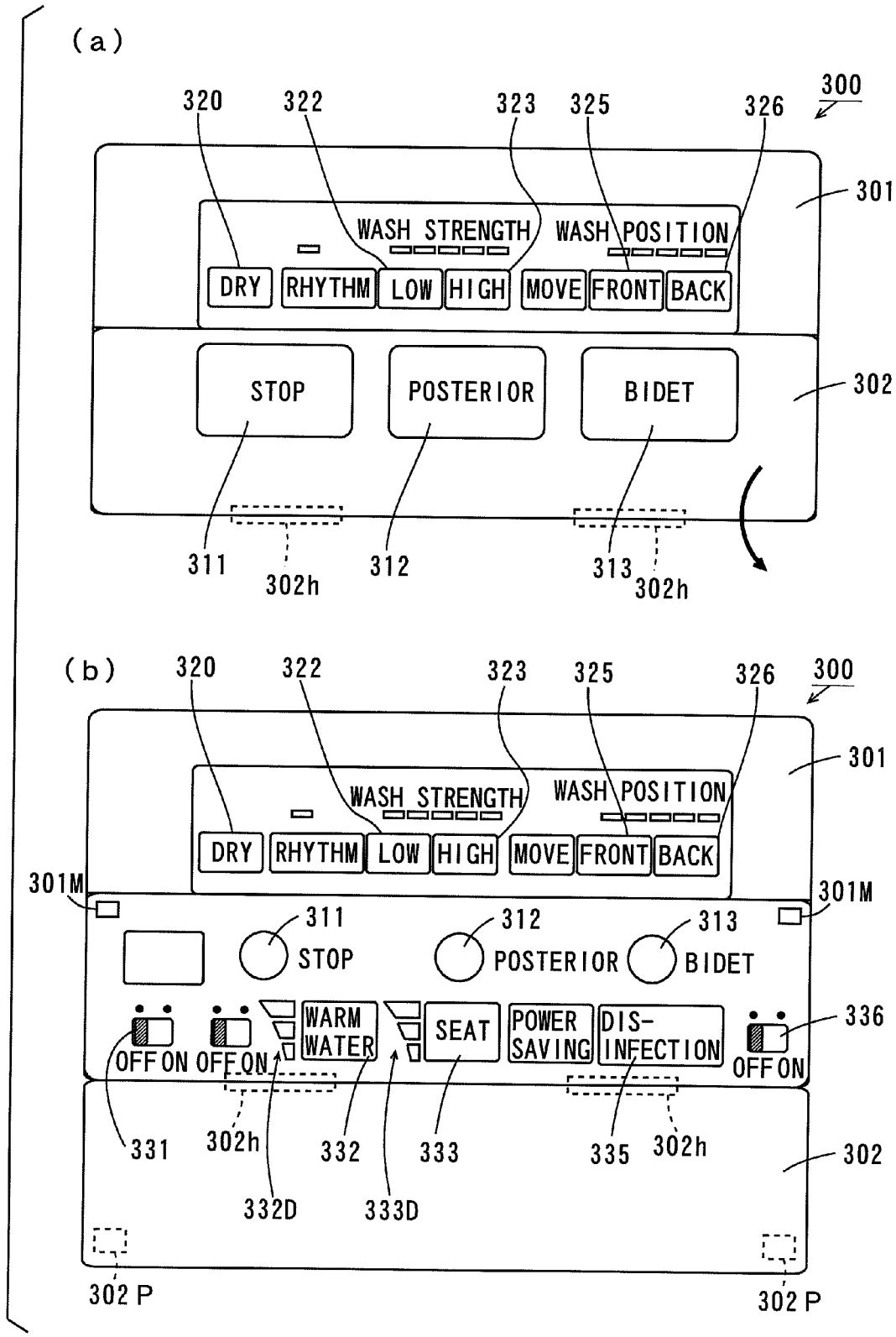
FIG. 2 shows plan views of a remote controller shown in FIG. 1.

FIG. 2 is a front view of the remote controller 300 of FIG. 1. In the remote controller 300, a controller cover 302 is attached to the lower part of a controller body 301 such that it can be opened and closed.

As shown in FIG. 2(*a*), when the controller cover 302 is closed, there are a dryer switch 320, strength adjustment switches 322, 323, and position adjustment switches 325, 326 in the upper part of the controller body 301, and there are a stop switch 311, a posterior switch 312, and a bidet switch 313 on the controller cover 302.

The switches are operated by a user. Then, given signals corresponding to the respective switches are sent by radio from the remote controller 300 to the main body 200 of FIG. 1. The controller 90 of the main body 200 (FIG. 3) controls the operations of components of the main body 200 (FIG. 1) and the toilet seat 400 (FIG. 1) on the basis of the received signals.

For example, when the user operates the posterior switch 312 or the bidet switch 313, washing water is released from the nozzle unit 20 described later (FIG. 3) to the local areas of the user. Also, when the user operates the stop switch 311, the release of washing water from the nozzle unit 20 to the local areas of the user is stopped.

When the user operates the dryer switch 320, a dryer unit 210 described later (FIG. 64) blows warm air to the local areas of the user. Also, when the user operates the strength adjustment switches 322 and 323, the flow rate, pressure, etc. of the washing water released to the local areas of the user are adjusted.

Also, when the user operates the position adjustment switches 325 and 326, the position of a posterior nozzle 21 described later (FIG. 3) or a bidet nozzle 22 described later (FIG. 3) is adjusted. The position of the release of washing water to the local areas of the user is thus adjusted.

FIG. 2(*b*) shows the front view of the remote controller 300 with the controller cover 302 opened. As shown in FIG. 2(*b*), in the lower part of the controller body 301 covered by the controller cover 302, there are an automatic open/close switch 331, a water temperature adjustment switch 332, a toilet seat temperature adjustment switch 333, a disinfection switch 335, and a toilet wash switch 336, as well as the above-described stop switch 311, posterior switch 312, and bidet switch 313.

Also when these switches are operated, given signals corresponding to the respective switches are sent by radio from the remote controller 300 to the main body 200. Thus, the controller 90 of the main body 200 controls the operations of components of the main body 200 and the toilet seat 400 on the basis of the received signals.

The automatic open/close switch 331 has a knob. When the user operates the knob of the automatic open/close switch 331, the operation of opening/closing the lid 500 (FIG. 1) is specified. That is to say, when the knob of the automatic open/close switch 331 is in the position of ON, the lid 500 is opened/closed in response to the entrance of a user into the lavatory.

When the user operates the water temperature adjustment switch 332, the temperature of the washing water released from the nozzle unit 20 to the local areas of the user is adjusted. When the user operates the toilet seat temperature adjustment switch 333, the temperature of the toilet seat 400 is adjusted.

Also, when the user operates the disinfection switch 335, washing water containing silver ions flows in the washing water supply mechanism of the main body 200 to effect disinfection operation.

Like the automatic open/close switch 331, the toilet wash switch 336 has a knob. When a user operates the knob of the toilet wash switch 336, the operations of toilet pre-wash and toilet rear wash by the toilet nozzle 40 are specified.

That is to say, when the knob of the toilet wash switch 336 is in the position of ON, the toilet nozzle 40 releases washing water to a large area inside the toilet 700 in response to the entrance of a user into the lavatory. Also, the toilet nozzle 40 releases washing water to the rear side of the inner surface of the toilet 700 while the user is sitting on the toilet seat 400.

As mentioned above, the controller cover 302 is attached to the lower part of the front side of the controller body 301 such that it can be opened and closed. This opening/closing mechanism will be described.

As shown in FIG. 2(*a*) and FIG. 2(*b*), the controller cover 302 is attached to the lower end of the controller body 301 with hinges 302*h*. Thus, the controller cover 302 can turn around the lower end of the controller body 301.

Now, two magnets 301M are attached in the lower part of the front side of the controller body 301. Then, when the controller cover 302 is formed of a ferromagnetic metal plate, the controller cover 302 can be easily held in the closed state. In the example of FIG. 2, when the controller cover 302 turns, the two corners 302*p* of the controller cover 302 abut on the two magnets 301M of the controller body 301.

In this way, the use of the magnets 301M eliminates the need to form projections and depressions on the controller cover 302 in order to close the controller cover 302. Also, when the two magnets 301M are arranged such that their surfaces coincide with the surface of the controller body 301, there is no need to form projections and depressions also on the controller body 301 in order to close the controller cover 302.

Thus, the controller body 301 and the controller cover 302 have no projections and depressions, so that the surfaces of the controller body 301 and the controller cover 302 can be easily wiped. This facilitates the cleaning of the remote controller 300.

The controller cover 302 may be formed of a resin plate, instead of a metal plate. In this case, ferromagnetic metal plates are disposed in the two corners 302*p* of the back side of the controller cover 302. This offers the same effect as described above. Also, this lightens the weight of the controller cover 302, facilitating the operation of opening/closing the controller cover 302.

The stop switch 311, the posterior switch 312, and the bidet switch 313 provided on the controller cover 302 correspond respectively to the stop switch 311, the posterior switch 312, and the bidet switch 313 provided in the lower part of the front side of the controller body 301. The user can select the operations of washing the local areas and the stop of operation by operating the stop switch 311, posterior switch 312 and bidet switch 313 provided on either of the controller body 301 and the controller cover 302.

The stop switch 311, the posterior switch 312, and the bidet switch 313 provided on the controller cover 302 have larger areas than the stop switch 311, the posterior switch 312, and the bidet switch 313 provided on the controller body 301.

In this way, the stop switch 311, posterior switch 312 and bidet switch 313, which are usually operated frequently, are large in area, so that, when the controller cover 302 is closed, the visual recognizability of the switches 311, 312 and 313 is improved and the operability of the remote controller 300 is also improved.

For example, even when the lavatory is dimly lit, the user can certainly and clearly recognize the stop switch 311, the posterior switch 312, and the bidet switch 313 when the controller cover 302 is closed.

Also, since the stop switch 311, the posterior switch 312 and bidet switch 313 on the controller cover 302 are large, the switches 311, 312 and 313 can be easily wiped. This facilitates keeping the controller cover 302 in sanitary conditions.

The controller cover 302 does not have the automatic open/close switch 331, water temperature adjustment switch 332, toilet seat temperature adjustment switch 333, disinfection switch 335 and toilet wash switch 336. These switches 331, 332, 333, 335 and 336 are usually not used.

Accordingly, when the controller cover 302 is closed, the automatic open/close switch 331, water temperature adjustment switch 332, toilet seat temperature adjustment switch 333, disinfection switch 335 and toilet wash switch 336 can be hidden behind the controller cover 302. This allows the remote controller 300 to be easily kept in sanitary conditions.

In the lower part of the controller body 301, a water temperature indicator 332D is provided at the side of the water temperature adjustment switch 332, and a toilet seat temperature indicator 333D is provided at the side of the toilet seat temperature adjustment switch 333. The water temperature indicator 332D and the toilet seat temperature indicator 333D are provided to indicate the temperature of washing water and the temperature of the toilet seat 400, respectively.

The water temperature indicator 332D and the toilet seat temperature indicator 333D are each formed of a plurality of (three in this example) LEDs (Light Emitting Diodes). The conditions of light emission from the water temperature indicator 332D and the toilet seat temperature indicator 333D are changed as the user operates the water temperature adjustment switch 332 and the toilet seat temperature adjustment switch 333.

The water temperature indicator 332D may be constructed such that the number of LEDs that emit light is increased/decreased according to how many times the water temperature adjustment switch 332 is pressed, or may be constructed such that the LED that emits light is sequentially changed according to how many times the water temperature adjustment switch 332 is pressed.

Also, the toilet seat temperature indicator 333D may be constructed such that the number of LEDs that emit light is increased/decreased according to how many times the toilet seat temperature adjustment switch 333 is pressed, or may be constructed such that the LED that emits light is sequentially changed according to how many times the toilet seat temperature adjustment switch 333 is pressed.

Thus, the user can easily recognize the current settings of washing water temperature and temperature of the toilet seat 400 by checking the water temperature indicator 332D and the toilet seat temperature indicator 333D.

Also, the on state and off state of the water temperature indicator 332D and the toilet seat temperature indicator 333D may be switched according to whether the controller cover 302 is opened or closed. For example, the water temperature indicator 332D and the toilet seat temperature indicator 333D turn off when the controller cover 302 is closed, and they turn on when the controller cover 302 is opened.

This reduces the power used for the remote controller 300, achieving energy saving. When the remote controller 300 operates with a battery, the life of the battery is lengthened.

<3> Configurations of Water Supply System and Control System in Main Body

FIG. 3 is a schematic diagram illustrating the configuration of the main body 200. As shown in FIG. 3, the main body 200 includes a branch water faucet 2, a strainer 4, a check valve 5, a constant flow rate valve 6, an electromagnetic shutoff valve 7, a flow rate sensor 8, a heat exchanger 9, a pump 11, a buffer tank 12, a switching valve for human body 13, the nozzle unit 20, vacuum breakers 31, 61, the toilet nozzle 40, a toilet nozzle motor 40*m*, a lamp 50, and the controller 90.

The nozzle unit 20 includes the posterior nozzle 21, the bidet nozzle 22 and a nozzle washing nozzle 23, and the switching valve for human body 13 includes a switching valve motor 13*m*.

As shown in FIG. 3, the branch water faucet 2 is inserted in the water service piping 1. The strainer 4, the check valve 5, the constant flow rate valve 6, the electromagnetic shutoff valve 7, and the flow rate sensor 8 are sequentially inserted in the piping 3 connected between the branch water faucet 2 and the heat exchanger 9. The pump 11 and the buffer tank 12 are inserted in the piping 10 connected between the heat exchanger 9 and the switching valve for human body 13.

The posterior nozzle 21, the bidet nozzle 22 and the nozzle washing nozzle 23 of the nozzle unit 20 are connected respectively to a plurality of ports of the switching valve for human body 13.

The vacuum breaker 31 is connected to branch piping 30 extending from the piping 3 between the electromagnetic shutoff valve 7 and the flow rate sensor 8, and is located in a position upper than the heat exchanger 9 and the washing water releasing opening of the toilet nozzle 40. One end of branch piping 32 is connected to the vacuum breaker 31. The branch piping 30 and the branch piping 32 are coupled through the vacuum breaker 31. The toilet nozzle 40 is connected to the other end of the branch piping 32. The toilet nozzle motor 40*m* and the lamp 50 are attached near the toilet nozzle 40. The vacuum breaker 61 is provided to the buffer tank 12, and is located in a position upper than the heat exchanger 9. The vacuum breaker 61 and the buffer tank 12 are integrated. Accordingly, the buffer tank 12, too, is located in a position upper than the heat exchanger 9.

Next, the flow of washing water in the main body 200 and the control to the components of the main body 200 by the controller 90 will be described.

Pure water flowing in the water service piping 1 is supplied as washing water to the strainer 4 by the branch water faucet 2. Particles, impurities, etc. contained in the washing water are removed by the strainer 4.

Next, the check valve 5 prevents backflow of the washing water in the piping 3, and the constant flow rate valve 6 maintains constant the flow rate of the washing water flowing in the piping 3. Then, the electromagnetic shutoff valve 7 switches the supply of washing water to the heat exchanger 9. The operation of the electromagnetic shutoff valve 7 is controlled by the controller 90.

In the piping 3, the flow rate sensor 8 measures the flow rate of the washing water flowing in the piping 3, and it gives the measured flow rate value to the controller 90. The heat exchanger 9 heats the washing water supplied through the piping 3 to given temperatures. The operation of the heat exchanger 9 is controlled by the controller 90 on the basis of the measured flow rate value measured by the flow rate sensor 8.

Next, the washing water heated by the heat exchanger 9 is sent with pressure by the pump 11 to the switching valve for human body 13 through the buffer tank 12. The operation of the pump 11 is controlled by the controller 90.

The buffer tank 12 functions as a temperature buffer for heated washing water. This suppresses temperature variations of the washing water sent with pressure to the switching valve for human body 13. Preferably, the total capacity of the heat exchanger 9 and the buffer tank 12 is 15 cc to 30 cc, and more preferably it is 20 cc to 25 cc.

In the switching nozzle for human body 13, the switching valve motor 13*m* operates so that the washing water sent with pressure from the pump 11 is supplied to the posterior nozzle 21, the bidet nozzle 22, or the nozzle washing nozzle 23. Then, the washing water is released from the posterior nozzle 21, the bidet nozzle 22, or the nozzle washing nozzle 23. The operation of the switching valve motor 13*m* is controlled by the controller 90.

The posterior nozzle 21 and the bidet nozzle 22 are used to wash the local areas of the user. The nozzle washing nozzle 23 is used to clean the parts of the posterior nozzle 21 and the bidet nozzle 22 that project inside the toilet 700.

In the washing water supplied from the electromagnetic shutoff valve 7 to the heat exchanger 9, extra part not used in the nozzle unit 20 is discharged as discarded water into the toilet 700 (FIG. 1) through the branch piping 30, the branch piping 32, and the toilet nozzle 40. That is, the branch piping 30 and the branch piping 32 function as a discarded water circuit. The toilet nozzle 40 will be fully described later.

In this example, the vacuum breaker 31 is provided between the heat exchanger 9 and the toilet nozzle 40, and the vacuum breaker 61 is provided between the heat exchanger 9 and the nozzle unit 20. They prevent the washing water in the heat exchanger 9 from flowing outside through the branch piping 30, the branch piping 32, and the toilet nozzle 40, and also from flowing outside through the piping 10 and the nozzle unit 20. As a result, the heat exchanger 9 is prevented from heating in an empty state.

Also, the vacuum breaker 31 prevents backflow of dirty water etc. from the side of the toilet nozzle 40, and the vacuum breaker 61 prevents backflow of dirty water etc. from the side of the nozzle unit 20.

Also, since the buffer tank 12 and the vacuum breaker 61 are integrated, the main body 200 can be smaller-sized. Also, since the vacuum breaker 61 discharges cold water in the buffer tank 12, it is possible to prevent the release of cold water from the posterior nozzle 21 during a posterior wash.

Figure 4:
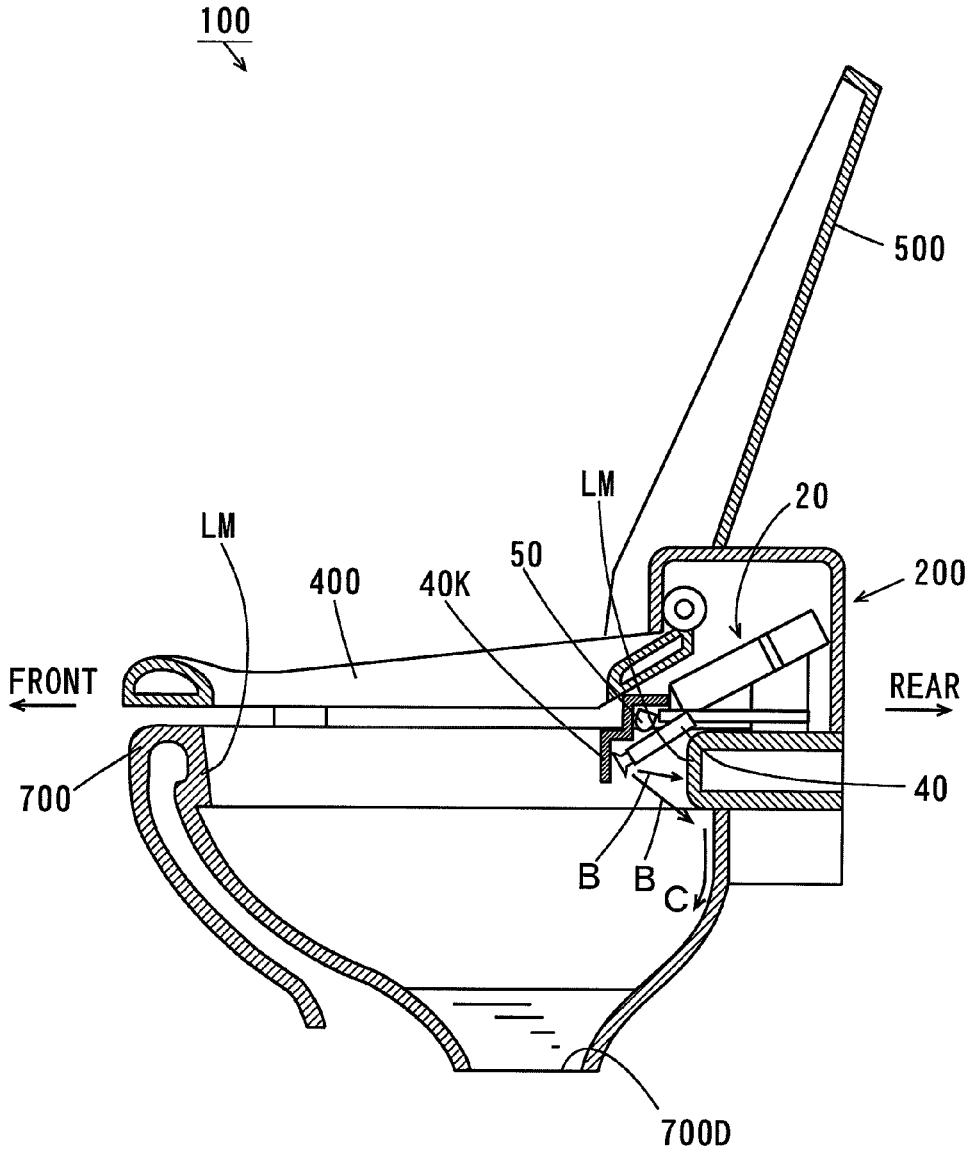
FIG. 4 is a vertical cross-sectional view of the sanitary washing apparatus.

<4> Structure and Operation of Toilet Nozzle (4-a) Brief Description of Toilet Nozzle Next, the toilet nozzle 40 will be described. FIG. 4 is a vertical cross-sectional view of the sanitary washing apparatus 100. As shown in FIG. 4, the toilet nozzle 40 is positioned near the nozzle unit 20 in the lower part of the main body 200, and its tip is positioned inside the toilet 700. The lamp 50, formed of, e.g. LED (Light Emitting Diode), is provided near the toilet nozzle 40.

Now, the various components will be described below, where, as shown in FIG. 4, the side of the sanitary washing apparatus 100 where the main body 200 is provided is taken as "rear" and the front end of the toilet seat 400 is taken as "front".

A toilet nozzle cover 40K is provided to cover the front side of the toilet nozzle 40 and the lamp 50 provided near it. The toilet nozzle cover 40K is made of transparent resin. Therefore, when the lamp 50 emits light, the light illuminates the inside of the toilet 700 through the toilet nozzle cover 40K.

Figure 5:
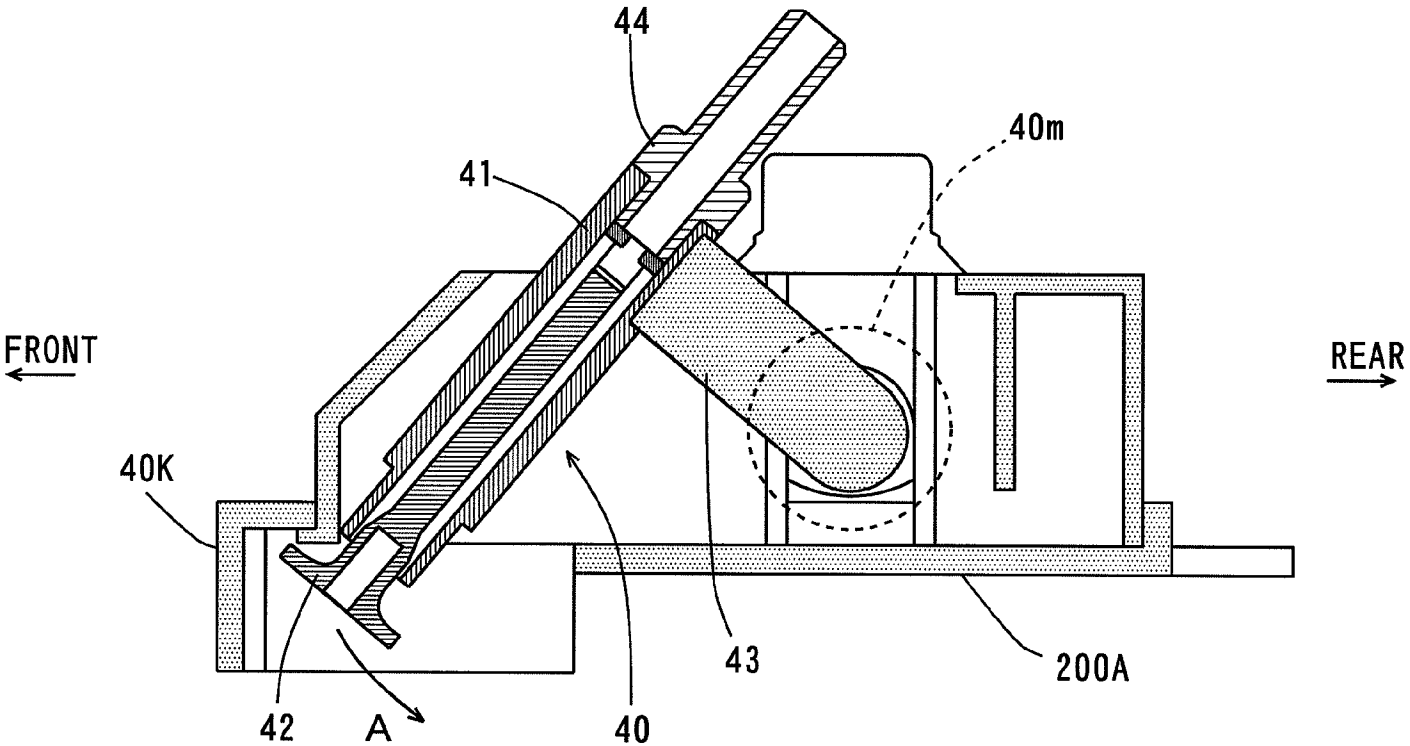
FIG. 5 is an enlarged cross-sectional view for describing the structure of the toilet nozzle of FIG. 4 and its vicinity.

FIG. 5 is an enlarged cross-sectional view for explaining the structure of the toilet nozzle 40 of FIG. 4 and its vicinity. As shown in FIG. 5, the toilet nozzle 40 includes a cylindrical toilet nozzle body 41 and a rod-like flow forming member 42 inserted in the end portion of the toilet nozzle body 41. In the toilet nozzle body 41, a gap is formed between the inner surface of the toilet nozzle body 41 and the peripheral surface of the flow forming member 42. A connection pipe 44, forming part of the branch piping 32 of FIG. 3, is connected to the rear end of the toilet nozzle body 41.

Thus, when washing water (discarded water) is supplied from the connection pipe (branch piping 32) to the toilet nozzle body 41, the washing water passes through the gap between the inner surface of the toilet nozzle body 41 and the peripheral surface of the flow forming member 42 and is released from the end of the toilet nozzle 40.

One end of a rotating piece 43 is fixed to the rear end of the toilet nozzle body 41. The other end of the rotating piece 43 is connected to the toilet nozzle motor 40*m* fixed to a lower main body casing 200A described later. Thus, when the toilet nozzle motor 40*m* operates, the end of the toilet nozzle body 41 turns.

Now, when the toilet nozzle 40 is in a standby state, that is, when no user is in the lavatory, the tip of the toilet nozzle 40 is positioned to stay near the inner surface of the toilet nozzle cover 40K. This position of the toilet nozzle 40 is hereinafter referred to as "an accommodated position".

In this state, when the entrance detecting sensor 600 of FIG. 1 detects the entrance of a user into the lavatory, the toilet nozzle motor 40*m* operates. Then, the tip of the toilet nozzle 40 turns in the direction shown with arrow A in FIG. 5. Then, the toilet pre-wash, described above, is started.

Figure 6:
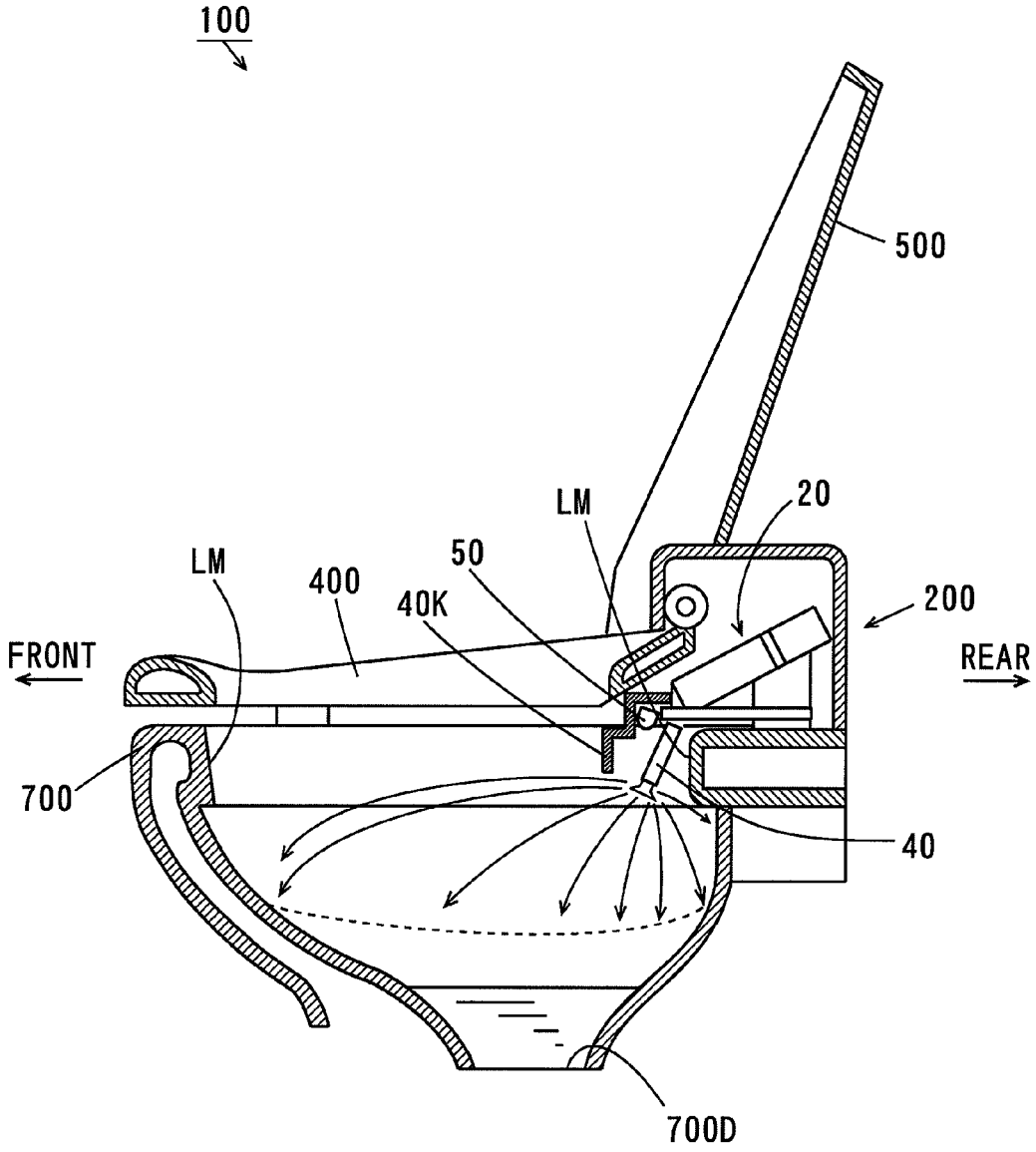
FIG. 6 is a vertical cross-sectional view of the sanitary washing apparatus during a toilet pre-wash.
Figure 7:
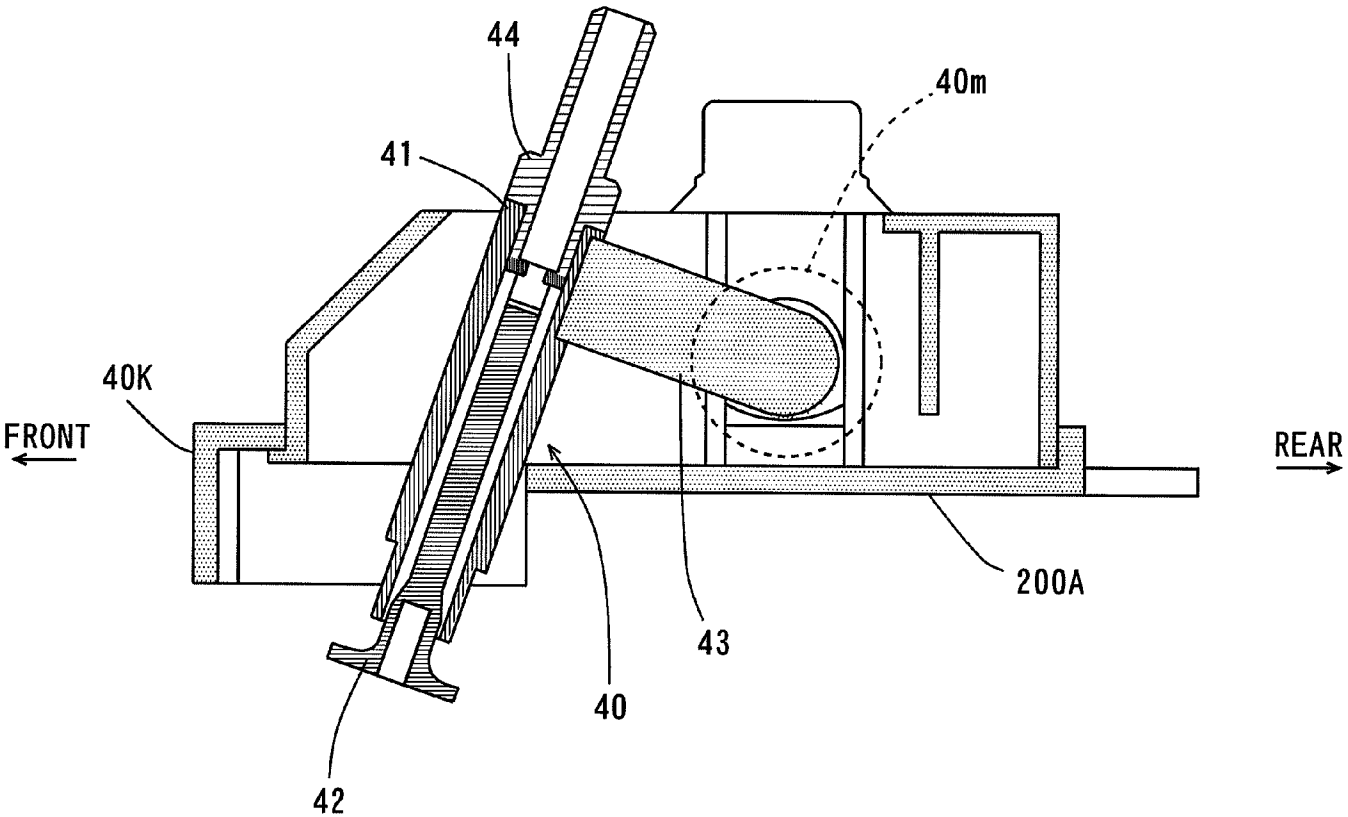
FIG. 7 is an enlarged cross-sectional view for describing the structure of the toilet nozzle and its vicinity in the state of FIG. 6.

FIG. 6 is a vertical cross-sectional view of the sanitary washing apparatus 100 during the toilet pre-wash, and FIG. 7 is an enlarged cross-sectional view for explaining the structure of the toilet nozzle 40 and its vicinity in the state shown in FIG. 6.

First, as shown in FIG. 6 and FIG. 7, the entrance of a user into the lavatory is detected and the tip of the toilet nozzle 40 turns, and then the tip moves to below the toilet nozzle cover 40K and is positioned to be exposed into the inner space of the toilet 700. This position of the toilet nozzle 40 is hereinafter referred to as "a toilet washing position".

In this state, washing water is supplied from the connection pipe 44 to the toilet nozzle body 41. Then the washing water is released from the tip of the toilet nozzle 40.

The washing water from the toilet nozzle 40 is radially released in a direction nearly perpendicular to the axial center of the toilet nozzle 40.

Thus, as shown in FIG. 6, the washing water is released onto a large area of the inner surface of the toilet 700 around the discharge opening 700D. Thus, the inner surface of the toilet 700, which was dry when the user entered the lavatory, is wetted by the washing water.

Also, at this time, the lamp 50 emits light so that the user can visually recognize that the toilet pre-wash is being performed.

Wetting the inner surface of the toilet 700 before use, as described above, prevents the adhesion of wastes to the inner surface of the toilet 700.

As will be described later, the toilet pre-wash operation is stopped by the passage of a given time, by the sitting of the user on the toilet seat 400, or by the operation of the remote controller 300 by the user.

When the toilet pre-wash ends, the toilet nozzle motor 40*m* operates again. Thus, the tip of the toilet nozzle 40 moves to the inside of the toilet nozzle cover 40K again, and is positioned near the inner surface of the toilet nozzle cover 40K. That is to say, after the toilet pre-wash, the toilet nozzle 40 moves to the accommodated position again. At this time, the washing water is continuously released from the tip of the toilet nozzle 40. The toilet rear wash is thus started.

During the toilet rear wash, as shown by arrows B and C in FIG. 4, washing water released from the toilet nozzle 40 to the rear side of the inner surface of the toilet 700 hits the inner surface and flows down in the toilet 700.

By the way, in general, in a toilet apparatus that releases washing water to the local areas of the user, wastes are likely to adhere to the rear side of the inner surface of the toilet because of the reason below.

During a posterior wash, the washing water is released to the local area of the user. Then, when the wastes adhering to the local part of the user are scattered by the washing water, the scattering wastes may adhere to the rear side of the inner surface of the toilet. This phenomenon is likely to occur immediately after the beginning of posterior wash.

After the use of the toilet apparatus, the wastes accumulated in the toilet are discharged to sewerage facility not shown by a large amount of washing water supplied from the vicinity of the upper end of the toilet. The large amount of washing water supplied into the toilet is hereinafter referred to as flush water.

However, the flush water is not always supplied to the entire inner surface of the toilet. For example, depending on the structure of the toilet, or depending on the structure of the flush water supply mechanism, the flush water is less likely to be supplied to the rear side of the inner surface of the toilet. Especially, flush water is not supplied to the inner surface of the rim (upper edge) LM in the rear part of the toilet. Accordingly, when wastes adhere to the rear side of the inner surface of the toilet as mentioned above, the adhering wastes dry without being washed away by the flush water. In this case, it is not easy to remove the hardened wastes away.

In contrast, in the toilet apparatus 1000 of this example, the toilet rear wash is performed with the user sitting on the toilet seat 400. During the toilet rear wash, the front side of the toilet nozzle 40 is shielded by the toilet nozzle cover 40K. Accordingly, it is possible to wet the rear side of the inner surface of the toilet 700 with washing water, while preventing forward splashes of the washing water released from the toilet nozzle 40. Specifically, during the toilet rear wash, as shown by arrows B in FIG. 4, the washing liquid released from the toilet nozzle 40 is supplied to the inner surface of the rim LM of the toilet 700.

This makes it possible to prevent the adhesion of wastes to the toilet 700, while preventing the washing water from splashing onto the user sitting on the toilet seat 400. Especially, it is possible to certainly prevent the adhesion of wastes that cannot be washed away by the flush water. As a result, the toilet 700 is kept in sanitary conditions.

As described above, the toilet rear wash certainly prevents the adhesion of wastes to the rear side of the inner surface of the toilet 700 while the user is using the toilet apparatus 1000.

Also, the washing water released from the toilet nozzle 40 to the inner surface of the toilet nozzle cover 40K hits the inner surface of the toilet nozzle cover 40K and rebounds to the tip of the toilet nozzle 40. The water thus washes the tip of the toilet nozzle 40, preventing contamination of the tip of the toilet nozzle 40.

After that, the toilet rear wash is stopped as the user stands up from the toilet seat 400, for example. That is, the release of washing water from the toilet nozzle 40 is stopped.

(4-b) Detailed Structure of Toilet Nozzle

Figure 8:
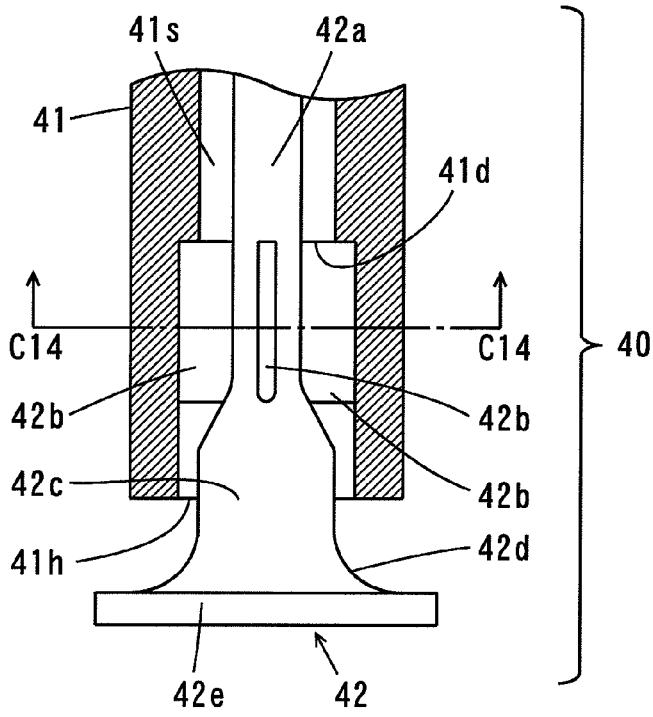
FIG. 8 shows cross-sectional views illustrating the structure of the tip of the toilet nozzle of FIG. 4.
Figure 8:
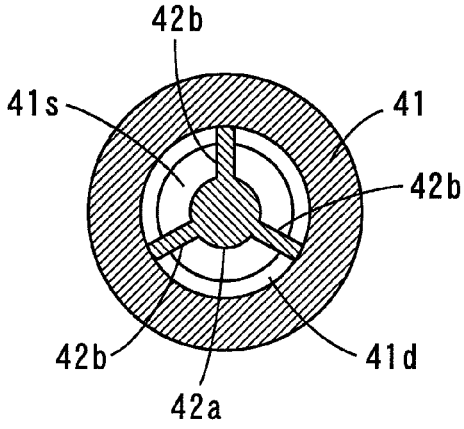

Now, the details of the structure of the tip of the toilet nozzle 40 will be described. FIG. 8 is a cross-sectional view illustrating the structure of the tip of the toilet nozzle 40 of FIG. 4. FIG. 8(*a*) shows a vertical cross section of the tip of the toilet nozzle 40, and FIG. 8(*b*) shows the cross section taken along line C14-C14 in FIG. 8(*a*).

As shown in FIG. 8(*a*), the flow forming member 42 is inserted into an end opening 41*h* of the toilet nozzle body 41. The flow forming member 42 has an insertion shaft 42*a*. As shown in FIG. 8(*b*), the insertion shaft 42*a* has three blade members 42*b* radially extending outward from the axial center of the insertion shaft 42*a*. A large-diameter portion 42*c*, an expanding portion 42*d*, and a flange 42*e* are formed from the blade members 42*b* to the end of the flow forming member 42.

The diameter of the large-diameter portion 42*c* is larger than the diameter of the insertion shaft 42*a*. Also, the expanding portion 42*d* has its diameter gradually further expanding toward the end of the flow forming member 42, and the diameter of the end of the flow forming member 42 is larger than the diameter of the end opening 41*h*. Also, the outer diameter of the flange 42*e* is larger than the outer diameter of the toilet nozzle body 41.

A step 41*d* is formed on the inner surface of the toilet nozzle body 41. When the flow forming member 42 is inserted in the toilet nozzle body 41, the step 41*d* and the blade members 42*b* of the flow forming member 42 abut on each other. At this time, the blade members 42*b* function as a spacer between the flow forming member 42 and the toilet nozzle body 41. The flow forming member 42 is thus positioned inside the toilet nozzle body 41.

In this state, the large-diameter portion 42*c* of the flow forming member 42 projects from the end opening 41*h* of the toilet nozzle body 41, and the expanding portion 42*d* and the flange 42*e* are positioned outside of the toilet nozzle body 41.

The outer diameters of the insertion shaft 42*a* and the large-diameter portion 42*c* are smaller than the inner diameter of the toilet nozzle body 41. Accordingly, as mentioned above, a gap is formed between the inner surface of the toilet nozzle body 41 and the peripheral surface of the flow forming member 42. This gap forms a flow passage 41*s* of washing water.

When washing water is supplied from the connection pipe 44 of FIG. 5, the washing water passes through the flow passage 41*s* and is released from the end opening 41*h*. At this time, the washing water is released outside along the peripheral surface of the large-diameter portion 42*c* and the expanding portion 42*d*. That is, the washing water is radially released in a direction nearly perpendicular to the axial center of the toilet nozzle 40.

(4-c) Release Speed of Washing Water During Toilet Pre-Wash

Figure 9:
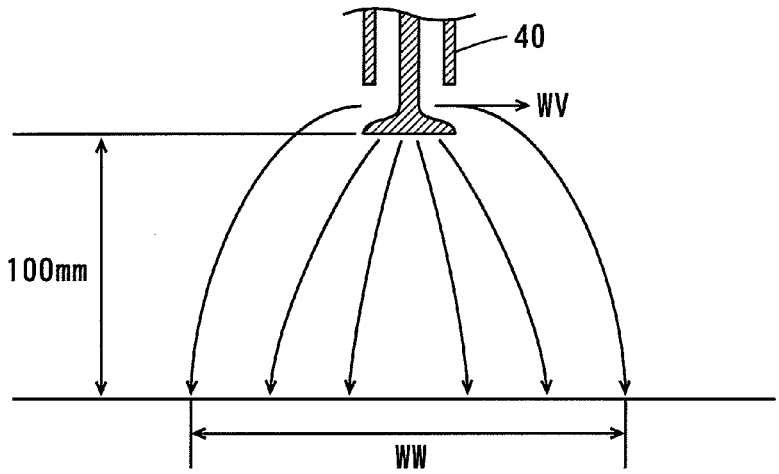
FIG. 9 shows diagrams illustrating the relation between release speed and expansion width of washing water released from the toilet nozzle of FIG. 4.
Figure 9:
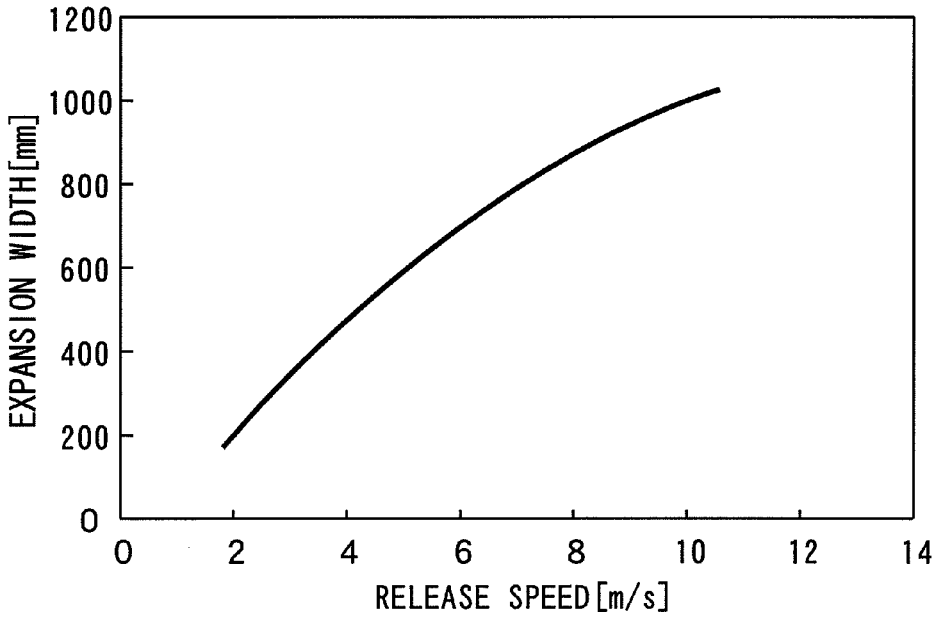

FIG. 9 is a diagram illustrating the relation between the release speed and expansion width of washing water released from the toilet nozzle 40 of FIG. 4.

First, the release speed and the expansion width will be described. FIG. 9(*a*) shows a diagram for explaining the definitions of the release speed and the expansion width.

FIG. 9(*a*) shows washing water released from the toilet nozzle 40 arranged such that its axial center is parallel to vertical direction.

Now, as shown by arrow WV, the release speed means the speed of flow of the washing water released in a horizontal direction from the tip of the toilet nozzle 40. Also, the expansion width means, as shown by arrow WW, the outer diameter of the area in which the washing water is supplied 100 mm below the toilet nozzle 40.

FIG. 9(*b*) shows experimental results obtained when washing water is released from the toilet nozzle 40. In FIG. 9(*b*), the vertical axis shows the expansion width WW of washing water, and the horizontal axis shows the release speed of washing water, and the solid line shows the relation between the expansion width WW and the release speed.

As shown in FIG. 9(*b*), the expansion width is larger than 200 mm when the washing water release speed is larger than 2 m/s. In this case, washing water can be supplied to a sufficiently large area of the inner surface of the toilet 700, and the adhesion of wastes to the inner surface of the toilet 700 is sufficiently prevented.

Also, the expansion width is smaller than 1000 mm when the washing water release speed is smaller than 10 m/s. In this case, the splashes of washing water to the outside of the toilet 700 can be prevented. Also, when the washing water release speed is smaller than 10 m/s, it is possible to prevent washing water released from the toilet nozzle 40 from violently rebounding at the inner surface of the toilet 700. This sufficiently prevents the splashes of washing water to the outside of the toilet 700.

Accordingly, it is possible to sufficiently prevent the adhesion of wastes to the toilet 700 while sufficiently preventing the splashes of washing water out of the toilet 700, by setting the washing water release speed in the range of 2 m/s to 10 m/s. It is more preferable to set the washing water release speed in the range of 4 m/s to 8 m/s. In this case, it is possible to certainly prevent the adhesion of wastes to the toilet 700 while certainly preventing the splashes of washing water out of the toilet 700.

The opening of the toilet 700 is designed to have a width of not less than about 27 cm nor more than about 30 cm, and a depth of not less than about 32 cm nor more than 38 cm. Accordingly, it is preferred that, in the toilet pre-wash, the tip of the toilet nozzle 40 be located about 2 cm below the top surface of the rim LM of FIG. 4 (the upper end face of the toilet 700).

When washing water is released from the toilet nozzle 40 in this state, the released washing water falls in a parabola by gravity. The washing water is thus supplied in a large area of the inner surface of the toilet 700.

Now, by setting the arrangement of the toilet nozzle 40 as described above, the washing water released from the toilet nozzle 40 to the inner surface of the toilet 700 hits the inner surface of the toilet 700 in an area lower than the lower end of the rim LM. This certainly prevents the washing water released from the toilet nozzle 40 from splashing out of the toilet 700 during the toilet pre-wash.

During the toilet rear wash, the tip of the toilet nozzle 40 is located such that the washing water released from the toilet nozzle 40 is supplied to the rear side of the inner surface of the rim LM of the toilet 700. In this case, the rear side of the toilet 700 is covered by the main body 200, so that the washing water hitting the rim LM is prevented from splashing out of the toilet 700.

(4-d) Operating Timing and Control Flow for Toilet Pre-Wash

In this example, the toilet pre-wash is started by control of the controller 90 when a user enters the lavatory. While the user is using the toilet apparatus 1000, the toilet rear wash is performed by control by the controller 90. That is, when the user is sitting on the toilet seat 400 (FIG. 1), the splashing of washing water from the toilet nozzle 40 (FIG. 1) to the front side is hindered. This prevents splashes of washing water on the user.

The controller 90 shifts from the toilet pre-wash to toilet rear wash on the basis of the passage of a given time, the sitting of the user on the toilet seat 400, or the operation of the remote controller 300 by the user.

Now, the given time is previously determined on the basis of an average time from when a user enters a lavatory to when the user sits down on the toilet seat 400. Accordingly, in order to determine the given time, the inventors of the present invention and others conducted research on the time from when a user enters a lavatory to when the user sits down on the toilet seat 400 (hereinafter referred to as an entrance-sitting time). The research was conducted by asking a given number of users to use a lavatory, measuring the entrance-sitting time of each user, and calculating cumulative percentage for each entrance-sitting time.

Figure 10:
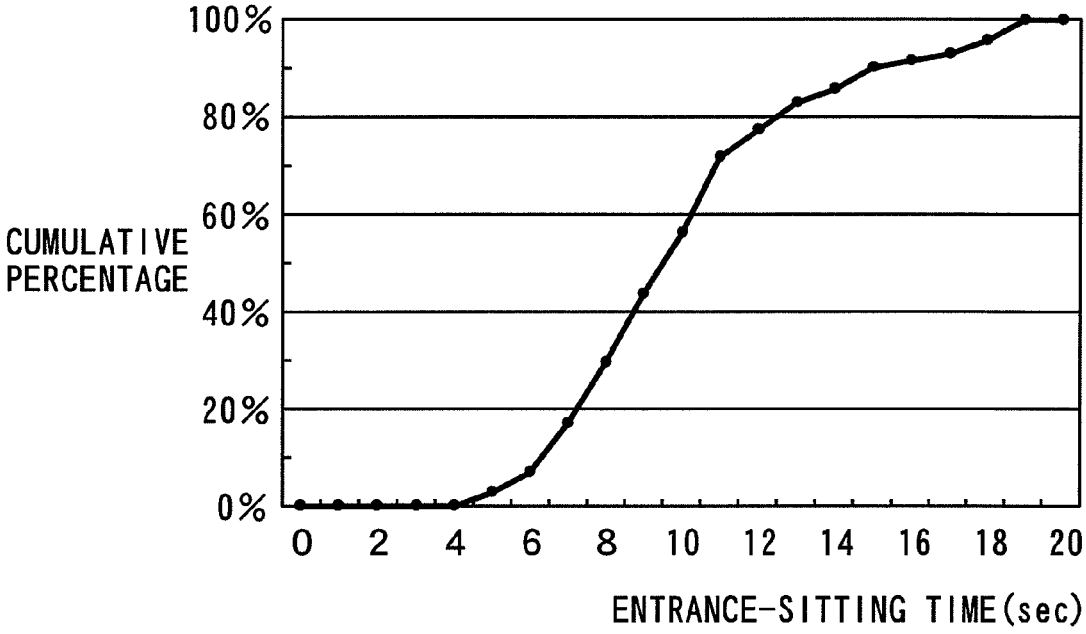
FIG. 10 is a diagram showing the results of research about entrance-sitting time.

FIG. 10 is a diagram illustrating the results of research on the entrance-sitting time. In FIG. 10, the horizontal axis shows the entrance-sitting time and the vertical axis shows the cumulative percentage of users.

As shown in FIG. 10, according to the research, it has become clear that most users (users of 90 percent or more) sit down on the toilet seat 400 after about 6 seconds have passed after the entrance to the lavatory. Accordingly, this example set the given time to 6 seconds. In this case, it is possible to shift from the toilet pre-wash to toilet rear wash immediately before the user sits down on the toilet seat 400. This makes it possible to sufficiently wet the inner surface of the toilet 700 immediately before the user sits down, and to certainly prevent washing water released from the toilet nozzle 40 from splashing on the user.

Next, a control flow of the toilet washing process (toilet pre-wash and toilet rear wash) by the controller 90 (FIG. 3) will be described.

Figure 11:
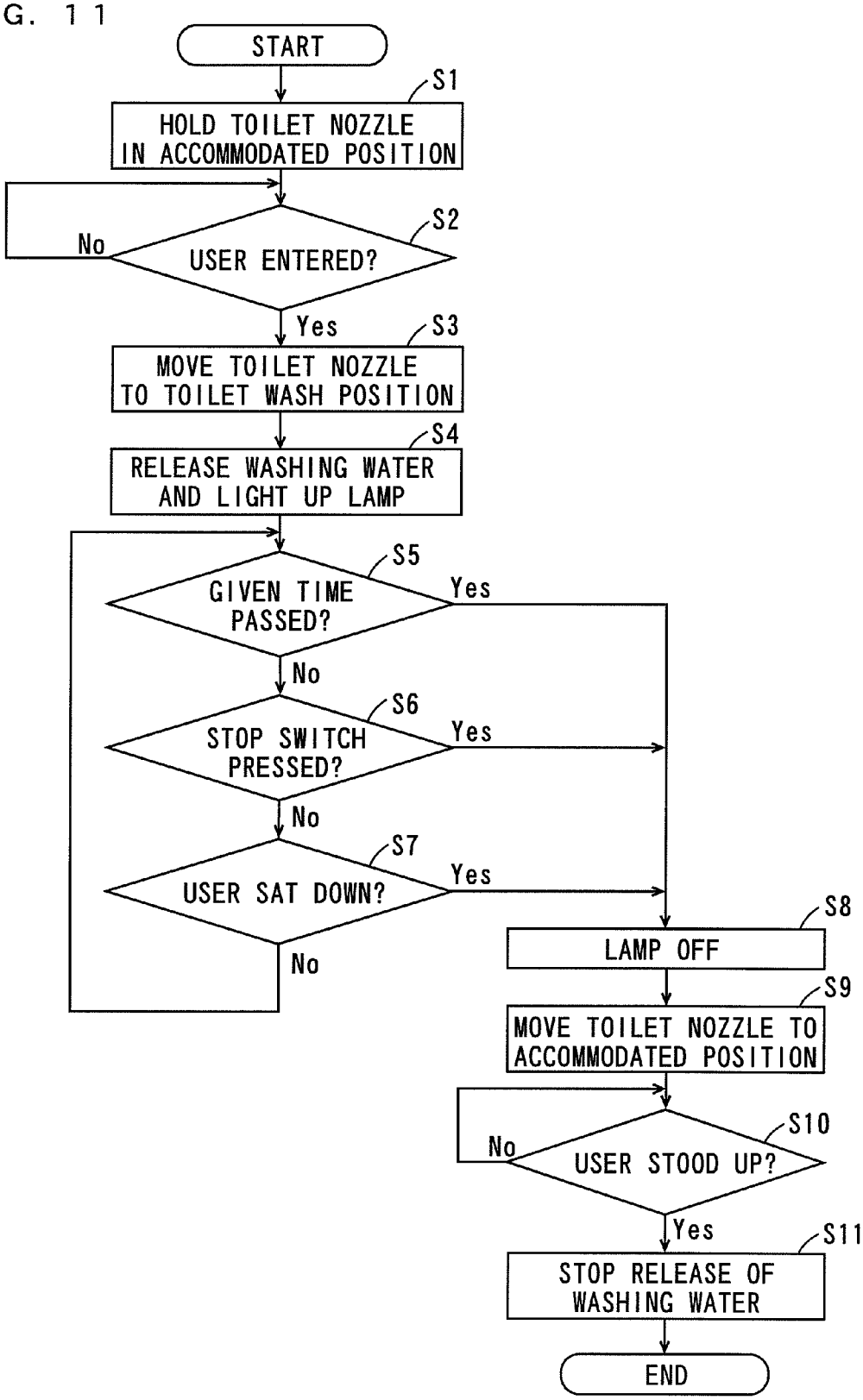
FIG. 11 is a diagram showing a control flow of a toilet washing process by a controller.

FIG. 11 is a diagram illustrating the control flow of the toilet washing process by the controller 90.

As shown in FIG. 11, the controller 90 first holds the toilet nozzle 40 in the accommodated position (the position shown in FIGS. 4 and 5) by controlling the toilet nozzle motor 40*m* (FIG. 3 (Step S1)).

Next, the controller 90 determines whether a user has entered the lavatory on the basis of the output signal of the entrance detecting sensor 600 (FIG. 1 (Step S2)). When a user entered the lavatory, the controller 90 moves the toilet nozzle 40 to the toilet washing position (the position shown in FIGS. 6 and 7) by controlling the toilet nozzle motor 40*m* (Step S3).

Next, the controller 90 causes the toilet nozzle 40 to release washing water by controlling the electromagnetic shutoff valve 7 (FIG. 3), the switching valve motor 13*m* (FIG. 3), and so on, and it also lights up the lamp 50 (Step S4).

Next, the controller 90 determines whether a given time (e.g. 6 seconds) has passed after the user entered the lavatory (Step S5). When the given time has not passed yet, the controller 90 determines whether the user pressed the stop switch 311 (FIG. 2 (Step S6)).

When the stop switch 311 is not pressed, the controller 90 determines whether the user has sat down on the toilet seat 400 (FIG. 1) on the basis of the output signal from the sitting sensor 610 (FIG. 1 (Step S7)). When the user has not sat down on the toilet seat 400, the controller 90 returns to the processing of Step S5.

When, in Step S5, the given time has passed, the controller 90 turns off the lamp 50 (Step S8). Next, the controller 90 moves the toilet nozzle 40 to the accommodated position (the position shown in FIGS. 4 and 5) by controlling the toilet nozzle motor 40*m* (FIG. 3 (Step S9)).

Next, the controller 90 determines whether the user has stood up on the basis of the output signal of the sitting sensor 610 (FIG. 1 (Step S10)). When the user has stood up, the controller 90 stops the release of washing water from the toilet nozzle 40 by controlling the electromagnetic shutoff valve 7 (FIG. 3) and so on (Step S11). The toilet washing process by the controller 90 thus ends.

When Step S2 determines that no user has entered, the controller 90 waits until a user enters.

When Step S6 determines that the user pressed the stop switch 311, or when Step S7 determines that the user has sat down on the toilet seat 400, the controller 90 moves to the processing of Step S8.

When Step S10 determines that the user has not stood up, the controller 90 waits until the user stands up.

As described above, in this example, the toilet pre-wash is ended when a given time has passed after the user entered the lavatory. In this case, as described above, it is possible to sufficiently wet the inner surface of the toilet 700 before the user sits down on the seat, and to certainly prevent washing water released from the toilet nozzle 40 from splashing on the user.

Also, the toilet pre-wash is ended when the user pressed the stop switch 311 or when the user sat down on the toilet seat 400. Accordingly, it is possible to prevent washing water released from the toilet nozzle 40 from splashing on the user even when the user sits down on the toilet seat 400 within the given time.

Also, the toilet rear wash is performed while the user is sitting on the toilet seat 400. This certainly prevents the adhesion of wastes to the rear side of the inner surface of the toilet 700.

In the control flow of FIG. 11, the release of washing water is started in Step S4 after the toilet nozzle 40 has moved to the toilet washing position in Step S3, but the release of washing water may be started before the toilet nozzle 40 moves to the toilet washing position, i.e. while it is held in the accommodated position. In this case, the toilet nozzle 40 can be washed before the toilet pre-wash. This certainly prevents the contamination of the toilet nozzle 40.

Also, in the control flow of FIG. 11, the toilet nozzle 40 is moved to the toilet washing position when the entrance of a user is confirmed in Step S2, but the toilet nozzle 40 may wait in advance in the toilet washing position. In this case, the toilet pre-wash can be quickly started and a sufficient amount of washing water can be supplied to the toilet 700. This more certainly prevents the adhesion of wastes to the toilet 700. When the toilet nozzle 40 is made to wait in advance in the toilet washing position, the toilet nozzle 40 may be moved to the toilet washing position when a given time passed after a user has finished using the toilet apparatus 1000, for example.

Also, when washing water is released from the toilet nozzle 40, the supply of washing water to the nozzle unit 20 (FIG. 3) may be stopped by controlling the switching valve for human body 13. In this case, a sufficient amount of washing water can be supplied to the toilet nozzle 40, and the toilet 700 can be sufficiently wetted with washing water. This sufficiently prevents the adhesion of wastes to the toilet 700.

The controller 90 may perform the following operations in the control flow of FIG. 11.

For example, after the operation of Step S4 of FIG. 11, in addition to the operations of Steps S5 to S7, the controller 90 determines whether the toilet seat 400 of FIG. 1 is opened or closed. This operation is hereinafter referred to as a toilet seat open/close determining operation. The closed state of the toilet seat 400 is a state in which the toilet seat 400 is held approximately horizontal (lying state), and the opened state of the toilet seat 400 is a state in which the toilet seat 400 is held approximately vertical (standing state).

When the toilet seat 400 is in the closed state, the controller 90 performs the operations of Steps S5 to S7 or the toilet seat open/close determining operation. On the other hand, when the toilet seat 400 is in the opened state, the controller 90 moves to the processing of Step S8.

Making the controller 90 operate in this way prevents the toilet pre-wash from being performed when the toilet seat 400 is in the opened state. This offers the following effects.

In general, the toilet seat 400 is opened when a male user urinates. When the toilet pre-wash is performed when a male user urinates, the washing water released in the toilet 700 and the urine collide with each other. This might cause washing water or urine to splash out of the toilet 700.

Also, in general, the toilet seat 400 is opened also when the toilet 700 of FIG. 1 is cleaned. When the toilet pre-wash is performed during the cleaning of the toilet 700, the washing water released in the toilet 700 and a cleaning tool (e.g. brush) put into the toilet 700 collide with each other. This might cause the washing water to splash out of the toilet 700.

Also, when the toilet pre-wash is performed when a liquid cleaner is applied on the toilet 700, the liquid cleaner applied on the toilet 700 will be washed away before cleaning.

These disadvantages can be certainly prevented when the apparatus is constructed such that the toilet pre-wash is not performed when the toilet seat 400 is in the opened state.

Also, the controller 90 may perform the toilet seat open/close determining operation after the entrance of a user is detected in Step S2. In this case, the controller 90 performs the operation of Step S3 when the toilet seat 400 is in the closed state, and ends the toilet washing process when the toilet seat 400 is in the opened state. This prevents unnecessary toilet pre-wash.

The controller 90 performs the toilet seat open/close determining operation on the basis of a detect signal of detecting means, not shown, that detects the opened or closed state of the toilet seat 400.

The detecting means is attached to an opening/closing mechanism, not shown, for the toilet seat 400 and the lid 500. A potentiometer or a limit switch is used as the detecting means, for example.

(4-e) Effects Related to Toilet Washing Process and Toilet Nozzle

As described above, in this example, the toilet pre-wash is performed before the user sits down on the toilet seat 400. Then, almost the entire area of the inner surface of the toilet 700 can be wetted with washing water, and the adhesion of wastes to the toilet 700 is prevented.

Also, the toilet rear wash is performed when the user is sitting on the toilet seat 400. During the toilet rear wash, the front side of the toilet nozzle 40 is shielded by the toilet nozzle cover 40K. This makes it possible to wet the rear side of the inner surface of the toilet 700 with washing water, while preventing forward splashing of the washing water released from the toilet nozzle 40. This prevents the adhesion of wastes to the toilet 700 while preventing the splashes of washing water on the user sitting on the toilet seat 400.

Also, during the toilet rear wash, the toilet nozzle cover 40K prevents the adhesion of wastes to the toilet nozzle 40. This prevents wastes from being released from the toilet nozzle 40 together with washing water during toilet pre-wash and toilet rear wash. This sufficiently prevents the adhesion of wastes to the toilet 700.

Also, during the toilet rear wash, the washing water released from the toilet nozzle 40 rebounds at the toilet nozzle cover 40K. The rebounding washing water cleans the toilet nozzle 40. This certainly prevents the adhesion of wastes to the toilet nozzle 40.

Also, the toilet nozzle 40 can be held in the accommodated position at the time of installation of the sanitary washing apparatus 100 to the toilet 700, or during transportation of the sanitary washing apparatus 100. In this case, the toilet nozzle 40 is prevented from being damaged because the toilet nozzle 40 is covered by the toilet nozzle cover 40K.

Also, the angle of turn of the tip of the toilet nozzle 40 can be adjusted by controlling the toilet nozzle motor 40*m*. The expansion width WW of washing water in the toilet 700 (see FIG. 9(*a*)) can then be adjusted.

Also, in this example, the toilet nozzle 40 is provided in the discarded water circuit (the branch piping 30 and the branch piping 32). That is to say, in this example, there is no need to separately provide a circuit for the provision of the toilet nozzle 40, which simplifies the water circuit structure.

In the example above, the toilet nozzle 40 is turned in a direction parallel to the front-rear direction, but the toilet nozzle 40 may be turned in a direction parallel to side-to-side direction.

(4-f) Another Example of Structure of Toilet Nozzle

Figure 12:
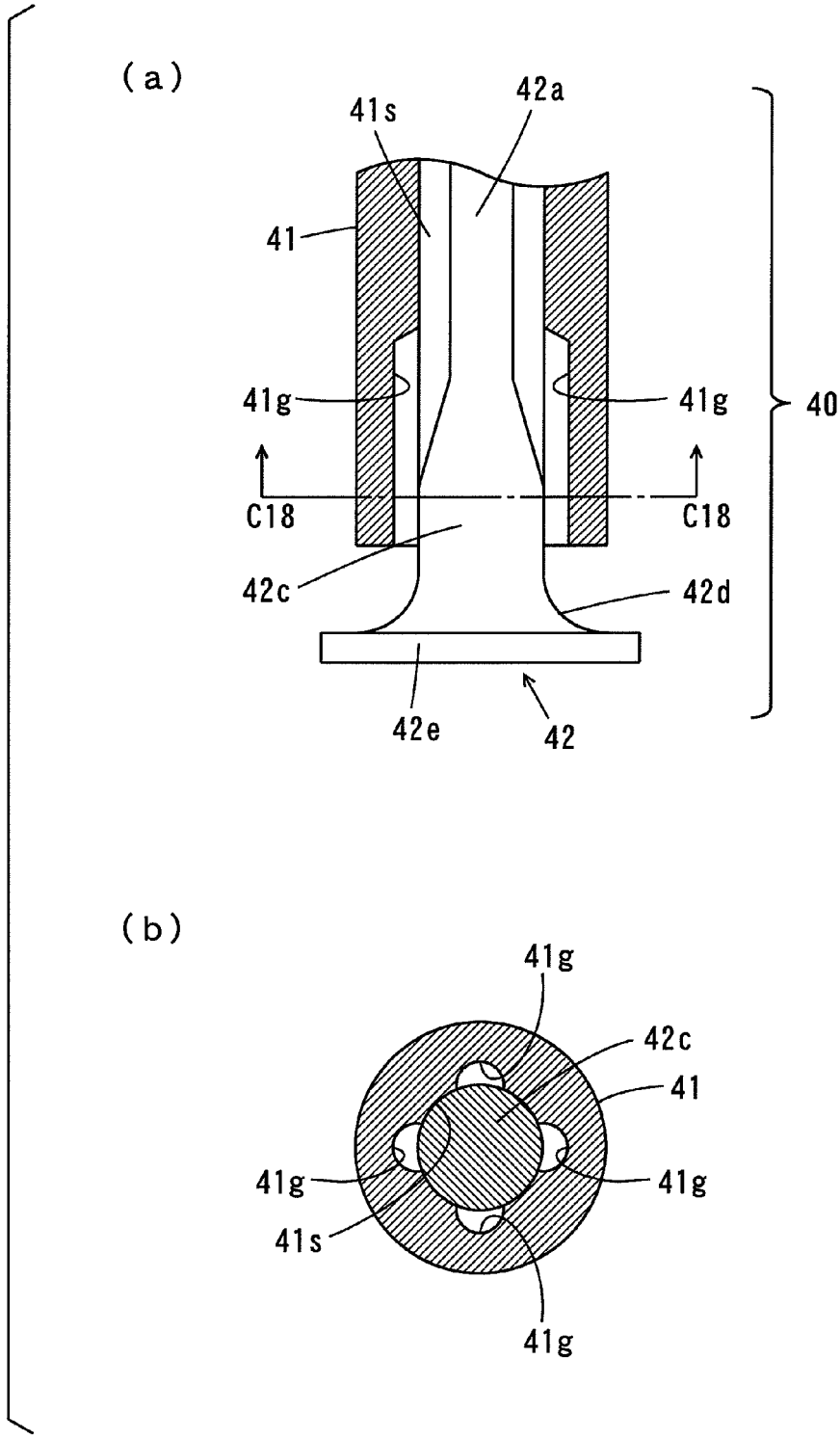
FIG. 12 shows cross-sectional views showing another example of the structure of the toilet nozzle.

FIG. 12 is a cross-sectional view illustrating another example of the structure of the toilet nozzle 40. FIG. 12(*a*) shows a vertical cross section of the tip of the toilet nozzle 40, and FIG. 12(*b*) shows the cross section taken along line C18-C18 in FIG. 12(*a*). The toilet nozzle 40 of FIG. 12 differs from the toilet nozzle 40 of FIG. 8 in the following respects.

In the toilet nozzle 40 of FIG. 12, a flow passage 41*s* is formed to extend to the end of the toilet nozzle body 41. A flow forming member 42 is inserted in the flow passage 41*s* such that the peripheral surface of a large-diameter portion 42*c* is in contact with the inner surface of the toilet nozzle body 41.

Also, in the end portion of the toilet nozzle body 41, grooves 41*g* are formed around the flow passage 41*s*, where the grooves 41*g* are shaped semicircular in cross section to protrude in the diameter direction of the flow passage 41*s*. The grooves 41*g* are formed to a given length such that, when the flow forming member 42 is inserted in the flow passage 41*s*, the upper ends of the grooves 41*g* are positioned higher than the upper end of the large-diameter portion 42*c*.

When washing water is supplied from the connection pipe 44 of FIG. 5 to the toilet nozzle 40, the washing water passes through the flow passage 41*s* and the grooves 41*g* and is released from the ends of the grooves 41*g*. At this time, the washing water is released out along the peripheral surface of the large-diameter portion 42*c* and the expanding portion 42*d*. The washing water is thus radially released from the toilet nozzle 40.

In this toilet nozzle 40, as explained above, the flow forming member 42 is inserted in the flow passage 41*s* such that the peripheral surface of the large-diameter portion 42*c* and the inner surface of the toilet nozzle body 41 are in contact with each other. This prevents the axial center of the toilet nozzle body 41 and the axial center of the flow forming member 42 from shifting from each other. As a result, the washing water can be stably released from the toilet nozzle 40.

FIG. 12 shows four grooves 41*g*, but the number of grooves 41*g* is not limited to four. For example, two or three grooves 41*g* may be formed, or five or more grooves 41*g* may be formed. Also, the cross-sectional shape of the grooves 41*g* is not limited to that of the example of FIG. 12. For example, the grooves 41*g* may be shaped rectangular in cross section.

(4-g) Still Another Example of Structure of Toilet Nozzle

Figure 13:
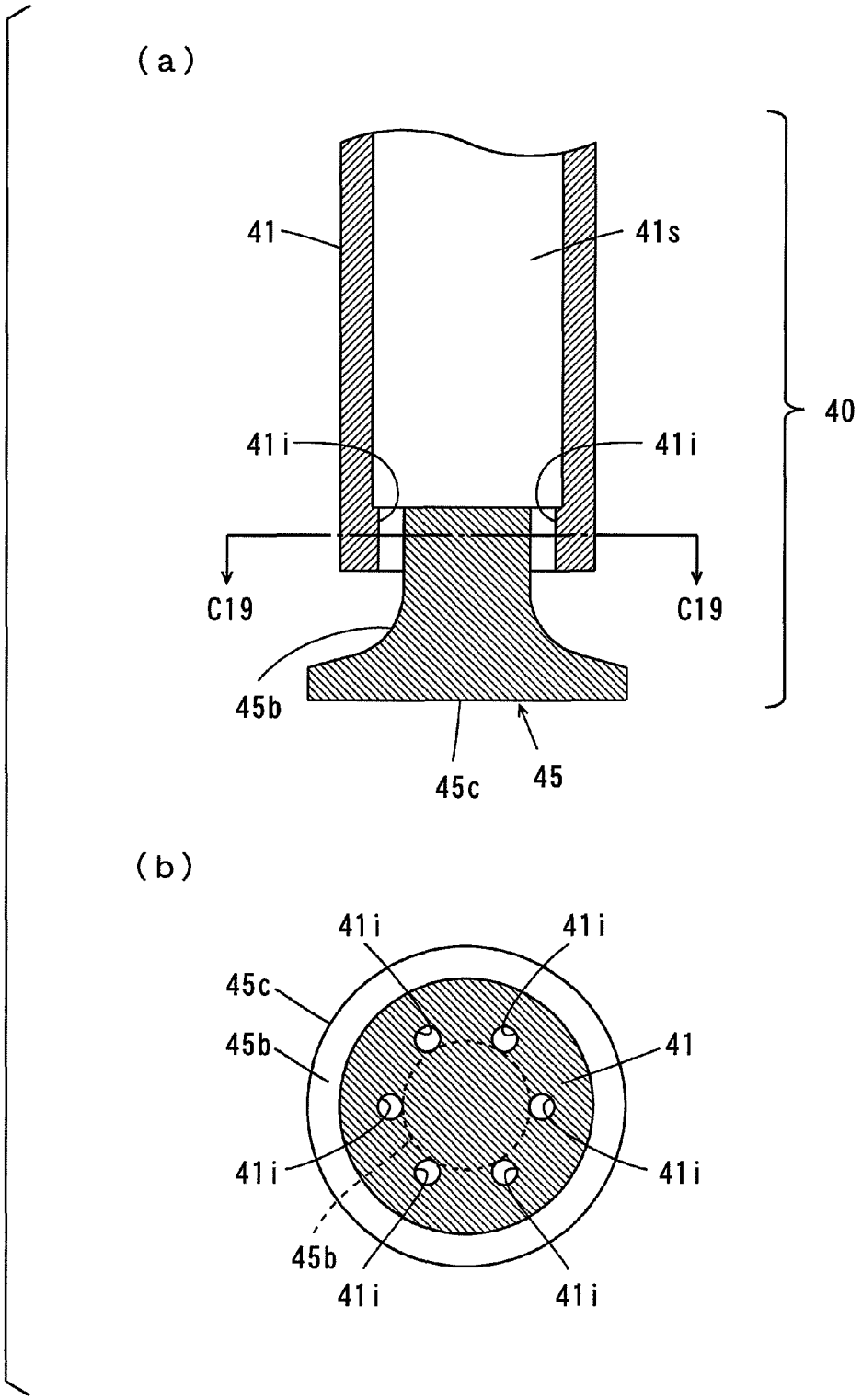
FIG. 13 shows cross-sectional views showing still another example of the structure of the toilet nozzle.

FIG. 13 is a cross-sectional view illustrating still another example of the structure of the toilet nozzle 40. FIG. 13(*a*) shows a vertical cross section of the tip of the toilet nozzle 40, and FIG. 13(*b*) shows the cross section taken along line C19-C19 in FIG. 13(*a*). The toilet nozzle 40 of FIG. 13 differs from the toilet nozzle 40 of FIG. 8 in the following respects.

In the toilet nozzle 40 of FIG. 13, six through holes 41*i* are formed at the end of the toilet nozzle body 41. The six through holes 41*i* are arranged at equal intervals on the circumference of a circle having a certain diameter around the axial center of the toilet nozzle body 41.

A flow forming member 45 is integrated at the end of the toilet nozzle body 41 and extends downward from the center part. The flow forming member 45 has an expanding portion 45*b* gradually expanding toward the end and a flange 45*c* formed at the end of the expanding portion 45*b*. The diameter of the rear end of the flow forming member 45 is equal to the diameter of the inscribed circle of the six through holes 411.

When washing water is supplied to the toilet nozzle 40 from the connection pipe 44 of FIG. 5, the washing water passes through the flow passage 41*s* and the through holes 41*i* to be released from the ends of the through holes 41*i*. At this time, the washing water is released out along the peripheral surface of the expanding portion 45*b*. The washing water is thus radially released from the toilet nozzle 40.

In this toilet nozzle 40, as explained above, the flow forming member 45 is integrated at the end of the toilet nozzle body 41. Accordingly, the axial center of the toilet nozzle body 41 and the axial center of the flow forming member 45 are not shifted from each other. As a result, washing water can be stably released from the toilet nozzle 40.

Also, the number of parts of the toilet nozzle 40 can be reduced since the toilet nozzle body 41 and the flow forming member 45 are integrated. This facilitates the production of the sanitary washing apparatus 100.

FIG. 13 illustrates six through holes 41*i*, but the number of through holes 41*i* is not limited to six. For example, five or less through holes 411 may be formed, or seven or more through holes 41*i* may be formed. Also, the cross sectional shape of the through holes 41*i* is not limited to that of the example of FIG. 13. For example, the through holes 41*i* may be shaped rectangular in cross section.

(4-h) Still Another Example of Structure of Toilet Nozzle

Figure 14:
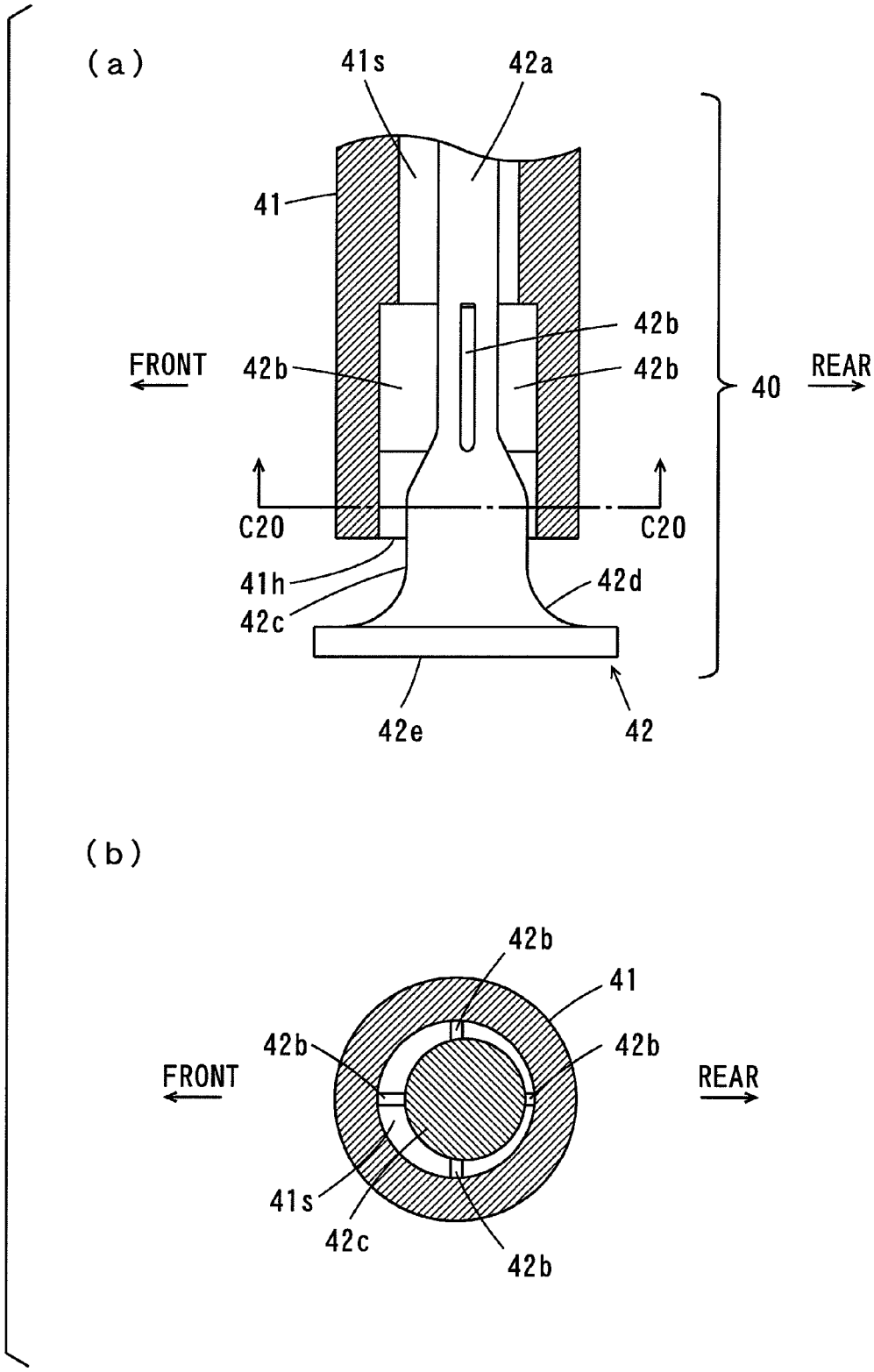
FIG. 14 shows cross-sectional views showing still another example of the structure of the toilet nozzle.

FIG. 14 is a cross-sectional view illustrating still another example of the structure of the toilet nozzle 40. FIG. 14(*a*) shows a vertical cross section of the tip of the toilet nozzle 40, and FIG. 14(*b*) shows the cross section taken along line C20-C20 in FIG. 14(*a*). The toilet nozzle 40 of FIG. 14 differs from the toilet nozzle 40 of FIG. 8 in the following respects.

In the toilet nozzle 40 shown in FIG. 14, a flow forming member 42 is formed such that the axial center of the insertion shaft 42*a* is shifted backward from the axial center of the toilet nozzle body 41.

Accordingly, the gap between the inner surface of the toilet nozzle body 41 and the peripheral surface of the flow forming member 42 is larger in the front side. In this case, the amount of washing water released from the gap on the front side of the toilet nozzle 40 is larger than the amount of washing water released from the gap on the rear side. Then, a sufficient amount of washing water can be supplied to the front side of the inner surface of the toilet 700 even when the toilet nozzle 40 is located on the rear side of the toilet 700 (FIG. 1). As a result, the front part of the inner surface of the toilet 700 is sufficiently wetted with washing water, certainly preventing the adhesion of wastes to the toilet 700.

Figure 15:
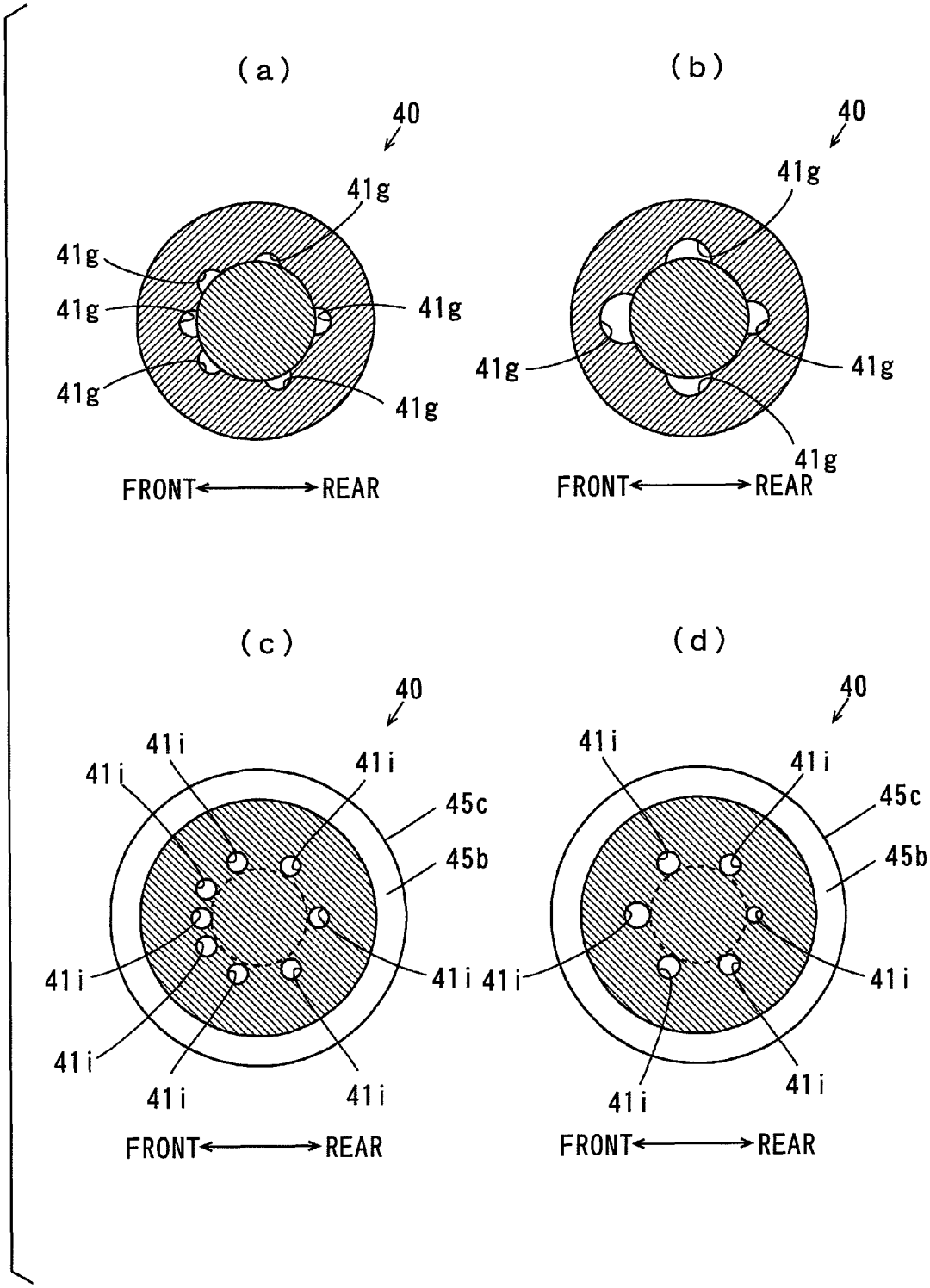
FIG. 15 is a diagram for describing other methods for releasing an increased amount of washing water from the front side of the toilet nozzle.

The method of releasing a larger amount of washing water from the front side of the toilet nozzle 40 is not limited to the method of the example above. FIG. 15 is a diagram for explaining other methods for releasing an increased amount of washing water from the front side of the toilet nozzle 40.

The toilet nozzle 40 of FIG. 15(*a*) differs from the toilet nozzle 40 of FIG. 12(*b*) in the following respect. In the toilet nozzle 40 of FIG. 15(*a*), the distance between grooves 41*g* on the front side is smaller than the distance between grooves 41*g* on the rear side. That is to say, a plurality of grooves 41*g* are arranged more densely in the front side of the toilet nozzle 40. This increases the amount of washing water released to the front side of the toilet nozzle 40.

Also, the toilet nozzle 40 shown in FIG. 15(*b*) differs from the toilet nozzle 40 shown in FIG. 12(*b*) in the following respect. In the toilet nozzle 40 of FIG. 15(*b*), the cross-sectional area of a groove 41*g* on the front side is larger than the cross-sectional area of a groove 41*g* on the rear side. This increases the amount of washing water released to the front side of the toilet nozzle 40.

Also, the toilet nozzle 40 shown in FIG. 15(*c*) differs from the toilet nozzle 40 shown in FIG. 13(*b*) in the following respect. In the toilet nozzle 40 of FIG. 15(*c*), the distance between through holes 41*i* on the front side is smaller than the distance between through holes 41*i* on the rear side. That is, a plurality of through holes 411 are arranged more densely in the front side of the toilet nozzle 40. This increases the amount of washing water released to the front side of the toilet nozzle 40.

Also, the toilet nozzle 40 shown in FIG. 15(*d*) differs from the toilet nozzle 40 shown in FIG. 13(*b*) in the following respect. In the toilet nozzle 40 of FIG. 15(*d*), the cross-sectional area of a through hole 411 on the front side is larger than the cross-sectional area of a through hole 41*i* on the rear side. This increases the amount of washing water released to the front side of the toilet nozzle 40.

(4-i) Still Another Example of Structure of Toilet Nozzle

Figure 16:
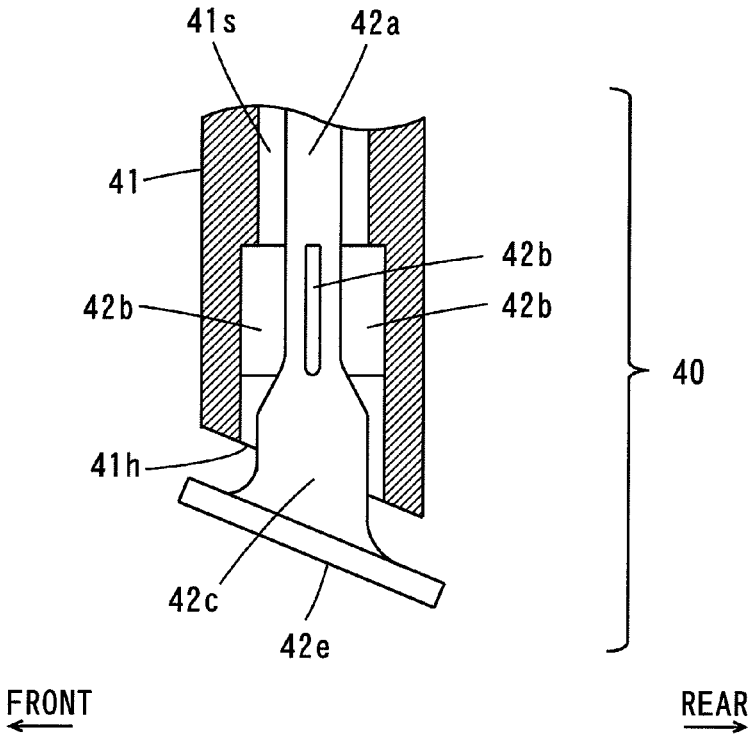
FIG. 16 is a cross-sectional view showing still another example of the structure of the toilet nozzle.

FIG. 16 is a cross-sectional view illustrating still another example of the structure of the toilet nozzle 40. The toilet nozzle 40 of FIG. 16 differs from the toilet nozzle 40 of FIG. 8 in the following respects.

In the toilet nozzle 40 shown in FIG. 16, the end surface of the toilet nozzle body 41 is formed such that the front side is inclined upward. Also, a flange 42*e* is provided at the end of the large-diameter portion 42*c* such that the front side is inclined upward.

In this case, washing water is released obliquely upward from the front side of the toilet nozzle 40. Then, a sufficient amount of washing water can be supplied to the front side of the inner surface of the toilet 700 even when the toilet nozzle 40 is located on the rear side of the toilet 700 (FIG. 1). As a result, the front part of the inner surface of the toilet 700 is sufficiently wetted with washing water, certainly preventing the adhesion of wastes to the toilet 700.

Also, the flow passage formed of the gap between the peripheral surface of the large-diameter portion 42*c* of the flow forming member 42 and the inner surface of the toilet nozzle body 41 has a shorter length on the front side and a longer length on the rear side in the direction parallel to the direction of axis. In this case, the flow rate of washing water flowing in the flow passage on the front side is larger than the flow rate of washing water flowing in the flow passage on the rear side. Accordingly, the front part of the inner surface of the toilet 700 can be sufficiently wetted with washing water. This certainly prevents the adhesion of wastes to the toilet 700.

(4-j) Still Another Example of Structure of Toilet Nozzle

Figure 17:
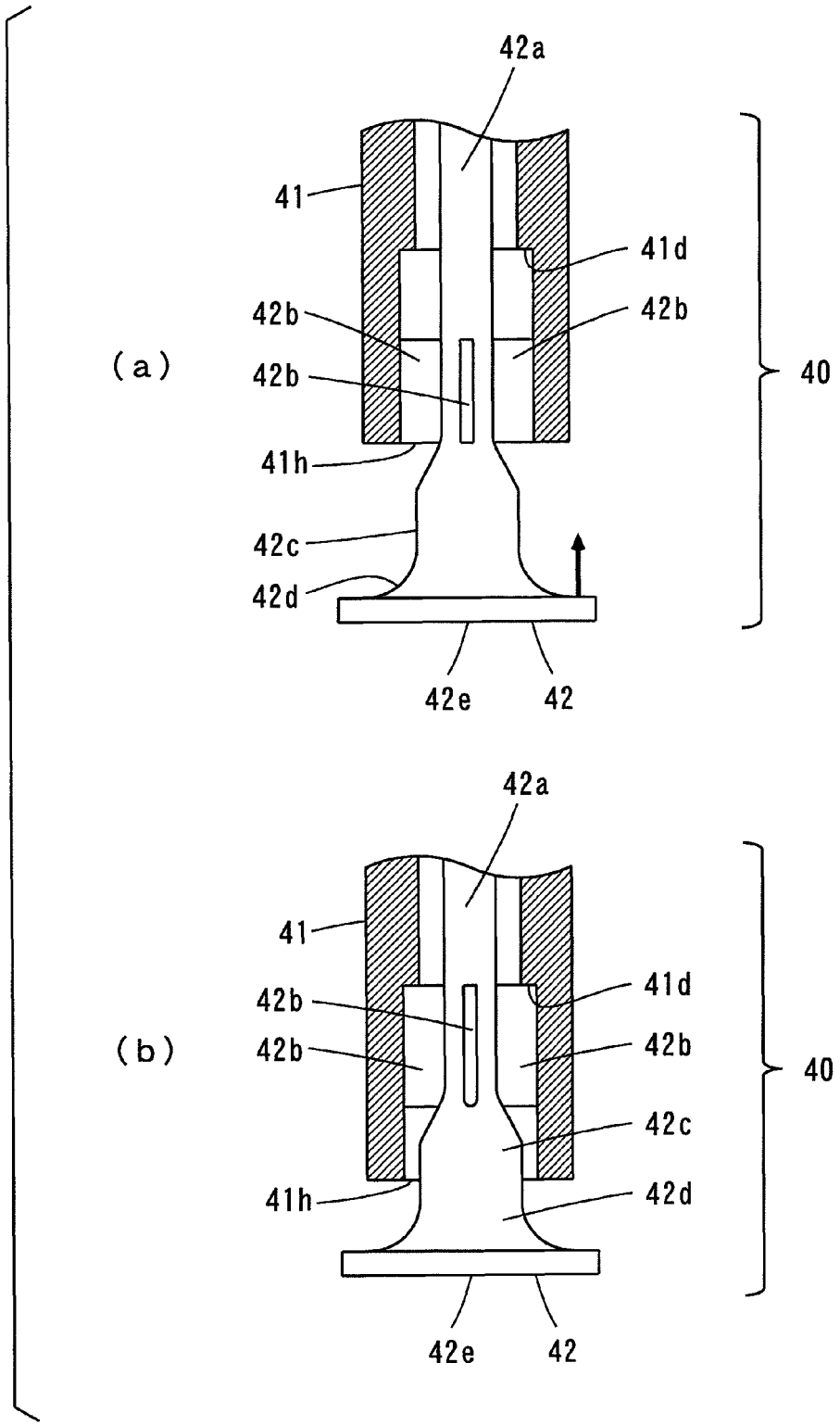
FIG. 17 shows cross-sectional views showing still another example of the structure of the toilet nozzle.

FIG. 17 is a cross-sectional view illustrating still another example of the structure of the toilet nozzle 40. The toilet nozzle 40 of FIG. 17 differs from the toilet nozzle 40 of FIG. 8 in the following respects.

In the toilet nozzle 40 shown in FIG. 17, a flow forming member 42 is formed to move up and down. In this example, the area of the gap between the inner surface of the toilet nozzle body 41 and the peripheral surface of the insertion shaft 42*a* (large-diameter portion 42*c*) can be adjusted by moving the flow forming member 42 up and down. The flow speed of washing water released from the toilet nozzle 40 can thus be adjusted.

As shown in FIG. 17(*a*), when the flange 42*e* is separated from the end opening 41*h*, the gap between the inner surface of the toilet nozzle body 41 and the peripheral surface of the insertion shaft 42*a* is enlarged. In this case, the flow speed of washing water released from the toilet nozzle 40 becomes smaller, and the expansion range of the radially released washing water becomes smaller.

Accordingly, for example, in the toilet rear wash, washing water is released from the toilet nozzle 40 in the condition shown in FIG. 17(*a*), making it possible to wet the rear side of the inner surface of the toilet 700 (FIG. 1) with washing water while preventing washing water from splashing forward from the toilet nozzle 40. This prevents the adhesion of wastes to the toilet 700 while preventing the splashes of washing water on the user.

Also, when, as shown in FIG. 17(*b*), the flange 42*e* is located closer to the end opening 41*h*, the gap between the inner surface of the toilet nozzle body 41 and the peripheral surface of the large-diameter portion 42*c* becomes smaller. This increases the flow speed of washing water released from the toilet nozzle 40.

Accordingly, for example, in the toilet pre-wash, washing water can be released from the toilet nozzle 40 in the condition shown in FIG. 17(*b*), so that a sufficient amount of washing water can be supplied to the front side of the inner surface of the toilet 700. As a result, the front side of the inner surface of the toilet 700 is sufficiently wetted with washing water and the adhesion of wastes to the toilet 700 is certainly prevented.

Also, in this example, the flow forming member 42 is formed such that the maximum cross-sectional area of the expanding portion 42*d* is larger than the area of the end opening 41*h*. In this case, the end opening 41*h* can be closed by the expanding portion 42*d* by moving the flow forming member 42 upward. Accordingly, the end opening 41*h* can be closed by the expanding portion 42*d* while the user is using the toilet apparatus 1000, so as to prevent the adhesion of wastes to the end opening 41*h*.

This prevents, during the toilet pre-wash, wastes from being released from the toilet nozzle 40 together with washing water. As a result, the adhesion of wastes to the toilet 700 can be sufficiently prevented.

Also, by closing the end opening 41*h*, it is possible to prevent dusts, cleaner, etc. from entering the flow passage 41*s* while the lavatory is being cleaned, for example. This more certainly prevents the contamination of the toilet nozzle 40.

Also, in this example, even if scale components of service water, rust, particles, or dirty matters adhere to the flow forming member 42 and the end opening 41*h*, the adhering matters can be easily removed by moving the flow forming member 42 up and down. This prevents clogging of the toilet nozzle 40.

Figure 18:
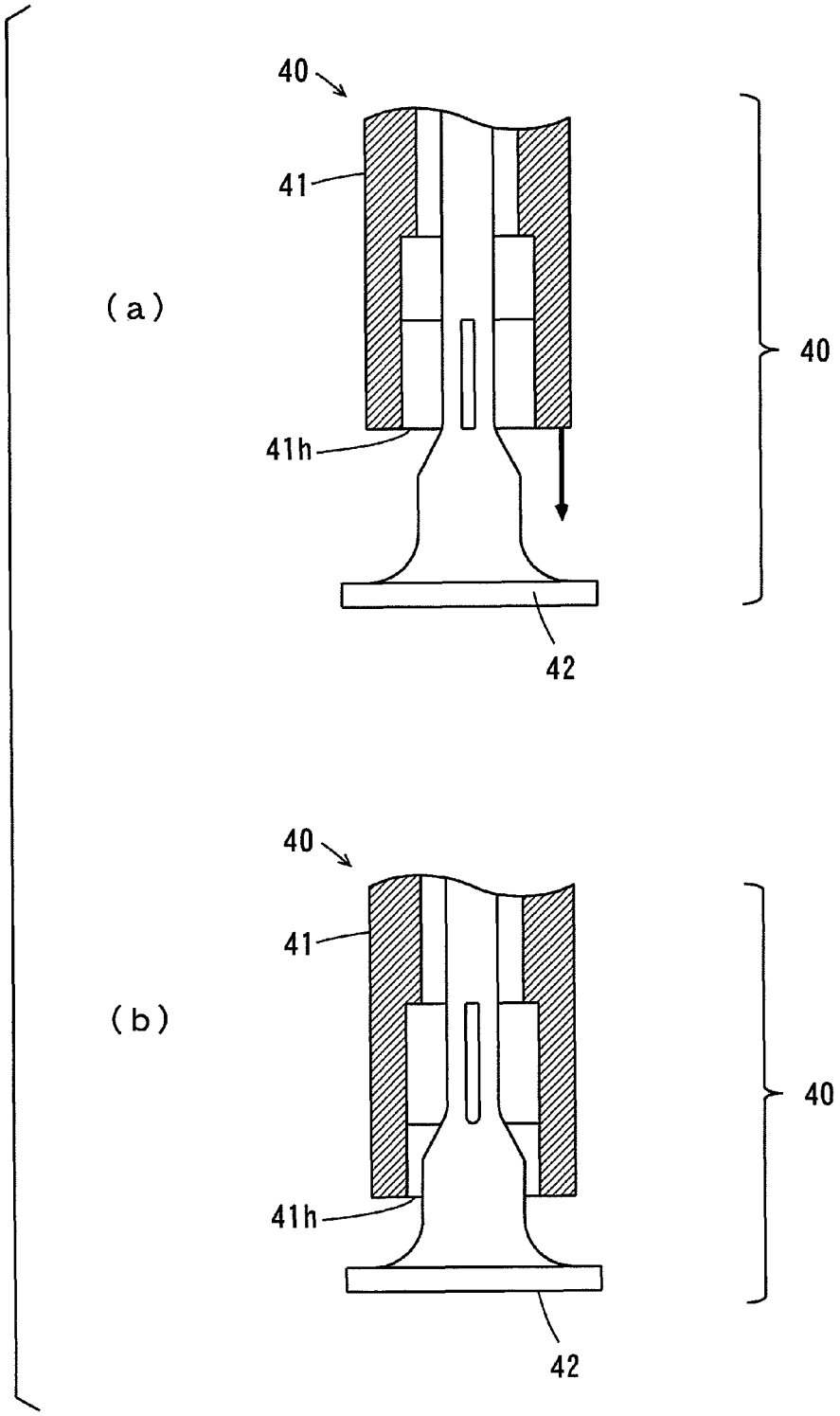
FIG. 18 shows cross-sectional views showing still another example of the structure of the toilet nozzle.

As shown in FIG. 18, the toilet nozzle body 41 may be formed to move up and down.

(4-k) Still Another Example of Structure of Toilet Nozzle and its Vicinity

Figure 19:
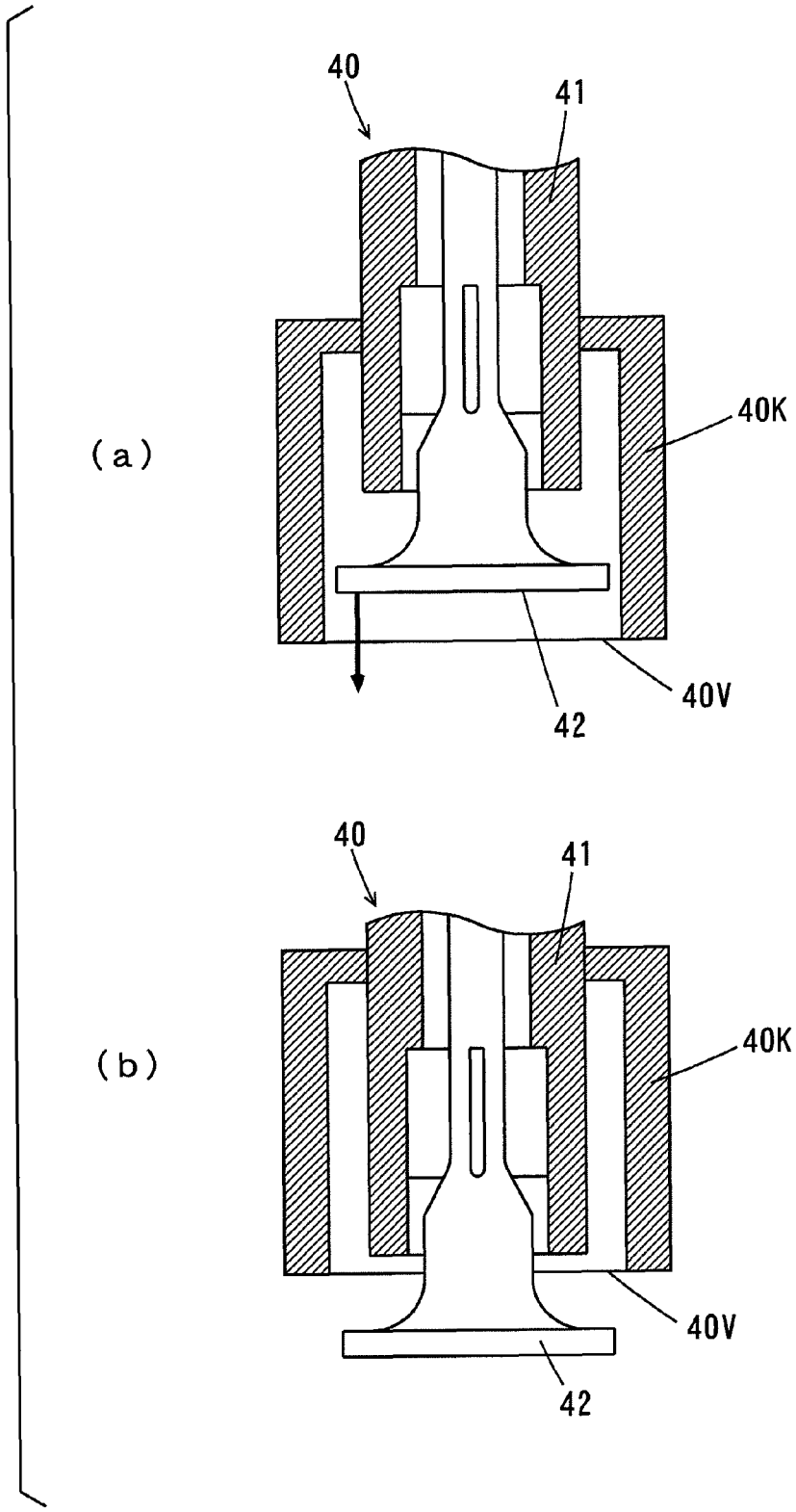
FIG. 19 is a diagram showing another example of the structure of the toilet nozzle and its vicinity.

FIG. 19 is a diagram showing another example of the structure of the toilet nozzle 40 and its vicinity (hereinafter referred to simply as "toilet nozzle 40 etc.") The toilet nozzle 40 etc. shown in FIG. 19 differ from the toilet nozzle 40 etc. shown in FIG. 5 in the following respects.

As shown in FIG. 19(*a*), in this example, a box-like toilet nozzle cover 40K, having a cover opening 40V at the lower end, is provided to cover the tip of the toilet nozzle 40. The toilet nozzle 40 can move up and down, and when the toilet nozzle 40 moves downward, as shown in FIG. 19(*b*), the flow forming member 42 projects from the cover opening 40V below the toilet nozzle cover 40K.

In this example, the toilet nozzle cover 40K surrounding the tip of the toilet nozzle 40 certainly prevents the adhesion of wastes to the toilet nozzle 40. Accordingly, the toilet nozzle 40 is not contaminated by wastes.

Also, because the toilet nozzle 40 is surrounded by the toilet nozzle cover 40K, the toilet nozzle 40 will not be damaged during transportation of the sanitary washing apparatus 100, for example.

Also, in this example, when washing water is released from the toilet nozzle 40 in the condition of FIG. 19(*a*), the washing water hits the inner surface of the toilet nozzle cover 40K and rebounds to the toilet nozzle 40. The toilet nozzle 40 is thus washed and contamination of the toilet nozzle 40 is prevented.

During the toilet pre-wash, washing water is released in the condition shown in FIG. 19(*b*).

Figure 20:
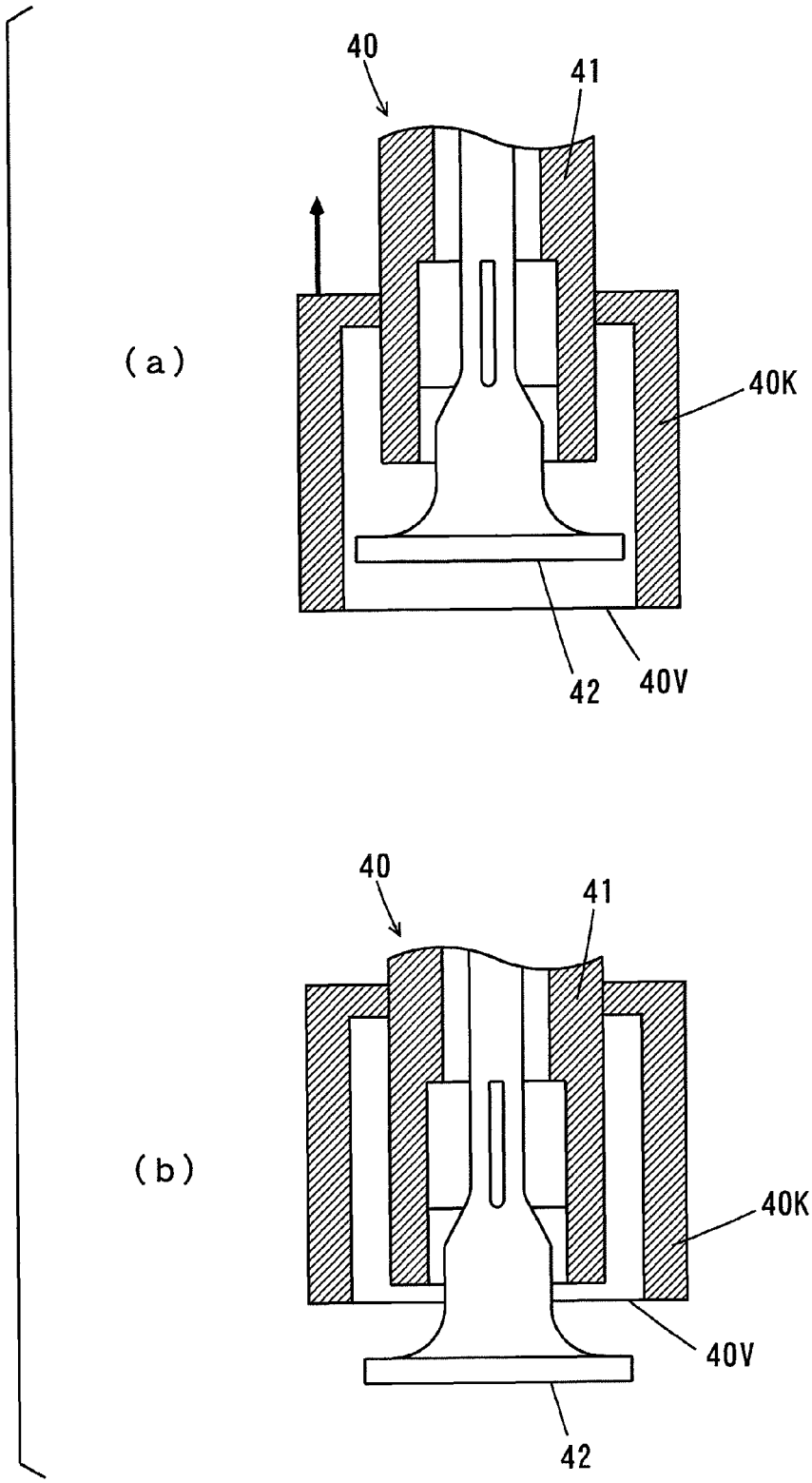
FIG. 20 is a diagram showing still another example of the structure of the toilet nozzle and its vicinity.

As shown in FIG. 20, the toilet nozzle cover 40K may be constructed to move up and down.

(4-l) Still Another Example of Structure of Toilet Nozzle and its Vicinity

Figure 21:
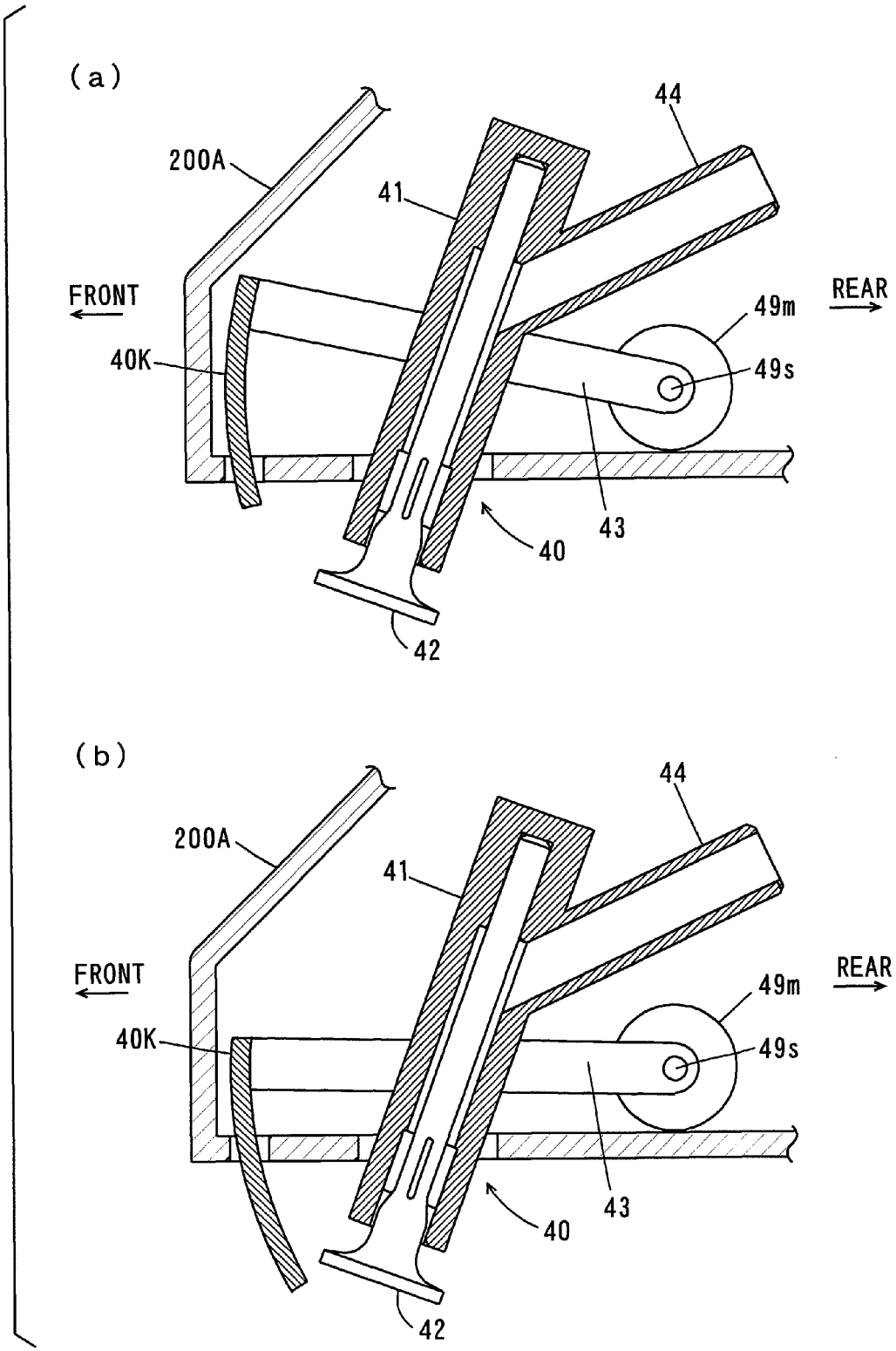
FIG. 21 is a diagram showing still another example of the structure of the toilet nozzle and its vicinity.

FIG. 21 is a diagram showing still another example of the structure of the toilet nozzle 40 etc. The toilet nozzle 40 etc. shown in FIG. 21 differ from the toilet nozzle 40 etc. shown in FIG. 5 in the following respects.

As shown in FIG. 21, in this example, the toilet nozzle 40 is fixed to the lower main body casing 200A. The tip of the toilet nozzle body 41 projects downward from the lower surface of the lower main body casing 200A. A connection pipe 44 is connected to a side of the toilet nozzle body 41.

Also, a motor 49*m* is provided in the lower main body casing 200A, and one end of a rotating piece 43 is fixed to the rotation shaft 49*s* of the motor 49*m*. A plate-like toilet nozzle cover 40K is attached to the other end of the rotating piece 43. The end of the toilet nozzle cover 40K projects downward from the lower surface of the lower main body casing 200A.

The rotation shaft 49*s* of the motor 49*m* turns to move the toilet nozzle cover 40K up and down in front of the toilet nozzle 40.

In this example, the toilet pre-wash is performed with the lower end of the toilet nozzle cover 40K positioned above the end of the toilet nozzle 40 as shown in FIG. 21(*a*).

Also, as shown in FIG. 21(*b*), the toilet rear wash is performed with the lower end of the toilet nozzle cover 40K positioned at almost the same height as the end of the toilet nozzle 40. In this case, washing water released forward from the toilet nozzle 40 hits the toilet nozzle cover 40K and rebounds to the end of the toilet nozzle 40. This prevents splashes of washing water on the human body, and the end of the toilet nozzle 40 is washed. Also, the toilet nozzle cover 40K prevents the adhesion of wastes to the end of the toilet nozzle 40. As a result, it is possible to certainly prevent the contamination of the end of the toilet nozzle 40.

Also, in this example, the toilet nozzle 40 is not turned, preventing damage to the toilet nozzle 40. Also, the toilet nozzle 40 can be stable and the release of washing water is also stable.

(4-m) Still Another Example of Structure of Toilet Nozzle and its Vicinity

Figure 22:
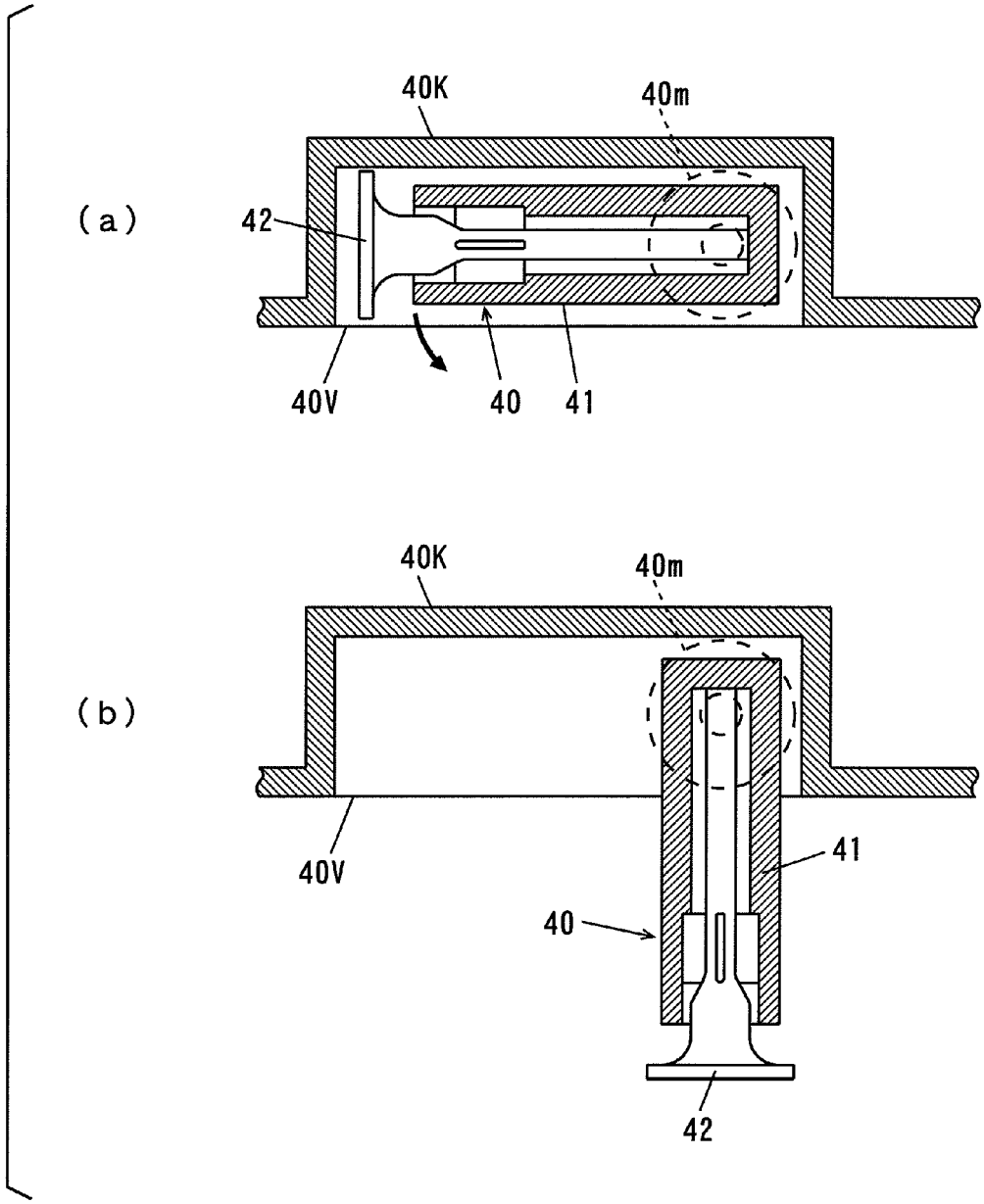
FIG. 22 is a diagram showing still another example of the structure of the toilet nozzle and its vicinity.

FIG. 22 is a diagram showing still another example of the structure of the toilet nozzle 40 etc. The toilet nozzle 40 etc. shown in FIG. 22 differ from the toilet nozzle 40 etc. shown in FIG. 5 in the following respects.

As shown in FIG. 22(*a*), in this example, the toilet nozzle 40 is provided in a box-like toilet nozzle cover 40K having a cover opening 40V at its bottom. The rear end of the toilet nozzle 40 is connected to a toilet nozzle motor 40*m*. Thus, the end of the toilet nozzle 40 turns when the toilet nozzle motor 40*m* operates.

When washing water is released with the toilet nozzle 40 held horizontally as shown in FIG. 22(*a*), the washing water hits the upper surface of the toilet nozzle cover 40K and rebounds to the toilet nozzle 40. The toilet nozzle 40 is thus washed and the contamination of the toilet nozzle 40 is prevented. When the toilet pre-wash is performed, washing water is released with the toilet nozzle 40 held in a vertical direction as shown in FIG. 22(*b*).

In this example, as shown in FIG. 22(*a*), the toilet nozzle 40 can be held horizontally inside the toilet nozzle cover 40K. Accordingly, the toilet nozzle 40 can be easily installed in the main body 200 even when a sufficient space in the height direction cannot be ensured in the main body 200 (FIG. 4). This enables size reduction of the main body 200 and facilitates the design of the main body 200.

Also, when the toilet nozzle 40 is held horizontally, the toilet nozzle 40 is sufficiently protected by the toilet nozzle cover 40K, which certainly prevents the adhesion of wastes to the toilet nozzle 40. Also, damage to the toilet nozzle 40 is certainly prevented.

Also, the expansion width WW of washing water (see FIG. 9(*b*)) can be adjusted by adjusting the turning angle of the toilet nozzle 40.

(4-n) Another Example of Configuration of Main Body

Figure 23:
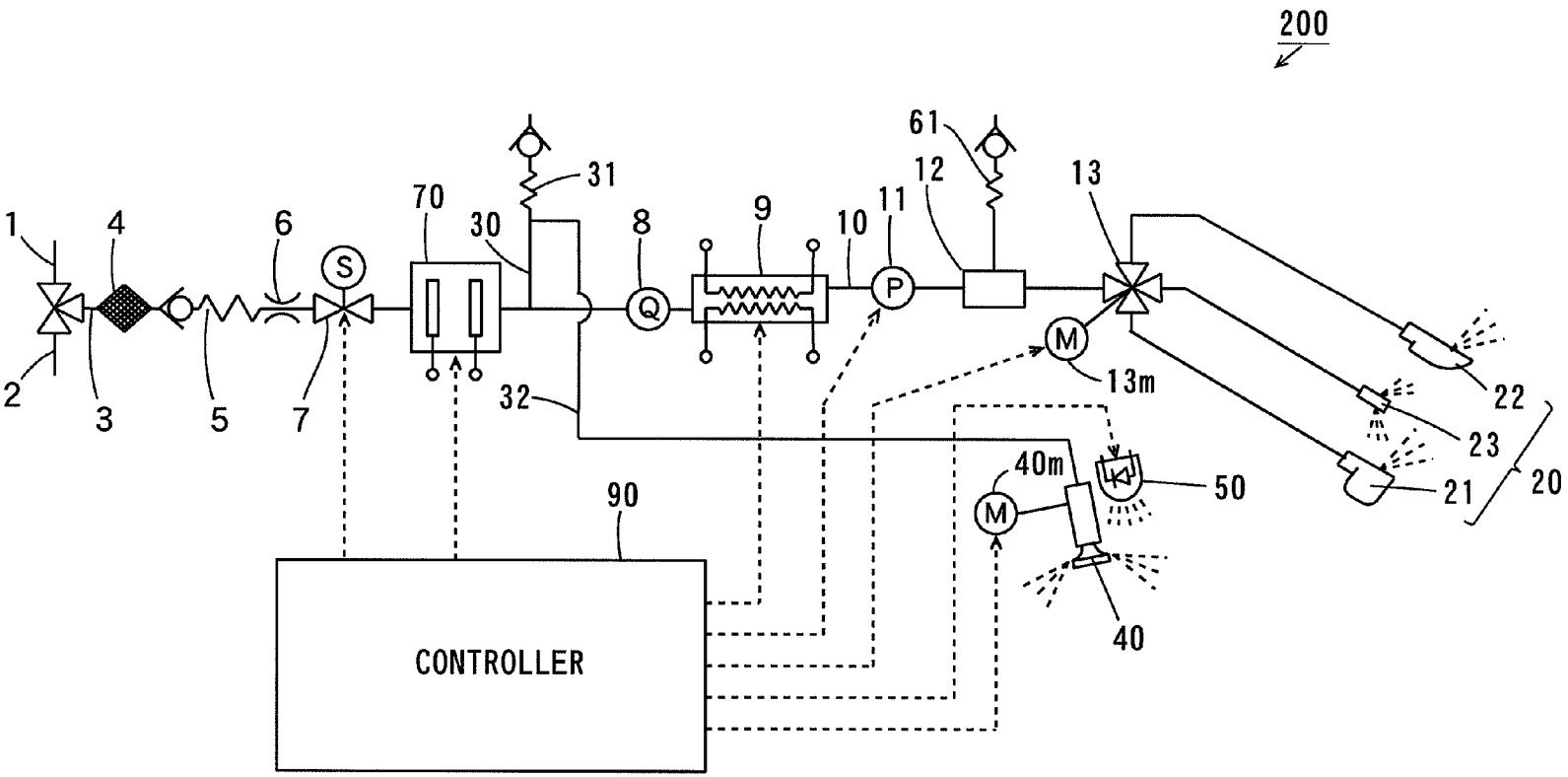
FIG. 23 is a schematic diagram showing another example of the configuration of the main body.

FIG. 23 is a schematic diagram showing another example of the configuration of the main body 200. The main body 200 of FIG. 23 differs from the main body 200 of FIG. 3 in the following respects.

In the main body 200 of FIG. 23, an ion elution device 70 is inserted in the piping 3 between the electromagnetic shutoff valve 7 and the flow rate sensor 8.

The ion elution device 70 is controlled by the controller 90 and elutes silver ions into the washing water flowing in the piping 3 (disinfection operation). Thus, washing water containing silver ions is released from the posterior nozzle 21, the bidet nozzle 22, the nozzle washing nozzle 23, and the toilet nozzle 40. The ion elution device 70 will be fully described later.

Silver ions have disinfection properties, and so kill bacteria adhering to the washing water releasing openings of the posterior nozzle 21, the bidet nozzle 22 and the toilet nozzle 40.

Also, the portions of the posterior nozzle 21 and the bidet nozzle 22 that project inside the toilet 700 are washed by the nozzle washing nozzle 23. This certainly disinfects the posterior nozzle 21 and the bidet nozzle 22.

Also, during the toilet pre-wash, the washing water is released from the toilet nozzle 40 in a large area of the inner surface of the toilet 700, so that the toilet 700 is certainly disinfected. This prevents bad smells and keeps the toilet 700 clean.

Also, in this example, as described above, the toilet nozzle 40 can be washed by washing water rebounded at the toilet nozzle cover 40K (FIG. 5). Accordingly, the toilet nozzle 40 is also certainly disinfected.

Ions eluted in the ion elution device 70 can be silver ions or any other metal ions having disinfection properties, such as copper ions or zinc ions. In this case, copper electrodes or zinc electrodes, instead of silver electrodes 75 described later (FIG. 24), are provided in the ion elution device 70.

(4-o) Structure of Ion Elution Device

Figure 24:
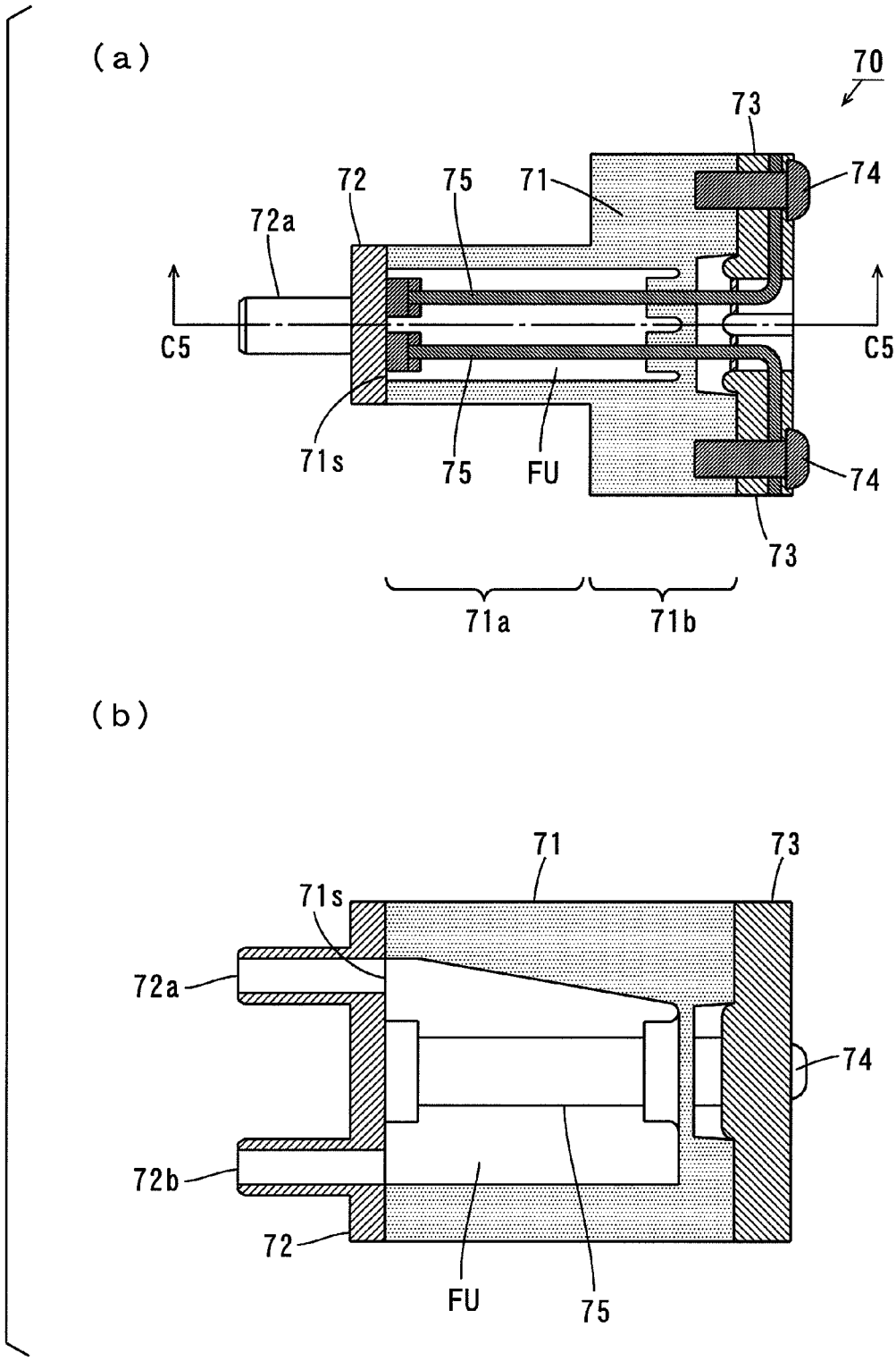
FIG. 24 shows cross-sectional views of an ion elution device of FIG. 23.

FIG. 24 is a cross-sectional view of the ion elution device 70 of FIG. 23. FIG. 24(*a*) shows a transverse cross section of the ion elution device 70, and FIG. 24(*b*) shows the cross section (vertical cross section) taken along line C5-C5 of the ion elution device 70 of FIG. 24(*a*).

As shown in FIG. 24(*a*) and FIG. 24(*b*), the ion elution device 70 has an electrode casing 71. The electrode casing 71 includes a flow passage forming part 71*a* and an electrode supporting part 71*b*. An ion elusion space FU is formed in the flow passage forming part 71*a*. The ion elusion space FU forms part of the flow passage of washing water.

An electrode supporting member 73 is fixed with screws 74 on one side of the electrode casing 71. One ends of two L-shaped silver electrodes 75 are buried in the electrode supporting member 73. The wall on one side of the electrode casing 71 has two through holes formed to allow the insertion of the two silver electrodes 75. The two silver electrodes 75 are inserted into the ion elusion space FU through the two through holes.

An opening 71*s* is formed on the other side of the electrode casing 71. A port member 72 is attached to close the opening 71*s*. The other ends of the two silver electrodes 75 are attached to the port member 72.

The port member 72 has a first port 72*a* and a second port 72*b* formed therein. The piping 3 of FIG. 23 is connected to the first port 72*a* and the second port 72*b*. Washing water flowing in the piping 3 is introduced into the ion elusion space FU through the second port 72*b*. Voltage is applied between the two silver electrodes 75 to cause elution of silver ions into the washing water from the silver electrodes 75 in the ion elution space FU. The washing water containing silver ions flows through the first port 72*a* back into the piping 3.

In the ion elution device 70 thus constructed, the two silver electrodes 75 are located approximately in the center in the ion elution space FU, and a gap is formed between the silver electrodes 75 and the inner bottom surface of the electrode casing 71.

Thus, deposits containing silver ions (silver chloride, silver oxide, etc.), generated by the electrolysis of the silver electrodes 75, precipitate on the inner bottom surface of the electrode casing 71. This prevents the reduction of potential between the two silver electrodes 75 due to eluted silver ions, providing stable electrolysis. Also, the adhesion of such deposits between the two silver electrodes 75 is prevented, thus preventing short-circuit between the electrodes.

Also, as shown in FIG. 24(*b*), the second port 72*b* is provided on the bottom side of the electrode casing 71. In this case, washing water flowing from the second port 72*b* to the first port 72*a* efficiently discharges the deposits on the inner bottom surface of the electrode casing 71 from the ion elusion space FU.

Also, as shown in FIG. 24(*b*), the upper surface of the ion elution space FU is inclined upward toward the port member 72. In this case, gas generated in the ion elution space FU is gathered to the upper part on the side of the port member 72. Thus, the gas generated in the ion elution space FU can be efficiently discharged from the first port 72*a*.

As mentioned above, the ion elution device 70 is controlled by the controller 90. That is to say, the controller 90 controls the timing of the application of voltage between the two silver electrodes 75.

(4-p) Still Another Example of Configuration of Main Body

Figure 25:
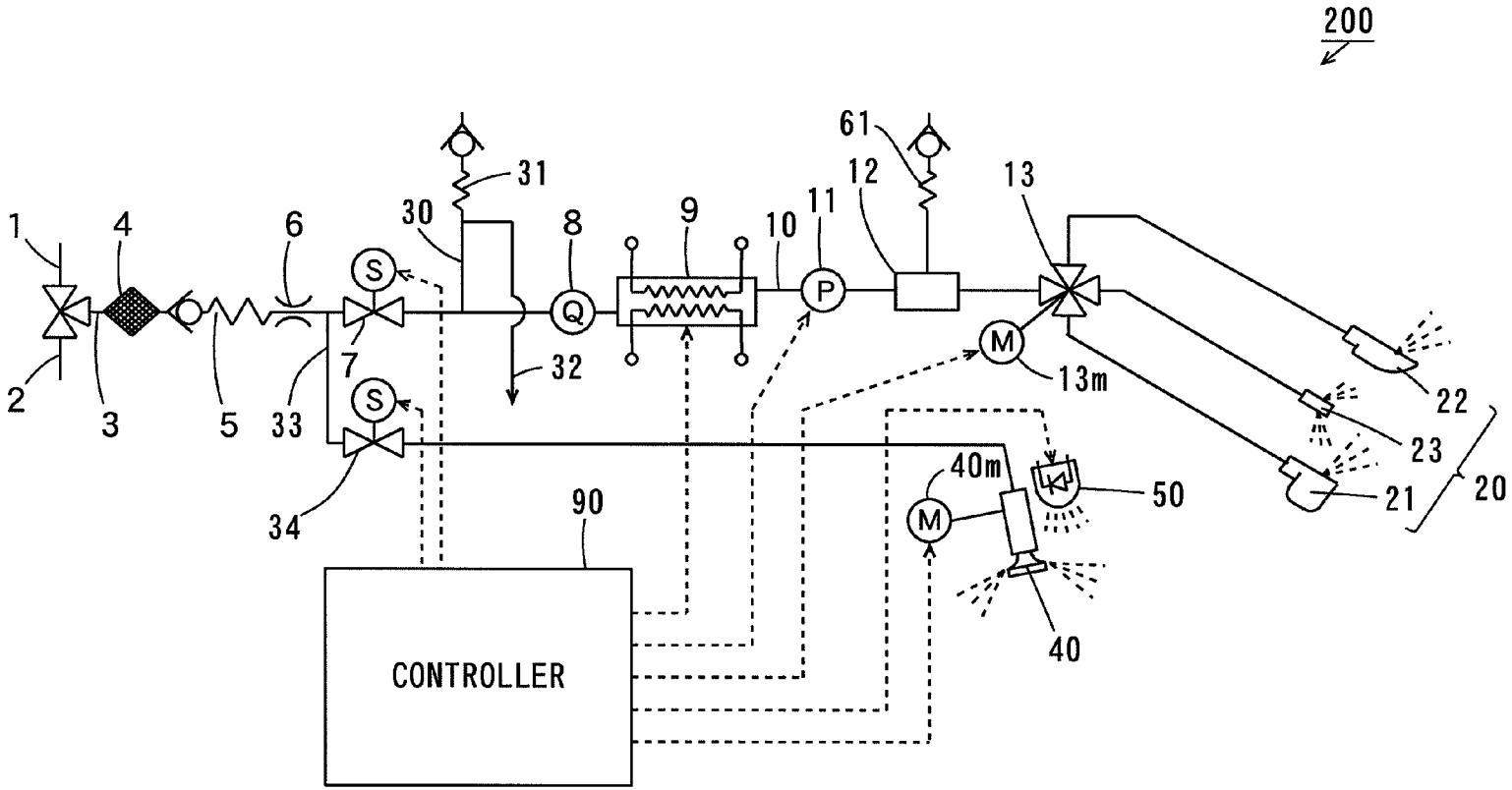
FIG. 25 is a schematic diagram showing still another example of the configuration of the main body.

FIG. 25 is a schematic diagram showing still another example of the configuration of the main body 200. The main body 200 of FIG. 25 differs from the main body 200 of FIG. 3 in the following respects.

In the main body 200 of FIG. 25, branch piping 33 is provided to extend from the piping 3 between the constant flow rate valve 6 and the electromagnetic shutoff valve 7. An electromagnetic shutoff valve 34 and the toilet nozzle 40 are connected to the branch piping 33.

In this case, the controller 90 can control the electromagnetic shutoff valve 34 to easily switch start and stop of the release of washing water from the toilet nozzle 40.

Also, the branch piping 33 is provided upstream in the main body 200, so that washing water can be supplied to the toilet nozzle 40 with sufficient pressure.

Also, washing water can be released simultaneously from the nozzle unit 20 and the toilet nozzle 40 by opening the electromagnetic shutoff valve 7 and the electromagnetic shutoff valve 34.

(4-q) Still Another Example of Configuration of Main Body

Figure 26:
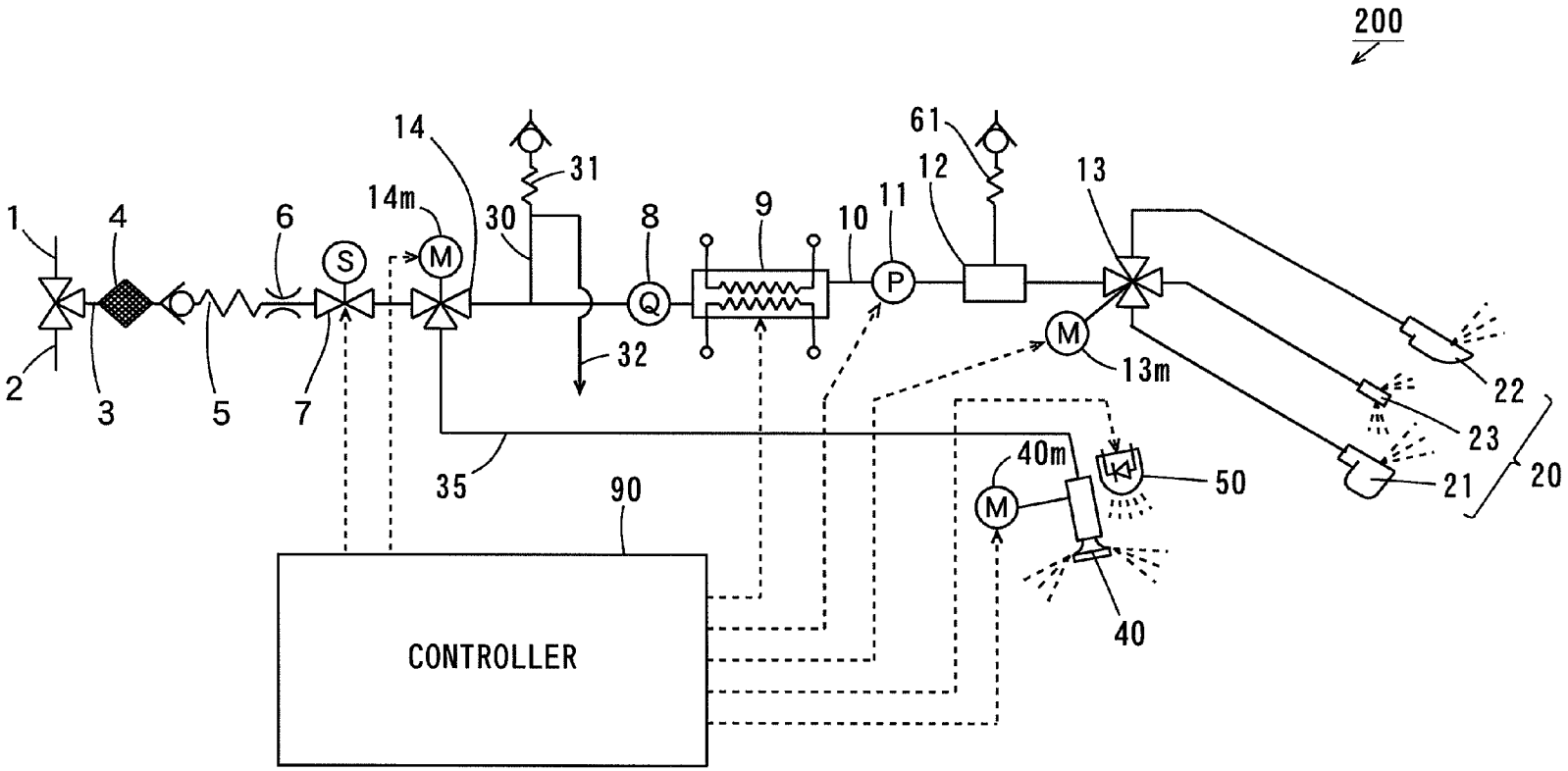
FIG. 26 is a schematic diagram showing still another example of the configuration of the main body.

FIG. 26 is a schematic diagram showing still another example of the configuration of the main body 200. The main body 200 of FIG. 26 differs from the main body 200 of FIG. 3 in the following respects.

In the main body 200 of FIG. 26, a switching valve for toilet, 14, is provided in the piping 3. The switching valve for toilet 14 includes a toilet switching valve motor 14*m*. In the piping 3, the switching valve for toilet 14 is provided upstream of the connection with the branch piping 30 and downstream of the electromagnetic shutoff valve 7. Piping 35 is connected to one of a plurality of ports of the switching valve for toilet 14. The toilet nozzle 40 is provided at the end of the piping 35.

In this case, the controller 90 can control the toilet switching valve motor 14*m* to easily switch start and stop of the release of washing water from the toilet nozzle 40.

Also, washing water can be supplied to the toilet nozzle 40 with sufficient pressure because the branch piping 35 is provided upstream in the main body 200.

(4-r) Still Another Example of Configuration of Main Body

Figure 27:
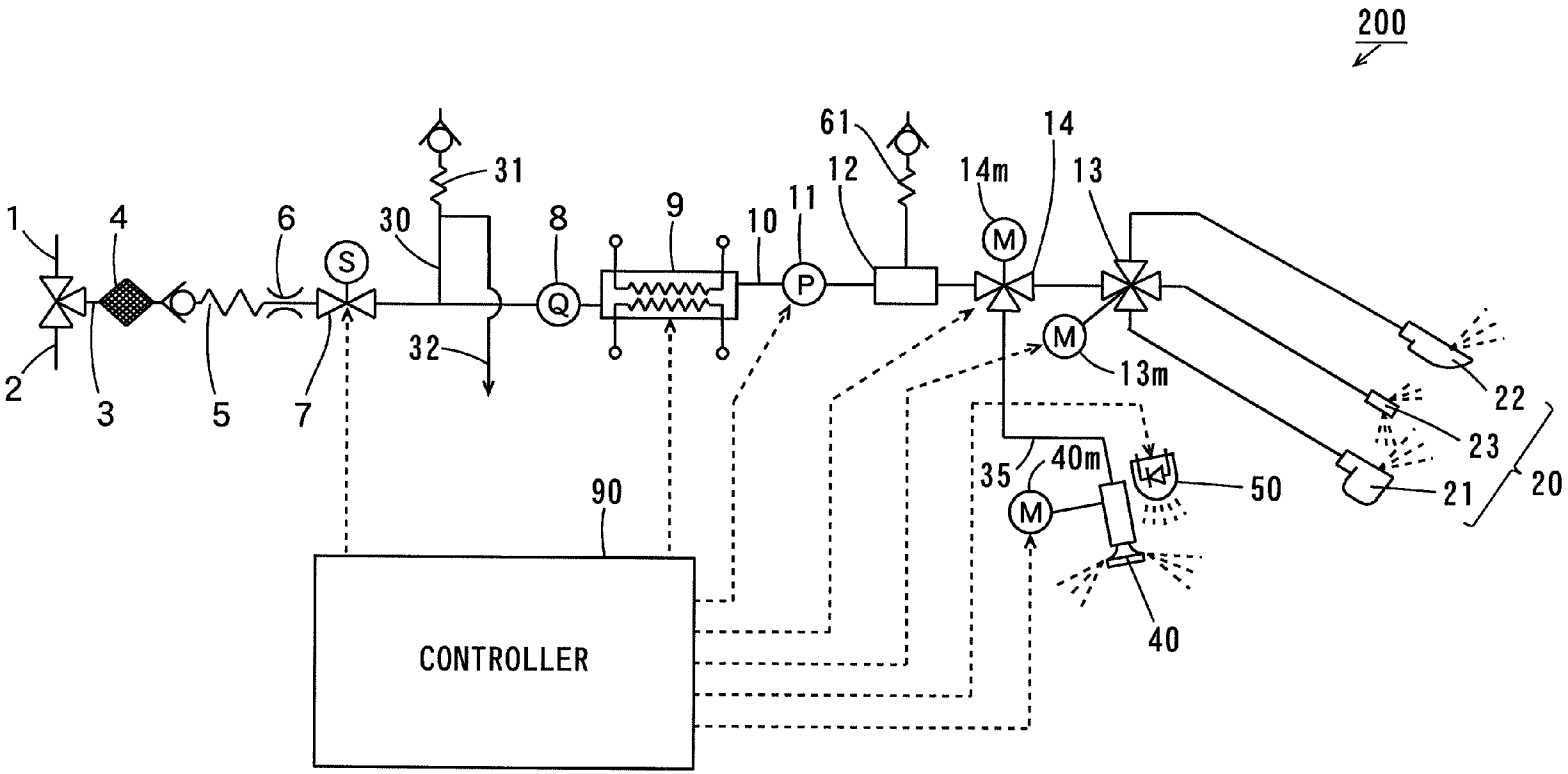
FIG. 27 is a schematic diagram showing still another example of the configuration of the main body.

FIG. 27 is a schematic diagram showing still another example of the configuration of the main body 200. The main body 200 of FIG. 27 differs from the main body 200 of FIG. 3 in the following respects.

In the main body 200 of FIG. 27, a switching valve for toilet, 14, is provided in the piping 10 between the buffer tank 12 and the switching valve for human body 13. Piping 35 is connected to one of a plurality of ports of the switching valve for toilet 14. The toilet nozzle 40 is provided at the end of the piping 35.

In this case, the controller 90 can control the toilet switching valve motor 14*m* to easily switch start and stop of the release of washing water from the toilet nozzle 40.

Also, since the piping 35 is provided downstream of the pump 11, the pressure of washing water supplied to the toilet nozzle 40 can be held constant.

Also, since the piping 35 is provided downstream of the heat exchanger 9, warm water can be released from the toilet nozzle 40. This more certainly prevents the adhesion of wastes to the toilet 700. Also, washing the toilet 700 with warm water offers a disinfection effect.

(4-s) Still Another Example of Configuration of Main Body

Figure 28:
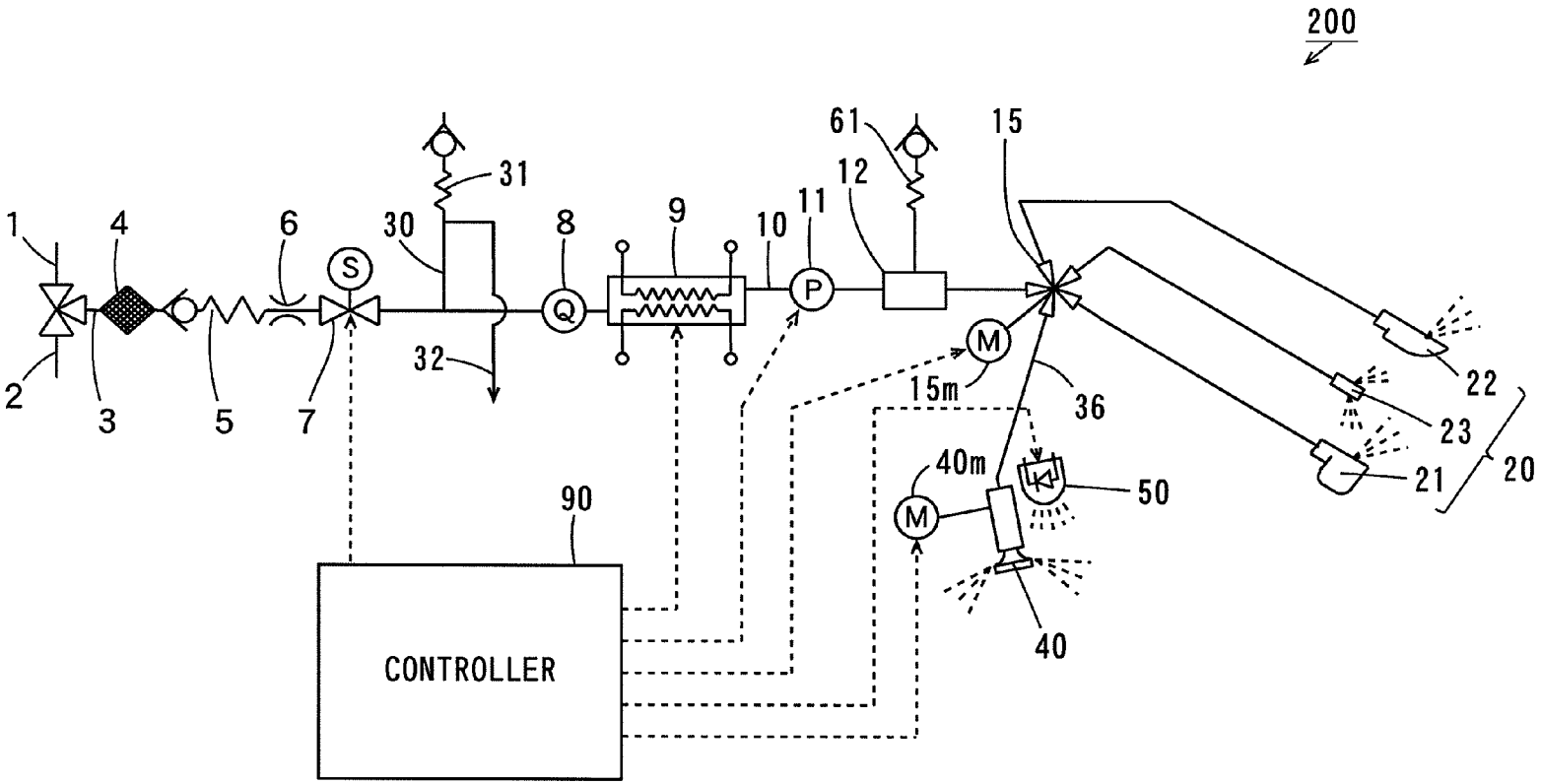
FIG. 28 is a schematic diagram showing still another example of the configuration of the main body.

FIG. 28 is a schematic diagram showing still another example of the configuration of the main body 200. The main body 200 of FIG. 28 differs from the main body 200 of FIG. 3 in the following respects.

In the main body 200 of FIG. 28, a switching valve 15 is provided in place of the switching valve for human body 13 of FIG. 3. The switching valve 15 includes a switching valve motor 15*m*. The posterior nozzle 21, the bidet nozzle 22, the nozzle washing nozzle 23, and piping 36 are connected respectively to a plurality of ports of the switching valve 15. The toilet nozzle 40 is provided at the end of the piping 36.

In the switching valve 15, the switching valve motor 15*m* operates so that washing water sent with pressure from the pump 11 is supplied to one of the posterior nozzle 21, the bidet nozzle 22, the nozzle washing nozzle 23, and the toilet nozzle 40 (piping 36).

In this example, the configuration of the main body is simplified because the posterior nozzle 21, the bidet nozzle 22, the nozzle washing nozzle 23, and the toilet nozzle 40 are connected to the common switching valve 15. This reduces the manufacturing costs of the sanitary washing apparatus 100.

Figure 29:
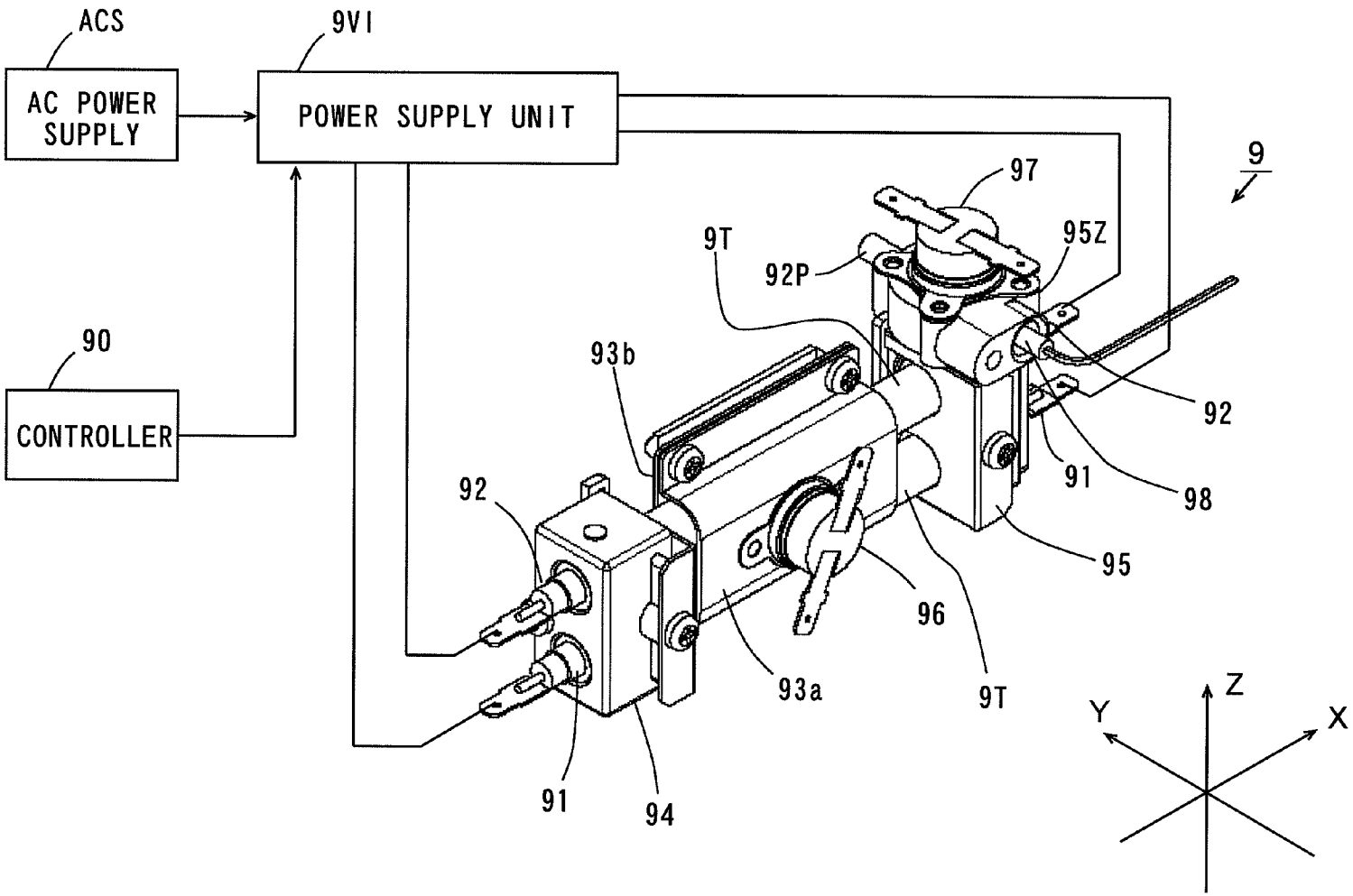
FIG. 29 is a perspective view illustrating the appearance of the heat exchanger of FIG. 3 seen from one direction.
Figure 30:
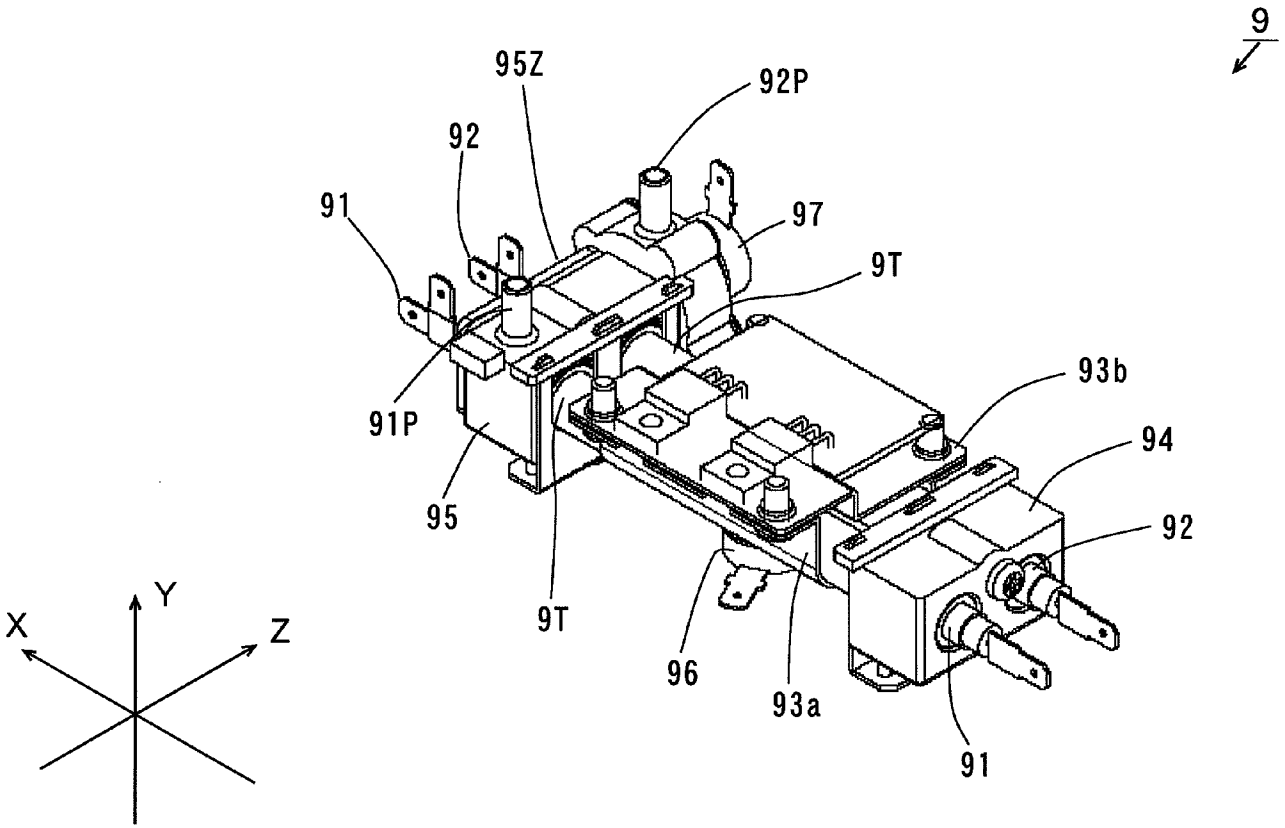
FIG. 30 is a perspective view illustrating the appearance of the heat exchanger of FIG. 3 seen from another direction.
Figure 31:
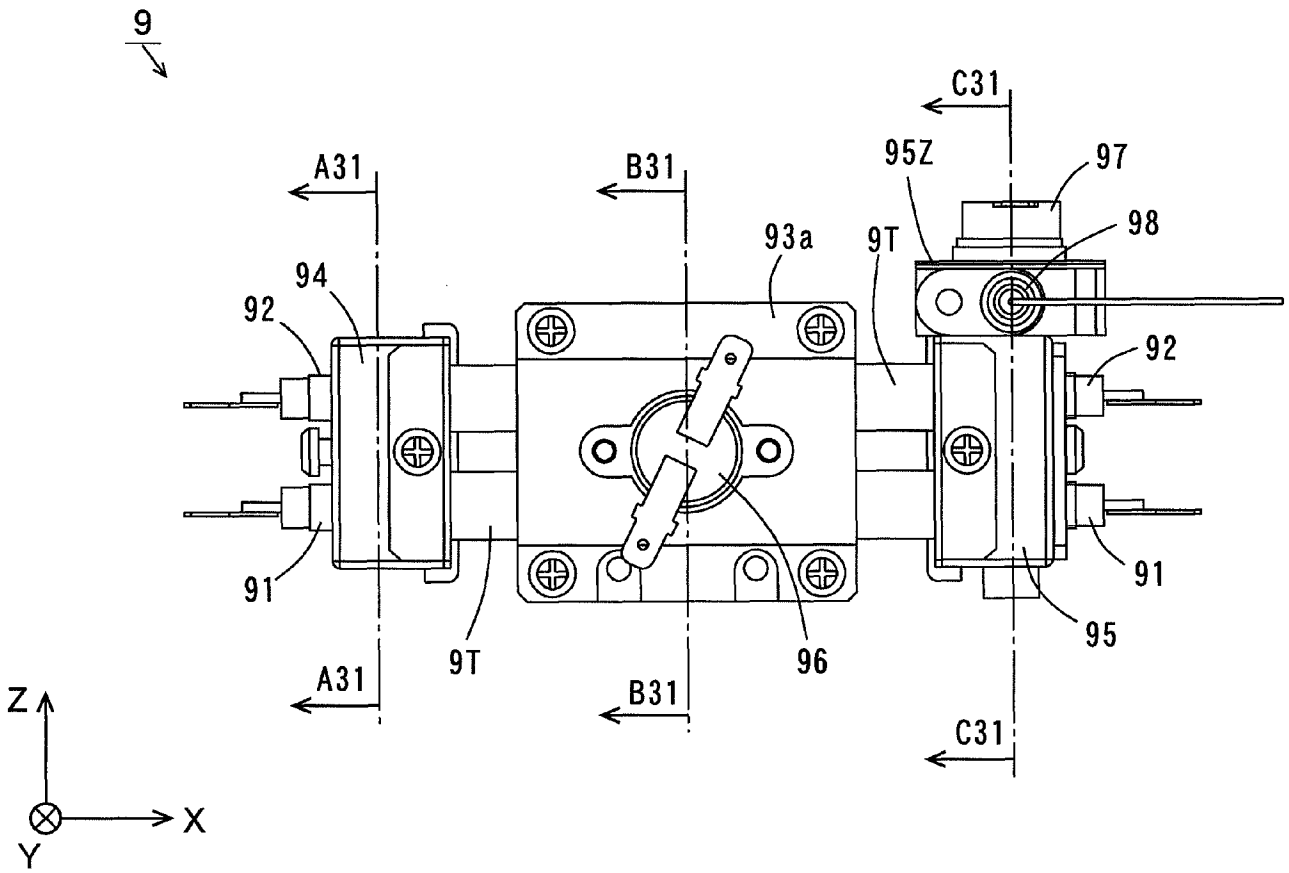
FIG. 31 is a plan view of the heat exchanger of FIG. 3.

<5> Structure and Control of Heat Exchanger (5-a) Appearance and Structure of Heat Exchanger The heat exchanger 9 will be described. FIG. 29 is a perspective view showing the appearance of the heat exchanger 9 of FIG. 3 seen from one side, FIG. 30 is a perspective view showing the appearance of the heat exchanger 9 of FIG. 3 seen from another side, and FIG. 31 is a plan view of the heat exchanger 9 of FIG. 3. FIG. 29 also shows the control system of the heat exchanger 9.

Figure 32:
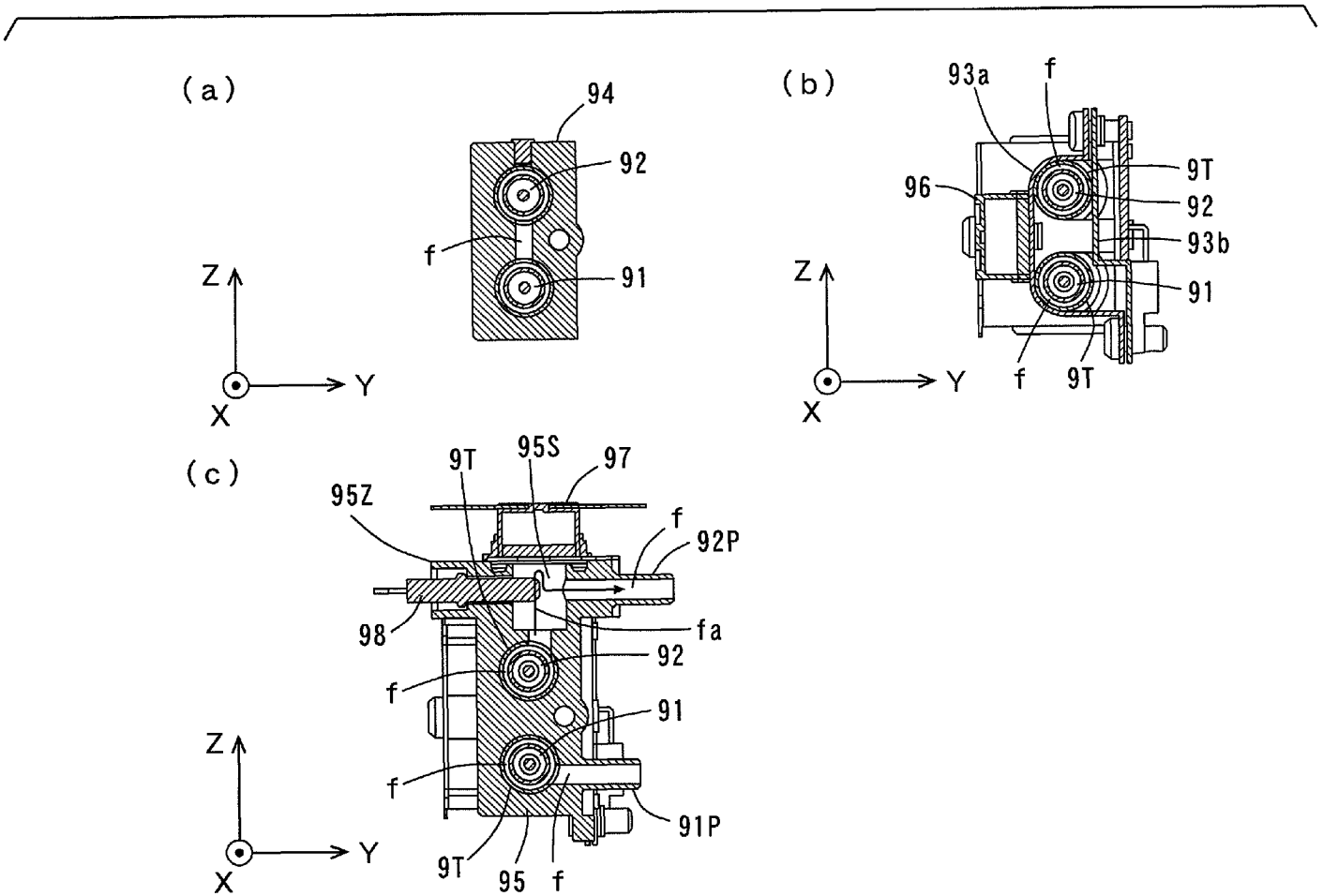
FIG. 32(*a*) is a cross-sectional view taken along line A31-A31 in FIG. 31, FIG. 32(*b*) is a cross-sectional view taken along line B31-B31 in FIG. 31, and FIG. 32(*c*) is a cross-sectional view taken along line C31-C31 in FIG. 31.

Also, FIG. 32(*a*) is a cross-sectional view taken along line A31-A31 in FIG. 31, FIG. 32(*b*) is a cross-sectional view taken along line B31-B31 in FIG. 31, and FIG. 32(*c*) is a cross-sectional view taken along line C31-C31 in FIG. 31. Also, FIG. 33(*a*) is a side view of the heat exchanger 9 of FIG. 3, and FIG. 33(*b*) is a cross-sectional view taken along line C33-C33 in FIG. 33(*a*).

In the description below, as shown with arrows X, Y and Z in FIGS. 29 to 33, mutually perpendicular three directions are defined as X direction, Y direction and Z direction, respectively. In this example, Z direction corresponds to vertical direction.

As shown in FIGS. 29 and 30, the heat exchanger 9 includes two sheathed heaters 91 and 92 arranged along the X direction side by side in the Z direction. The middle portions of the two sheathed heaters 91 and 92 are respectively inserted in tube-like flow passage forming tubes 9T. Thus, flow passages of washing water (FIGS. 32 and 33) are formed respectively between the peripheral surfaces of the sheathed heaters 91 and 92 and the inner surfaces of the flow passage forming tubes 9T.

Both ends of the sheathed heaters 91 and 92 and the flow passage forming tubes 9T are fixed with end members 94 and 95. Also, the middle portions of the two flow passage forming tubes 9T are sandwiched and fixed between two metal plates 93*a* and 93*b*. The sheathed heaters 91, 92, end members 94, 95, flow passage forming tubes 9T, and metal plates 93*a*, 93*b* are thus integrated and fixed together.

The metal plates 93*a* and 93*b* fix the flow passage forming tubes 9T and also function as radiator plates when the sheathed heaters 91 and 92 are driven.

A non-returning type thermostat 96 is attached to one metal plate 93*a* sandwiching the two flow passage forming tubes 9T (FIG. 29). The thermostat 96 is used to monitor the temperature of the metal plate 93*a*, and serves as a temperature fuse that shuts off electricity when the heat exchanger 8 heats without water therein or when a triac short-circuits.

A temperature fuse may be used in place of the non-returning type thermostat 96. In this case, for example, the temperature fuse is placed between the two flow passage forming tubes 9T and sandwiched between the two metal plates 93*a* and 93*b*. Thus, the temperature fuse can be integrated with the heat exchanger 9, making it possible to effectively use dead space. Also, the heat exchanger with integrated temperature fuse can be sized thinner.

The end member 95 fixing one ends of the sheathed heaters 91 and 92 has a water inlet port 91P formed to extend in the Y direction (FIG. 30). Also, an exit water temperature detecting portion 95Z is integrated on one side of the end member 95 in the Z direction. In the exit water temperature detecting portion 95Z, a water outlet port 92P is formed and a returning-type thermostat 97 and an exit water temperature sensor 98 are attached (FIG. 29).

Also, the water inlet port 91P is coupled to a unit (not shown) formed of the flow rate sensor 8 of FIG. 3 and an intake water temperature sensor not shown. This unit may be integrated with the end member 95. In this case, the space for installation of the flow rate sensor 8, intake water temperature sensor and heat exchanger 9 can be sufficiently reduced in the main body 200 of FIG. 3.

As shown in FIG. 31 and FIG. 32(*c*), in the end member 95, the water inlet port 91P is formed such that its internal space communicates with the internal space of the flow passage forming tube 9T that covers the sheathed heater 91.

Also, the water outlet port 92P is formed such that its internal space communicates with the internal space of the flow passage forming tube 9T covering the sheathed heater 92 through a temperature detecting space 95S formed in the end member 95Z.

The internal spaces of the water inlet port 91P and the water outlet port 92P, the spaces between the inner surfaces of the flow passage forming tubes 9T and the peripheral surfaces of the sheathed heaters 91, 92, and the temperature detecting space 95S form a washing water flow passage f.

As described above, in the end member 95, the flow passage f of the sheathed heater 91 and the flow passage f of the sheathed heater 92 are separated from each other. Therefore, washing water supplied to the water inlet port 91P is sent to the end member 94 along the peripheral surface of the sheathed heater 91 (FIG. 32(*b*)).

As shown in FIG. 32(*a*), in the end member 94, a flow passage f is formed between the two fixed flow forming tubes 9T so as to connect the internal space of the flow passage forming tube 9T covering the sheathed heater 91 and the internal space of the flow passage forming tube 9T covering the sheathed heater 92.

Accordingly, washing water supplied to the end member 94 along the peripheral surface of the sheathed heater 91 passes through the flow passage f formed between the two flow passage forming tubes 9T and is led into the flow passage f of the flow passage forming tube 9T covering the sheathed heater 92. Then, the washing water is sent again to the end member 95 along the peripheral surface of the sheathed heater 92 (FIG. 32(*c*)). The washing water sent to the end member 95 flows out from the water outlet port 92P through the temperature detecting space 95S.

As shown in FIG. 32(*c*), the tip of the exit water temperature sensor 98 is inserted in the temperature detecting space 95S. The temperature of the washing water flowing in the temperature detecting space 95S is measured by the tip of the exit water temperature sensor 98. Also, the thermostat 97 is attached to one side of the exit water temperature detecting portion 95Z that is perpendicular to the Z direction. The thermostat 97 is used to monitor the temperature of the washing water flowing in the temperature detecting space 95S, and it shuts off electricity to the heat exchanger 9 when the exit water temperature (the temperature of washing water flowing out from the heat exchanger 9) exceeds a given temperature.

Figure 33:
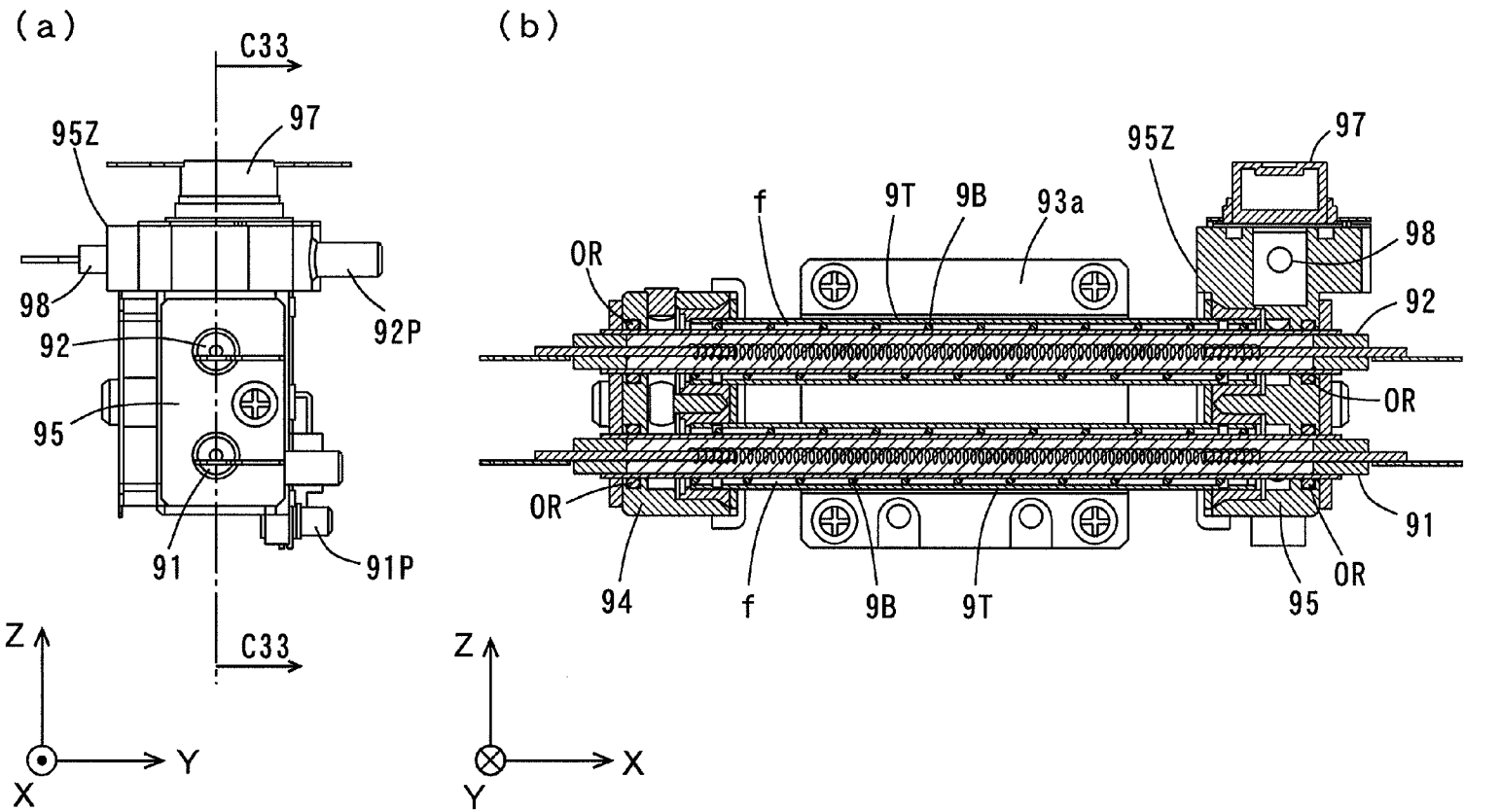
FIG. 33(*a*) is a side view of the heat exchanger of FIG. 3, and (b) is a cross-sectional view taken along line C33-C33 of (a).

The structure of the vicinity of the sheathed heaters 91 and 92 will be described. As shown in FIG. 33(*b*), between the sheathed heater 91, 92 and the flow passage forming tube 9T, a helical spring 9B is wound around the outer peripheral surface of the sheathed heater 91, 92.

Thus, the helical flow passage f is formed by the outer peripheral surfaces of the sheathed heaters 91 and 92, the inner peripheral surfaces of flow passage forming tubes 9T, and the springs 9B. Accordingly, when washing water flows along the peripheral surfaces of the sheathed heaters 91 and 92, the washing water flows while turning helically.

When current is supplied to the sheathed heaters 91 and 92, the sheathed heaters 91 and 92 generate heat. In this condition, washing water is passed along the peripheral surfaces of the sheathed heaters 91 and 92. In this case, the washing water flowing in the peripheral portions is heated. As a result, washing water heated by the sheathed heaters 91 and 92 flows out from the water outlet port 92P.

The cross-sectional area of the flow passage f (flow passage cross-sectional area) formed by the sheathed heaters 91, 92, the flow passage forming tubes 9T, and springs 9B can be set much smaller than the flow passage cross-sectional area of a heat exchanger using ceramic heaters.

Specifically, the flow passage cross-sectional area of the heating portion of the heat exchanger 9 of FIG. 33(*b*) is set to about 7 $mm^2$. On the other hand, the flow passage cross-sectional area of the heating portion of a heat exchanger using ceramic heaters is set to about 32 $mm^2$.

Here, a heat exchanger using ceramic heaters means a heat exchanger in which two ceramic heaters shaped approximately the same as the sheathed heaters 91 and 92 are attached to the heat exchanger 9 of FIG. 29 in place of the sheathed heaters 91, 92.

The reason for this will be described. As explained above, in the heat exchanger 9 using sheathed heaters 91 and 92, washing water flows along the peripheral surfaces of the sheathed heaters 91 and 92. The peripheral surfaces of the sheathed heaters 91 and 92 are formed of a metal tube member, as will be described later.

On the other hand, the peripheral surfaces of ceramic heaters are formed of a ceramic tube member. Such a ceramic tube member is produced by biscuit, and so the peripheral surfaces of the ceramic heaters have larger surface roughness than the peripheral surfaces of the sheathed heaters 91 and 92.

Accordingly, the pressure loss of washing water flowing along the peripheral surfaces of the ceramic heaters is larger than the pressure loss of washing water flowing along the peripheral surfaces of the sheathed heaters 91 and 92. Larger pressure loss reduces the flow speed of washing water.

Accordingly, to ensure a required flow speed of washing water, the flow passage cross-sectional area of the heat exchanger 9 using the sheathed haters 91 and 92 can be smaller than the flow passage cross-sectional area of a heat exchanger using ceramic heaters.

Now, in general, a toilet apparatus that releases washing water to the local areas of a user is used while directly connected to the water service piping. Accordingly, the water supply system of such a toilet apparatus is designed such that it can withstand the hydrostatic pressure of service water in the water service piping.

The hydrostatic pressure of service water in the water service piping differs in each area. In an area where the hydrostatic pressure is low, the hydrostatic pressure in water service piping is about 49 kPa, for example. Also, in an area where the hydrostatic pressure is high, the hydrostatic pressure in water service piping is about 735 kPa, for example. Accordingly, the water supply system of a toilet apparatus has to be constructed to withstand service water hydrostatic pressure at least in the range of not less than about 49 kPa nor more than 735 kPa.

Realizing such a water supply system requires the use of members that can withstand service water hydrostatic pressure. Accordingly, given strength and given costs are required for individual components of the water supply system; for example, sufficient material thicknesses with additional ribs and structures for ensuring strength are required.

Then, when the pressure loss in a washing water flow passage in the water supply system is large, larger loads are imposed on individual components (a pump, etc.) In this case, the components of the water supply system are sized still larger and the costs further increase. Accordingly, it is desirable to form the washing water flow passage in the water supply system such that the pressure loss is as small as possible.

Accordingly, the heat exchanger 9 using the sheathed heaters 91 and 92 is used as described above. Then, at least part of the water supply system can be formed such that the pressure loss of washing water is low. This suppresses increase in size of the water supply system and also suppresses increase in costs.

As mentioned above, the cross-sectional area of the flow passage f of the heat exchanger 9 of FIG. 33(*b*) is set much smaller than the flow passage cross-sectional area of a heat exchanger using ceramic heaters. Then, as compared with an example using ceramic heaters, the occurrence of temperature variations of washing water heated by the sheathed heaters 91 and 92 is sufficiently suppressed. This stabilizes the flow rate of the heated washing water.

As a result, the temperature gradient in the heater is nearly constant, and the flow rate can be estimated with the temperatures detected by the exit water temperature sensor 98 and intake water temperature sensor (not shown) and the amount of electricity passed to the pump 11. This removes the need for the flow rate sensor 8 (FIG. 3), enabling space saving. Of course, more precise control is enabled by attaching the flow rate sensor 8.

Also, by setting small the cross-sectional area of the flow passage f of the heat exchanger 9 of FIG. 33(*b*), the generation of sharp temperature gradient is suppressed between washing water in contact with the peripheral surfaces of the sheathed heaters 91 and 92 and washing water in contact with the inner surfaces of the flow passage forming tubes 9T. Also, the flow speed of washing water flowing in the flow passage f becomes higher, and turbulent flow occurs in the flow passage f. The occurrence of turbulent flow in the flow passage f causes the temperature distribution in the flow passage f to sharply vary. This improves the efficiency of heat exchange in the heat exchanger 9.

As described above, the heat exchanger 9 of FIG. 29 has a simple structure, and there is no need for ultrasonic welding and potting during assembly. This reduces the assembly process works.

As shown by arrow fa in FIG. 32(*c*), heated washing water flows in the temperature detecting space 95S from the flow passage f of the sheathed heater 92.

As explained above, the tip of the exit water temperature sensor 98 is inserted in the temperature detecting space 95S. The tip of the exit water temperature sensor 98 is positioned approximately in the center of the temperature detecting space 95S. Therefore, the washing water heated by the sheathed heaters 91 and 92 flows into the temperature detecting space 95S and passes the tip of the exit water temperature sensor 98. Thus, the precision of the temperature detection of washing water by the exit water temperature sensor 98 is improved.

After that, the washing water passing the tip of the temperature sensor 98 hits the temperature monitoring surface of the thermostat 97. Thus, the heated water is certainly supplied to the thermostat 97, allowing highly precise temperature monitoring of washing water by the thermostat 97.

As the washing water hits the thermostat 97, the direction of flow of washing water is easily changed. Thus, the washing water flowing into the temperature detecting space 95S smoothly flows into the flow passage f of the water outlet port 92P.

In this way, in this heat exchanger 9, the thermostat 97 monitors the temperature of washing water immediately before it flows out of the heat exchanger 9, so that abnormal temperatures of washing water flowing out of the heat exchanger 9 can be quickly detected.

As explained above, both ends of the sheathed heaters 91 and 92 are fixed by the end members 94 and 95. The fixing of the sheathed heaters 91 and 92 will be described in detail.

As shown in FIG. 33(*b*), O rings OR are attached to both ends of the sheathed heaters 91 and 92. Then, the O rings OR attached to the sheathed heaters 91 and 92 are fixed by the end members 94 and 95.

In this case, the O rings OR provide seal between the peripheral surfaces of the sheathed heaters 91 and 92 and the end members 94 and 95. The O rings OR are elastic body. Accordingly, even when the sheathed heaters 91 and 92 expand/shrink with heat, the expansion and shrinkage are permitted by the O rings OR.

Figure 34:
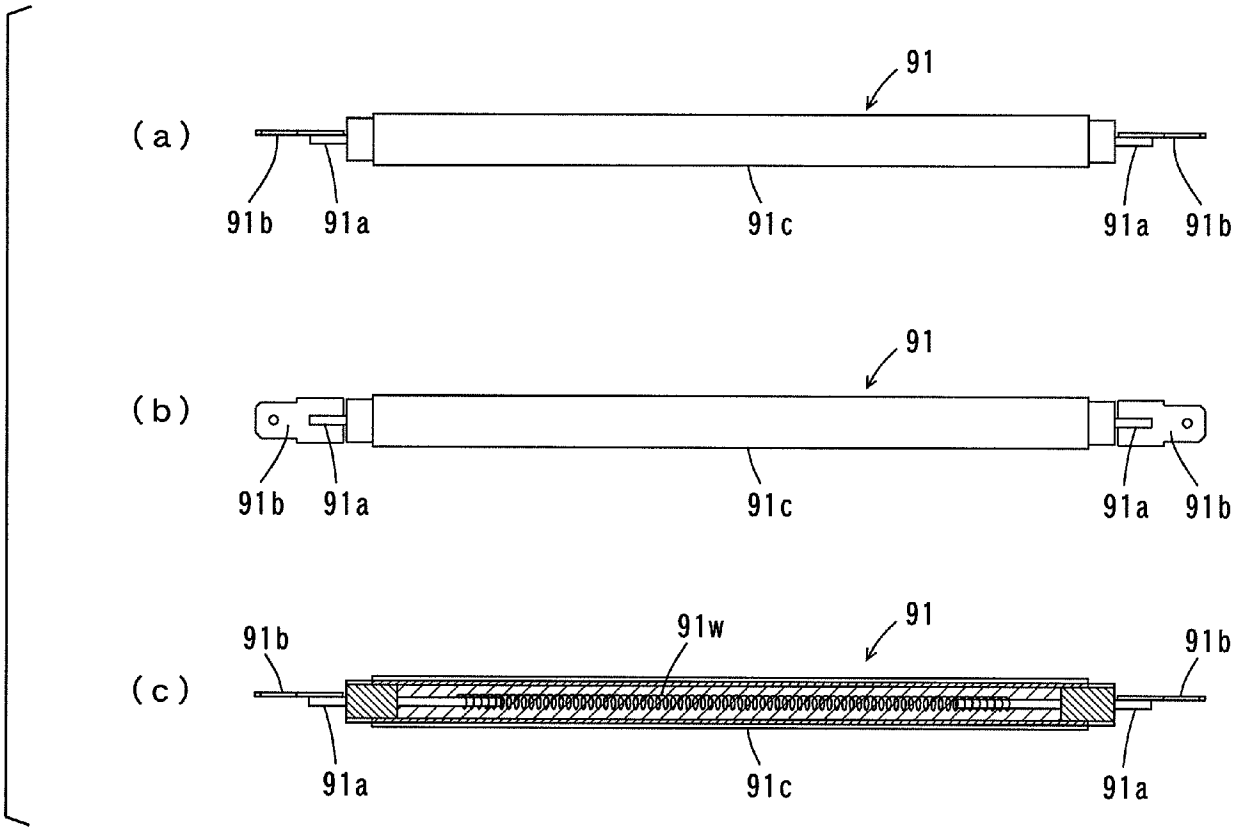
FIG. 34 is a diagram for describing the structure of the sheathed heaters of FIG. 29.

As will be explained later, the peripheral surfaces of the sheathed heaters 91 and 92 are formed of copper tubes 91*c* (FIG. 34). The coefficient of linear expansion of copper is $16.8\times10^{-6}$/° C. Accordingly, when washing water at 20° C. is heated to 40° C., the temperature of the sheathed heaters 91 and 92 rises by about 50 K, and so a copper tube 91*c* of about 100 mm stretches by about 0.1 mm.

In this case, when the sheathed heaters 91 and 92 are completely fixed by the end members 94 and 95, repeatedly heating washing water causes repeated stresses in the fixed portions, possibly breaking the sheathed heaters 91 and 91.

Also, gaps may form between the sheathed heaters 91 and 92 and the end members 94 and 95.

Accordingly, in the heat exchanger 9 of this example, as explained above, the sheathed heaters 91 and 92 are elastically fixed with the O rings OR.

Now, the structure of the sheathed heaters 91 and 92 will be described. Since the sheathed heaters 91 and 92 have the same structure, only the structure of the sheathed heater 91 will be described below.

FIG. 34 is a diagram for describing the structure of the sheathed heater 91 of FIG. 29. FIG. 34(*a*) shows a side view of the sheathed heater 91, FIG. 34(*b*) shows a top view of the sheathed heater 91, and FIG. 34(*c*) shows a vertical cross section of the sheathed heater 91.

As shown in FIG. 34(*a*) and FIG. 34(*b*), in the sheathed heater 91, electrodes 91*a* project respectively from both ends of one copper tube 91*c*. Also, terminals 91*b* are attached respectively to the portions of the two electrodes 91*a* that project from both ends of the copper tube 91*c*.

As shown in FIG. 34(*c*), inside the copper tube 91*c*, the portions of the inserted two electrodes 91*a* are connected by a heat wire 91*w*. Also, powder of magnesium oxide as insulating material is charged into the copper tube 91*c*.

In the sheathed heater 91 thus structured, a metal tube of, e.g. steel, stainless, or inconel, may be used in place of the copper tube 91*c*. Also, tungsten filament is used as the heat wire 91*w*, for example.

As above, the two sheathed heaters 91 and 92 are used in the heat exchanger 9. Their rated power is 600 W each. Accordingly, the heat exchanger 9 is driven at 1200 W at the maximum. The value 1200 W is almost the maximum amount of power that can be obtained from normal household receptacles.

(5-b) Method of Driving Heat Exchanger by Phase Control

As shown in FIG. 29, the two sheathed heaters 91 and 92 provided in the heat exchanger 9 are connected to a power supply unit 9VI. Also, the power supply unit 9VI is connected with an alternating-current power supply ACS and the controller 90.

The power supply unit 9VI includes triacs and a trigger section not shown. The trigger section responses to a control signal given from the controller 90 to give a pulse-like firing signal to the triacs. Then, the firing angle of the triacs is phase-controlled, and the power supplied from the alternating-current power supply ACS to the sheathed heaters 91 and 92 is adjusted.

When the power supplied to the sheathed heaters 91 and 92 is thus adjusted by phase control of firing angle, harmonic components (harmonic current) occur in the currents flowing in the sheathed heaters 91 and 92.

The level of harmonic current becomes higher as the amplitude of alternating current at the firing angle is larger. Accordingly, in this example, in order to suppress the occurrence of high-level harmonic current due to the phase control of firing angle, the two sheathed heaters 91 and 92 having rated power of 600 W are used, and the heat exchanger 9 is driven by methods described below. In this example, the gross rated power of the heat exchanger 9 is 1200 W.

In the description below, the sheathed heater 91 provided on the side of the water inlet port 91P of FIG. 30 is referred to as a first-side sheathed heater 91, and the sheathed heater 92 provided on the side of the water outlet port 92P of FIG. 30 is referred to as a second-side sheathed heater 92. Also, with reference to the gross rated power (1200 W) of the heat exchanger 9, the ratio of the total of driving power actually supplied to the sheathed heaters 91 and 92 of the heat exchanger 9 is referred to as a gross load factor. Also, the control of driving power by the phase control of firing angle of triacs is referred to as phase control.

(5-c) First Driving Method for Heat Exchanger

Figure 35:
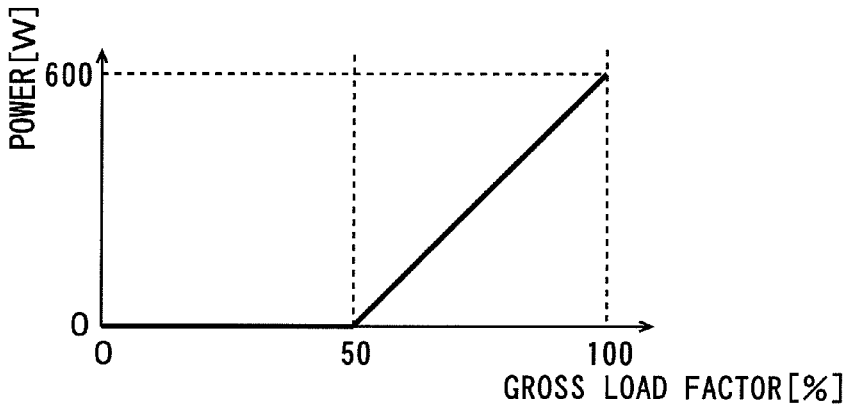
FIG. 35 is a diagram illustrating a first driving method for the heat exchanger of FIG. 29.
Figure 35:
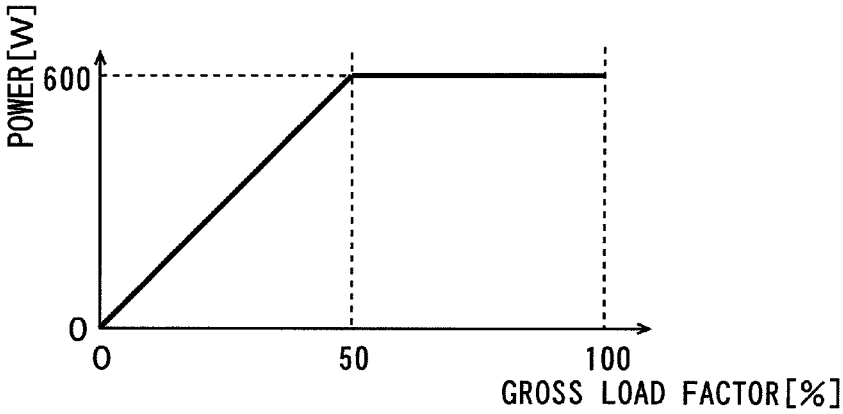

A first driving method for the heat exchanger 9 will be described. FIG. 35 is a diagram for describing the first driving method for the heat exchanger 9 of FIG. 29. FIG. 35(*a*) illustrates the relation between the driving power of the first-side sheathed heater 91 and the gross load factor. Also, FIG. 35(*b*) illustrates the relation between the driving power of the second-side sheathed heater 92 and the gross load factor.

As shown in FIG. 35(*a*) and FIG. 35(*b*), in this driving method, in the range where the gross load factor is larger than 0% and not more than 50%, phase control is performed such that only the driving power of the second-side sheathed heater 92 is proportional to the value of the gross load factor, and no driving power is supplied to the first-side sheathed heater 91.

On the other hand, in the range where the gross load factor is larger than 50% and not more than 100%, with the second sheathed heater 92 being supplied with driving power of 600 W, phase control is performed such that only the driving power of the first-side sheathed heater 91 is proportional to the value of the gross load factor. In this case, the driving power of the second-side sheathed heater 92 is not phase-controlled, and so no harmonic current flows in the second-side sheathed heater 92.

As above, in the first driving method, phase control of driving power is not simultaneously applied to the first-side sheathed heater 91 and the second-side sheathed heater 92. This prevents harmonic currents simultaneously flowing in the first-side sheathed heater 91 and the second-side sheathed heater 92 when the heat exchanger 9 is driven.

Also, the level of harmonic current occurring at a given firing angle in a sheathed heater having rated power of 600 W is sufficiently lower than the level of harmonic current occurring at the same firing angle in a sheathed heater having rated power of 1200 W.

This is because the amplitude of alternating current flowing in the sheathed heater with rated power of 600 W is sufficiently smaller than the amplitude of alternating current flowing in the sheathed heater with rated power of 1200 W.

From this reason, by driving the heat exchanger 9 of FIG. 29 by the first driving method, the occurrence of high level harmonic current is sufficiently suppressed as compared with a structure in which a sheathed heater with rated power of 1200 W is used in the heat exchanger 9.

Also, in this example, the heat exchanger 9 can be driven at 1200 W at the maximum. This makes it possible to obtain a sufficient amount of heat generation required to heat washing water. Accordingly, the temperature of washing water can be quickly and certainly raised even when the temperature of washing water supplied from the water service piping is very low. As a result, washing water supplied to the local areas of the user can be certainly adjusted to proper temperatures.

Also, as described above, in the range where the gross load factor is larger than 0% and not more than 50%, only the driving power of the second-side sheathed heater 92 is phase-controlled. The second-side sheathed heater 92 is located on the side of the water outlet port 92P (FIG. 30), and the exit water temperature sensor 98 (FIG. 32(*c*)) is provided near the water outlet port 92P. Accordingly, the temperature of washing water heated by the second-side sheathed heater 92 is accurately measured by the exit water temperature sensor 98 immediately after it was heated.

Accordingly, in the range where the gross load factor is larger than 0% and not more than 50%, the driving power of the heat exchanger 9 is accurately controlled by the controller 90 of FIG. 29 on the basis of the temperature value measured by the exit water temperature sensor 98. As a result, washing water supplied to the local areas of the user can be certainly adjusted to more proper temperatures.

(5-d) Second Driving Method for Heat Exchanger

Figure 36:
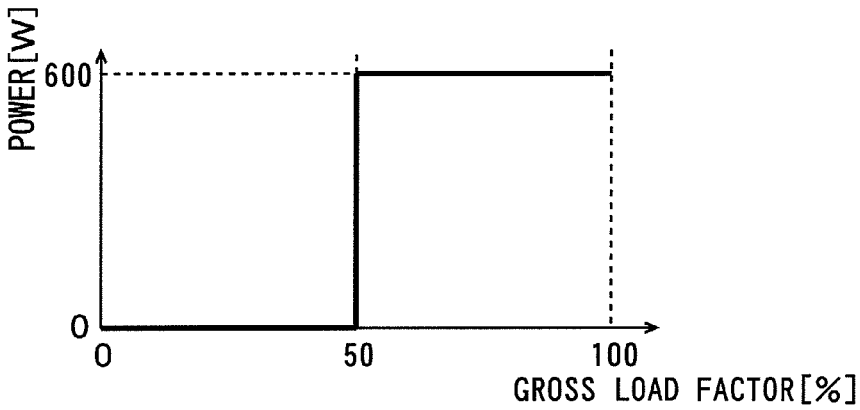
FIG. 36 is a diagram illustrating a second driving method for the heat exchanger of FIG. 29.
Figure 36:
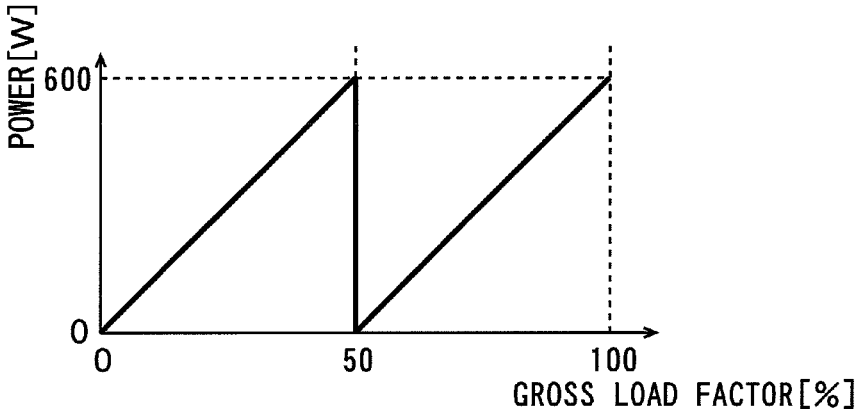

A second driving method for the heat exchanger 9 will be described about differences from the first driving method. FIG. 36 is a diagram for describing the second driving method for the heat exchanger 9 of FIG. 29. FIG. 36(*a*) illustrates the relation between the driving power of the first-side sheathed heater 91 and the gross load factor. Also, FIG. 36(*b*) illustrates the relation between the driving power of the second-side sheathed heater 92 and the gross load factor.

As shown in FIG. 36(*a*) and FIG. 36(*b*), in this driving method, as in the first driving method, in the range where the gross load factor is larger than 0% and smaller than 50%, phase control is performed such that only the driving power of the second-side sheathed heater 92 is proportional to the value of the gross load factor, and no driving power is supplied to the first-side sheathed heater 91.

When the gross load factor is 50%, the driving power supplied to the first-side sheathed heater 91 becomes 600 W, and the driving power supplied to the second-side sheathed heater 92 becomes 0 W.

On the other hand, in the range where the gross load factor is larger than 50% and not more than 100%, with the first-side sheathed heater 91 being supplied with power of 600 W, phase control is performed such that only the driving power of the second-side sheathed heater 92 is proportional to the value of gross load factor. In this case, the driving power of the first-side sheathed heater 91 is not phase-controlled, and so no harmonic current flows in the first-side sheathed heater 91.

As described above, in the second driving method, in the whole range of gross load factor from 0% to 100%, only the driving power to the second-side sheathed heater 92 is phase-controlled. The temperature of the washing water heated by the second-side sheathed heater 92 is accurately measured by the exit water temperature sensor 98 immediately after it was heated.

Thus, in the whole range of gross load factor, the driving power of the heat exchanger 9 is accurately controlled on the basis of the temperature value measured by the exit water temperature sensor 98. As a result, washing water supplied to the local areas of the user can be certainly adjusted to more proper temperatures.

(5-e) Third Driving Method for Heat Exchanger

Figure 37:
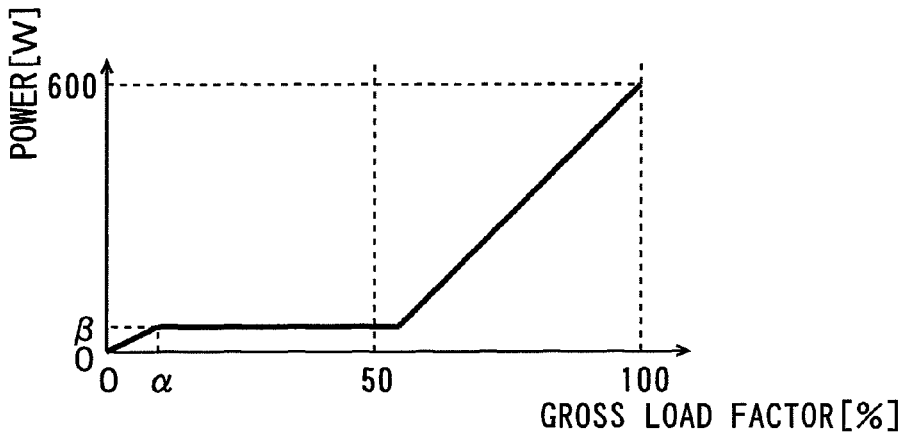
FIG. 37 is a diagram illustrating a third driving method for the heat exchanger of FIG. 29.
Figure 37:
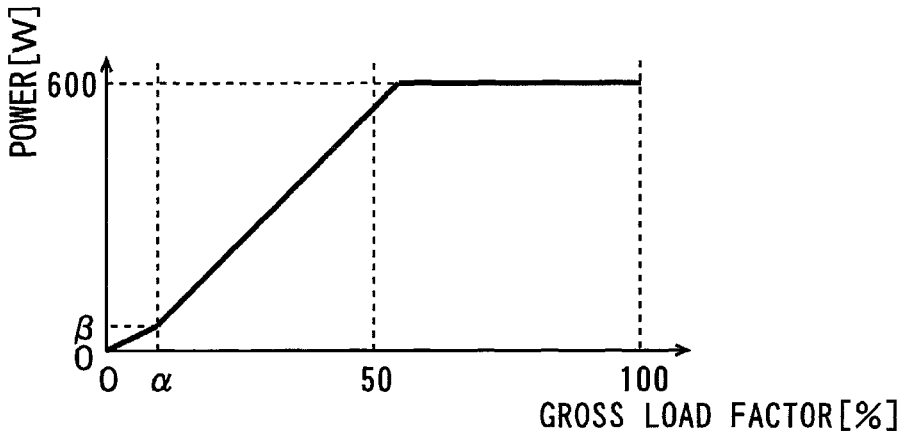

A third driving method for the heat exchanger 9 will be described about differences from the first driving method. FIG. 37 is a diagram for describing the third driving method for the heat exchanger 9 of FIG. 29. FIG. 37(*a*) illustrates the relation between the driving power of the first-side sheathed heater 91 and the gross load factor. Also, FIG. 37(*b*) illustrates the relation between the driving power of the second-side sheathed heater 92 and the gross load factor.

As shown in FIG. 37(*a*) and FIG. 37(*b*), in this driving method, in the range where the gross load factor is larger than 0% and not more than $\alpha$ %, phase control is performed such that the driving power of the first-side sheathed heater 91 and the driving power of the second-side sheathed heater 92 are proportional to the value of gross load factor.

In this example, "a" indicates a predetermined low gross load factor of about 5%. When the gross load factor is $\alpha$%, the first-side sheathed heater 91 is driven with power of $\beta$W, and the second-side sheathed heater 92 is also driven with power of $\beta$W. Thus, the heat exchanger 9 is driven with power of ($\beta$+$\beta$) W on the whole.

Then, in the range where the gross load factor is larger than $\alpha$ % and not more than (50+$\alpha$/2) %, phase control is performed such that the driving power to the first-side sheathed heater 91 is constant at $\beta$W. Also, phase control is performed such that the driving power to the second-side sheathed heater 92 is proportional to the value of the gross load factor.

Also, in the range where the gross load factor is larger than (50+$\alpha$/2) % and not more than 100%, with the second-side sheathed heater 92 being supplied with driving power of 600 W, phase control is performed such that the driving power to the first-side sheathed heater 91 is proportional to the value of the gross load factor.

As described above, in the third driving method, in the range where the gross load factor is larger than 0% and not more than $\alpha$ %, phase control is performed such that the driving power to the first-side sheathed heater 91 and the driving power to the second-side sheathed heater 92 are proportional to the value of the gross load factor. Then, in the range where the gross load factor is larger than $\alpha$ % and not more than 100%, the driving power to the first-side sheathed heater 91 and the driving power to the second-side sheathed heater 92 are always $\beta$W or more.

Thus, in the range where the gross load factor is larger than $\alpha$ % and not more than 100%, the first-side sheathed heater 91 is always driven with power of $\beta$W or more and generating heat at low temperatures. Accordingly, when the driving power to the first-side sheathed heater 91 significantly varies, for example, when the gross load factor rises over (50+$\alpha$/2) %, the delay of heat generation of the first-side sheathed heater 91 is prevented.

In the range where the gross load factor is larger than 0% and not more than $\alpha$ %, the driving voltage supplied to the first-side sheathed heater 91 and the driving voltage supplied to the second-side sheathed heater 92 are both phase-controlled, but the amplitude of the alternating current at the firing angle is very small. Accordingly, the generation of high-level harmonic current is sufficiently suppressed.

(5-f) Fourth Driving Method for Heat Exchanger

Figure 38:
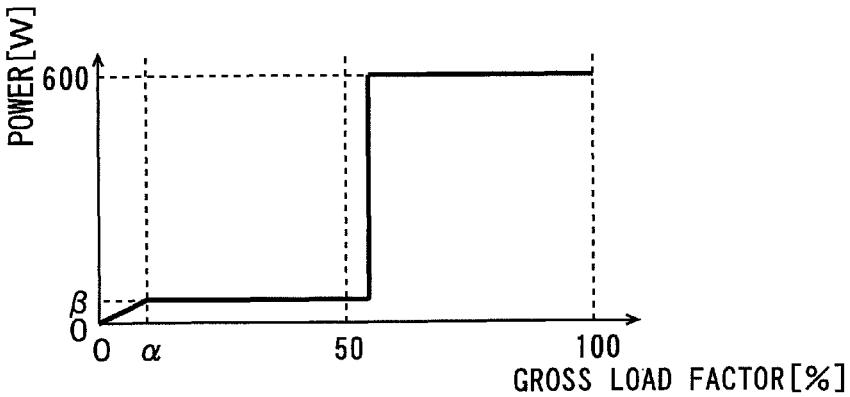
FIG. 38 is a diagram illustrating a fourth driving method for the heat exchanger of FIG. 29.
Figure 38:
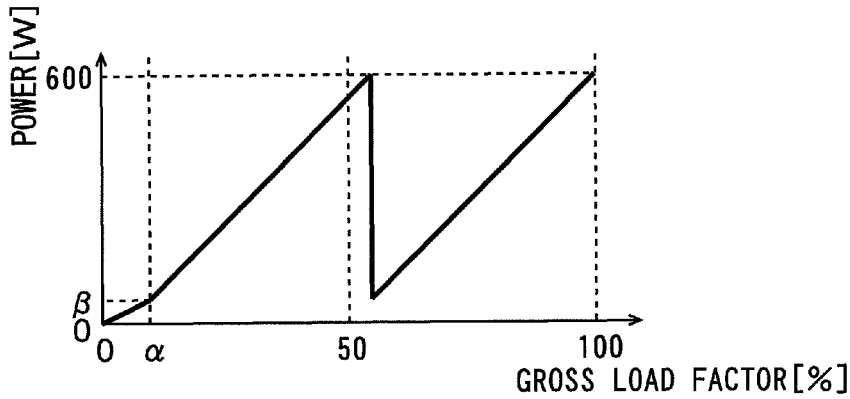

A fourth driving method for the heat exchanger 9 will be described about differences from the third driving method. FIG. 38 is a diagram for describing the fourth driving method for the heat exchanger 9 of FIG. 29. FIG. 38(*a*) illustrates the relation between the driving power of the first-side sheathed heater 91 and the gross load factor. Also, FIG. 38(*b*) illustrates the relation between the driving power of the second-side sheathed heater 92 and the gross load factor.

As shown in FIG. 38(*a*) and FIG. 38(*b*), in this driving method, as in the third driving method, in the range where the gross load factor is larger than 0% and not more than $\alpha$ %, phase control is performed such that the driving power of the first-side sheathed heater 91 and the driving power of the second-side sheathed heater 92 are proportional to the value of gross load factor.

Then, in the range where the gross load factor is larger than $\alpha$ % and smaller than (50+$\alpha$/2) %, phase control is performed such that the power to the first-side sheathed heater 91 is constant at $\beta$W. Also, phase control is performed such that the power to the second-side sheathed heater 92 is proportional to the value of the gross load factor.

When the gross load factor is (50+$\alpha$/2) %, the driving power supplied to the first-side sheathed heater 91 becomes 600 W, and the driving power supplied to the second-side sheathed heater 92 becomes $\beta$W.

In the range where the gross load factor is larger than (50+$\alpha$/2) % and not more than 100%, with the first-side sheathed heater 91 being supplied with driving power of 600 W, phase control is performed such that only the driving power of the second-side sheathed heater 92 is proportional to the value of the gross load factor. In this case, no harmonic current flows in the first-side sheathed heater 91 since the driving power to the first-side sheathed heater 91 is not phase-controlled.

As described above, in the fourth driving method, in the range where the gross load factor is from α % to 100%, phase control is performed such that only the driving power of the second-side sheathed heater 92 is proportional to the value of the gross load factor. The temperature of the washing water heated by the second-side sheathed heater 92 is accurately measured by the exit water temperature sensor 98 immediately after it was heated.

Accordingly, in the whole range of gross load factor, the driving power of the heat exchanger 9 is accurately controlled on the basis of the temperature value measured by the exit water temperature sensor 98. As a result, the washing water supplied to the local areas of the user can be certainly adjusted to more proper temperatures.

(5-g) Fifth Driving Method for Heat Exchanger

Figure 39:
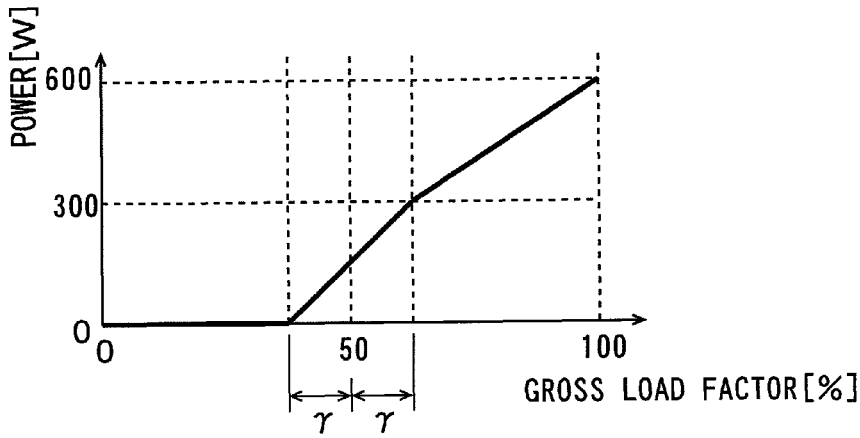
FIG. 39 is a diagram illustrating a fifth driving method for the heat exchanger of FIG. 29.
Figure 39:
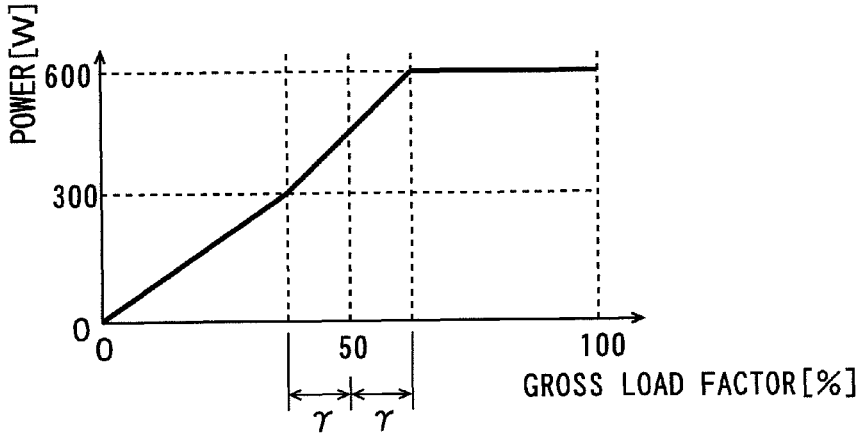

A fifth driving method for the heat exchanger 9 will be described about differences from the first driving method. FIG. 39 is a diagram for describing the fifth driving method for the heat exchanger 9 of FIG. 29. FIG. 39(*a*) illustrates the relation between the driving power of the first-side sheathed heater 91 and the gross load factor. Also, FIG. 39(*b*) illustrates the relation between the driving power of the second-side sheathed heater 92 and the gross load factor.

As shown in FIG. 39(*a*) and FIG. 39(*b*), in this driving method, in the range where the gross load factor is larger than 0% and not more than (50-7) %, phase control is performed such that only the driving power of the second-side sheathed heater 92 is proportional to the value of the gross load factor, and no driving power is supplied to the first-side sheathed heater 91.

In this example, "γ" indicates an arbitrarily set value of gross load factor. It is preferable to set the gross load factor γ in the range from about 5% to about 25%, for example.

When the gross load factor is (50−γ) %, the driving power of the second-side sheathed heater 92 is 300 W, and harmonic current flows in the second-side sheathed heater 92. On the other hand, no harmonic current flows in the first-side sheathed heater 91 since the driving power of the first-side sheathed heater 91 is not phase-controlled.

In the range where the gross load factor is larger than (50−γ) % and not more than (50+γ) %, phase control is performed such that the driving power of the first-side sheathed heater 91 and the driving power of the second-side sheathed heater 92 are proportional to the value of the gross load factor. The proportional relation between the driving power to the first-side sheathed heater 91 and the gross load factor, and the proportional relation between the driving power to the second-side sheathed heater 92 and the gross load factor, are set so that they are equal.

Thus, the driving power to the first-side sheathed heater 91 rises from 0 W to 300 W as the gross load factor rises from (50−γ) % to (50+γ) %. Also, the driving power to the second-side sheathed heater 92 rises from 300 W to 600 W as the gross load factor rises from (50−γ) % to (50+γ) %.

In the range where the gross load factor is larger than (50−γ) % and smaller than (50+γ) %, as explained above, the driving power to the first-side sheathed heater 91 and the driving power to the second-side sheathed heater 92 are phase-controlled, and so harmonic currents flow in the sheathed heaters 91 and 92, but the total of the levels of the harmonic currents flowing in the sheathed heaters 91 and 92 does not exceed the maximum value of the harmonic current level generated in one sheathed heater.

Also, when the gross load factor is (50+γ) %, the driving power of the first-side sheathed heater 91 becomes 300 W, and harmonic current flows in the first-side sheathed heater 91. On the other hand, no harmonic current flows in the second-side sheathed heater 92 since the driving power for the second-side sheathed heater 92 is not phase-controlled.

In the range where the gross load factor is larger than (50+γ) % and not more than 100%, with the second-side sheathed heater 92 being supplied with driving power of 600 W, phase control is performed such that only the driving power to the first-side sheathed heater 91 is proportional to the value of the gross load factor. In this case, no harmonic current flows in the second-side sheathed heater 92 since the driving power to the second-side sheathed heater 92 is not phase-controlled.

As described above, in the fifth driving method, in the range where the gross load factor is larger than 0% and not more than (50−γ) %, and in the range where the gross load factor is larger than (50+γ) % and not more than 100%, harmonic current does not flow simultaneously in the first-side sheathed heater 91 and the second-side sheathed heater 92, so that the occurrence of high-level harmonic current is sufficiently suppressed.

Also, in the range where the gross load factor is larger than (50−γ) % and smaller than (50+γ) %, the total of levels of the harmonic currents flowing in the first-side sheathed heater 91 and the second-side sheathed heater 92 does not exceed the maximum value of harmonic current level occurring in one sheathed heater, and the generation of high-level harmonic current is sufficiently suppressed as compared with a structure in which a sheathed heater with rated power of 1200 W is used in the heat exchanger 9.

As described above, in the fifth driving method, in the gross load factor range that is lower than the gross load factor range where only the driving power of the first-side sheathed heater 91 is phase-controlled, i.e. in the range larger than (50−γ) % and not more than (50+γ) %, driving power is supplied to the first-side sheathed heater 91.

Accordingly, the first-side sheathed heater 91 is generating heat at low temperatures in the range where the gross load factor is larger than (50−γ) % and not more than (50+γ) %. Accordingly, when the gross load factor rises over (50+γ) %, for example, the delay of heat generation of the first-side sheathed heater 91 is prevented.

(5-h) Sixth Driving Method for Heat Exchanger

Figure 40:
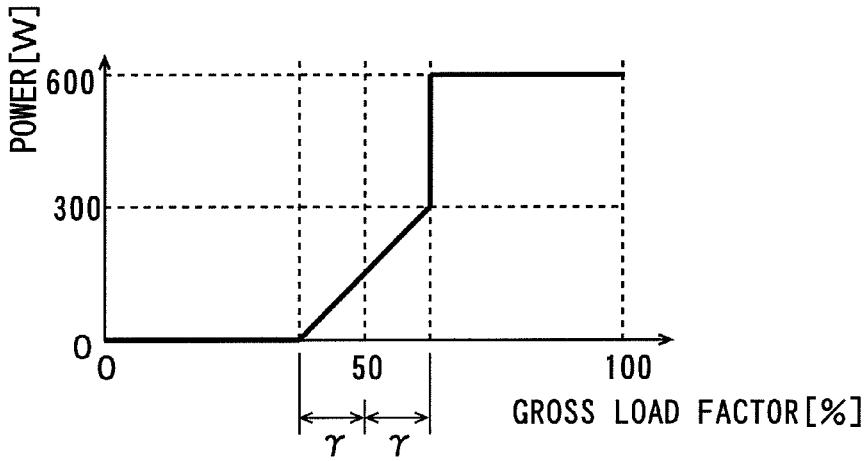
FIG. 40 is a diagram illustrating a sixth driving method for the heat exchanger of FIG. 29.
Figure 40:
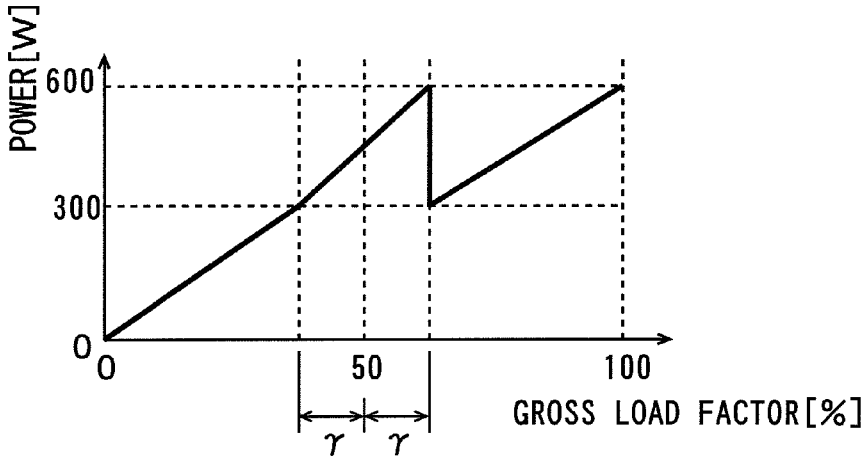

A sixth driving method for the heat exchanger 9 will be described about differences from the fifth driving method. FIG. 40 is a diagram for describing the sixth driving method for the heat exchanger 9 of FIG. 29. FIG. 40(*a*) illustrates the relation between the driving power of the first-side sheathed heater 91 and the gross load factor. Also, FIG. 40(*b*) illustrates the relation between the driving power of the second-side sheathed heater 92 and the gross load factor.

As shown in FIG. 40(*a*) and FIG. 40(*b*), in this driving method, in the range where the gross load factor is from 0% and smaller than (50+γ) %, the driving power of the first-side sheathed heater 91 and the driving power of the second-side sheathed heater 92 are controlled in the same way as in the fifth driving method.

When the gross load factor is (50+γ) %, the driving power supplied to the first-side sheathed heater 91 becomes 600 W, and the driving power supplied to the second-side sheathed heater 92 becomes 300 W. In this case, no harmonic current flows in the first-side sheathed heater 91 since the driving power of the first-side sheathed heater 91 is not phase-controlled.

In the range where the gross load factor is larger than (50+γ) % and not more than 100%, with the first-side sheathed heater 91 being supplied with driving power of 600 W, phase control is performed such that only the driving power of the second-side sheathed heater 92 is proportional to the value of the gross load factor.

In this way, in the sixth driving method, in the gross load factor range that is lower than the gross load factor range where the first-side sheathed heater 91 is driven with power of 600 W, i.e. in the range larger than (50−γ) % and not more than (50+γ) %, driving power is supplied to the first-side sheathed heater 91.

Thus, the first-side sheathed heater 91 is generating heat at low temperatures in the range where the gross load factor is larger than (50−γ) % and not more than (50+γ) %. Accordingly, when the gross load factor rises over (50+γ) %, for example, the delay of heat generation of the first-side sheathed heater 91 is prevented.

As described above, in the sixth driving method, in the whole range of gross load factor from 0% to 100%, the driving power of the second-side sheathed heater 92 is phase-controlled. The temperature of washing water heated by the second-side sheathed heater 92 is accurately measured by the exit water temperature sensor 98 immediately after it was heated.

Accordingly, in the whole range of gross load factor, the driving power of the heat exchanger 9 is accurately controlled on the basis of the temperature value measured by the exit water temperature sensor 98. As a result, the washing water supplied to the local areas of the user can be certainly adjusted to more proper temperatures.

(5-i) Seventh Driving Method of Heat Exchanger

Figure 41:
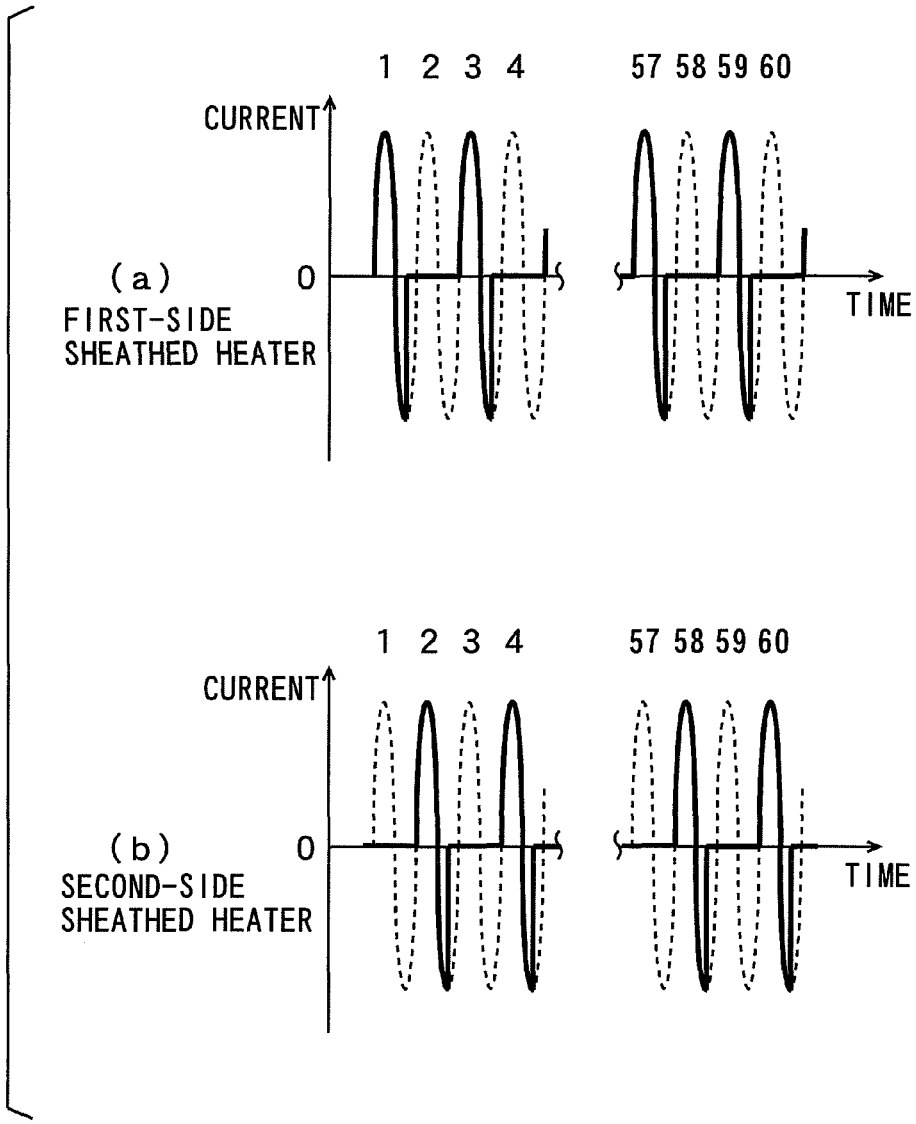
FIG. 41 is a diagram illustrating a seventh driving method for the heat exchanger of FIG. 29.

A seventh driving method for the heat exchanger 9 will be described. FIG. 41 is a diagram for describing the seventh driving method for the heat exchanger 9 of FIG. 29. FIG. 41(*a*) shows an example of a current waveform flowing in the first-side sheathed heater 91, and FIG. 41(*b*) shows an example of a current waveform flowing in the second-side sheathed heater 92.

In this example, the frequency of the alternating-current power supply ACS to which the heat exchanger 9 is connected is 60 Hz.

In FIG. 41(*a*) and FIG. 41(*b*), the vertical axis shows current and the horizontal axis shows time. Thick solid line shows currents flowing in the first-side sheathed heater 91 and the second-side sheathed heater 92. Also, in FIG. 41(*a*) and FIG. 41(*b*), to facilitate the understanding, the numbers 1 to 60 respectively indicate the 60 cycles of the alternating current in one second.

In the seventh driving method, only the driving power of one of the first-side sheathed heater 91 and the second-side sheathed heater 92 is phase-controlled.

In the example of FIG. 41(*a*) and FIG. 41(*b*), a cycle in which the driving power supplied to the first-side sheathed heater 91 is phase-controlled and the driving power supplied to the second-side sheathed heater 92 is not phase-controlled, and a cycle in which the driving power supplied to the first-side sheathed heater 91 is not phase-controlled and the driving power supplied to the second-side sheathed heater 92 is phase-controlled, are alternately switched.

In this way, in the seventh driving method, the driving power to the first-side sheathed heater 91 and the driving power to the second-side sheathed heater 92 are not phase-controlled at the same time. This prevents harmonic currents from simultaneously flowing in the first-side sheathed heater 91 and the second-side sheathed heater 91 when the heat exchanger 9 is driven.

Thus, by driving the heat exchanger 9 of FIG. 29 by the seventh driving method, the generation of high-level harmonic current is sufficiently suppressed as compared with a structure using a sheathed heater having a rated power of 1200 W in the heat exchanger 9.

The phase control of the driving power supplied to the first-side sheathed heater 91 and the phase control of the driving power supplied to the second-side sheathed heater 92 do not necessarily have to be switched in alternate cycles, but the setting can be made arbitrarily. For example, they can be switched in two cycles or in three cycles.

(5-j) Other Driving Methods

The description above has illustrated driving methods for the heat exchanger 9 in which phase control is applied to the driving powers to the first-side sheathed heater 91 and the second-side sheathed heater 92, but the heat exchanger 9 may be driven by methods described below in place of such phase control.

(5-k) Eighth Driving Method of Heat Exchanger

Figure 42:
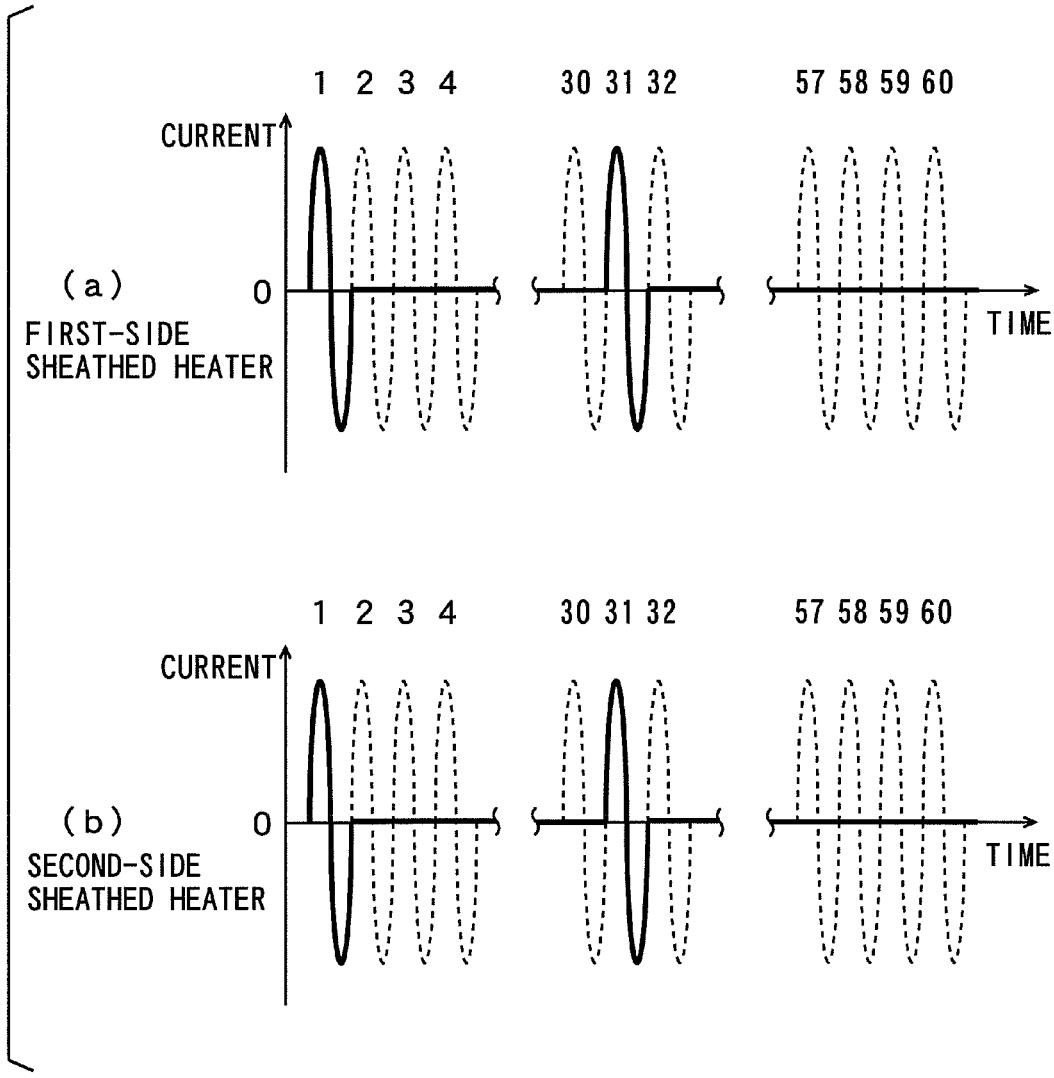
FIG. 42 is a diagram illustrating an eighth driving method for the heat exchanger of FIG. 29.

An eighth driving method for the heat exchanger 9 will be described. FIG. 42 is a diagram for describing the eighth driving method for the heat exchanger 9 of FIG. 29. FIG. 42(*a*) shows an example of a current waveform flowing in the first-side sheathed heater 91, and FIG. 42(*b*) shows an example of a current waveform flowing in the second-side sheathed heater 92.

In FIG. 42(*a*) and FIG. 42(*b*), the vertical axis shows current and the horizontal axis shows time. Thick solid line shows the currents flowing in the first-side sheathed heater 91 and the second-side sheathed heater 92. Also, in FIG. 42(*a*) and FIG. 42(*b*), to facilitate the understanding, the numbers 1 to 60 respectively indicate the 60 cycles of the alternating current in one second.

In the eighth driving method, the on/off states of electricity to the first-side sheathed heater 91 and the second-side sheathed heater 92 are selected in each cycle of the alternating current.

In the example of FIG. 42(*a*), a full-wave alternating current is passed to the first-side sheathed heater 91 in the 1st cycle and the 31st cycle. In the example of FIG. 42(*b*), a full-wave alternating current is passed to the second-side sheathed heater 92 in the 1st cycle and the 31st cycle.

In this case, the driving powers to the first-side sheathed heater 91 and the second-side sheathed heater 92 are each 20 W. Therefore the heat exchanger 9 is driven with power of 40 W on the whole.

In this way, in the eighth driving method, the on/off states of electricity to the first-side sheathed heater 91 and the second-side sheathed heater 92 are selected for each cycle, so that the heat exchanger 9 can be driven without using phase control, to adjust the gross load factor of the heat exchanger 9. Accordingly, no harmonic current flows in the first-side sheathed heater 91 and the second-side sheathed heater 92.

Also, in the eighth driving method, the timings of applying electricity to the first-side sheathed heater 91 and the second-side sheathed heater 92 are distributed in the 60 cycles (one second).

For example, as shown in the example of FIG. 42(*a*), when full-wave alternating current is applied to the first-side sheathed heater 91 twice in the 60 cycles, the full-wave alternating current is passed in the 1st cycle and the 31st cycle.

Also, for example, when full-wave alternating current is passed to the first-side sheathed heater 91 four times in the 60 cycles, full-wave alternating current is passed in the 1st cycle, the 16th cycle, the 31st cycle, and the 46th cycle.

By distributing the electricity applying timings to the first-side sheathed heater 91 and the second-side sheathed heater 92 in the 60 cycles, it is possible to suppress significant voltage drops at low frequencies occurring in the power-supply line connected to the heat exchanger 9. Accordingly, even when there is an illumination apparatus connected to the same power-supply line with the heat exchanger 9, the occurrence of flicker in that illumination apparatus is suppressed.

(5-l) Ninth Driving Method of Heat Exchanger

Figure 43:
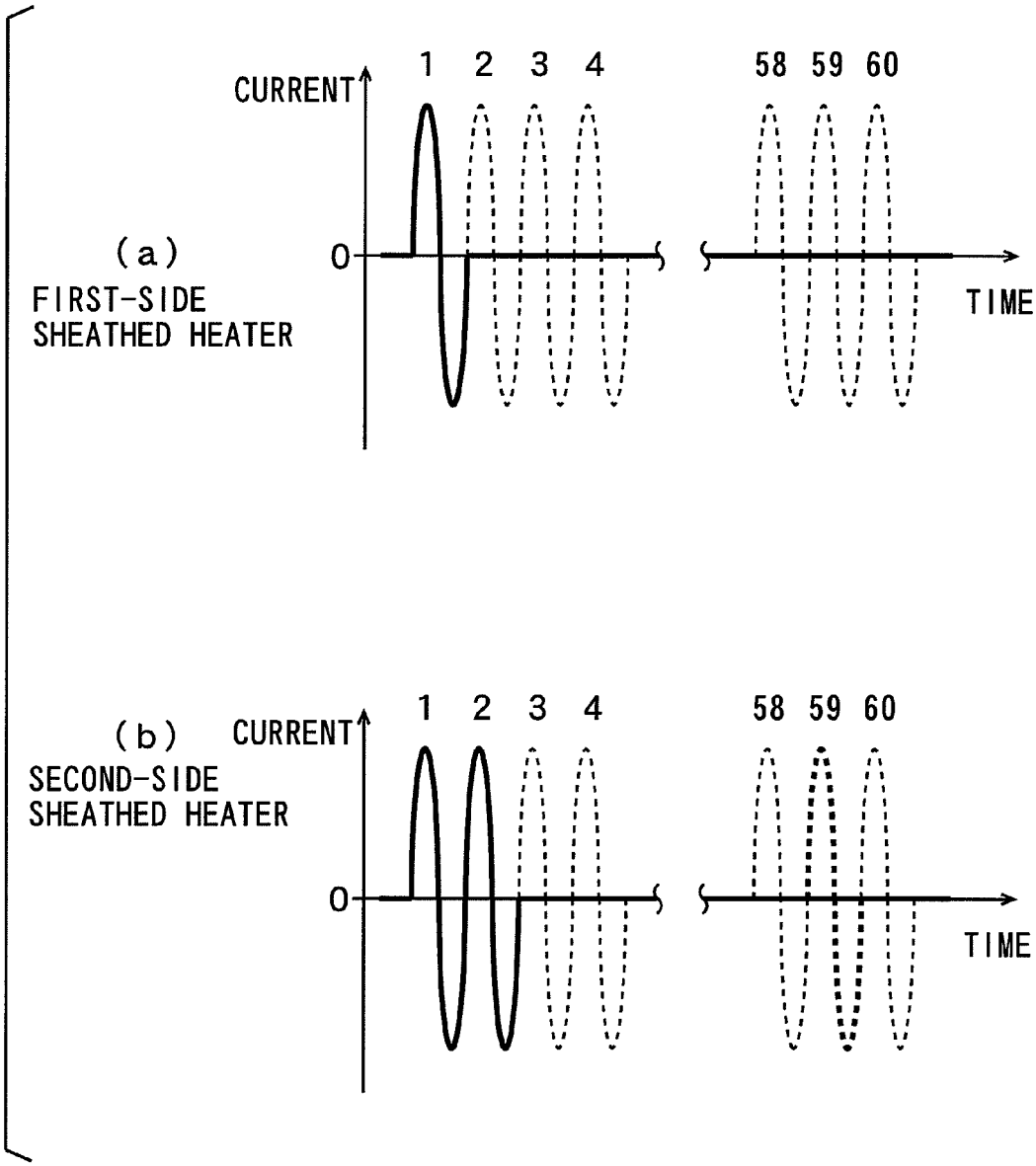
FIG. 43 is a diagram illustrating a ninth driving method for the heat exchanger of FIG. 29.

A ninth driving method for the heat exchanger 9 will be described about differences from the eighth driving method. FIG. 43 is a diagram for describing the ninth driving method for the heat exchanger 9 of FIG. 29. FIG. 43(*a*) shows an example of a current waveform flowing in the first-side sheathed heater 91, and FIG. 43(*b*) shows an example of a current waveform flowing in the second-side sheathed heater 92.

In FIG. 43(*a*) and FIG. 43(*b*), the vertical axis shows current and the horizontal axis shows time. Thick solid line shows the currents flowing in the first-side sheathed heater 91 and the second-side sheathed heater 92. Also, in FIG. 43(*a*) and FIG. 43(*b*), to facilitate the understanding, the numbers 1 to 60 respectively indicate the 60 cycles of the alternating current in one second.

In the ninth driving method, the timings for passing electricity to the first-side sheathed heater 91 and the second-side sheathed heater 92 are individually controlled.

In this way, by individually controlling the timings for passing electricity to the first-side sheathed heater 91 and the second-side sheathed heater 92, as shown in the example of FIG. 43(*a*) and FIG. 43(*b*), it is possible to apply full-wave current to the first-side sheathed heater 91 in the 1st cycle of the 60 cycles, and to apply full-wave current to the second-side sheathed heater 92 in the 1st cycle and the 2nd cycle of the 60 cycles. Also, the timing for passing electricity to the first-side sheathed heater 91 and the timing for passing electricity to the second-side sheathed heater 92 partially differ.

In this case, a current at a high level (amplitude) flows in the heat exchanger 9 in the 1st cycle. Accordingly, when there is an illumination apparatus connected to the same power-supply line with the heat exchanger 9, flicker is likely to occur in the illumination apparatus.

However, in this example, in the 2nd cycle, a current at a level (amplitude) half that in the 1st cycle flows to the heat exchanger 9. Accordingly, the variation of current level flowing to the heat exchanger 9 is alleviated as compared with when a high-level (amplitude) current flows to the heat exchanger 9 only in the 1st cycle. This alleviates the amount of variation of voltage drop occurring in the same power-supply line as the heat exchanger 9. As a result, even if flicker occurs, the flicker is not very noticeable.

As shown by the thick dotted line in FIG. 43(*b*), when the application of electricity to the second-side sheathed heater 92 in the 2nd cycle is made in the 59th cycle, a locally high-level current flows in the heat exchanger 9 in the 1st cycle. Then, when there is an illumination apparatus connected to the same power-supply line with the heat exchanger 9, significant flicker is likely to occur in the illumination apparatus.

(5-m) Harmonic Tests

"JIS (Japanese Industrial Standards) C6100-3-2" determines limit values of harmonic components (harmonic current) contained in input current generated by appliances tested under given test conditions.

Accordingly, the inventors of the present invention measured the harmonic currents to the 40th order that are generated when the heat exchanger 9 of FIG. 29 is driven at 900 W by using the first driving method described above.

Figure 44:
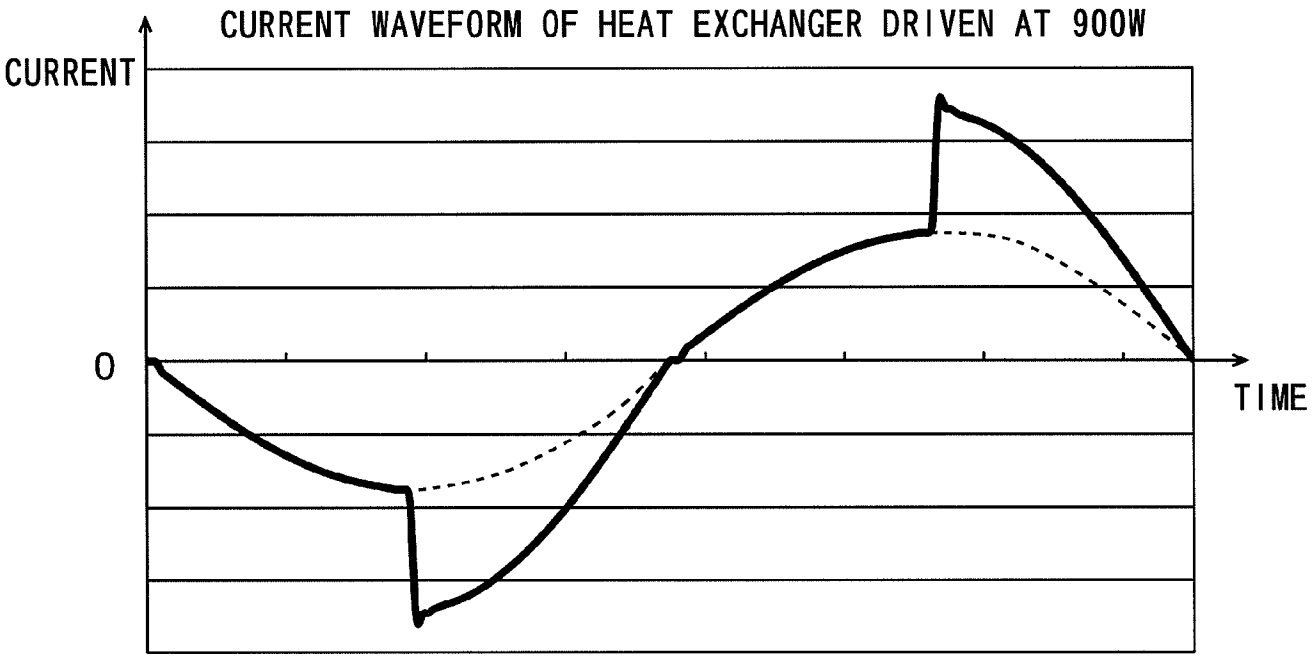
FIG. 44 is a waveform diagram of current applied when the heat exchanger is driven at 900 W by the first driving method.
Figure 45:
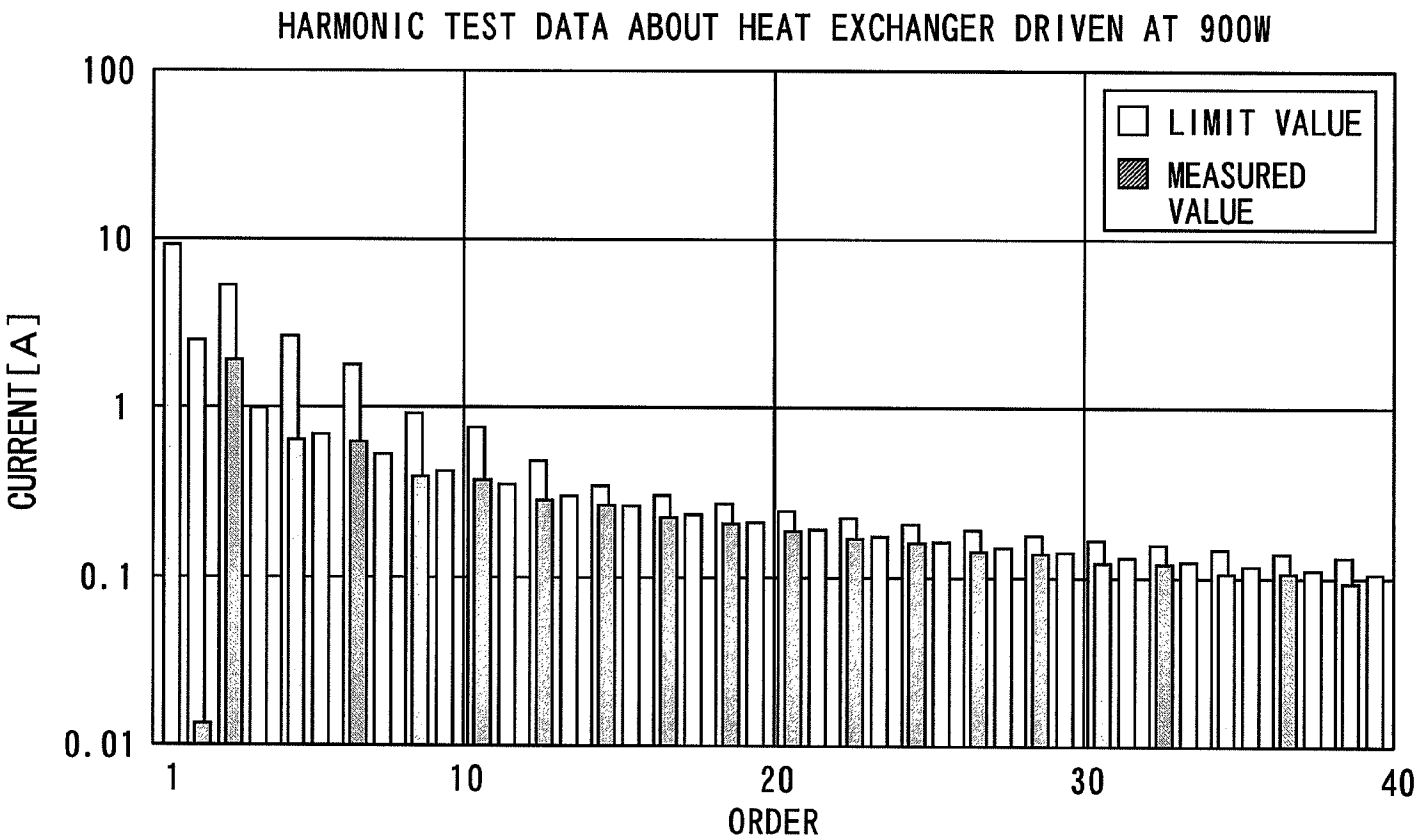
FIG. 45 is a graph showing the results of measurement of harmonic current to the 40th order generated when the heat exchanger is driven at 900 W by the first driving method.

FIG. 44 is a diagram showing a current waveform passed to the heat exchanger 9 driven by the first driving method at 900 W, and FIG. 45 is a graph showing the measurements of harmonic currents to the 40th order generated when the heat exchanger 9 is driven by the first driving method at 900 W.

In FIG. 44, the vertical axis shows current and the horizontal axis shows time. Also, the thick curve shows the current flowing in the heat exchanger 9. As shown in FIG. 44, the diagram of the current waveform passed to the heat exchanger 9 driven at 900 W has portions where the current sharply varies due to phase control. Harmonic current occurs in these portions.

In FIG. 45, the vertical axis shows the current value (level) of harmonic current, and the horizontal axis shows the orders of harmonic current. Also, the white bars indicate the limit value at each order of harmonic current, and the black bars indicate actually measured value of harmonic current at each order.

According to FIG. 45, odd harmonic current and even harmonic current at lower level than the odd harmonic current both occur when the heat exchanger 9 is driven by the first driving method at 900 W. The levels of harmonic current of almost all orders were below the limit values.

In this way, according to the first driving method, the generation of high-level harmonic current, that exceeds limit values, is sufficiently suppressed even when the heat exchanger 9 is driven at power as high as 900 W.

(5-n) High-Temperature Water Release Preventing Mechanism

In the sanitary washing apparatus 100 of this example, immediately after the wash of the local areas of a user, the washing water that was already heated for the wash remains in the heat exchanger 9.

The amount of heat remaining in the sheathed heaters 91 and 92 of the heat exchanger 9 is large enough to sufficiently heat the washing water remaining in the heat exchanger 9. Accordingly, immediately after the wash of the local areas of a user, the washing water remaining in the heat exchanger 9 is continuously heated by the remaining heat of the sheathed heaters 91 and 92 after the electromagnetic shutoff valve 7 of FIG. 3 was closed ("heat rise after shut off" occurs).

Accordingly, when the operation of washing the local areas of the user is started again, the washing water remaining in the heat exchanger 9 might have been heated to high temperatures. Therefore, a high-temperature water release preventing mechanism as shown below should be provided such that washing water heated to high temperatures by the heat exchanger 9 will not be released from the nozzle unit 20 of FIG. 3 to the local areas of the user.

Figure 46:
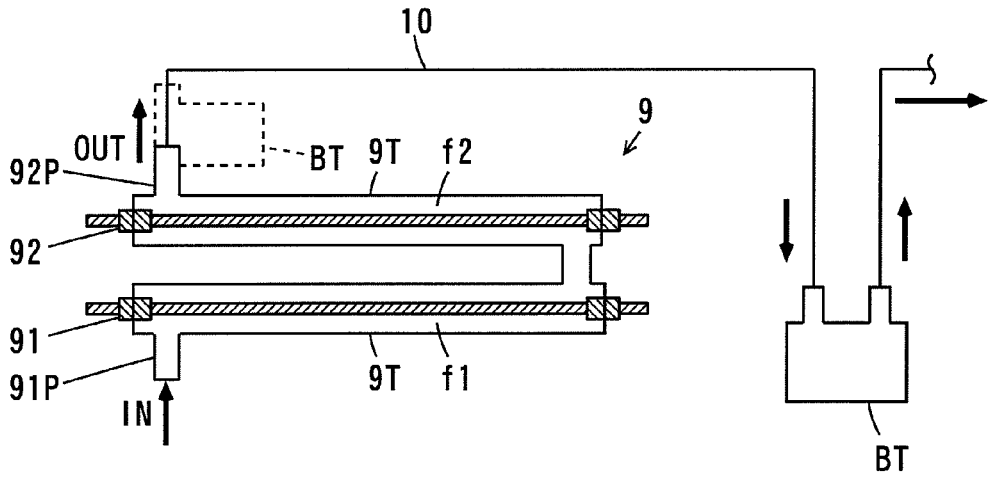
FIG. 46 is a diagram showing a first example of a high-temperature water release preventing mechanism.

FIG. 46 is a diagram showing a first example of such a high-temperature water release preventing mechanism. As shown in FIG. 46, in this example, a buffer tank BT is interposed in the piping 10 connected to the water outlet port 92P of the heat exchanger 9.

Then, even when washing water is heated to high temperatures in the heat exchanger 9, the high-temperature washing water is temporarily stored in the buffer tank BT, and the temperature of the washing water is buffered. This prevents the release of highly heated washing water to the local areas of the user.

As shown by dotted line in FIG. 46, the buffer tank BT may be integrated with the water outlet port 92P of the heat exchanger 9. This realizes size reduction of the main body 200 of the sanitary washing apparatus 100.

Figure 47:
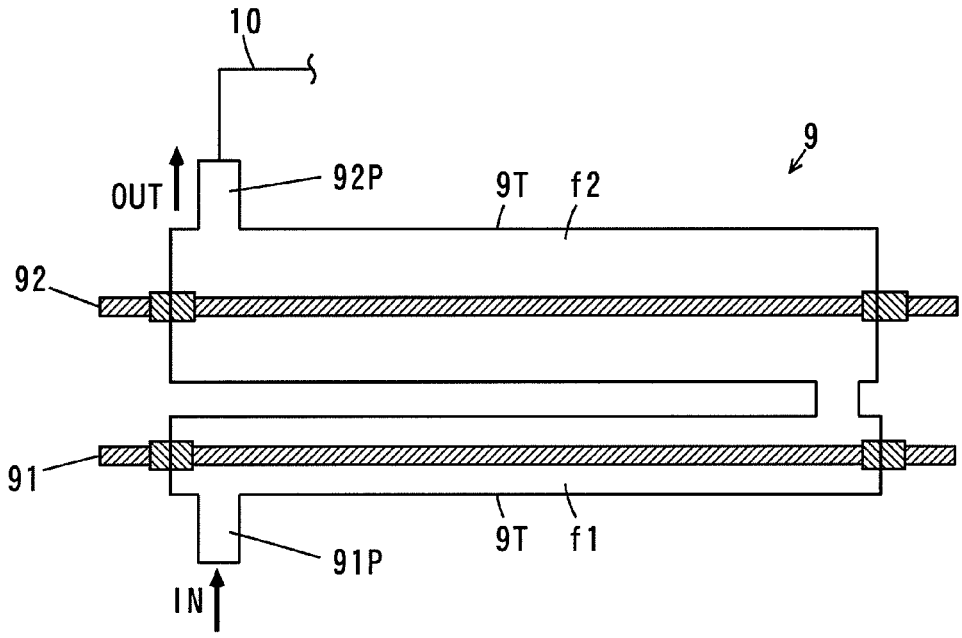
FIG. 47 is a diagram showing a second example of the high-temperature water release preventing mechanism.

FIG. 47 is a diagram showing a second example of a high-temperature water release preventing mechanism. As shown in FIG. 47, in this example, the inner diameter of the flow passage forming tube 9T covering the second-side sheathed heater 92 is formed much larger than the inner diameter of the flow passage forming tube 9T covering the first-side sheathed heater 91.

In this case, the cross-sectional area of the second flow passage 12 formed along the peripheral surface of the second-side sheathed heater 92 is larger than the cross-sectional area of the first flow passage f1 formed along the peripheral surface of the first-side sheathed heater 91. Then, the second flow passage f2 functions as a temperature buffer for heated washing water. This prevents the release of highly heated washing water to the local areas of the user.

Also, in this case, since the second flow passage 12 plays the role of the buffer tank BT of FIG. 46, it is not necessary to provide a buffer tank as a high-temperature water release preventing mechanism in the main body 200. This realizes size reduction of the main body 200.

Figure 48:
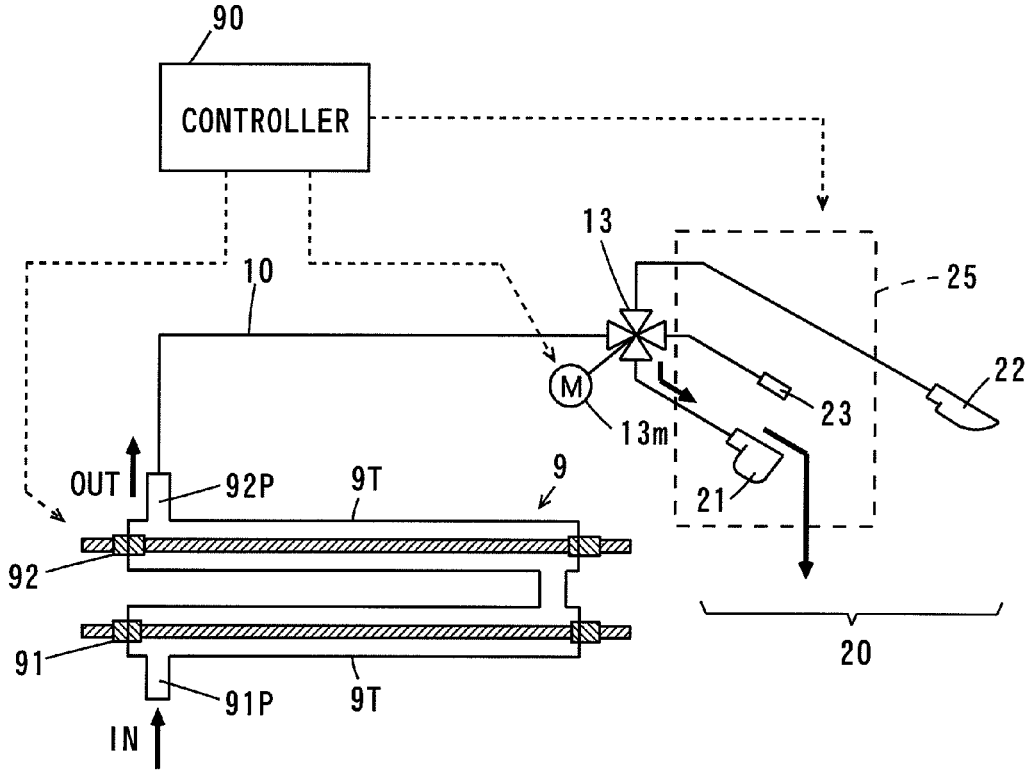
FIG. 48 is a diagram showing a third example of the high-temperature water release preventing mechanism.

FIG. 48 is a diagram showing a third example of a high-temperature water release preventing mechanism. FIG. 48 shows the heat exchanger 9, the switching valve for human body 13, the nozzle unit 20, and the controller 90.

In the nozzle unit 20, the tips of the posterior nozzle 21, the bidet nozzle 22, and the nozzle washing nozzle 23 are all accommodated in a nozzle end accommodating section 25 shown by broken line. In this case, the washing water releasing openings, not shown, of the posterior nozzle 21 and the bidet nozzle 22 are covered by the nozzle end accommodating section 25. The nozzle end accommodating section 25 will be fully described later (see FIG. 63).

When washing the local areas of a user, the tip of the posterior nozzle 21 or bidet nozzle 22 projects from the nozzle end accommodating section 25. FIG. 48 shows the bidet nozzle 22 projecting from the nozzle end accommodating section 25.

In this example, when the operation of washing the local areas of a user is finished once and then the wash of the local areas of the user is performed again within a given time period, the controller 90 controls the switching valve for human body 13 as follows.

The controller 90 controls the switching valve for human body 13 so that washing water flows to a nozzle (the posterior nozzle 21) other than the nozzle used (the bidet nozzle 22). At this time, the posterior nozzle 21 is accommodated in the nozzle end accommodating section 25.

Accordingly, even when washing water is heated to high temperature by the heat exchanger 9, the high-temperature washing water is released within the nozzle end accommodating section 25, and flows down without being released to the local areas of the user.

When washing water is released from the posterior nozzle 21 or bidet nozzle 22 and then washing water is again released from the posterior nozzle 21 or bidet nozzle 22 within a given time period, the controller 90 may control the switching valve for human body 13 so that washing water flows to the nozzle washing nozzle 23.

Figure 49:
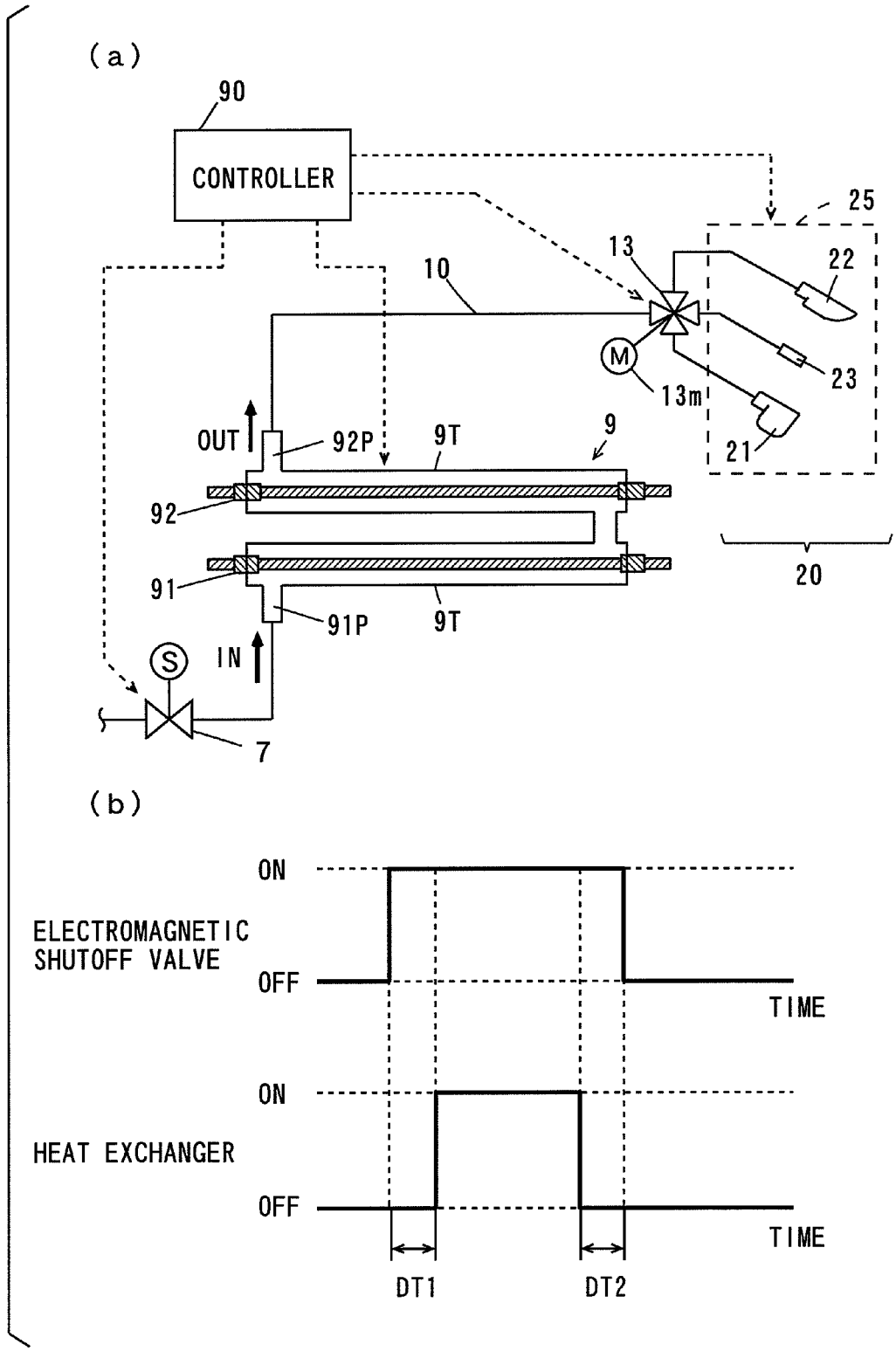
FIG. 49 is a diagram showing a fourth example of the high-temperature water release preventing mechanism.

FIG. 49 is a diagram showing a fourth example of a high-temperature water release preventing mechanism. FIG. 49(*a*) shows the electromagnetic shutoff valve 7, heat exchanger 9, switching valve for human body 13, nozzle unit 20, and controller 90. FIG. 49(*b*) shows a control sequence of the electromagnetic shutoff valve 7 and the heat exchanger 9 by the controller 90.

In this example, the electromagnetic shutoff valve 7 opens in the on state and closes in the off state. The heat exchanger 9 generates heat in the on state and does not generate heat in the off state.

As shown in FIG. 49(*b*), when the operation of washing the local areas of a user is not performed, the controller 90 turns off the electromagnetic shutoff valve 7 and the heat exchanger 9.

Then, when the operation of washing the local areas of a user is started, the controller 90 first turns on the electromagnetic shutoff valve 7. Then, washing water supplied from the water service piping 1 of FIG. 3 flows into the heat exchanger 9, and the washing water remaining in the heat exchanger 9 flows out into the piping 10. Then, the heat exchanger 9 is cooled by the newly supplied washing water. At this time, the posterior nozzle 21 or bidet nozzle 22 is not projecting from the nozzle end accommodating section 25. Accordingly, even if the washing water remaining in the heat exchanger 9 (remaining water) is heated to high temperatures, the remaining water is released within the nozzle end accommodating section 25 and flows down without being released to the local areas of the user.

Next, as a short time DT1 passes, the controller 90 turns on the heat exchanger 9. The washing water is then heated by the heat exchanger 9. The heated washing water is sent to the switching valve for human body 13 through the piping 10 and released from the posterior nozzle 21 or bidet nozzle 22 projecting from the nozzle end accommodating section 25. The local areas of the user are thus washed.

In this way, in this example, when the operation of washing the local areas of a user is started, the washing water remaining in the heat exchanger 9 is sent out of the heat exchanger 9 without being heated. Thus, the heat exchanger 9 is cooled, and excessive heat generation of the heat exchanger 9 is prevented when it generates heat after that. This sufficiently prevents the release of high-temperature washing water to the local areas of the user.

After that, when the wash of the local areas of the user is finished, the controller 90 turns off the heat exchanger 9 first. Then, the high-temperature washing water remaining in the heat exchanger 9 flows out into the piping 10. Then, newly supplied washing water cools the heat exchanger 9.

Next, as a short time DT2 passes, the controller 90 turns off the electromagnetic shutoff valve 7. This stops the supply of washing water to the heat exchanger 9.

In this way, in this example, washing water remaining in the heat exchanger 9 is sent out of the heat exchanger 9 without being heated also at the end of a wash of the local areas of the user. Accordingly, when the operation of washing the local areas of a user is performed and then the washing operation is started again immediately after that, the washing water heated to high temperature by the heat exchanger 9 is certainly not released to the local areas of the user.

In this example, the release of high-temperature washing water to the local areas of the user is prevented by the control sequence of the controller 90. Accordingly, there is no need to provide a new component as a high-temperature water release preventing mechanism, preventing increase in size of the sanitary washing apparatus 100.

In the control sequence described above, the short periods DT1 ad DT2 are adjusted by the controller 90 on the basis of the temperature of washing water supplied to the heat exchanger 9. This prevents the release of cold washing water to the local areas of the user.

In addition to controlling the electromagnetic shutoff valve 7 and the heat exchanger 9 as described above, the controller 90 may make the heat exchanger 9 operate and also make the pump 11 of FIG. 3 operate before the wash of the local areas by the user, for example. Then, cool washing water remaining in the water supply system downstream of the heat exchanger 9 can be released inside the nozzle end accommodating section 25. This prevents the release of cold washing water to the local areas of the user.

At this time, the heat exchanger 9 may control the switching valve for human body 13 so that washing water supplied to the nozzle unit 20 before washing the local areas of the user is sent to the nozzle washing nozzle 23. Thus, the tips of the posterior nozzle 21 and the bidet nozzle 22 are washed before washing the local areas of the user.

Also, the controller 90 may make the heat exchanger 9 operate and also make the pump 11 of FIG. 3 operate after the wash of the local areas by the user. Then, the heat exchanger 9, which generated heat during the wash of the local areas of the user, can be cooled by newly supplied cool washing water.

At this time, the controller 90 may control the switching valve for human body 13 so that washing water supplied to the nozzle unit 20 after the wash of the local areas of the user is sent to the nozzle washing nozzle 23. Thus, the tips of the posterior nozzle 21 and the bidet nozzle 22 are washed after washing the local areas of the user.

Also, the controller 90 may control the components of the main body 200 as follows, in addition to the control operations explained above.

The exit water temperature sensor 98 of FIG. 32(*c*) detects the temperature of washing water heated by the heat exchanger 9 and gives it to the controller 90. Then, at the time of washing the local areas of the user, when the temperature of washing water given from the exit water temperature sensor 98 becomes higher than a previously determined abnormality temperature (e.g. 42 degrees), the controller 90 determines that an abnormality has occurred and stops the operations of the components of the sanitary washing apparatus 100. This prevents the release of high-temperature washing water to the human body.

The temperature detected by the exit water temperature sensor 98 is likely to exceed the abnormality temperature when high-temperature washing water in the heat exchanger 9 is discharged as described above. Accordingly, when discharging high-temperature washing water from the heat exchanger 9, the controller 90 sets the abnormality temperature higher than that for the wash of the local areas of the user. Then, the operation of the sanitary washing apparatus 100 is not stopped when high-temperature washing water is discharged.

(5-o) Prevention of Disconnection of Heat Wire

As shown in FIG. 34(*c*), a heat wire 91*w* is provided in the first-side sheathed heater 91 and the second-side sheathed heater 92 provided in the heat exchanger 9.

The watt density of the heat wire 91*w* is extremely high. Accordingly, when the density distribution of magnesium oxide charged in the copper tube 91*c* of each of the sheathed heaters 91 and 92 is uneven, the temperature of the heat wire 91*w* considerably rises in the part where the density of magnesium oxide is low. Then the heat wire 91*w* may be disconnected.

The charge of magnesium oxide into the copper tube 91*c* is achieved by forcing powder of magnesium oxide into the copper tube 91*c* from its one end and applying compression. However, the density of magnesium oxide in the copper tube 91*c* is likely to be lower at the end on the other side.

This is because, the heat wire 91*w* having a large number of turns per unit length is provided in the copper tube 91*c* and magnesium oxide is forced into it, and it is difficult to force the magnesium oxide to the other end. Accordingly, sheathed heaters are likely to suffer disconnection of the heat wire in the vicinity of the end on one side or the other side.

Accordingly, in order to prevent the disconnection of the heat wires 91*w*, the first-side sheathed heater 91 and the second-side sheathed heater 92 are structured as shown below.

Figure 50:
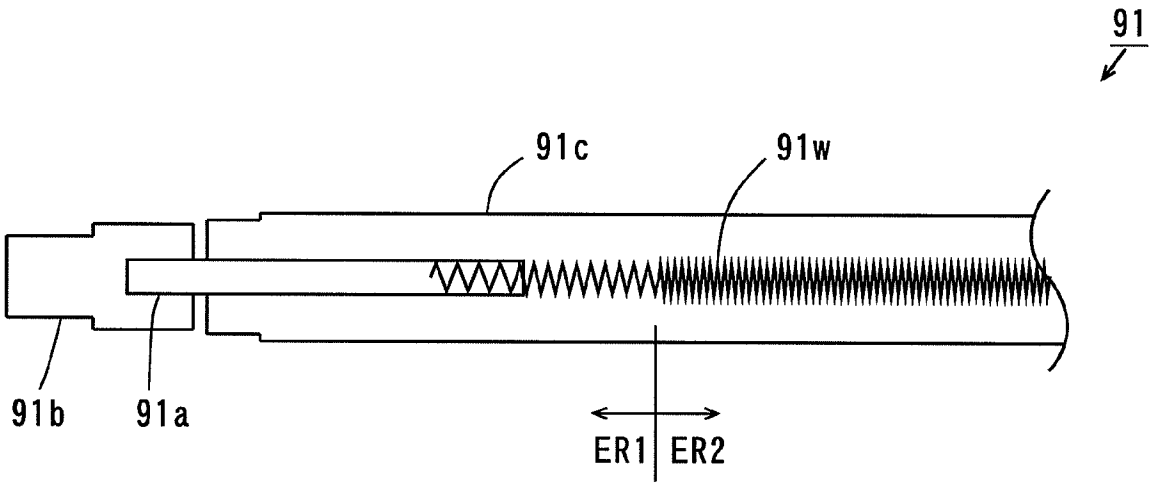
FIG. 50 is a diagram showing a first example of the structure of the sheathed heaters for preventing disconnection of the heat wire of FIG. 34(*c*).

FIG. 50 is a diagram showing a first example of the structure of the sheathed heaters 91 and 92 for preventing the disconnection of the heat wire 91*w* of FIG. 34(*c*).

As shown in FIG. 50, in the first example structure of the sheathed heaters 91 and 92, the number of turns per unit length of the heat wire 91*w* in the regions ER1 near both ends of the sheathed heater 91, 92 is smaller than the number of turns per unit length of the heat wire 91*w* in the region ER2 in the center of the sheathed heater 91, 92.

This facilitates the charge of magnesium oxide powder in the vicinities of both ends of the copper tube 91*c*. This makes it possible to increase the density of magnesium oxide in both ends of the sheathed heater 91, 92, preventing the disconnection of the heat wire in the vicinity of the end on one side or the other side of the sheathed heater 91, 92.

Figure 51:
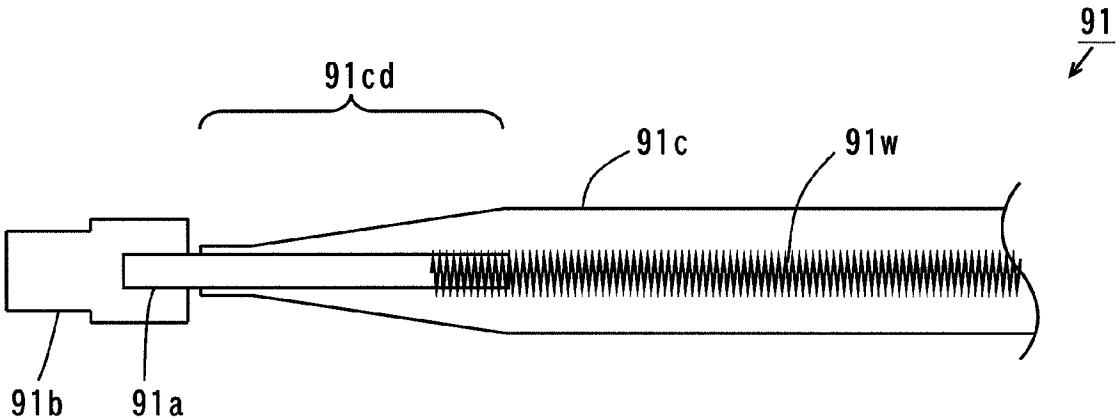
FIG. 51 is a diagram showing a second example of the structure of the sheathed heaters for preventing disconnection of the heat wire of FIG. 34(*c*).

FIG. 51 is a diagram showing a second example of the structure of the sheathed heaters for preventing the disconnection of the heat wire 91*w* of FIG. 34(*c*).

As shown in FIG. 51, in the second example structure of the sheathed heaters 91 and 92, the outer diameter of the copper tube 91*c* in the vicinity 91*cd* of one end of the sheathed heater 91, 92 is formed to become gradually smaller from the middle portion to the end portion.

Then, when powder of magnesium oxide is charged into the copper tube 91*c*, the powder of magnesium oxide can be easily charged in the vicinities of both ends of the copper tube 91*c*. This makes it possible to increase the densities of magnesium oxide in both ends of the sheathed heaters 91 and 92, preventing the disconnection of heat wire in the vicinity of the end on one side or the other side of the sheathed heaters 91 and 92.

(5-p) Improvement of Safety

As mentioned earlier, the power supply unit 9VI of FIG. 29 includes triacs. Considering safety, it is preferable to attach the triacs to the heat exchanger 9 as follows.

Figure 52:
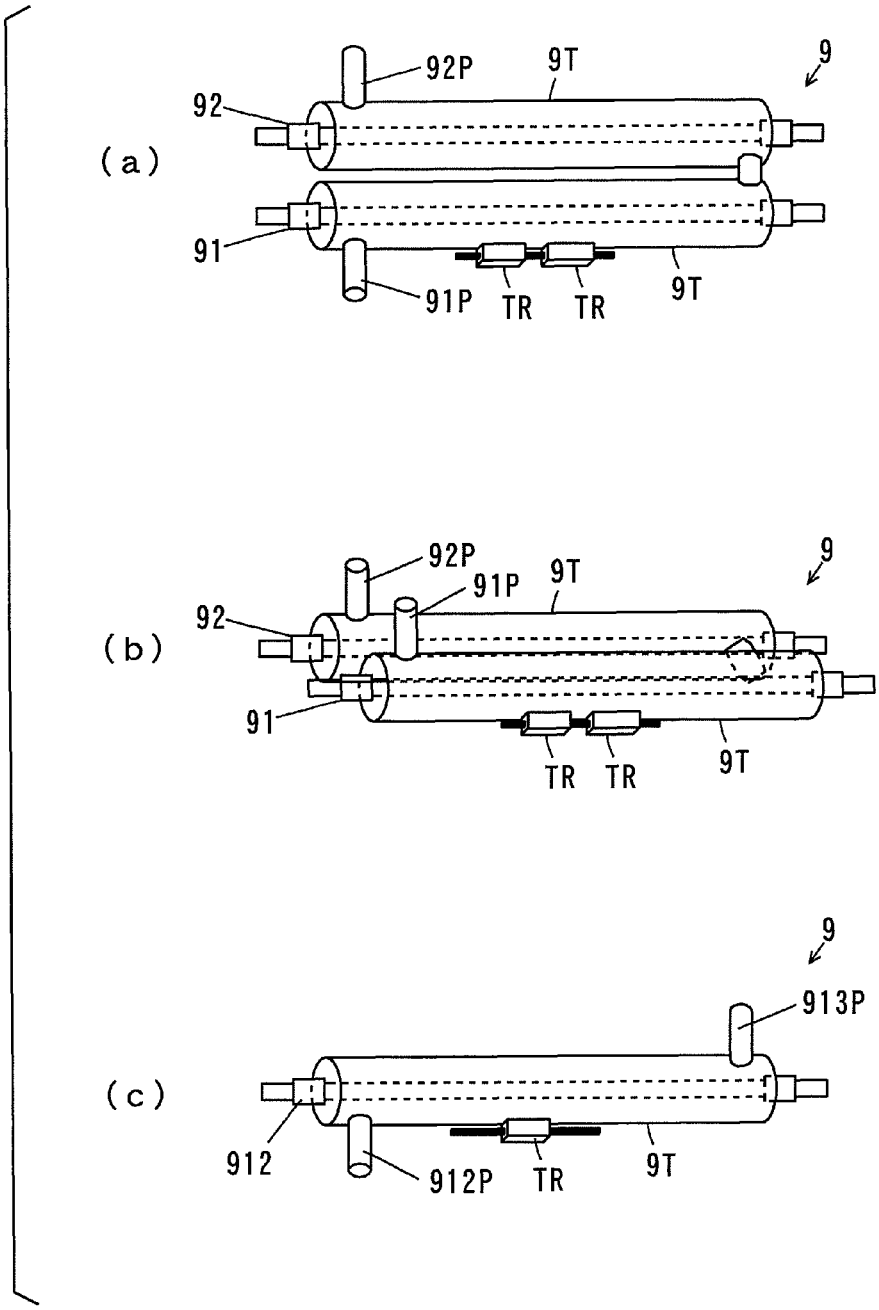
FIG. 52 is a diagram showing examples of the attachment of triac(s) of the power-supply unit of FIG. 29 to the heat exchanger.

FIG. 52 is a diagram showing examples of the attachment of triacs of the power supply unit 9VI of FIG. 29 to the heat exchanger 9. FIG. 52 shows three examples of the attachment of triac(s) to the heat exchanger 9.

As shown in FIG. 52(*a*), suppose that the heat exchanger 9 is provided in the main body 200 such that the first-side sheathed heater 91 and the second-side sheathed heater 92 are arranged above and below each other.

In this case, it is preferable to attach the triacs under the flow passage forming tube 9T that covers the first-side sheathed heater 91 located below. This sufficiently improves the safety of the triacs.

As shown in FIG. 52(*b*), suppose that the heat exchanger 9 is provided in the main body 200 such that the first-side sheathed heater 91 and the second-side sheathed heater 92 are arranged side by side in horizontal direction.

In this case, it is preferable to attach the triacs under the flow passage forming tube 9T that covers the first-side sheathed heater 91 or the second-side sheathed heater 92. This sufficiently improves the safety of the triacs.

As shown in FIG. 52(*c*), suppose that only one sheathed heater is provided in the heat exchanger 9. In this case, it is preferable to attach the triac under the flow passage forming tube covering that sheathed heater. This sufficiently improves the safety of the triac.

Now, unheated cool water flows into the first flow passage f1 (see FIG. 47) formed along the first-side sheathed heater 91. Accordingly, it is preferable to attach the triacs to the flow passage forming tube 9T that covers the first-side sheathed heater 91. Then, the triacs are cooled by the washing water flowing in the first flow passage f1.

(5-q) Prevention of Temperature Variations (5-q-1) First Example of Structure of Heat Exchanger for Preventing Temperature Variations It is not always necessary that the first-side sheathed heater 91 and the second-side sheathed heater 92 provided in the heat exchanger 9 have the same rated power.

Figure 53:
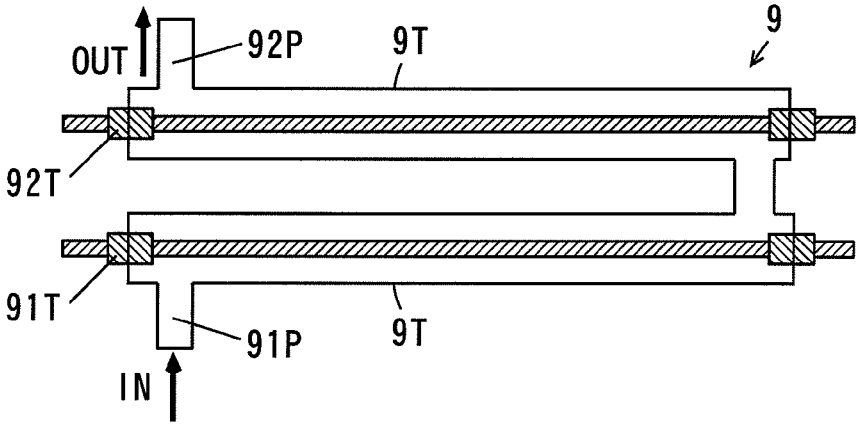
FIG. 53 is a diagram illustrating a heat exchanger having two kinds of sheathed heaters with different rated power values.

FIG. 53 is a diagram illustrating a heat exchanger 9 having two kinds of sheathed heaters having different rated power values. For example, a sheathed heater having a rated power of 900 W is used as the first-side sheathed heater 91, and a sheathed heater having a rated power of 300 W is used as the second-side sheathed heater 92.

In this case, the temperature of washing water supplied from the water inlet port 91P can be quickly raised by the first-side sheathed heater 91T driven with larger driving power. After that, the temperature of the washing water immediately before flowing out from the water outlet port 92P can be finely adjusted by the second-side sheathed heater 92T driven with smaller driving power. As a result, even when washing water at low temperature is supplied to the heat exchanger 9, the occurrence of temperature variations of the washing water flowing out from the heat exchanger 9 can be suppressed.

(5-q-2) Second Example of Structure of Heat Exchanger for Preventing Temperature Variations The heat exchanger 9 may have the structure below in order to prevent temperature variations of washing water that flows out.

Figure 54:
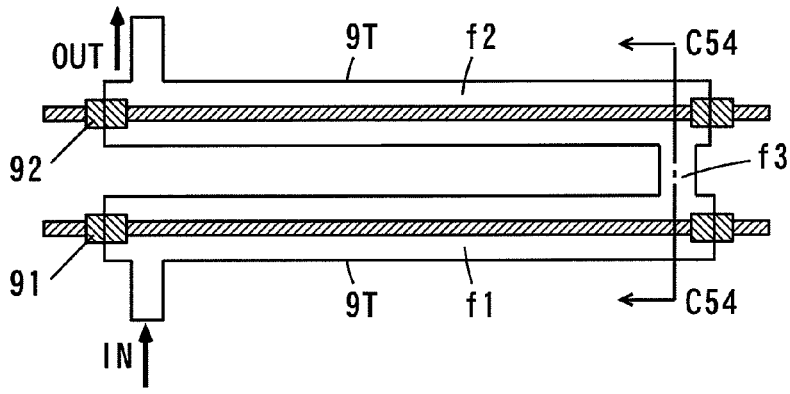
FIG. 54 is a diagram for describing another example of the structure of a flow passage formed in the heat exchanger.
Figure 54:
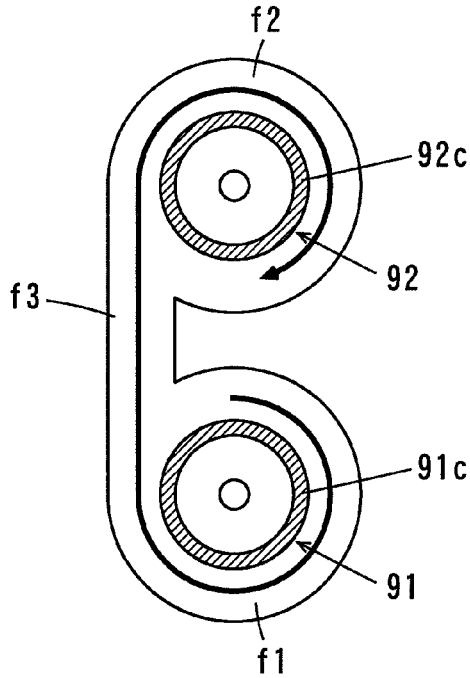

FIG. 54 is a diagram showing another example of the structure of the flow passage formed in the heat exchanger 9. FIG. 54(*a*) shows a schematic plan view of the heat exchanger 9, and FIG. 54(*b*) shows a cross-sectional view taken along line C54-C54 in FIG. 54(*a*).

As shown in FIG. 54(*a*), in this description, the flow passage that connects the first flow passage f1 for washing water formed along the first-side sheathed heater 91 and the second flow passage f2 for washing water formed along the second-side sheathed heater 92 is referred to as a connection flow passage f3.

As shown in FIG. 54(*b*), in this example, the connection flow passage f3 is formed to pass along a tangential line common to the peripheral surfaces of the copper tubes 91*c* and 92*c* of the first-side sheathed heater 91 and the second-side sheathed heater 92.

In this case, as shown by thick arrow in FIG. 54(*b*), washing water flowing in the first flow passage f1 while turning along the peripheral surface of the first-side sheathed heater 91 smoothly flows into the connection flow passage f3. Then, the washing water flowing into the connection flow passage f3 smoothly flows into the second flow passage f2 surrounding the peripheral surface of the second-side sheathed heater 92.

Then, in the heat exchanger 9, the flow of washing water is smoothly maintained between the first flow passage f1 and the second flow passage f2, and variations of the flow speed of washing water in the heat exchanger 9 are suppressed. This suppresses the occurrence of temperature variations of the washing water flowing out of the heat exchanger 9.

(5-r) Size Reduction of Heat Exchanger

As described above, the heat exchanger 9 of FIG. 29 has the first-side sheathed heater 91 and the second-side sheathed heater 92, so that the size in the length direction is reduced as compared with that of a structure using one sheathed heater having a rated power of 1200 W. This suppresses increase in size of the main body 200.

The heat exchanger 9 may be structured as follows in order to achieve size reduction of the main body 200 of FIG. 3.

Figure 55:
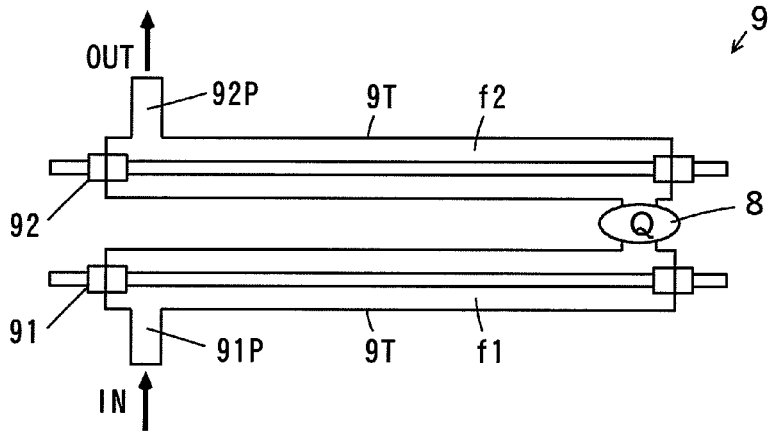
FIG. 55 is a diagram showing a first example of a structure for realizing size reduction of the main body of FIG. 3.

FIG. 55 is a diagram for describing a first example of a structure for achieving size reduction of the main body 200 of FIG. 3. In this example, as shown in FIG. 55, the flow rate sensor 8 of FIG. 3 is integrated with the heat exchanger 9. This eliminates the need to separately provide the flow rate sensor 8 and the heat exchanger 9 in the main body 200. This achieves size reduction of the main body 200.

The value of measured flow rate of washing water obtained by the flow rate sensor 8 varies with the temperature of washing water. Accordingly, as shown in FIG. 55, by providing the flow rate sensor 8 between the first flow passage f1 and the second flow passage f2, the flow rate sensor 8 measures the flow rate of washing water being heated by the heat exchanger 9. Then, as compared with a structure in which the flow rate sensor 8 is provided upstream of the heat exchanger 9, the flow rate of washing water flowing from the heat exchanger 9 into the nozzle unit 20 of FIG. 23 can be more precisely measured.

Also, the flow rate sensor 8 may be provided downstream of the heat exchanger 9. In this case, the flow rate sensor 8 measures the flow rate of washing water after heated by the heat exchanger 9. Then, the flow rate of washing water flowing from the heat exchanger 9 to the nozzle unit 20 can be more precisely measured.

Figure 56:
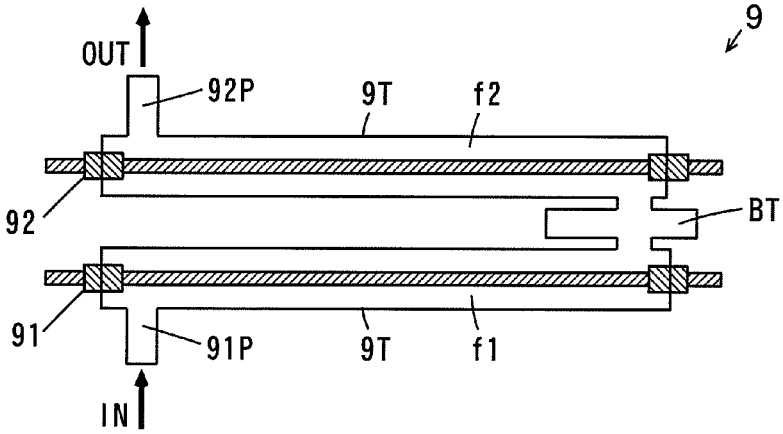
FIG. 56 is a diagram showing a second example of a structure for realizing size reduction of the main body of FIG. 3.

FIG. 56 is a diagram for describing a second example of a structure for achieving size reduction of the main body 200 of FIG. 3. When a buffer tank BT is provided as described with FIG. 46 in order to prevent high-temperature washing water flowing out from the heat exchanger 9, the buffer tank BT is integrated with the heat exchanger 9. This eliminates the need to separately provide the buffer tank BT and the heat exchanger 9 in the main body 200. This realizes size reduction of the main body 200.

Now, in the first flow passage f1 into which cool washing water flows, a temperature difference is likely to occur between the vicinity of the peripheral surface of the first-side sheathed heater 91 and the vicinity of the inner surface of the flow passage forming tube 9T. However, when the buffer tank BT is provided as shown in FIG. 56 between the first flow passage f1 and the second flow passage f2, temperature variations of washing water flowing from the first-side sheathed heater 91 to the second-side sheathed heater 92 can be quickly alleviated.

Figure 57:
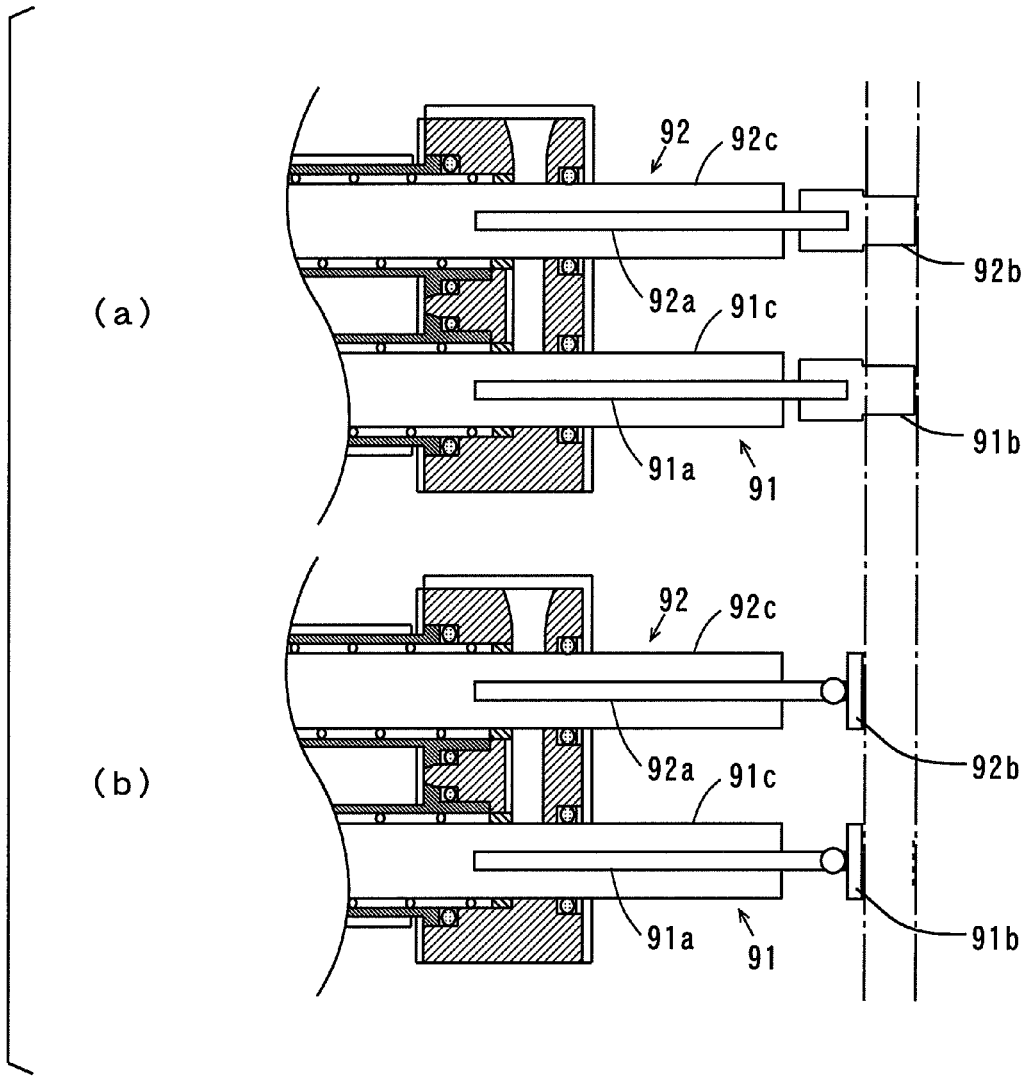
FIG. 57 is a diagram showing a third example of a structure for realizing size reduction of the main body of FIG. 3.

FIG. 57 is a diagram for describing a third example of structure for realizing size reduction of the main body 200 of FIG. 3. FIG. 57 shows a cross-sectional view illustrating the structure of the vicinity of one end of the heat exchanger 9.

As shown in FIG. 57(*a*), at the ends of the first-side sheathed heater 91 and the second-side sheathed heater 92 described with FIG. 34, the terminals 91*b* and 92*b* are attached along the axial centers of the electrodes 91*a* and 92*a*.

On the other hand, in this example, as shown in FIG. 57(*b*), the portions of the electrodes 91*a* and 92*a* that project from the copper tubes 91*c* and 92*c* are bent at about 90 degrees. Then, terminals 91*b* and 92*b* are attached to the bent portions of the electrodes 91*a* and 92*a*. This reduces the size of the heat exchanger 9 in the elongate direction. This realizes size reduction of the main body 200 in a certain direction and facilitates the assembly of the main body 200.

Figure 58:
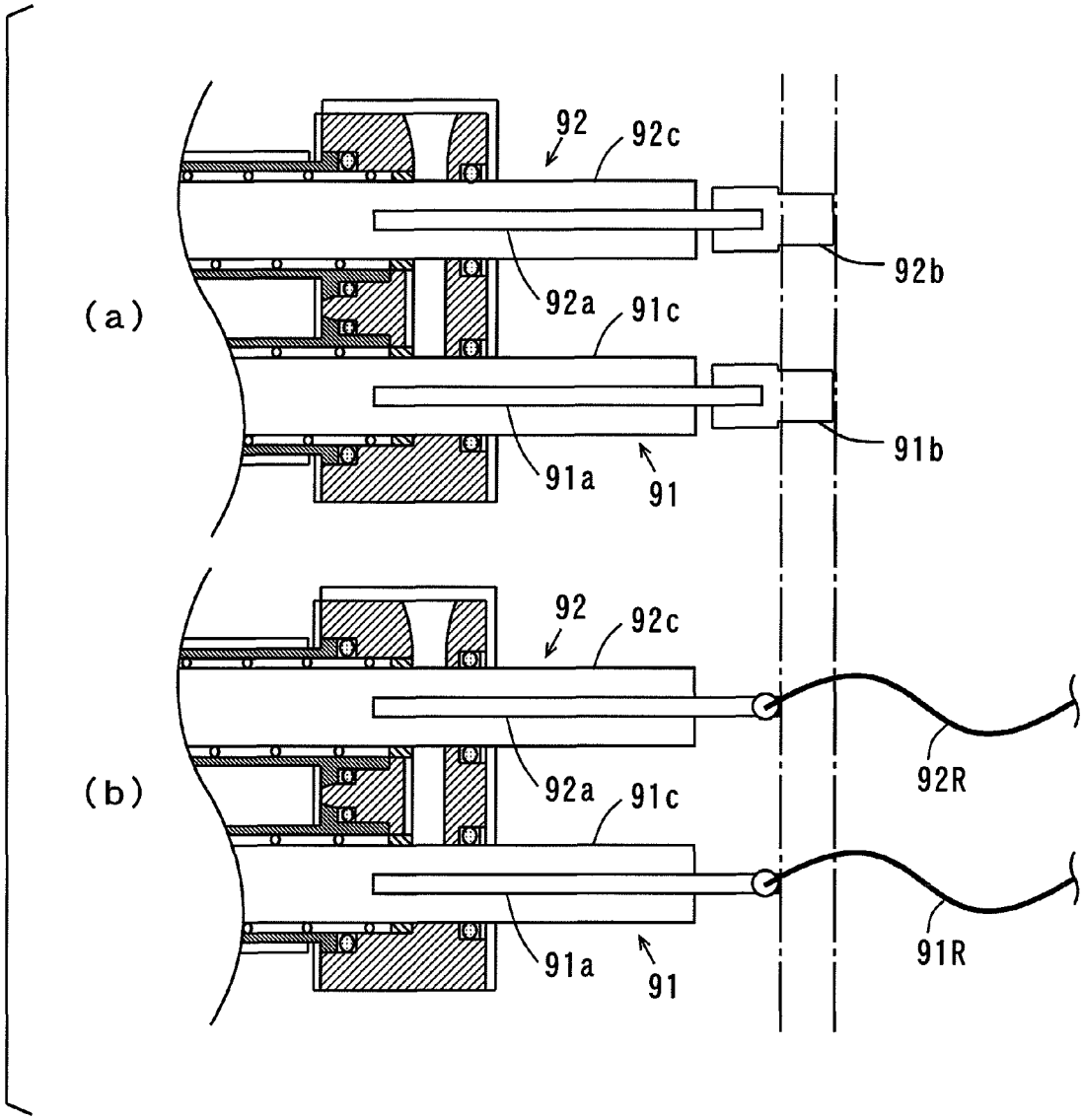
FIG. 58 is a diagram showing a fourth example of a structure for realizing size reduction of the main body of FIG. 3.

FIG. 58 is a diagram for describing a fourth example of a structure for realizing size reduction of the main body 200 of FIG. 3. FIG. 58 shows a cross-sectional view illustrating the structure of the vicinity of one end of the heat exchanger 9.

As shown in FIG. 58(*a*), at the ends of the first-side sheathed heater 91 and the second-side sheathed heater 92 described with FIG. 34, the terminals 91*b* and 92*b* are attached along the axial centers of the electrodes 91*a* and 92*a*.

On the other hand, in this example, as shown in FIG. 58(*b*), lead wires 91R and 92R are connected by spot welding to the ends of the electrodes 91*a* and 92*a* that project from the copper tubes 91*c* and 92*c*. This enables size reduction of the heat exchanger 9 in the elongate direction. This enables size reduction of the main body 200 in a certain direction and facilitates the assembly of the main body 200.

(5-s) Arrangement of Heat Exchanger in Main Body

It is preferable to arrange the heat exchanger 9 such that the first-side sheathed heater 91 and the second-side sheathed heater 92 lie above and below each other and extend in the right-left direction in the main body 200 of FIG. 1, and to provide a toilet seat and lid opening/closing mechanism, described later, above the heat exchanger 9. This reduces the size of the main body 200 in the front-rear direction (depth) in the sanitary washing apparatus 100.

(5-t) Method for Controlling Pump and Heat Exchanger

As explained earlier, a user can adjust the flow rate, pressure, etc. of the washing water released to the local areas by operating the remote controller 300 of FIG. 2 while washing the local areas.

Now, when the user significantly varies the flow rate of the washing water released to the local areas by operating the remote controller 300 while washing the local areas, the temperature of the washing water released to the local areas of the user may rapidly vary. A control method for preventing such rapid temperature variation of washing water will be described.

Figure 59:
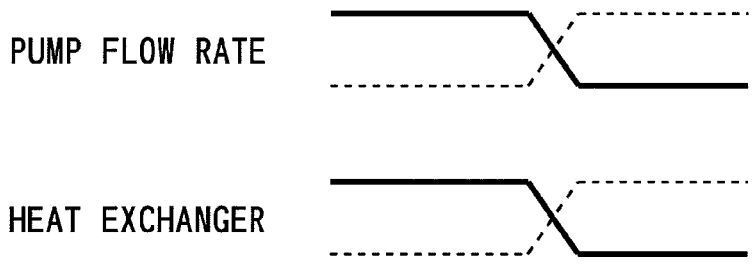
FIG. 59 is a diagram for describing a first control method for preventing rapid temperature variations of washing water released to the local areas of a user.

FIG. 59 is a diagram for describing a first control method for preventing a rapid temperature variation of washing water released to the local areas of the user. FIG. 59 shows variations of the flow rate of washing water discharged from the pump 11 of FIG. 3 and variations of the temperature of the heat exchanger 9.

When the controller 90 controls the operation of the pump 11, almost no delay time occurs from the beginning of the control of the pump 11 by the controller 90 to the actual adjustment of the flow rate of discharged washing water.

On the other hand, when the current flowing to the heat exchanger 9 increases, the temperature of the sheathed heaters 91 and 92 of the heat exchanger 9 first rises. This raises the temperature of the washing water flowing in the heat exchanger 9 (see dotted line about heat exchanger). When the current flowing in the heat exchanger 9 decreases, the temperature of the sheathed heaters 91 and 92 of the heat exchanger 9 decreases. Then, the temperature of the washing water flowing in the heat exchanger 9 decreases (see thick line about heat exchanger). In this case, a delay time occurs from when the control of the heat exchanger 9 by the controller 90 begins to when the temperature of the washing water actually reaches a given temperature.

In this example, the controller 90 provides control such that, according to the delay time of temperature variation of washing water occurring in the heat exchanger 9, a same delay time occurs in the variation of the discharging flow rate of the pump 11 (see dotted line and thick line about pump flow rate). This prevents the rapid temperature variation of washing water released to the local areas of the user.

Figure 60:
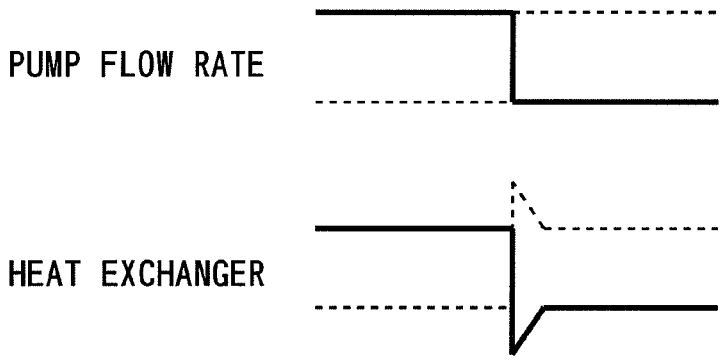
FIG. 60 is a diagram for describing a second control method for preventing rapid temperature variations of washing water released to the local areas of a user.

FIG. 60 is a diagram for describing a second control method for preventing a rapid temperature variation of washing water released to the local areas of the user. FIG. 60 shows variations of the flow rate of washing water discharged from the pump 11 of FIG. 3 and variations of the temperature of the heat exchanger 9.

As shown in FIG. 60, when the flow rate of washing water released to the user is reduced, the controller 90 temporarily shuts off the current flowing to the sheathed heaters 91 and 92 of the heat exchanger 9 (see thick line about heat exchanger).

Thus, the heat of the sheathed heaters 91 and 92 is dissipated into the washing water passing in the heat exchanger 9. The sheathed heaters 91 and 92 can thus be quickly cooled. Also, this prevents an abrupt increase in the temperature of washing water when the heat exchanger 9 heats washing water again.

When the flow rate of washing water released to the user is raised, the controller 90 temporarily rapidly increases the current flowing to the sheathed heaters 91 and 92 of the heat exchanger 9 (see dotted line about heat exchanger).

Then, when the controller 90 controls the operation of the pump 11, the temperature of washing water can be quickly and accurately adjusted in response to the variation of the flow rate of discharge of washing water by the pump 11. Thus, the rapid temperature variation of washing water released to the local areas of the user is prevented.

Figure 61:
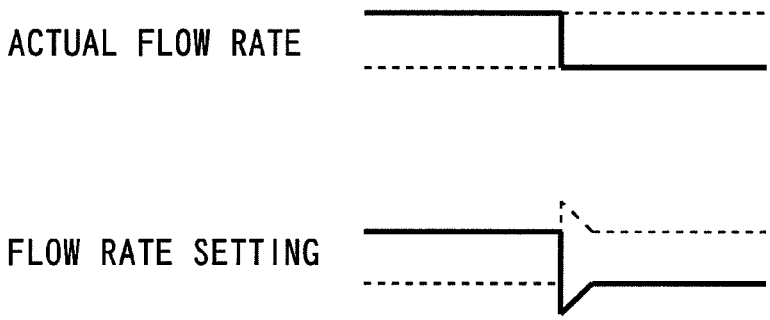
FIG. 61 is a diagram for describing a third control method for preventing rapid temperature variations of washing water released to the local areas of a user.

FIG. 61 is a diagram for describing a third control method for preventing a rapid temperature variation of washing water released to the local areas of the user. FIG. 61 shows variations of actual discharged flow rate of washing water discharged from the pump 11 of FIG. 3, and variations of the setting of flow rate that is one of factors for determining the amount of electricity passed to the heat exchanger 9 and that is calculated from a signal from the flow rate sensor 8 of FIG. 3.

As shown in FIG. 61, when the flow rate of washing water is reduced, the setting of flow rate is temporarily rapidly lowered (see thick line about setting of flow rate). Then, the amount of electricity passed to the heat exchanger 9 is reduced lower than the setting value, and the sheathed heaters 91 and 92 can be rapidly cooled. Also, an abrupt increase in the temperature of washing water can be prevented when the heat exchanger 9 heats washing water again.

Also, when the flow rate of washing water is raised, the setting of flow rate is temporarily rapidly raised (see dotted line about setting of flow rate). This raises the amount of electricity passed to the heat exchanger 9 higher than the setting value, and the temperature of the sheathed heaters 91 and 92 can be rapidly increased.

Thus, when the controller 90 controls the operation of the pump 11, the temperature of washing water can be quickly and accurately adjusted in response to the variation of the flow rate of discharge of washing water by the pump 11. Thus, rapid temperature variations of washing water released to the local areas of the user are prevented.

(5-u) Another Example of Heat Exchanger

Figure 62:
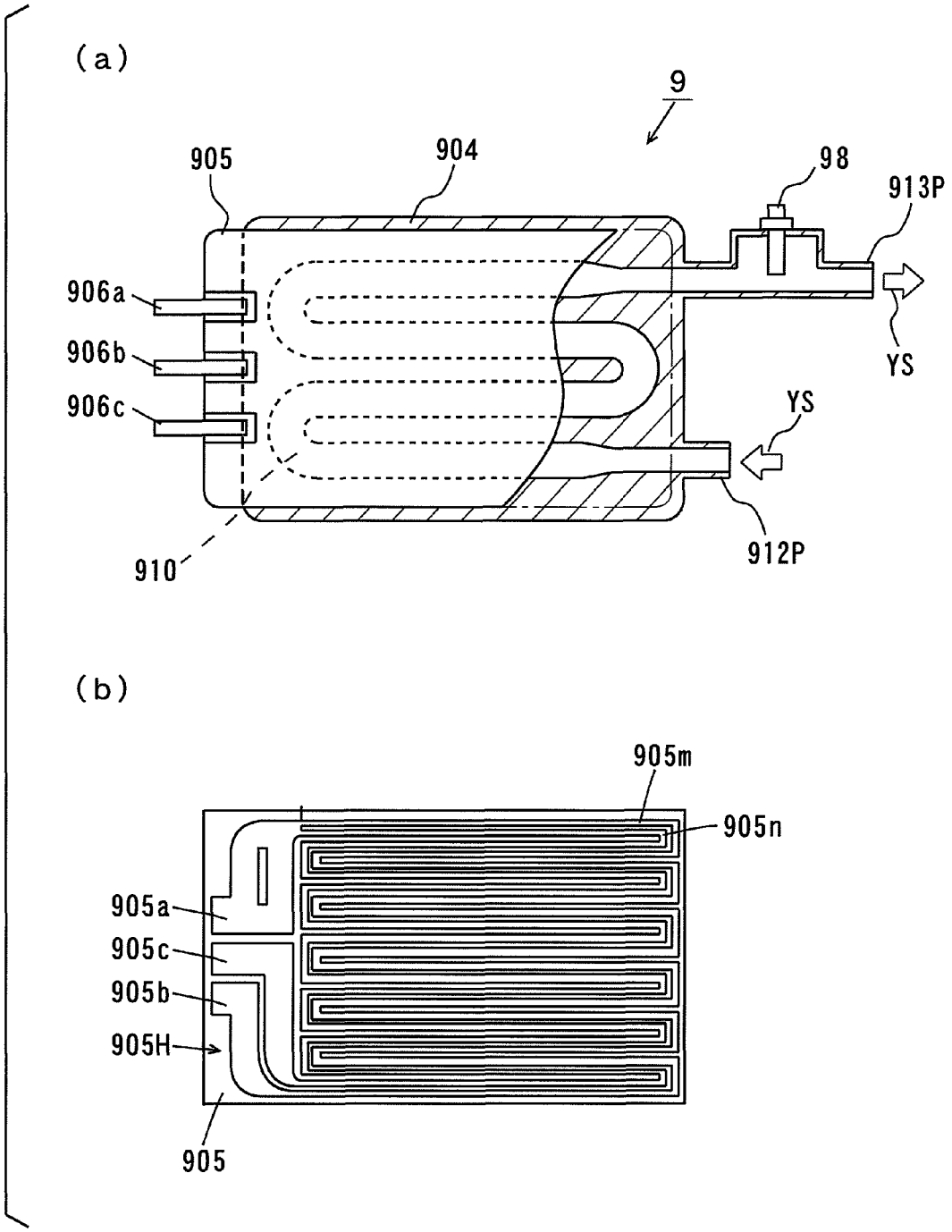
FIG. 62 is a diagram showing another example of the heat exchanger of FIG. 3.

FIG. 62 is a diagram showing another example of the heat exchanger 9 of FIG. 3. FIG. 62(*a*) shows a partially broken cross-sectional view of the heat exchanger 9 of this example.

As shown in FIG. 62(*a*), a curved, serpentine piping 910 is buried in a resin case 904. A plate-like ceramic heater 905 is provided in contact with the serpentine piping 910. As shown by arrow YS, washing water is supplied from a water supply opening 912P into the serpentine piping 910, efficiently heated by the ceramic heater 905 while flowing in the serpentine piping 910, and discharged from a discharge opening 913P.

The controller 90 of FIG. 3 applies feedback control to the temperature of the ceramic heater 905 of the heat exchanger 9 on the basis of the measured value of temperature given from the exit water temperature sensor 98.

Three power-supply terminals 906*a*, 906*b* and 906*c* are connected to the ceramic heater 905.

FIG. 62(*b*) illustrates the heater pattern of the ceramic heater 905. As shown in FIG. 62(*b*), in this heater pattern 905H, two branch wirings 905*m* and 906*n* branch off from a first terminal 905*a* and extend in a serpentine fashion.

Then, the ends of the branch wirings 905*m* and 906*n* form a second terminal 905*b* and a third terminal 905*c*, respectively.

Then, the branch wiring 905*m* generates heat when current is passed between the first terminal 905*a* and the second terminal 905*b*. Also, the branch wiring 905*n* generates heat when current is passed between the first terminal 905*a* and the third terminal 905*c*.

In this way, the branch wirings 905*m* and 905*n* can be individually driven by individually passing current between the first terminal 905*a* and the second terminal 905*b* and third terminal 905*c*. Thus, a driving method similar to that for the sheathed heaters 91 and 92, as described above, can be used.

The controller 90 may control the temperature of the ceramic heater 905 by forward-forward control, or it may perform composite control in which it controls the ceramic heater 905 by forward-forward control for temperature rise, and controls the ceramic heater 905 by feedback control for normal operation.

<6> Structure of Nozzle Unit 20

Figure 63:
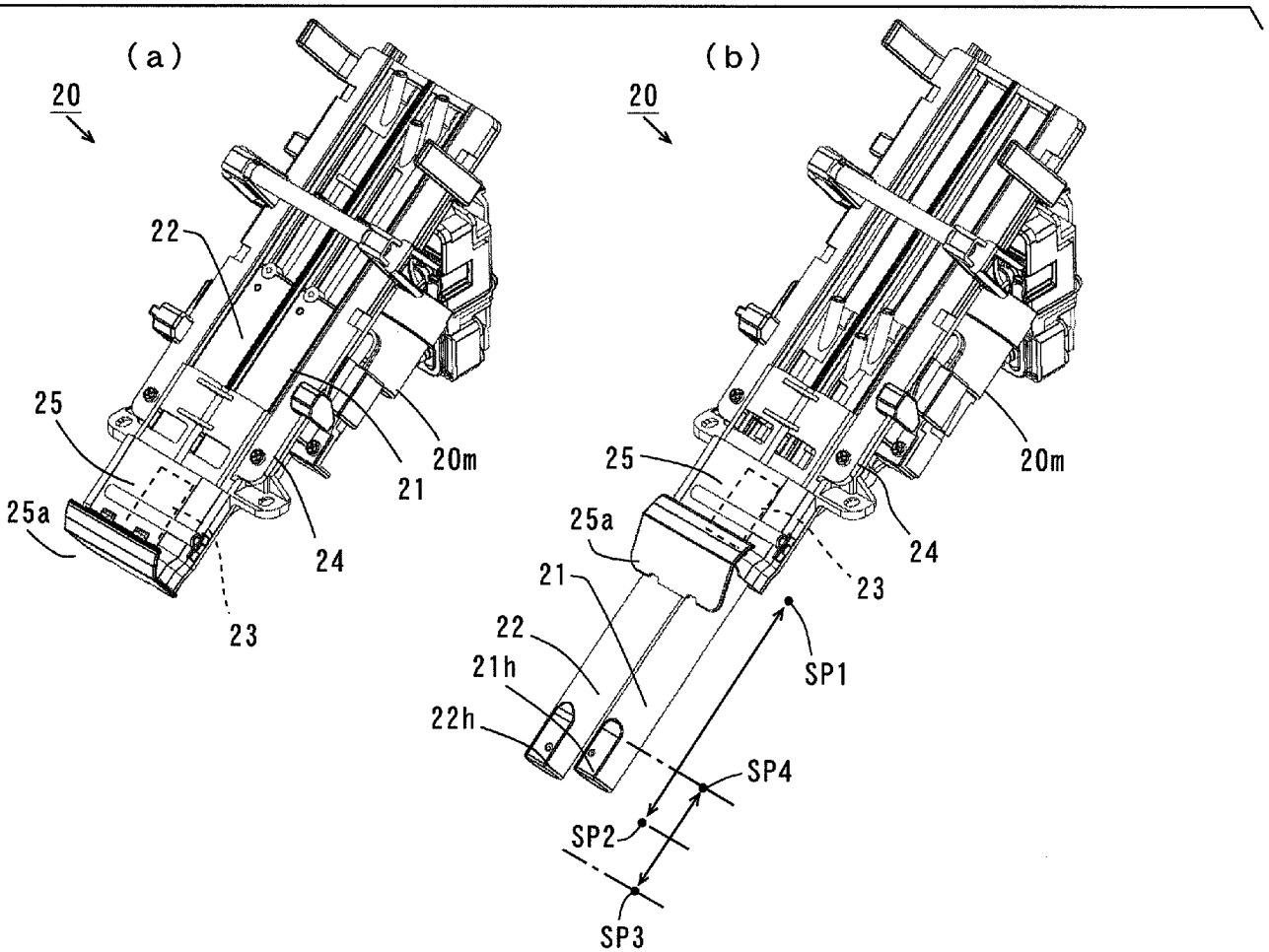
FIG. 63 shows perspective views illustrating the appearance of a nozzle unit.

FIG. 63 is a perspective view of the appearance of the nozzle unit 20.

As shown in FIG. 63(*a*), (*b*), the nozzle unit 20 includes the posterior nozzle 21, the bidet nozzle 22, and the nozzle washing nozzle 23. The posterior nozzle 21 and the bidet nozzle 22 are mounted on a nozzle guide stand 24 such that they can move forward and backward. The nozzle end accommodating section 25 is provided at the end of the nozzle guide stand 24. A nozzle accommodation cover 25*a* is attached to the end opening of the nozzle end accommodating section 25 such that it can be opened and closed.

FIG. 63(*a*) shows the posterior nozzle 21 and the bidet nozzle 22 accommodated in the nozzle guide stand 24 and the nozzle end accommodating section 25, and FIG. 63(*b*) shows the posterior nozzle 21 and the bidet nozzle 22 projecting from the nozzle end accommodating section 25.

The position of the posterior nozzle 21 where the end of the posterior nozzle 21 is in the position of the end of the nozzle end accommodating section 25 is referred to as a nozzle accommodated position SP1, and the position of the posterior nozzle 21 where the end of the posterior nozzle 21 projects for a given length from the end of the nozzle end accommodating section 25 is referred to as a standard washing position SP2. Also, the position of the posterior nozzle 21 where the end of the posterior nozzle 21 is located a given length forward from the standard washing position SP2 is referred to as a forward washing position SP3, and the position of the posterior nozzle 21 where the end of the posterior nozzle 21 is located a given length backward from the standard washing position SP2 is referred to as a backward washing position SP4.

The standard washing position, the forward washing position, and the backward washing position of the bidet nozzle 22 are located forward for given lengths from the standard washing position, the forward washing position, and the backward washing position of the posterior nozzle 21.

When washing the posterior, the posterior nozzle 21 moves between the nozzle accommodated position SP1, the backward washing position SP4, the standard washing position SP2, and the forward washing position SP3 as the nozzle driving motor 20*m* rotates. In the same way, for bidet washing, the bidet nozzle 22 moves between the nozzle accommodated position, the backward washing position, the standard washing position, and the forward washing position as the nozzle driving motor 20*m* rotates.

<7> Structure and Layout of Main Body (7-a) Internal Structure and Casing of Main Body 200

Figure 64:
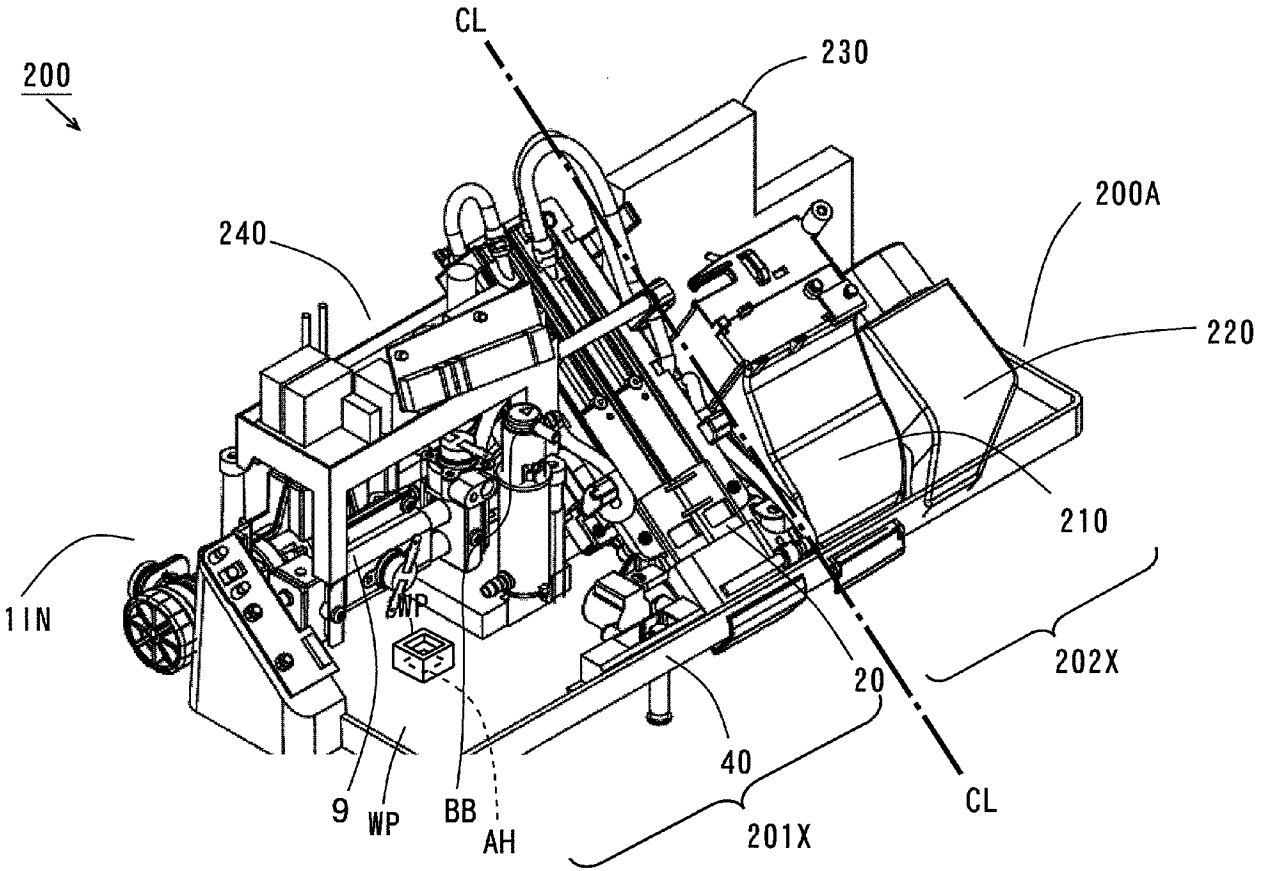
FIG. 64 is a perspective view showing the appearance to illustrate the internal structure of the main body of FIG. 1.
Figure 65:
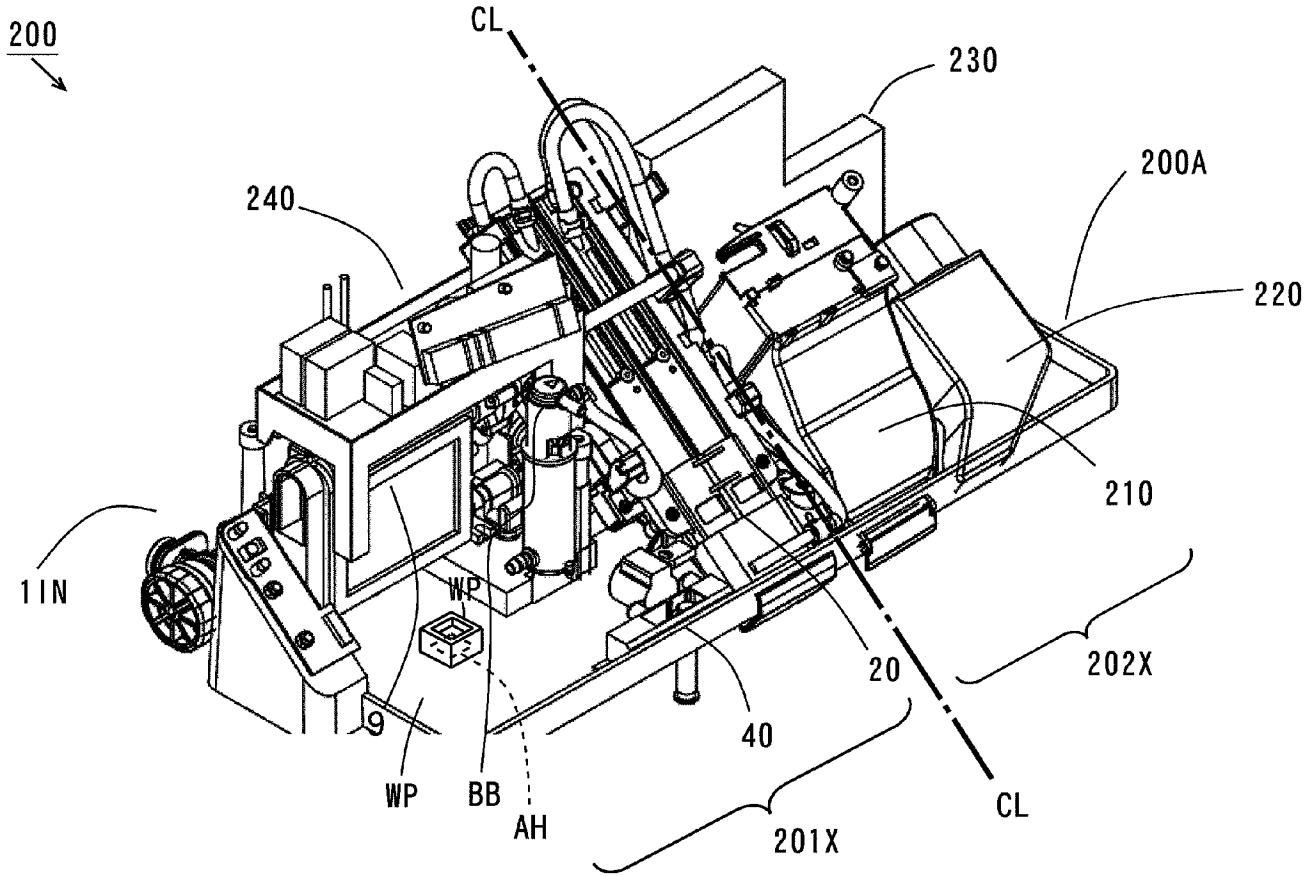
FIG. 65 is a perspective view showing the appearance to illustrate the internal structure of the main body of FIG. 1.

FIGS. 64 and 65 are perspective views showing the appearance of the main body 200 of FIG. 1 to illustrate its internal structure. FIG. 64 shows an example of the main body 200 having a heat exchanger 9 using sheathed heaters, and FIG. 65 shows an example of the main body 200 having a heat exchanger 9 using the ceramic heater of FIG. 65.

As shown in FIGS. 64 and 65, the main body 200 has a lower main body casing 200A. The lower main body casing 200A is formed by mixing polypropylene material (20%) and reworked material (80%). This contributes to environmental protection. In this case, using reworked material raises no design problem since the lower main body casing 200A is not seen by the user.

As shown by one-dot chain line CL, the lower main body casing 200A can be sectioned into a first main body region 201X and a second main body region 202X.

In the first main body region 201X, a water supply connection section 11N in which washing water flows, the heat exchanger 9, the nozzle unit 20, and the toilet nozzle 40 are provided, and a vacuum breaker BB is also provided. The nozzle unit 20 is inserted in an opening formed in the lower main body casing 200A. The opening is positioned above the bowl surface of the toilet 700. Accordingly, even if water leaks in the main body 200, the leaking water falls down into the toilet 700 through the opening. This prevents leakage water from wetting the floor of the lavatory.

Also, a board case 240 is attached on the back of the first main body region 201X. The board case 240 will be described in detail later.

In the second main body region 202X, a dryer unit 210, a deodorizing unit 220, and a printed board 230 are provided.

In this way, components related to water are arranged in the first main body region 201X, and components related to air blow are arranged in the second main body region 202X. Thus, the water-related components can share water leakage measures, and the air-related components can share dust measures. This enhances the reliability and facilitates the assembly.

Waterproofing wall WP is formed along the perimeters of the lower main body casing 200A, especially along the perimeters of the first main body region 201X. Also, a hole AH may be formed in the lower main body casing 200A to allow the attachment of the main body 200 to the toilet 700, for example. In this case, waterproofing wall WP is also formed to surround the hole AH. Accordingly, even when water leaks in water-related components, the leaking water is prevented from flowing out of the main body 200.

Figure 66:
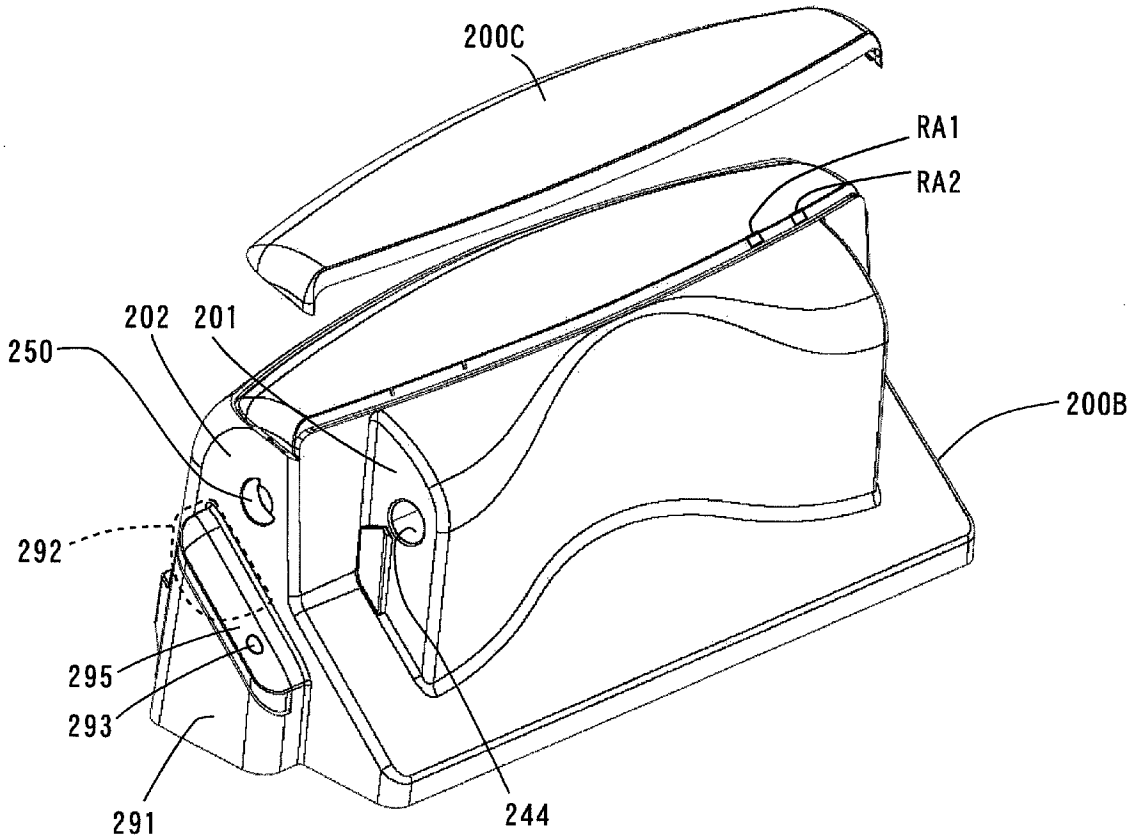
FIG. 66 is a diagram illustrating an upper main body casing of the main body of FIG. 1.

FIG. 66 is a diagram illustrating an upper main body casing of the main body 200 of FIG. 1.

As shown in FIG. 66, the upper main body casing 200B is made of polypropylene. An acrylic decorative panel 200C is attached by hot-melt resin to the upper surface of the upper main body casing 200B. This realizes beautiful appearance and enhances the design.

The upper main body casing 200B has an inner side 201 and an outer side 202 on each side. A toilet seat connector 244 is formed on the inner side 201, and a lid connector 250 is formed on the outer side 202. A toilet seat temperature adjustment lamp RA1 and a disinfection lamp RA2 are provided in the upper part of the upper main body casing 200B.

The toilet seat temperature adjustment lamp RA1 is off when a toilet seat heater 450, described later, is off, it illuminates in green when the toilet seat heater 450 is in a heating standby state, and it changes from flashing to illuminating in orange when the toilet seat heater 450 heats. This allows the user to recognize the present state of the toilet seat heater 450, improving usability.

Also, the disinfection lamp RA2 is off when disinfection operation is off, flashes in blue during disinfection operation, and illuminates in blue in a disinfection standby state. This offers piece in mind to the user. Also, the user can recognize disinfection operation in progress, without mistaking the automatic operation for a failure.

Also, a sleeve 291 is provided on the side of the upper main body casing 200B. A main body operating section 295 is provided on the inclined upper surface of the sleeve 291. Part of the main body operating section 295 serves as a lid stopper 292. The main body operating section 295 has an infrared-ray receiver and electric leakage breaker test button 293. The infrared-ray receiver and electric leakage breaker test button 293 receives infrared signals from the remote controller 300 and sends various kinds of operation signals to the controller 90 on the basis of the infrared signals.

In this case, since an infrared-ray receiver and an electric leakage breaker test button are provided as one, the main body operating section 295 is sized smaller and provides improved recognizability and operability.

The upper main body casing 200B is attached to the lower main body casing 200A shown in FIGS. 64 and 65.

Figure 66A:
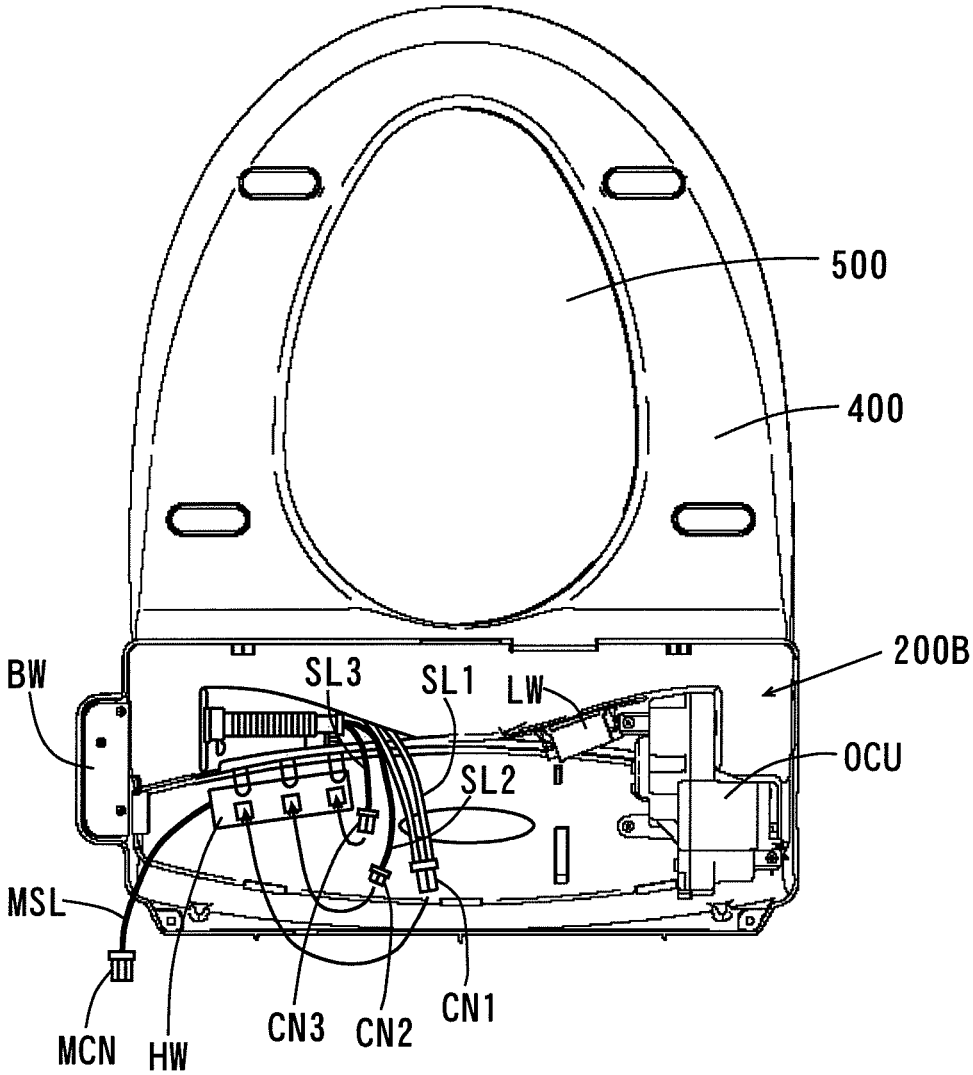
FIG. 66A is a diagram illustrating the upper main body casing seen from below.

FIG. 66A is a view of the upper main body casing 200B seen from below. As shown in FIG. 66A, the toilet seat 400 and the lid 500 are attached to the upper main body casing 200B. Also, an electric open/close unit OCU for opening/closing the toilet seat 400 and the lid 500 is attached in the upper main body casing 200B.

Also, a lamp board LW, a button board BW, and a harness gathering board HW are provided in the upper main body casing 200B. The toilet seat temperature adjustment lamp RA1 and the disinfection lamp RA2 of FIG. 66 are connected to the lamp board LW, and the infrared-ray receiver and electric leakage breaker test button 293 is connected to the button board BW.

Signal lines SL1, SL2 and SL3 are connected respectively to the electric open/close unit OCU, the lamp board LW and the button board BW. The three signal lines SL1, SL2 and SL3 are drawn out from inside the upper main body casing 200B near the harness gathering board HW.

Connectors CN1, CN2 and CN3 are attached respectively to the ends of the signal lines SL1, SL2 and SL3. As shown by arrows, the connectors CN1, CN2 and CN3 are all connected to the harness gathering board HW.

One main signal line MSL is connected to the harness gathering board HW. The main signal line MSL is a bundle of a plurality of signal lines corresponding to the above-mentioned signal lines SL1, SL2 and SL3.

A main connector MCN is attached to the end of the main signal line MSL. The main connector MCN is connected to the printed board 230 provided in the lower main body casing 200A.

In this way, the plurality of signal lines SL1, SL2 and SL3 extending from the electric open/close unit OCU, the lamp board LW and the button board BW in the upper main body casing 200B are tied together by the harness gathering board HW.

This eliminates the need to separately connect the plurality of signal lines SL1, SL2 and SL3 from the upper main body casing 200B to the printed board 230. This improves the workability of assembly of the main body 200. This prevents inferior connection (inferior insertion) between the connectors CN1, CN2 and CN3 and the printed board 230. This significantly improves the reliability of the main body 200.

In this example, the plurality of signal lines SL1, SL2 and SL3 extending from the upper main body casing 200B are tied together into the single main signal line MSL, but two main signal lines MSL may be provided according to the magnitudes of signals passing through the individual signal lines, for example.

(7-b) Appearance of Main Body 200

Figure 67:
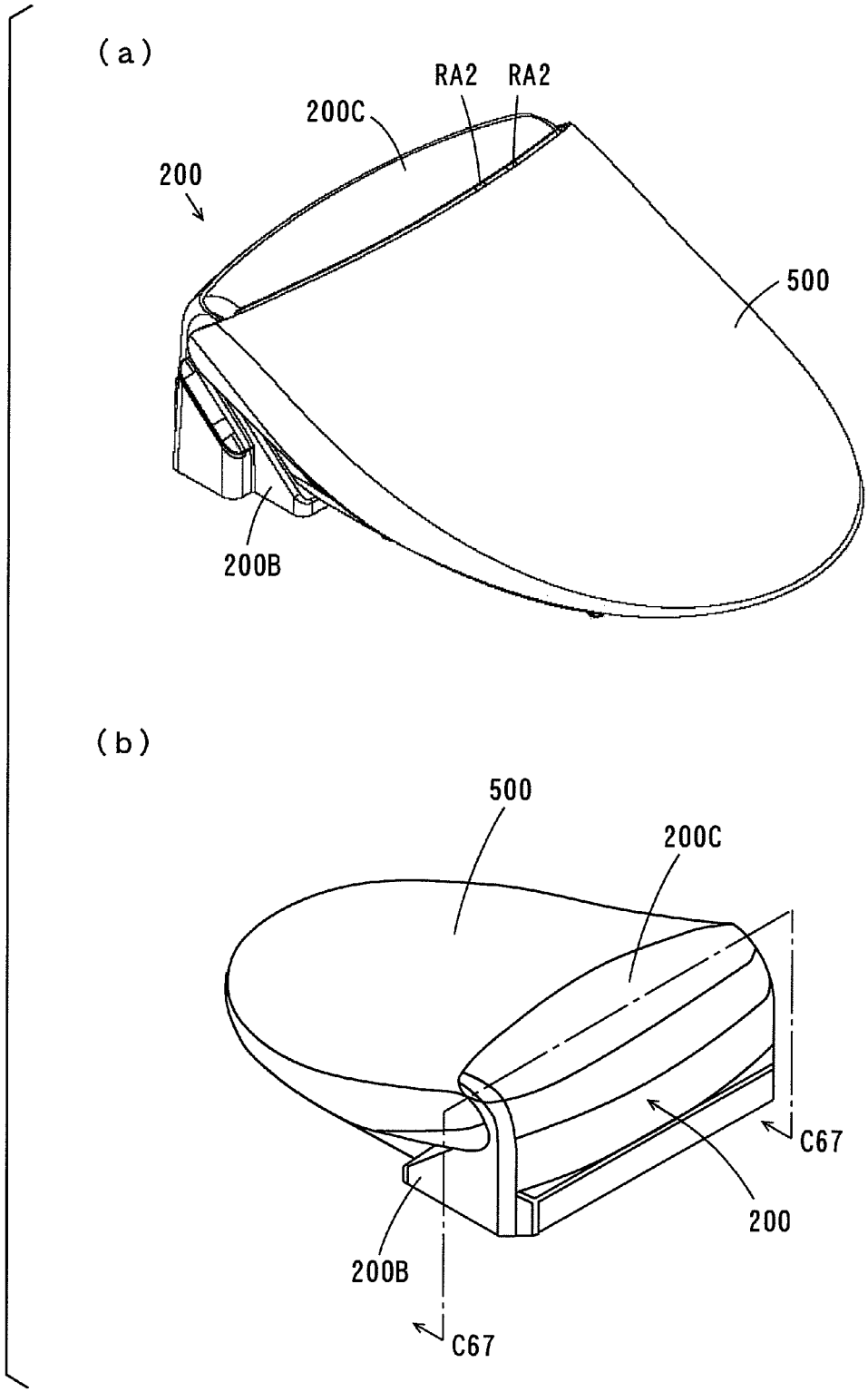
FIG. 67 shows perspective views illustrating the appearance of the main body to which a toilet seat and lid are attached.
Figure 68:
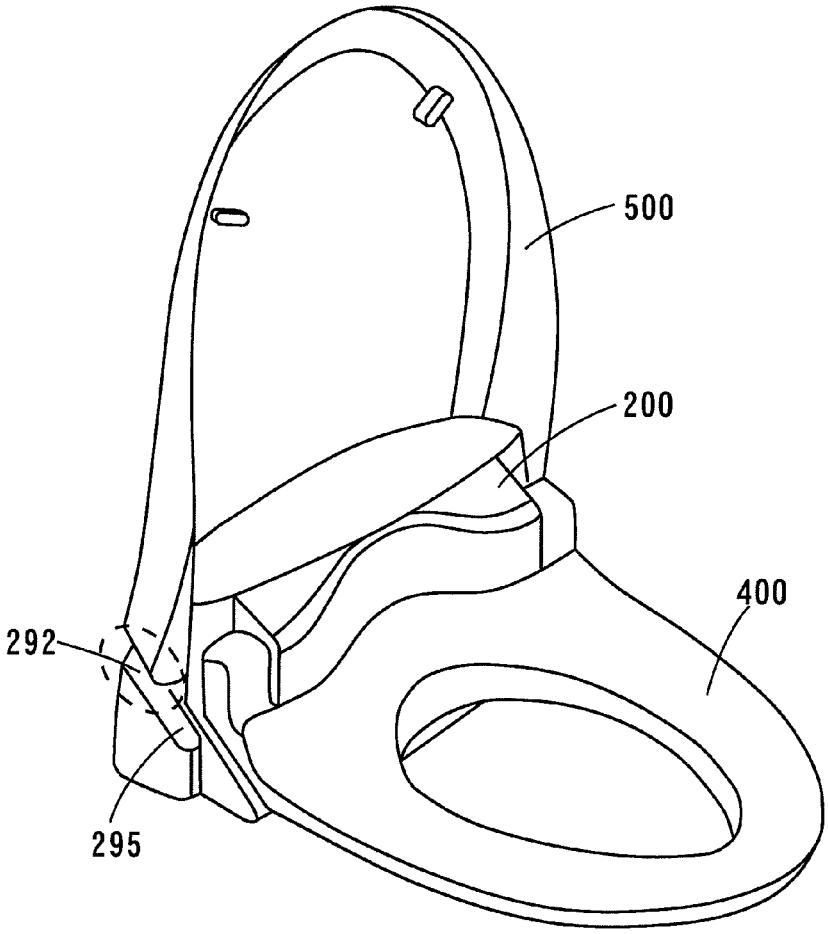
FIG. 68 is a perspective view illustrating the appearance of the main body to which the toilet seat and lid are attached.

FIGS. 67 and 68 are perspective views showing the appearance of the main body 200 to which the toilet seat 400 and the lid 500 are attached. FIG. 67(*a*), (*b*) shows the lid 500 closed, and FIG. 68 shows the lid 500 opened.

As shown in FIG. 67, the lid 500 is attached to the lid connectors 250 (see FIG. 66) of the upper main body casing 200B such that it can turn. Also, as shown in FIG. 68, the toilet seat 400 is attached to the toilet seat connectors 244 (see FIG. 66) of the upper main body casing 200B such that it can turn.

In this case, part of the main body operating section 295 of the main body 200 serves as the lid stopper 292, to hinder the lid 500 from opening over a given angle. A water vessel for discharging water from the toilet 700 after evacuation, called a low tank, may be installed behind the main body 200. The lid stopper 292 prevents the lid 500 from opening over a specified angle so as to prevent the lid 500 from hitting the low tank and making a sound. In this way, the main body operating section 295 serves also as the lid stopper 292, eliminating the need to separately provide a lid stopper. This facilitates the cleaning of the main body 200, so that the main body 200 can be kept in sanitary conditions. Also, since the main body operating section 295 is inclined, it offers good recognizability and operability from the user sitting on the toilet seat 400, and also offers good looking.

Figure 69:
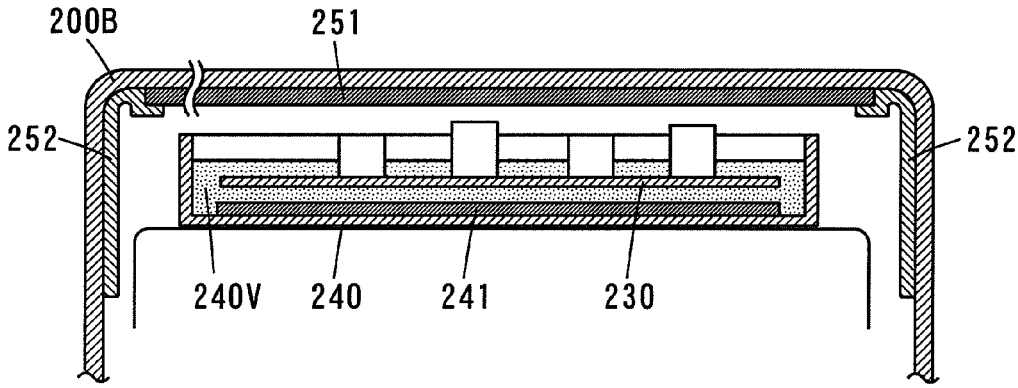
FIG. 69 is a vertical cross-sectional view taken along line J-J in FIG. 67(*b*).

FIG. 69 is a vertical cross-sectional view taken along line C67-C67 in FIG. 67(*b*). The board case 240 is provided in the upper main body casing 200B. An incombustible mica plate 241 is placed at the bottom of the board case 240, and the printed board 230 is placed over the mica plate 241 at a given interval. The mica plate 241 and the printed board 230 are sealed with resin 240V.

Also, an incombustible mica plate 251 is placed on the upper inner surface of the upper main body casing 200B and bonded by incombustible glass tape 252.

In this way, the printed board 230 is surrounded by the incombustible mica plates 241, 251 and the incombustible glass tape 252, so that the safety of the printed board 230 is sufficiently ensured.

<8> Toilet Seat Apparatus (8-a) Configuration of Toilet Seat Apparatus

Figure 70:
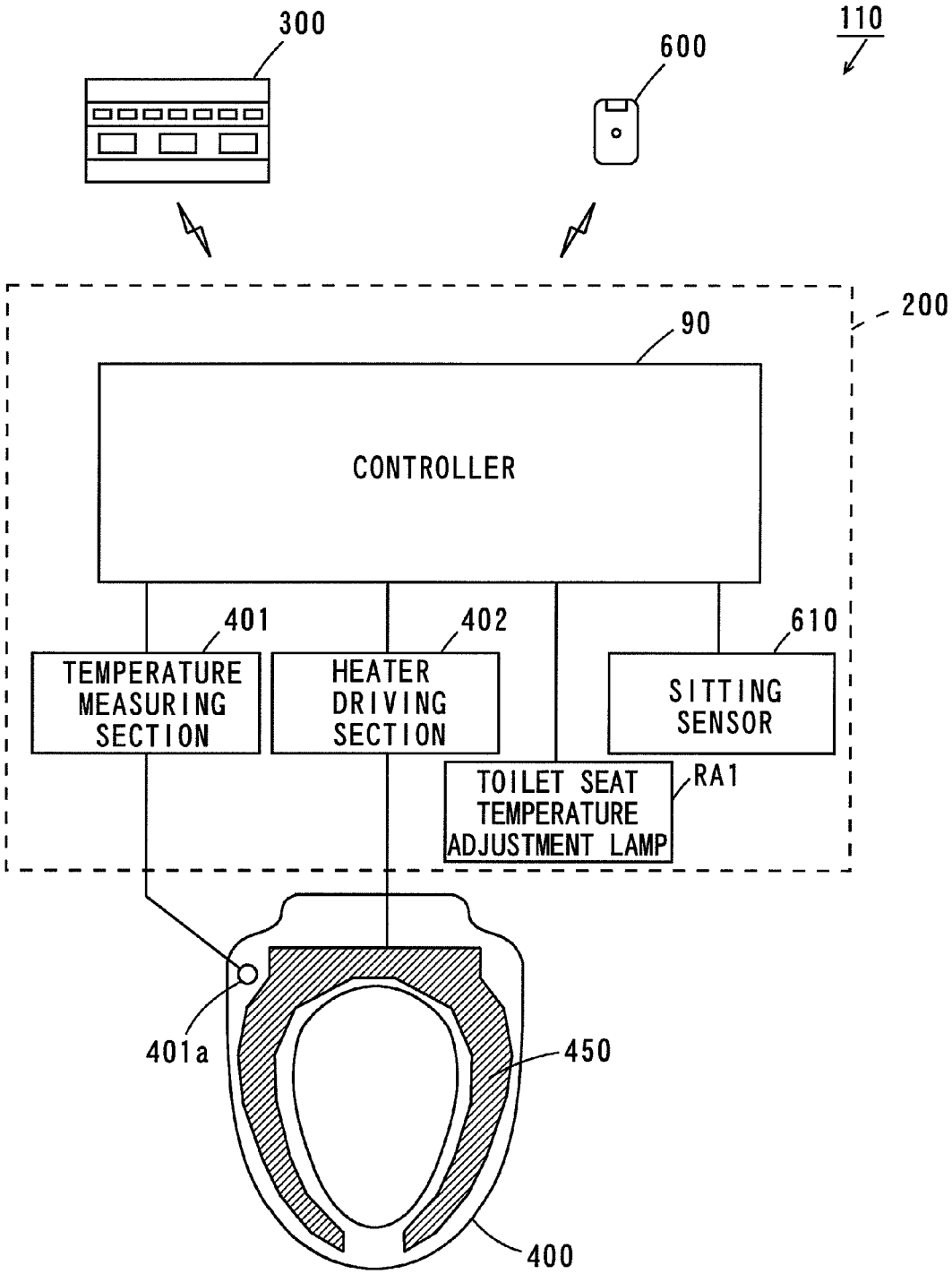
FIG. 70 is a schematic diagram illustrating the configuration of the toilet seat apparatus.

FIG. 70 is a schematic diagram illustrating the configuration of the toilet seat apparatus 110. As described above, the toilet seat apparatus 110 includes the main body 200, the remote controller 300, the toilet seat 400, and the entrance detecting sensor 600.

As shown in FIG. 70, the main body 200 includes the controller 90, a temperature measuring section 401, a heater driving section 402, the toilet seat temperature adjustment lamp RA1, and the sitting sensor 610.

Also, the toilet seat 400 includes a toilet seat heater 450 and a thermistor 401*a*.

The controller 90 is formed of a microcomputer, for example, and it includes a determination section for checking the entrance of a user, the temperature of the toilet seat 400, etc., a timer section having a timer function, a storage for storing various information, a duty factor switching circuit for controlling the operation of the heater driving section 402, and so on.

The temperature measuring section 401 of the main body 200 is connected to the thermistor 401*a* of the toilet seat 400. Thus, the temperature measuring section 401 measures the temperature of the toilet seat 400 on the basis of a signal outputted from the thermistor 401*a*. Now, the temperature of the toilet seat 400 measured by the temperature measuring section 401 through the thermistor 401*a* is hereinafter referred to as "a measured temperature value".

The heater driving section 402 of the main body 200 is connected to the toilet seat heater 450 of the toilet seat 400. Thus, the heater driving section 402 drives the toilet seat heater 450.

In this embodiment, the toilet seat apparatus 110 operates as follows. At initialization, the controller 90 controls the heater driving section 402 so that the temperature of the toilet seat 400 is adjusted to about 18° C., for example. This temperature is referred to as "a standby temperature".

Now, when a user operates the toilet seat temperature adjustment switch 333 of the remote controller 300, the toilet seat setting temperature is sent to the controller 90. The controller 90 stores in the storage the toilet seat setting temperature received from the remote controller 300.

When a user enters the lavatory, the entrance detecting sensor 600 detects the entrance of the user. Then, a user entrance detect signal is sent to the controller 90.

Next, the operations in normal use will be described. The determination section of the controller 90 detects the entrance of the user into the lavatory with the entrance detect signal from the entrance detecting sensor 600. Then, the determination section selects a particular heater control pattern about the driving of the toilet seat heater 450 on the basis of the measured temperature value of the toilet seat 400 and the toilet seat setting temperature stored in the storage.

The duty factor switching circuit controls the operation of the heater driving section 402 on the basis of the selected heater control pattern and time information obtained from the timer section.

Then, the toilet seat heater 450 is driven by the heater driving section 402, and the temperature of the toilet seat 400 is instantly raised to the toilet seat setting temperature.

(8-b) First Example of Toilet Seat 400

Figure 71:
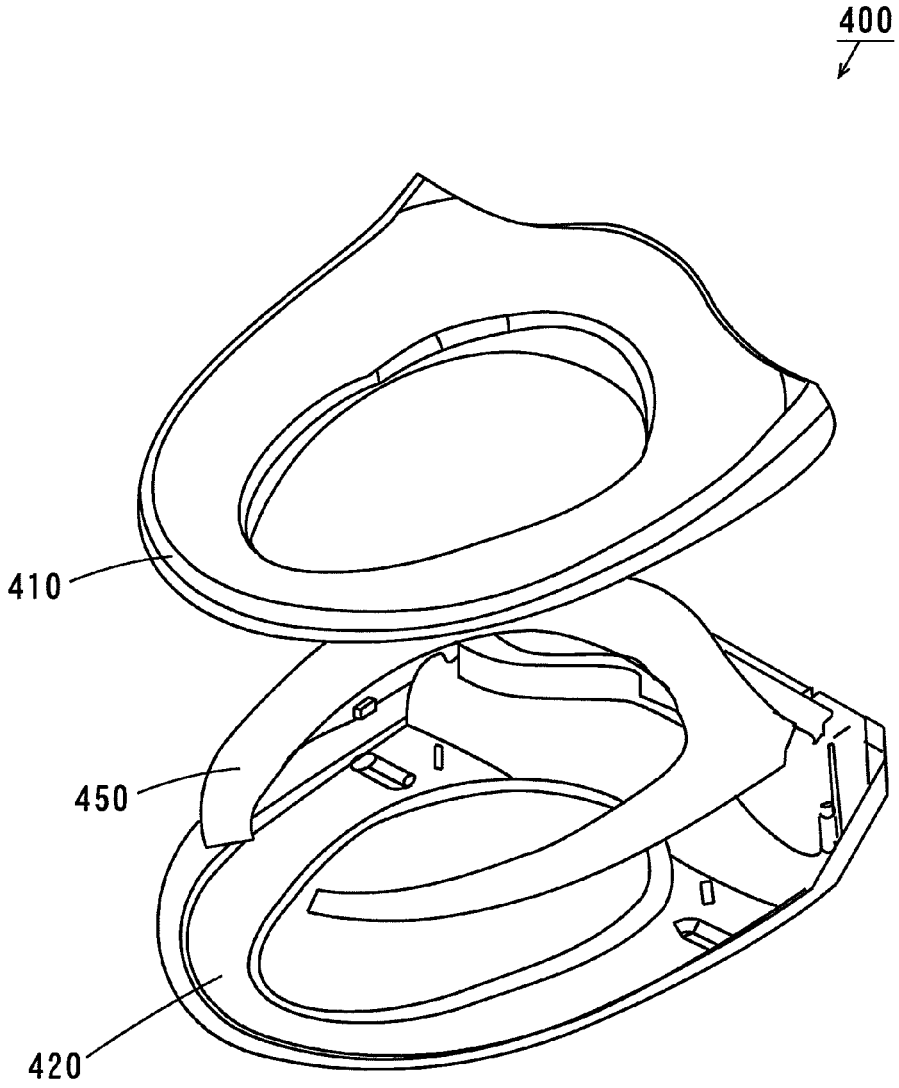
FIG. 71 is an exploded perspective view of the toilet seat.
Figure 72:
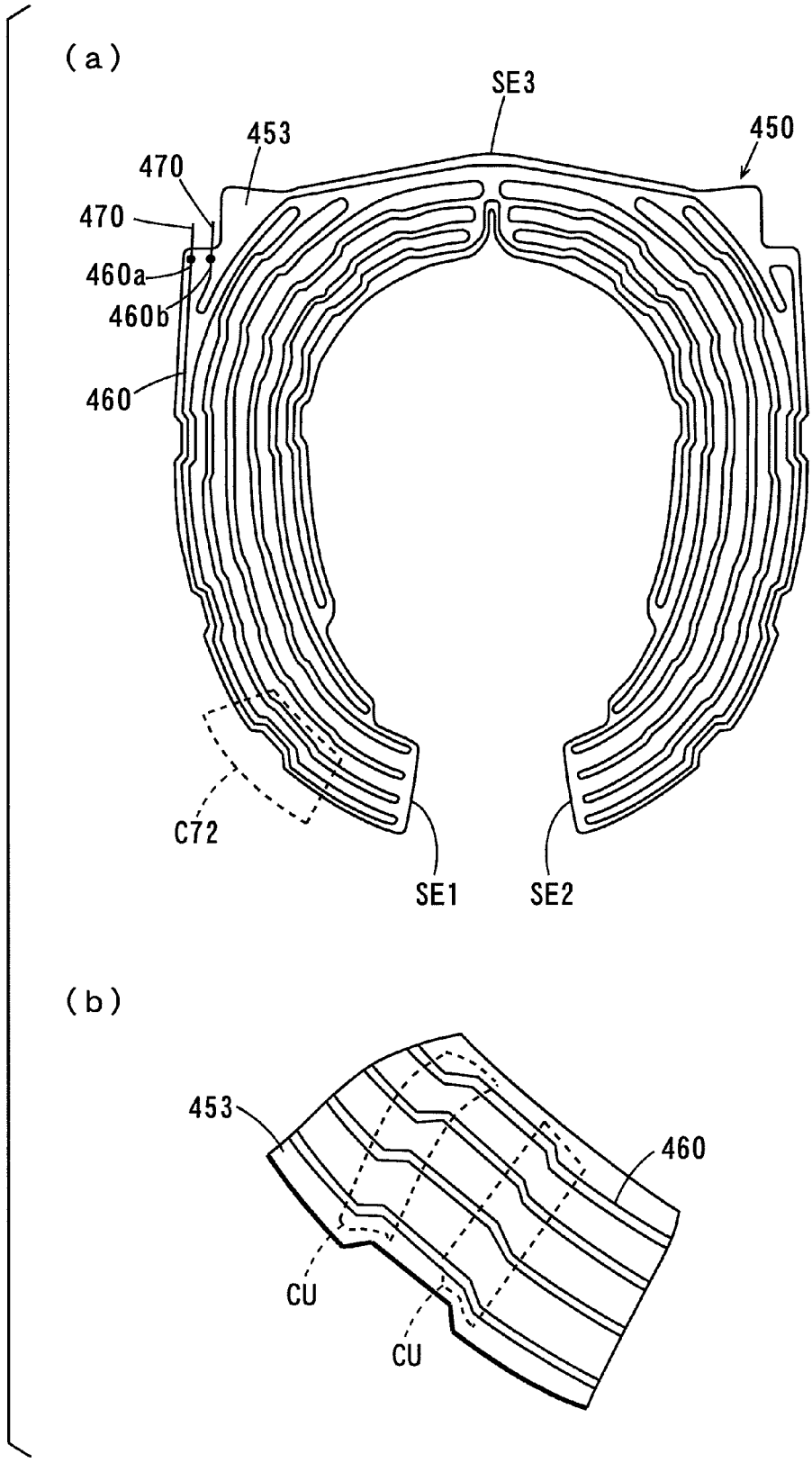
FIG. 72(*a*) is a plan view of a toilet seat heater of a toilet seat of a first example, and (b) is an enlarged view of a part of (a).
Figure 73:
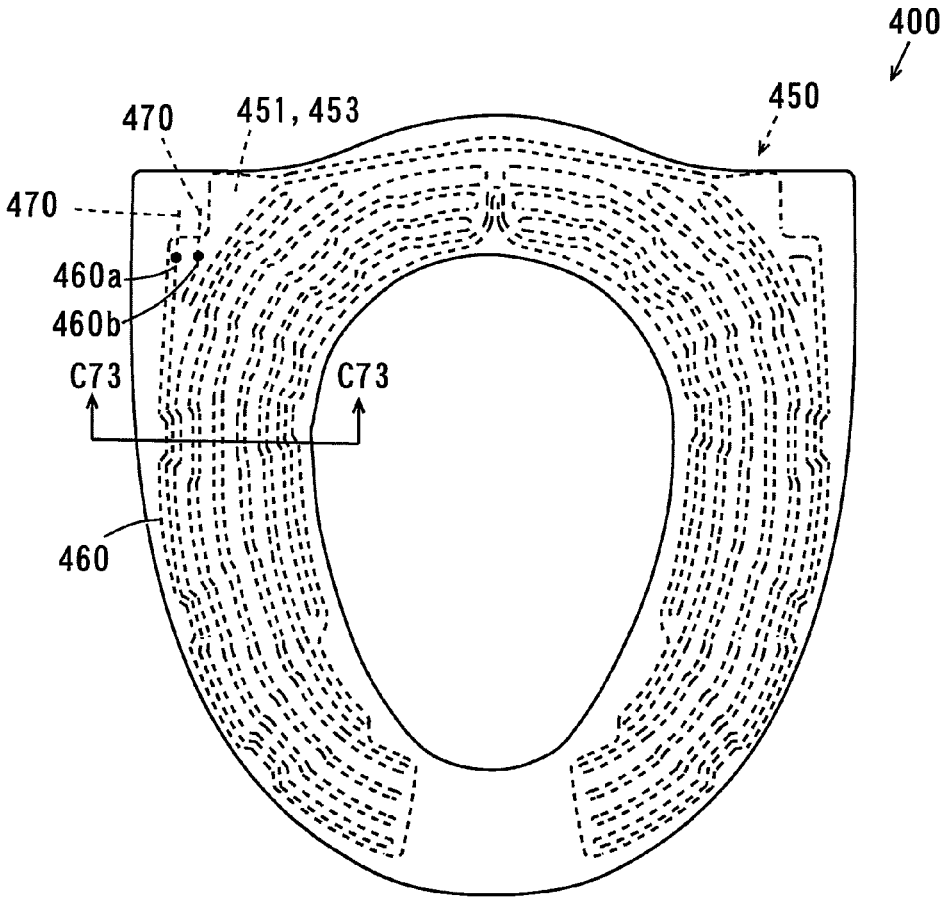
FIG. 73 is a plan view of the toilet seat of the first example.
Figure 74:
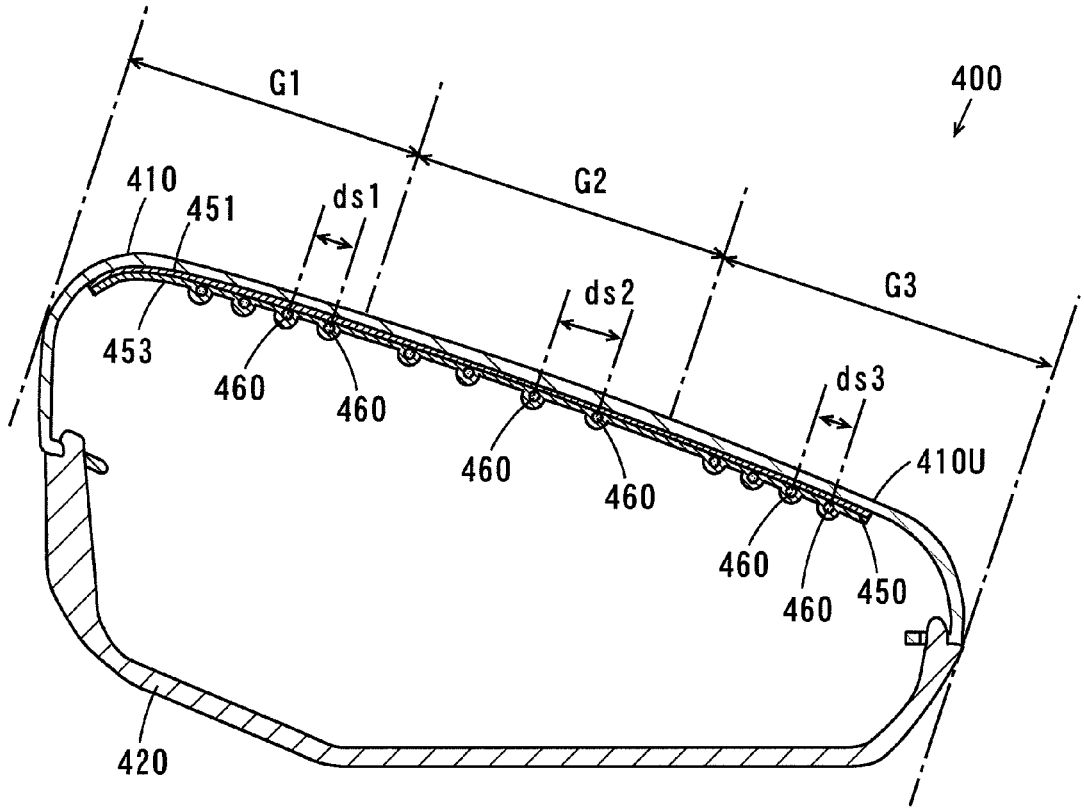
FIG. 74 is a cross-sectional view taken along line C73-C73 of the toilet seat of FIG. 73.

FIG. 71 is an exploded perspective view of the toilet seat 400. FIG. 72(*a*) is a plan view of a toilet seat heater 450 of a toilet seat 400 of a first example, and FIG. 72(*b*) is an enlarged view of the area C72 of FIG. 72(*a*). FIG. 73 is a plan view of the toilet seat 400 of the first example. FIG. 74 is a cross-sectional view taken along line C73-C73 of the toilet seat 400 of FIG. 73.

As shown in FIG. 71, the toilet seat 400 includes an approximately oval-shaped upper toilet seat casing 410 mainly made of aluminum, an approximately horseshoe-shaped toilet seat heater 450, and an approximately oval-shaped lower toilet seat casing 420 made of synthetic resin.

Now, the front side seen from a user sitting on the seat is referred to as the front of the toilet seat 400, and the rear side seen from the user sitting on the seat is referred to as the rear of the toilet seat 400.

As shown in FIG. 72(*a*) and FIG. 73, the toilet seat heater 450 is approximately horseshoe-shaped with its front portion removed. The toilet seat heater 450 may be approximately oval-shaped. The toilet seat heater 450 includes metal foils 451 and 453 made of aluminum, for example, and a linear heater 460.

The linear heater 460 is arranged in a serpentine form in correspondence with the shape of the upper toilet seat casing 410, in the area from the seat center SE3 to the one seat end SE1, and in the area from the seat center SE3 to the other seat end SE2.

Specifically, the linear heater 460 is shaped to form about six U-shaped portions on each side. The U-shaped portions are arranged parallel approximately along the direction of the thighs of the user sitting on the seat. The intervals of the linear heater 460 between the U-shaped portions are about 5 mm.

The heater beginning 460*a* and the heater end 460*b* of the linear heater 460 are respectively connected to lead wires 470 drawn from one side of the rear of the toilet seat 400.

Also, as shown in FIG. 72(*b*), a plurality of bent portions CU are formed as thermal stress buffer portions in the route of the serpentine linear heater 460. The necessity of the thermal stress buffer portions will be described.

As will be described later, the linear heater 460 has a structure in which a plurality of layers are formed around a heating wire 463*a* (FIG. 79) made of copper, for example. Now, the coefficient of linear expansion of copper is $16.8\times 10^{-6}/°$ C. Then, when a straight line portion of the linear heater 460 is 50 mm and the temperature of the straight portion rises by about 50 K, the heating wire 463*a* stretches by about 0.1 mm. Accurately, the heating wire 463*a* stretches from 50 mm to 50.126 mm.

Accordingly, when both ends of the straight portion of the linear heater 460 are fixed, the heating wire 463*a* distorts by about 1.5 mm. Accordingly, if the linear heater 460 is bonded linearly over a long distance between the metal foils 451 and 453, the linear heater 460 will locally bend with temperature variations. Or, the position of the linear heater 460 will be shifted.

Accordingly, in this embodiment, thermal buffer portions as shown above are formed so that the expansion and shrinkage of the linear heater 460 can be absorbed by the thermal stress buffer portions. This enhances the reliability of the linear heater 460.

Also when a foil-like (belt-like) heater is used in place of the linear heater 460, the foil-like heater expands and shrinks with temperature variations. Accordingly, also in this case, it is preferable to provide similar thermal stress buffer portions. This improves the reliability of the foil-like heater.

As shown in FIG. 74, the interval ds1 of the linear heater 460 in the region G1 along the outer side of the upper toilet seat casing 410, and the interval ds3 of the linear heater 460 in the region G3 along the inner side, are set smaller than the interval ds2 of the linear heater 460 in the center region G2 of the upper toilet seat casing 410. Thus, the linear heater 460 is arranged more densely in the region G1 along the outer side of the upper toilet seat casing 410 and the region G3 along the inner side, than in the center region G2.

(8-c) Second Example of Toilet Seat 400

Figure 75:
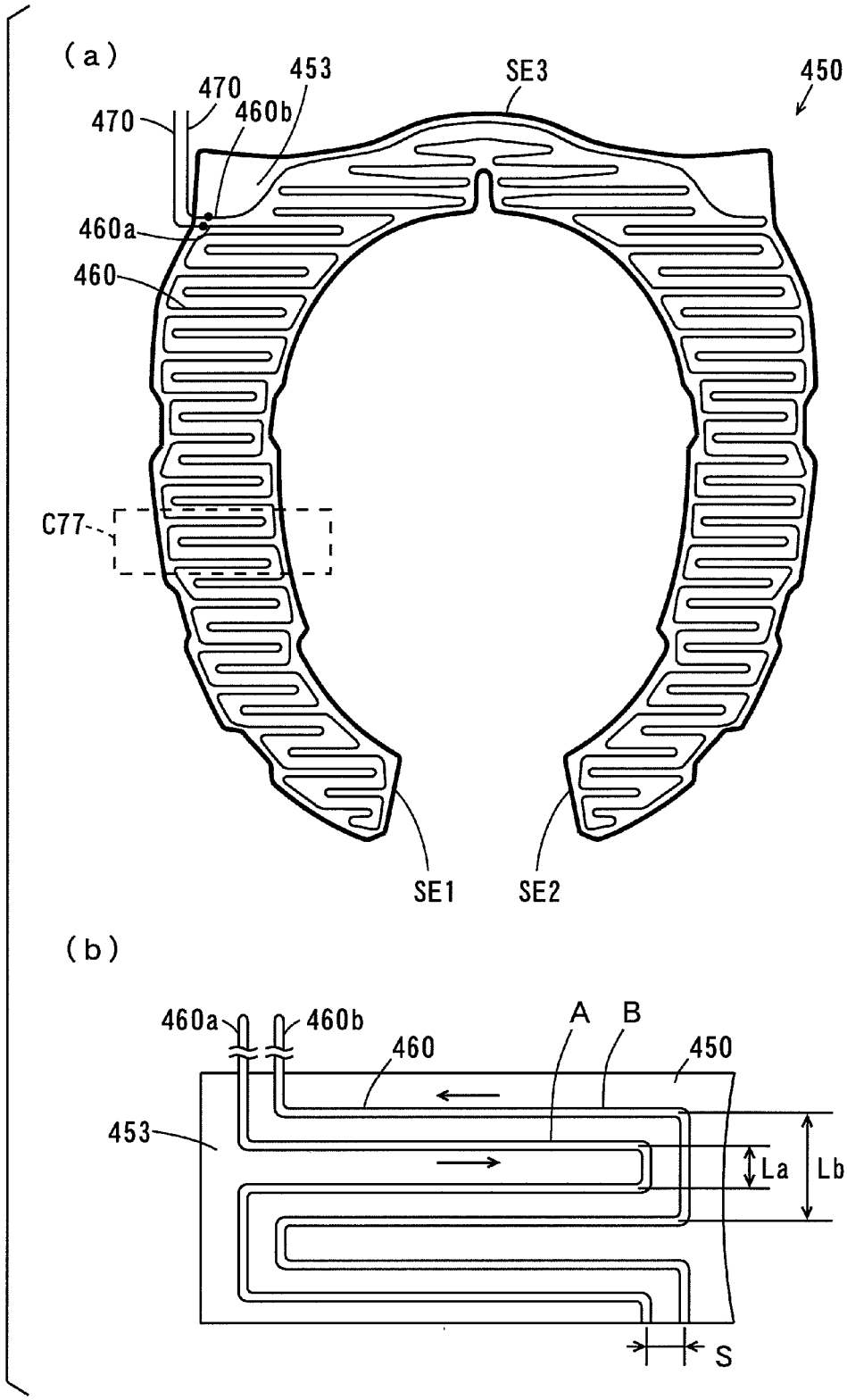
FIG. 75(*a*) is a plan view of a toilet seat heater of a toilet seat of a second example, and (b) is an enlarged view of a part of (a).
Figure 76:
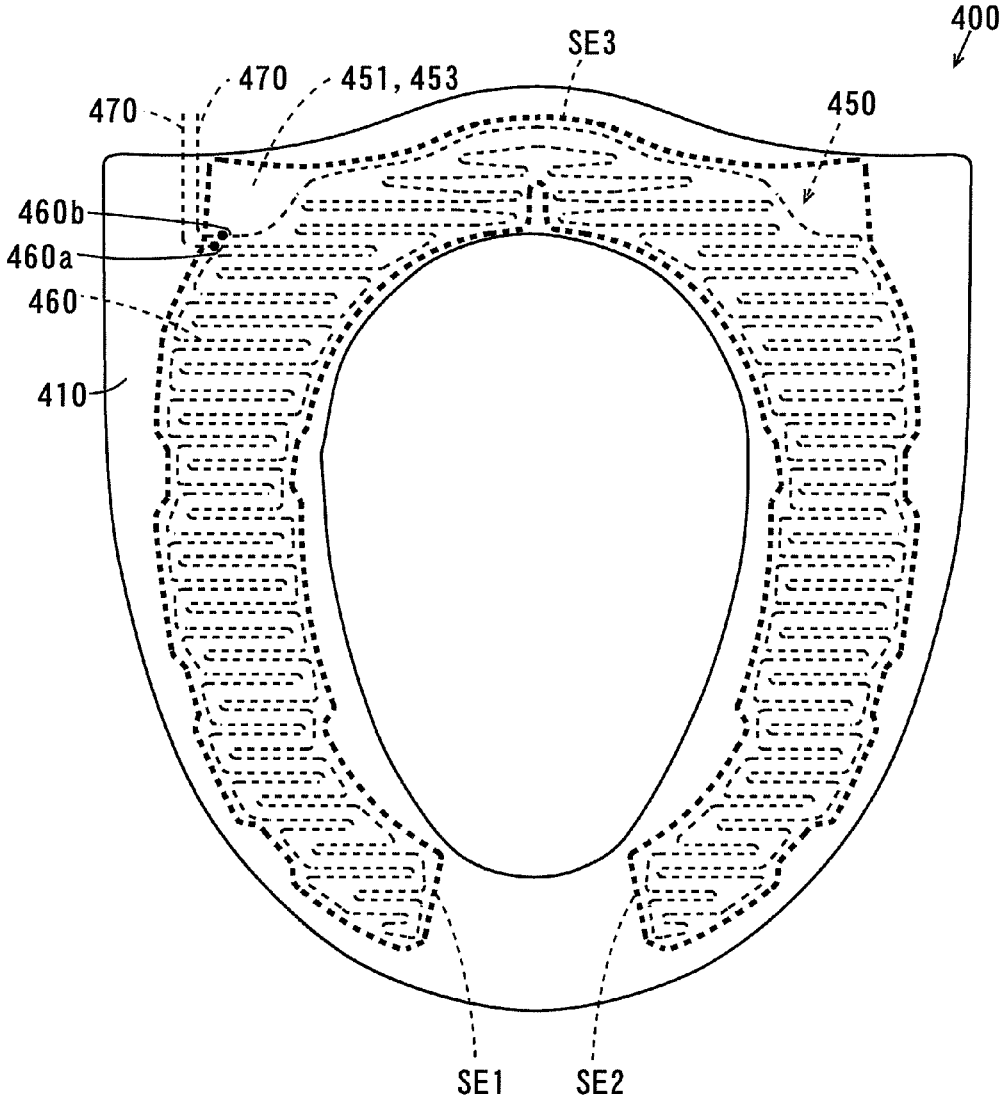
FIG. 76 is a plan view of the toilet seat of the second example.

FIG. 75(*a*) is a plan view of a toilet seat heater 450 of a toilet seat 400 according to a second example, FIG. 75(*b*) is an enlarged view of the region C77 of FIG. 75(*a*), and FIG. 76 is a plan view of the toilet seat 400 of the second example.

As shown in FIG. 75(*a*) and FIG. 76, the linear heater 460 is arranged in a serpentine form winding from side to side in correspondence with the shape of the upper toilet seat casing 410, in the region from the seat center SE3 to the one seat end SE1, and in the region from the seat center SE3 to the other seat end SE2. In this example, the linear heater 460 is arranged such that the bent portions of the serpentine form are located near the outer side and the inner side of the upper toilet seat casing 410.

Specifically, the linear heater 460 serpentinely extends from side to side from one side of the rear of the toilet seat heater 450 to a vicinity of the one seat end SE1 to form a first serpentine line A of FIG. 75(*b*). Also, the linear heater 460 serpentinely extends from side to side from the vicinity of the one seat end SE1 via a vicinity of the seat center SE3 to a vicinity of the other seat end SE2 to form a second serpentine line B. Furthermore, the linear heater 460 extends from the vicinity of the other seat end SE2 via a vicinity of the seat center SE3 to the one side of the rear of the toilet seat heater 450 to form the first serpentine line A.

As shown in FIG. 75(*b*), the first serpentine line A of the linear heater 460 and the second serpentine line B of the linear heater 460 are arranged approximately parallel. The first serpentine line A and the second serpentine line B of the linear heater 460 continue from the heater beginning 460*a* to the heater end 460*b*.

The heater beginning 460*a* and the heater end 460*b* of the linear heater 460 are respectively connected to lead wires 470 drawn from one side of the rear of the toilet seat 400.

In this example, the linear heater 460 has a serpentine shape in which the bent portions are located near the inner side and the outer side of the toilet seat heater 450. Accordingly, the intervals between the bent portions are short. Therefore, the variation of length due to thermal expansion and thermal shrinkage is small, and so the distortion due to expansion and shrinkage is absorbed and buffered in the bent portions even when the linear heater 460 expands and shrinks. As a result, stresses of the linear heater 460 due to thermal expansion and thermal shrinkage are small, and damage can be suppressed during long-term use.

Also, since the thermal expansion and shrinkage of the linear heater 460 are small, good adhesion to the metal foils 451 and 453 can be maintained for a long time. This enables effective and ensured heating of the toilet seat heater 450.

Also, as shown in FIG. 75(*b*), the lengths La and Lb of the bent portions and the interval S between the bent portions can be arbitrarily adjusted. This allows adjustment of the heating distribution of the toilet seat heater 450.

For example, the lengths La and Lb of the bent portions and the interval S between the bent portions are adjusted so that the heating density in the vicinities of the outer side and the inner side of the toilet seat heater 450 is higher than the heating density in the center part of the toilet seat heater 450. This makes it possible to maintain uniform heating temperature in the whole area of the toilet seat heater 450.

Also, in this example, the direction of current in the linear heater 460 in the first serpentine line A is opposite to the direction of current in the linear heater 460 in the second serpentine line B. Thus, the electromagnetic waves generated from the linear heater 460 cancel each other out. This prevents the occurrence of noise.

(8-d) Third Example of Toilet Seat 400

Figure 77:
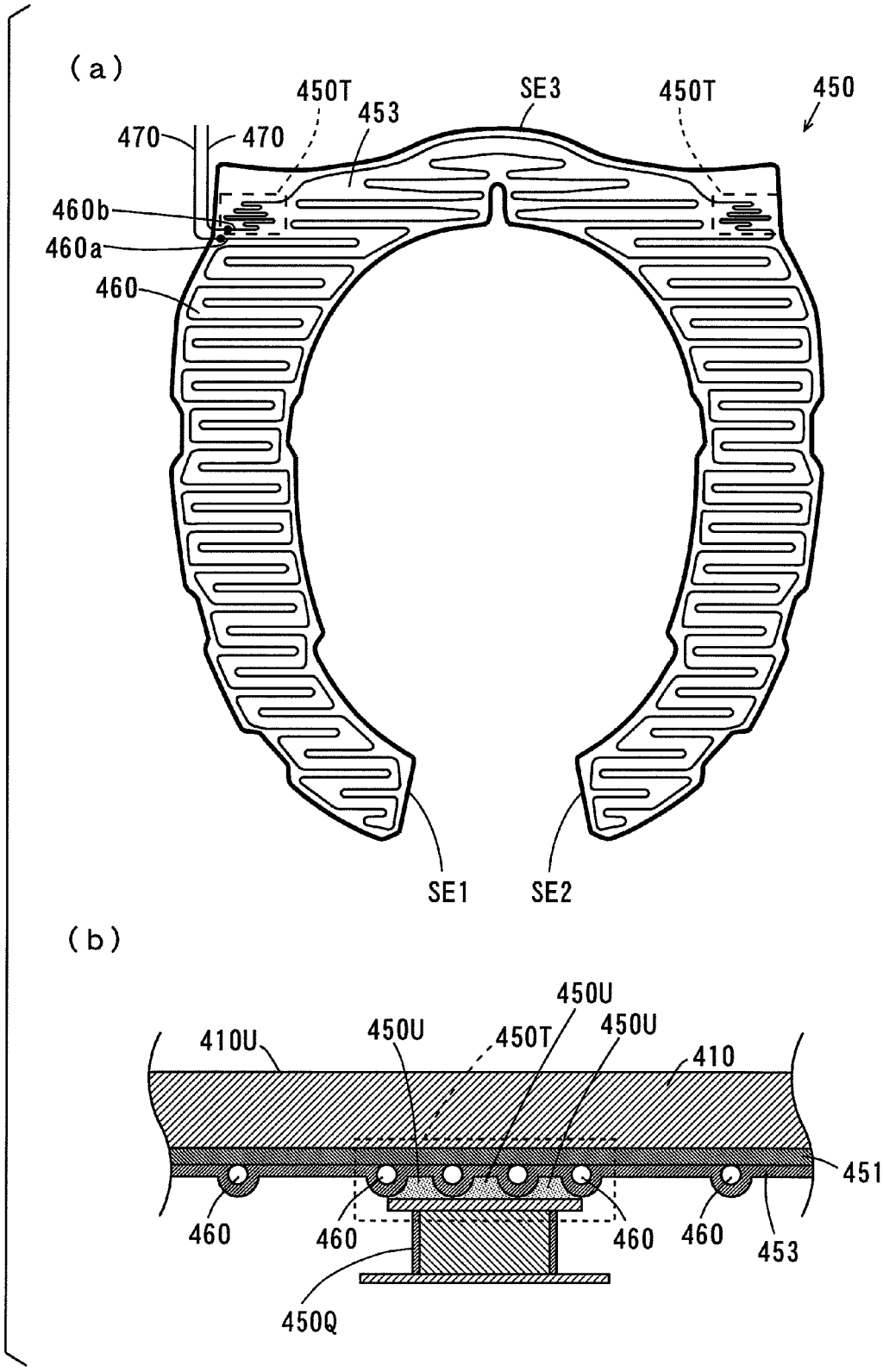
FIG. 77(*a*) is a plan view of a toilet seat heater of a toilet seat of a third example, and (b) is an enlarged cross-sectional view of a part of (a).

FIG. 77(*a*) is a plan view of a toilet seat heater 450 of a toilet seat 400 according to a third example, and FIG. 77(*b*) is an enlarged cross-sectional view of a part of FIG. 77(*a*).

As shown in FIG. 77(*a*), temperature detecting portions 450T where the linear heater 460 densely winds are formed respectively in both sides of the rear of the toilet seat heater 450. As shown in FIG. 77(*b*), a returning-type thermostat 450Q, e.g. using bimetal, is provided in one temperature detecting portion 450T. A non-returning type thermostat, e.g. using a temperature fuse, is provided in the other temperature detecting portion 450T.

For example, when the temperature of the toilet seat heater 450 becomes an unexpected abnormal temperature, the returning-type thermostat 450Q opens to temporarily stop the passage of electricity. Also, when the temperature of the toilet seat heater 450 is reaching a dangerous temperature, e.g. when the returning-type thermostat 450Q fails, the non-returning type thermostat opens to shut off the supply of power.

Now, it is preferred that the setting of operating temperature of the thermostat 450Q or the temperature fuse, for preventing over-temperature, be lower than the actually desirable shutoff temperature. The toilet seat having the structure described in this embodiment has a high temperature rise rate. Accordingly, depending on the operating speed of the safety device (for example, the thermostat 450Q or temperature fuse), the temperature of the toilet seat surface might be higher than the predetermined temperature when the passage of electricity is actually stopped. In human skin, the skin of the buttocks and thighs, which is not exposed normally, is more sensitive than the skin in other parts. Therefore, more improved safety design like this is important.

Also, another reason will be described for which the operating temperature of the safety device is desirably set lower than the actually desired shutoff temperature.

Another reason is to prevent overshoot. With the toilet seat 400 constructed as above, a temperature difference of about 100 K occurs between the linear heater 460 and the toilet seat surface when the temperature of the toilet seat surface is raised in a short time. When such a large temperature gradient exists between the linear heater 460 and the toilet seat surface, the movement of heat from the linear heater 460 to the toilet seat surface continues for a while even after the passage of electricity to the linear heater 460 is shut off.

That is to say, the heat of the linear heart 460 is continuously transferred to the toilet seat surface because the temperature of the toilet seat surface is lower than the temperature of the linear heater 460 when the heat generation of the linear heater 460 is stopped.

Accordingly, in order to prevent the temperature of the toilet seat surface from rising over desired temperature (overshoot), it is desirable to set the operating temperature of the safety device lower than the actually desired shutoff temperature.

Still another reason is to prevent the response delay due to a difference in heat capacity between the safety device and the linear heater 460 and toilet seat surface. The heat capacity of the safety device is larger than the heat capacity of the linear heater 460 and metal foils 451, 453. Accordingly, a significant response delay occurs in the safety device.

Accordingly, it is desirable to set the operating temperature of the safety device lower than the actually desirable shutoff temperature considering such a response delay of the safety device.

Now, the toilet seat 400 may be structured as shown below in order to prevent such a response delay of a safety device.

For example, in an area where the temperature monitoring surface of the safety device is in contact (the temperature detecting portion 450T above), the density of the linear heater 460 is set further higher than the density in other areas. Then, the heat density in the temperature detecting portion 450T becomes higher, and the temperature of the safety device having larger heat capacity can be raised at a rate close to that of the toilet seat surface.

Preferably, on the basis of the relation between the heat density of the temperature detecting portion 450T and the heat capacity of the safety device, the density of the linear heater 460 in the temperature detecting portion 450T is designed such that the rate of temperature rise in the temperature detecting portion 450T and the rate of temperature rise of the temperature monitoring surface of the safety device approximately coincide with each other when the temperature of the toilet seat surface is raised in a short time.

By the way, in the temperature detecting portion 450T, as shown in FIG. 77(*b*), a heat conducting material 450U is charged in the gaps formed between the irregular surface of the metal foil 453, formed due to the linear heater 460, and the temperature monitoring surface of the thermostat 450Q.

This enlarges the heat transfer route between the linear heater 460 and the temperature monitoring surface of the thermostat 450Q. Heat generated in the linear heater 460 can thus be efficiently transferred to the temperature monitoring surface of the thermostat 450Q.

This certainly reduces the difference between the actual surface temperature of the temperature detecting portion 450T and the temperature of the temperature monitoring surface of the thermostat 450Q. As a result, the accuracy of monitoring of the temperature of the linear heater 460 by the thermostat 450Q is improved and the reliability of the thermostat 450Q is significantly enhanced.

The heat conducting material 450U can be heat conductive grease, or a heat conductive sheet having elasticity, for example.

It is preferred that the temperature monitoring surface of the thermostat 450Q be made of aluminum. Aluminum has a high coefficient of thermal conductivity (237 W/m·K). Accordingly, the heat transferred from the temperature detecting portion 450T to the temperature monitoring surface can be efficiently transferred to the bimetal in the thermostat 450Q.

Also, as mentioned above, the metal foils 451 and 453 are made of aluminum, for example. In this case, when the temperature monitoring surface of the thermostat 450Q is made of aluminum, the temperature detecting portion 450T and the thermostat 450Q come in contact as the same metal.

As a result, even in a humid space like a lavatory, the occurrence of bimetallic corrosion (galvanic corrosion) is prevented in the contact between the temperature detecting portion 450T and the thermostat 450Q. This improves the reliability of the thermostat 450Q.

"Bimetallic corrosion" means corrosion that occurs when a cell is formed between different kinds of metals by electrically connecting the different kinds of metals. Accordingly, when the metal foils 451 and 453 are made of material other than aluminum, it is preferable to form the temperature monitoring surface of the thermostat 450Q also with the same material as the metal foils 451 and 453.

(8-e) Fourth Example of Toilet Seat 400

Figure 78:
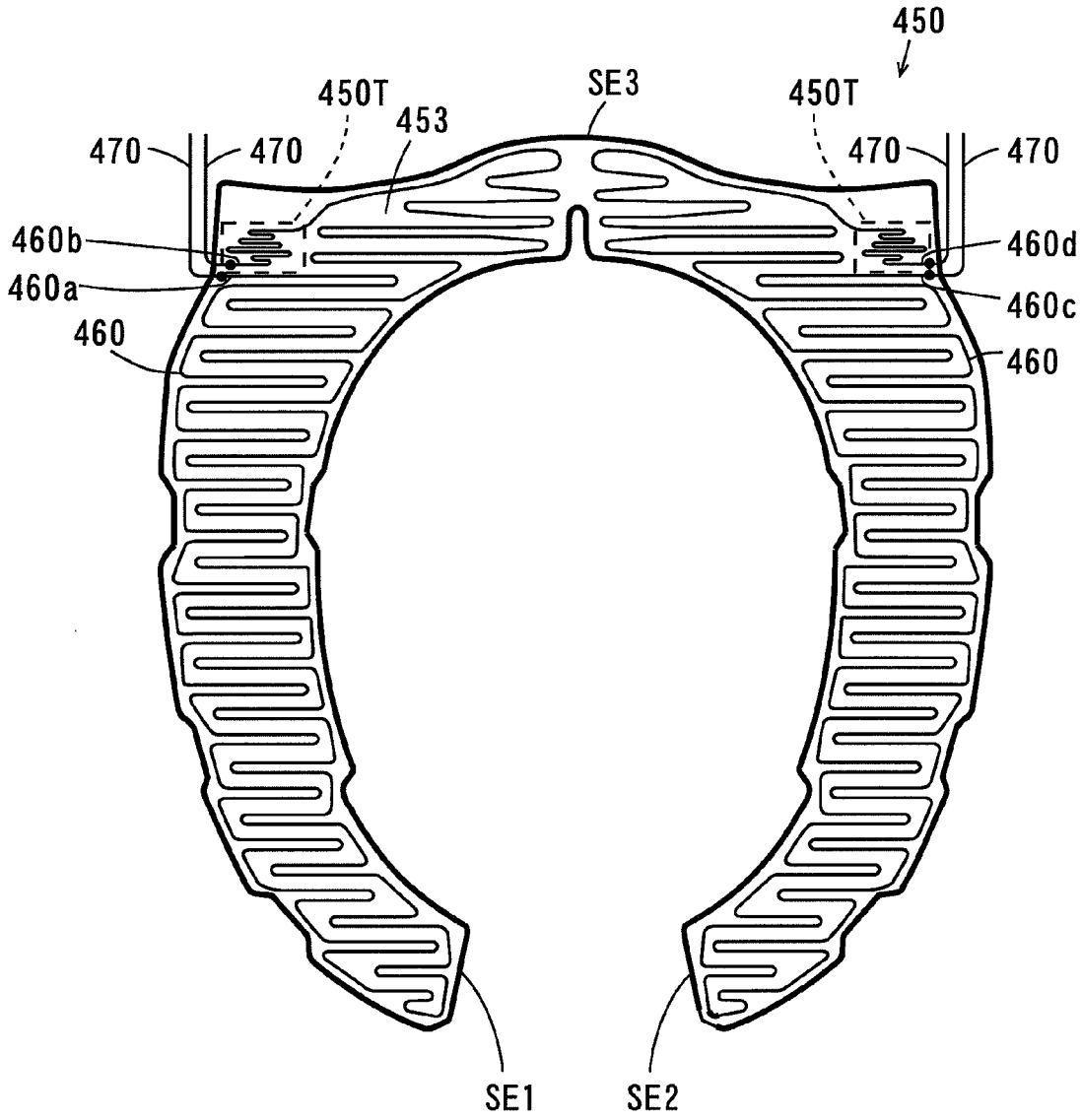
FIG. 78 is a plan view of a toilet seat heater of a toilet seat of a fourth example.

FIG. 78 is a plan view of a toilet seat heater 450 of a toilet seat 400 according to a fourth example.

As shown in FIG. 78, a linear heater 460 arranged in the region from the seat center SE3 to the left seat side SE1, and a linear heater 460 arranged in the region from the seat center SE3 to the other seat end SE2, are separated from each other.

The heater beginning 460*a* and the heater end 460*b* of one linear heater 460 are respectively connected to lead wires 470 drawn from one side of the rear of the toilet seat 400. The heater beginning 460*c* and the heater end 460*d* of the other linear heater 460 are respectively connected to lead wires 470 drawn from the other side of the rear of the toilet seat 400.

(8-f) Example of Structure of Toilet Seat Heater 450

Figure 79:
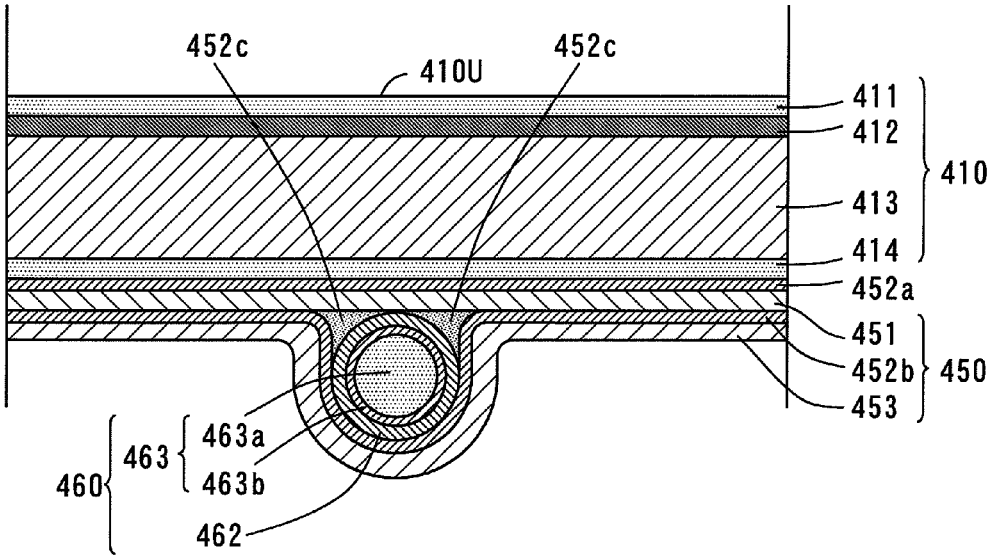
FIG. 79 is a cross-sectional view showing an example of the structure of the toilet seat heater attached to the upper toilet seat casing.

FIG. 79 is a cross-sectional view showing an example of the structure of the toilet seat heater 450 attached to the upper toilet seat casing 410.

As shown in FIG. 79, the upper toilet seat casing 410 is formed of an aluminum plate 413 having a thickness of 1 mm, for example. An Alumite layer 412 and a decorative surface layer 411 are formed over the upper surface of the aluminum plate 413. The upper surface of the decorative surface layer 411 forms the seat surface 410U. Also, a coating film 414 is formed on the lower surface of the aluminum plate 413. The coating film 414 is a film of polyester powder coating having a film thickness of 40 μm and heat resistance of 150° C., for example.

In place of the aluminum plate 413, one or a plurality of a copper plate, a stainless plate, an aluminum plated steel plate, and a zinc aluminum plated steel plate may be used.

A metal foil 451, e.g. made of aluminum, is formed below the lower surface of the coating film 414 with an adhesion layer 452*a* interposed therebetween. The film thickness of the metal foil 451 is not less than 50 μm, and it is 50 μm, for example.

When the film thickness of the metal foil 451 is not less than 50 μm, the heat generated from the linear heater 460 can be favorably transferred sideward from the linear heater 460. That is, a sufficient amount of heat movement is ensured between adjacent linear heater 460 on the metal foil 451. As a result, the heat generated in the linear heater 460 is uniformly diffused in the whole surface of the toilet seat heater 450.

Also, when the film thickness of the metal foil 451 is not less than 50 μm, the heat generated in the linear heater 460 is sufficiently diffused by the metal foil 451. This prevents the toilet seat heater 450 from locally heating to high temperatures.

Also, when the film thickness of the metal foil 451 is not less than 50 μm, the toilet seat heater 450 can be an incombustible structure. This improves safety.

The linear heater 460 is composed of a heating wire 463*a* that is circular in cross section, an enamel layer 463*b*, and an insulating coating layer 462. The peripheral surface of the heating wire 463*a*, circular in cross section, is coated sequentially with the enamel layer 463*b* and the insulating coating layer 462. The heating wire 463*a* and the enamel layer 463*b* form an enameled wire 463.

The heating wire 463*a* has a diameter of 0.16 to 0.25 mm, for example, and is made of copper or copper alloy. In this example, a high-tensile type heater wire made of 4% Ag—Cu alloy having a diameter of 0.176 mm is used as the heating wire 463*a*. The resistance value is 0.833 Ω/m.

The enamel layer 463*b* is formed of polyester imide (PEI) having heat resistance of 300 to 360° C., for example. The film thickness of the enamel layer 463*b* is not more than 20 μm, and it is 12 to 13 μm in this example. Such an enamel wire 463 can sufficiently ensure an electric insulation withstand voltage ability of one minute or more at 1000 V, based on electrical appliance technical standards, even when the film thickness of the enamel layer 463*b* is extremely thin as about 0.01 to 0.02 mm. Also, polyimide (PI) or polyamide imide (PAI) may be used as the material of the enamel layer 463*b*.

In the production of the enamel wire 463, a coat made of heat resisting insulating material, such as polyester imide (PEI), polyimide (PI), or polyamide imide (PAI), is applied for a plurality of times (not less than 10 times nor more than 20 times) on the outer surface of the heating wire 463*a*. Accordingly, the enamel layer 463*b* has a structure in which a plurality of layers of single material are stacked on each other (multi-layered structure).

In this case, it is difficult to enlarge the thickness of the enamel layer 463*b*, but the formation of pinholes is sufficiently suppressed even when the thickness of the enamel layer 463*b* is small. This ensures sufficient insulating properties of the enamel wire 463.

JIS defines plural kinds of enamel layers (Kind 0, Kind 1, Kind 2, and so on). Among such enamel layers, in the enamel layer of Kind 0, the number of coats (the number of layers) formed on the heating wire is larger than those of enamel layers of other Kinds. Accordingly, it is preferable to use an enamel layer 463*b* corresponding to Kind 0 as the enamel layer 463*b* of this example. This ensures more sufficient insulating properties of the enamel wire 463 and improves safety.

When polyester imide (PEI) is used for the enamel layer 463*b*, the heat resistance temperature, indicating the temperature at which the enamel wire 463 softens, is not less than 300° C. nor more than 360° C. as mentioned above. The temperature index of the enamel wire 463 using polyester imide is about 180° C.

The insulating coating layer 462 is formed of fluororesin, such as perfluoroalkoxy mixture (hereinafter referred to as PFA) having heat resistance of 260° C., for example. The thickness of the insulating coating layer 462 is 0.1 to 0.15 mm, for example. The insulating coating layer 462 made of PFA can be formed by extruding. In this case, it is possible to ensure an electrical insulation withstand voltage property that can endure even lightning surge even when the thickness of the insulating coating layer 462 is as thin as 0.05 to 0.1 mm.

Also, the use of PFA as the insulating coating layer 462 provides the effects below.

The insulating coating layer 462 made of PFA can be produced by extruding. Therefore, the produced insulating coating layer 462 is less likely to suffer pinholes even when it is thin. This improves the reliability of the insulating coating layer 462.

Also, the thickness of the insulating coating layer 462 can be easily adjusted by extruding. Accordingly, it is possible to highly precisely form the insulating coating layer 462 having a single-layer structure of single material.

Also, required mechanical strength can be certainly obtained by adjusting the thickness of the insulating coating layer 462. This sufficiently improves the reliability of the linear heater 460.

PFA is a kind of fluororesin. Therefore, PFA has low wettability to adhesives or bonding materials. Accordingly, as will be described later, even when the linear heater 460 is attached between the metal foil 451 and a metal foil 452 by using an adhesion layer 452*b*, the linear heater 460 is not firmly fixed by the adhesion layer 452*b*.

Accordingly, the linear heater 460 can float between the metal foil 451 and the metal foil 452. Accordingly, even when the linear heater 460 expands and shrinks, the stresses occurring in expanding and shrinking can be diffused without concentrating locally. As a result, the expansion and shrinkage of the linear heater 460 are certainly absorbed by the above-described thermal stress buffer portions.

The melting point of PFA is 310° C. Also, the heat resistance temperature (maximum use temperature) of PFA is 260° C. as mentioned above. Also, the ball pressure temperature of PFA is 230° C.

The material of the insulating coating layer 462 can be polyimide (PI) or polyamide imide (PAI).

The outer diameter of the linear heater 460 is 0.46 to 0.50 mm, for example. The power density of the linear heater 460 is 0.95 W/cm$^2$, for example.

The linear heater 460 is attached to the metal foil 451 while covered with the adhesion layer 452*b* and the metal foil 453 made of aluminum, for example. The film thickness of the metal foil 453 is 50 μm, for example.

Again, when the film thickness of the metal foil 453 is not less than 50 μm, the heat generated from the linear heater 460 can be favorably transferred sideward from the linear heater 460. As a result, the heat generated in the linear heater 460 is uniformly diffused in the whole surface of the toilet seat heater 450. Also, when the film thickness of the metal foil 453 is not less than 50 μm, the toilet seat heater 450 can be an incombustible structure. This improves safety.

By the way, as shown in FIG. 79, it is preferred that an adhesive 452*c* is charged into the gap between the metal foil 451 and the linear heater 460. In this case, no gap is formed inside the toilet seat heater 450, and the heat transfer efficiency is improved.

Preferably, the adhesion layer 452*b* and the adhesive 452*c* used to bond the metal foils 451 and 453 have the following properties.

Figure 79A:
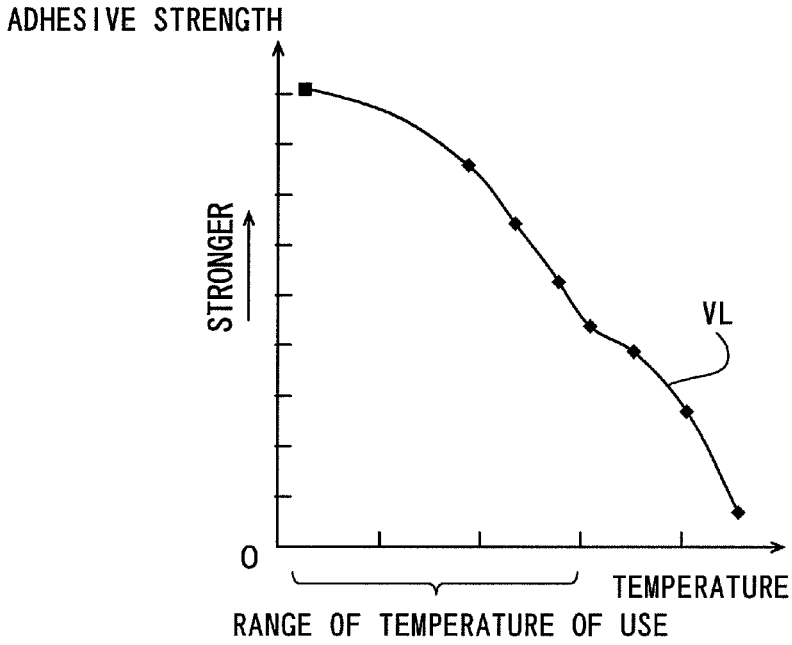
FIG. 79A is a graph illustrating the relation between temperature and adhesive strength of an adhesion layer and an adhesive used to bond metal foils of FIG. 79.

FIG. 79A is a graph illustrating the relation between temperature and the adhesive strength of the adhesion layer 452*b* and the adhesive 452*c* used to bond the metal foils 451 and 453 of FIG. 79. In FIG. 79A, the vertical axis shows the adhesive strength of the adhesion layer 452*b* and the adhesive 452*c*, and the horizontal axis shows the temperature of the adhesion layer 452*b* and the adhesive 452*c*.

As shown by solid line VL in FIG. 79A, the adhesion layer 452*b* and the adhesive 452*c* exhibit higher adhesive strength at lower temperatures, and the adhesive strength becomes weaker as the temperature rises.

When the adhesion layer 452*b* and the adhesive 452*c* having such a characteristic are used, the linear heater 460 floats between the metal foils 451 and 453 when the toilet seat heater 450 generates heat. Then, the stresses of the linear heater 460 generated as the temperature of the toilet seat heater 450 rises can be efficiently diffused.

On the other hand, when the toilet seat heater 450 is not being heated, e.g. in the process of bonding the metal foils 451 and 453, the linear heater 460 is fixed and the toilet seat heater 450 can be assembled easily.

Also, the use of the adhesion layer 452*b* and the adhesive 452*c* having the characteristic above provides the following effect.

In the toilet seat heater 450 of this example, heat is efficiently diffused also in the intervals of the linear heater 460, but actually a temperature difference occurs between a vicinity of the linear heater 460 and a part separated from the linear heater 460.

Accordingly, the adhesive strength of the adhesion layer 452*b* and the adhesive 452*c*, surrounding the linear heater 460, is lowered by the heat generated from the linear heater 460. This makes it possible to sufficiently diffuse stresses generated in the linear heater 460.

On the other hand, in areas separated away from the linear heater 460, such as intervals of the linear heater 460, the influence of the heat generated from the linear heater 460 is somewhat reduced, and high adhesive strength is maintained. The bonding between the metal foils 451 and 453 can thus be certainly maintained.

As described above, the formation of the insulating coating layer 462 on the single enamel wire 463 ensures a double insulation structure.

The enamel layer 463*b* and the insulating coating layer 462 are formed on the surface of the heating wire 463*a* by methods that are not likely to form pinholes. Accordingly, the possibility of overlap of pinholes formed in one or the other can be almost zero. This improves the insulating properties of the linear heater 460.

As described so far, the enamel layer 463*b* and the insulating coating layer 462 are formed by using materials having heat resistance temperatures that are sufficiently higher than temperatures required to raise the temperature of the seat surface 410U. This sufficiently ensures the insulation of the linear heater 460 when the linear heater 460 generates heat.

The heating wire 463*a* is coated sequentially with the enamel layer 463*b* made of polyester imide (PEI) and the insulating coating layer 462 of PFA. Now, it is preferred that a plurality of coatings covering the heating wire 463*a* be made of materials having heat resistance temperatures that sequentially become lower outwardly from the surface of the heating wire 463*a*. Accordingly, it is preferred that a material (polyester imide) having a heat resistance temperature higher than that of the material (PFA) of the insulating coating layer 462 be used as the material of the enamel layer 463*b*.

In this case, the enamel layer 463*b* and the insulating coating layer 462 can offer maximum insulating properties. Also, proper insulating coatings are used in a plurality of temperature regions where the temperature decreases as the distance from the heating wire 463*a* increases. This realizes longer life. For the lives of heat resisting insulating materials, it is said that an increase of 8° C. in the temperature of use approximately halves the life time (Rule of halved by 8° C.).

As described above, the enamel layer 463*b* is formed by applying a coat of heat resisting insulating material (polyester imide) onto the heating wire 463*a* for a plurality of times, so that sufficient insulating properties can be obtained but enlarging the thickness is difficult.

Accordingly, the mechanical strength is limited when the enamel wire 463 alone is used as the linear heater 460. If the number of stacked coatings is increased to obtain sufficient mechanical strength, the costs of the enamel wire 463 increase. Also, the heating wire 463*a* is more likely to disconnect during the process of producing the enamel wire 463. This deteriorates yield.

Also, unlike PFA, polyester imide used as the enamel layer 463*b* in this example has high wettability to adhesives or bonding materials. Accordingly, when the linear heater 460 is attached to the adhesion layer 452*b* when the enamel wire 463 alone is used as the linear heater 460, the linear heater 460 is firmly fixed by the adhesion layer 452*b*. As a result, stresses occurring when the linear heater 460 expands and shrinks are not diffused, and the life of the toilet seat heater 450 is shortened.

In this example, the enamel wire 463 is coated with the insulating coating layer 462 of PFA. Thus, the linear heater 460 is reinforced by the insulating coating layer 462. As a result, it is possible to sufficiently improve the mechanical strength of the linear heater 460 while suppressing cost increase and deterioration of yield. Also, since the mechanical strength of the linear heater 460 is sufficiently improved, the production of the linear heater 460 is made easier. Also, the life of the toilet seat heater 450 is lengthened.

Also, the insulating coating layer 462 provides sufficient insulating properties even when it is relatively thin. Therefore, the insulating coating layer 462 can be formed thinner. In the example above, the thickness of the resin layers (the enamel layer 463*b* and the insulating coating layer 462) of the linear heater 460 is as thin as about 0.12 mm. In this case, the heat transfer from the heating wire 463*a* to the metal foil 451 and the toilet seat casing 410 can be achieved extremely rapidly.

In this regard, in a conventional toilet seat apparatus, the thickness of the coating tube of the linear heater, made of silicone rubber or vinyl chloride, is about 1 mm, which is about ten times that of the example above. The rate of heat transfer of such a coating tube is extremely lower, and it was not possible to increase the rate of temperature rise of the toilet seat.

In such a conventional toilet seat apparatus, when large power is supplied to the heater wire to forcedly speed up the rate of temperature rise of the toilet seat, the coating tube will melt or burn as when the temperature of the heater wire is elevated in a thermally insulated condition. Accordingly, heating the toilet seat by such a method could not be put into practical use.

In contrast, as in this example, when the enamel wire 463 having excellent heat resisting properties is used as the heater wire, the temperature of the toilet seat can be raised in a sufficiently short time, and electrical insulation and safety are also ensured. Accordingly, the structure of this example can be effectively applied to various kinds of toilet seat apparatuses.

Also, in the structure of this example, the resin layers, including the enamel layer 463*b* and the insulating coating layer 462, can be formed to a small thickness of about 0.1 to 0.4 mm. This makes it possible to quickly raise the temperature of the toilet seat, with the heating wire 463*a* and the resin layers kept at lower absolute temperatures. This allows the use of relatively inexpensive insulating materials in place of high-priced heat resisting insulating material.

Also, in this example, the linear heater 460 is sandwiched between the aluminum foils 451 and 452 in order to efficiently transfer heat from the linear heater 460 to the toilet seat casing 410. Now, in the linear heater 460 of this example, the enamel layer 463*b* and the insulating coating layer 462 can be formed thinner, so that the outer diameter of the linear heater 460 can be formed smaller (about ϕ0.2 to ϕ0.4). In this case, when bonding the aluminum foil 451 and the aluminum foil 452, the air layer between the aluminum foil 451 and the aluminum foil 452 can be small, and fewer wrinkles are formed in the aluminum foils 451 and 452. This suppresses local high temperatures of the enamel wire 463, and prevents disconnection of the enamel wire 463 and damage to the electrical insulating layers (the enamel layer 463*b* and the insulating coating layer 462). This lengthens the life of the toilet seat apparatus 110.

Also, since the enamel wire 463 can be thinner, the weight of the toilet seat heater 450 can be reduced, and the toilet seat opening/closing torque can be made smaller. This allows size reduction of the electric opening/closing unit for opening/closing the toilet seat, allowing size reduction of the toilet seat apparatus 110.

The toilet seat heater 450 of FIG. 79 uses the enamel wire 463, circular in cross section, as the heat generator. The enamel wire 463 can be easily produced by forming a plurality of insulating coatings on the heating wire 463*a*. Also, the insulating coating layer 462 can be easily formed by extruding. Also, the heating wire 463*a* has a fine cylindrical shape (linear). These factors facilitate the manufacture of the toilet seat heater 450. Also, the toilet seat heater 450 can be mass-produced, and the manufacturing costs can be sufficiently reduced.

Also, the linear heater 460 produced as described above has no directivity. Accordingly, routing is easy during the assembly of the toilet seat heater 450.

The heat generating means in the toilet seat heater 450 is not limited to the heating wire 463*a* circular in cross section. In place of the heating wire 463*a*, a heating wire that is rectangular in cross section may be used, or a heating wire that is oval in cross section may be used. Also, a belt-like heat generator may be used, or a foil-like heat generator may be used.

(8-g) Another Example of Structure of Toilet Seat Heater 450

Figure 80:
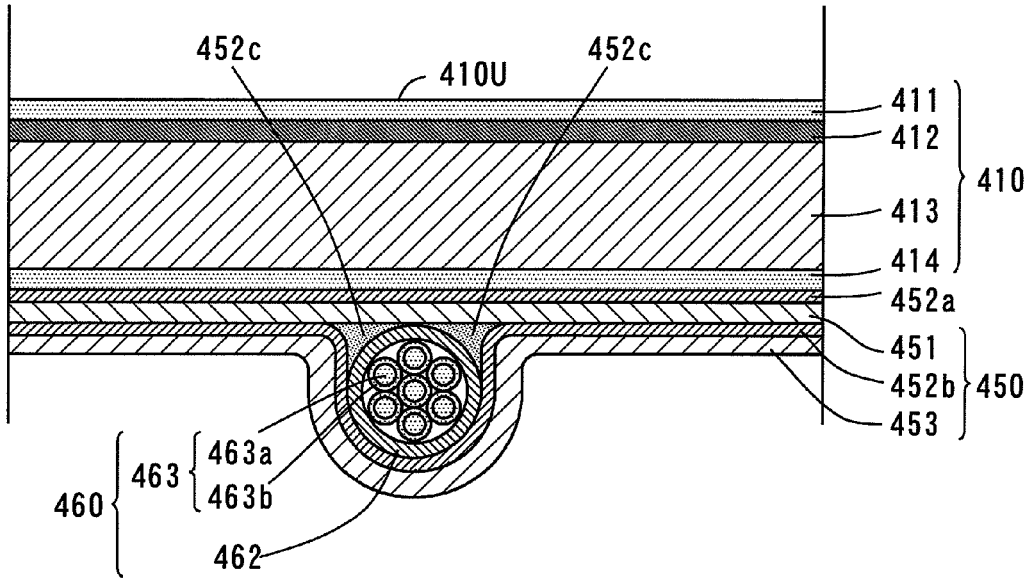
FIG. 80 is a cross-sectional view showing another example of the structure of the toilet seat heater attached to the upper toilet seat casing.

FIG. 80 is a cross-sectional view showing another example of the structure of the toilet seat heater 450 attached to the upper toilet seat casing 410.

In the example of FIG. 80, a plurality of enamel wires 463 are twisted together and coated with an insulating coating layer 462. Each enamel wire 463 is composed of a heating wire 463*a* having a diameter of 0.1 mm and an enamel layer 463*b* having a film thickness of 10 μm, for example.

In this way, forming the insulating coating layer 462 to surround a bundle of a plurality of enamel wires 463 ensures a double insulating structure.

In the example of FIG. 80, seven enamel wires 463 are twisted together, but the number of enamel wires 463 is not limited to seven. For example, two enamel wires 463 and one heating wire 463*a* that is not coated with an enamel layer 463*b* (hereinafter referred to as a simple heating wire 463*a*) may be twisted together.

With this structure, when the enamel layer 463*b* of one of the two enamel wires 463 is dielectrically broken down due to local excess heating, for example, the heating wire 463*a* of that enamel wire 463 and the simple heating wire 463*a* are electrically connected. Accordingly, with this structure, the dielectric breakdown of the enamel layer 463*b* can be detected by using the simple heating wire 463*a* as a dielectric breakdown detecting wire. Thus, when the enamel layer 463*b* of either of the two enamel wires 463 is dielectrically broken down, the passage of electricity to all heating wires 463*a* can be shut off.

That is to say, by forming at least one of a plurality of twisted wires as a non-insulated wire without the enamel layer 463*b*, it is possible to quickly detect dielectric breakdown when the enamel layer 463*b* of any enamel wire 463 is dielectrically broken down due to local excess heating, for example. Then, the passage of electricity to the heating wires 463*a* can be shut off safely.

In the example above, a plurality of enamel wires 463 are twisted together, but a plurality of enamel wires 463 may be simply tied together.

Also, among a plurality of heating wires 463*a*, the direction of current flowing in a certain number of heating wires 463*a* may be set opposite to the direction of current flowing in the remaining heating wires 463*a*. In this case, the magnetic field generated by the current flowing in one direction and the magnetic field generated by the current flowing in the opposite direction cancel each other out. This suppresses generation of leakage field and occurrence of noise.

(8-h) Still Another Example of Structure of Toilet Seat Heater 450

Figure 81:
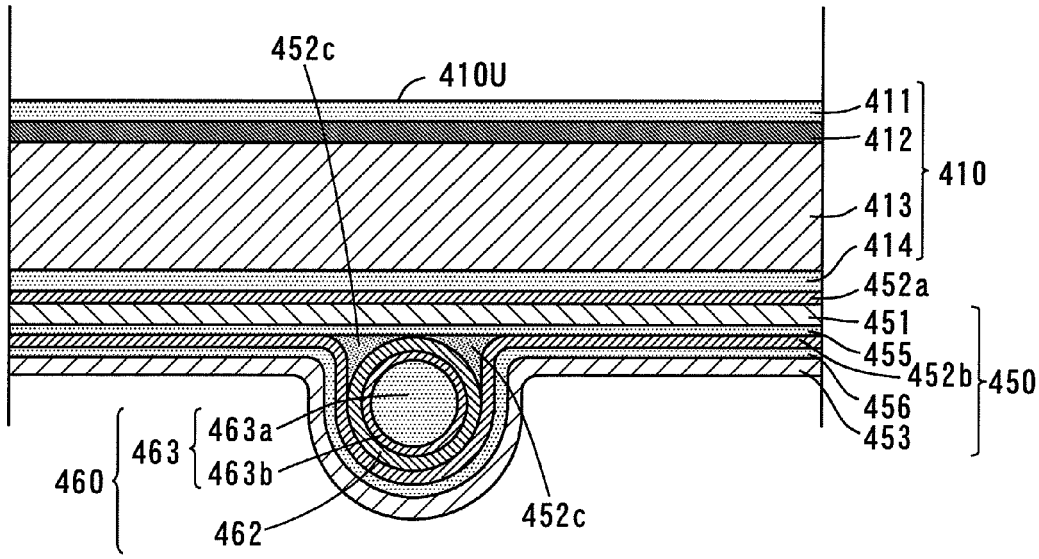
FIG. 81 is a cross-sectional view showing still another example of the structure of the toilet seat heater attached to the upper toilet seat casing.

FIG. 81 is a cross-sectional view showing still another example of the structure of the toilet seat heater 450 attached to the upper toilet seat casing 410.

In the example of FIG. 81, a heat resisting insulating layer 455 is formed between the metal foil 451 and the adhesion layer 452*b*. Also, a heat resisting insulating layer 456 is formed between the adhesion layer 452*b* and the metal foil 453. The heat resisting insulating layer 455 is made of polyethylene terephthalate (PET) having heat resistance of 150° C. and a film thickness of 12 to 25 μm, for example. In the same way, the heat resisting insulating layer 455 is made of PET having heat resistance of 150° C. and a film thickness of 12 to 25 μm, for example.

In this way, the heat resisting insulating layers 455 and 456 are formed in addition to the insulating coating layer 462 formed on a single enamel wire 463, which ensures a triple insulating structure.

In the toilet seat heater 450 of FIG. 81, a bundle of a plurality of enamel wires 463 may be used in place of the single enamel wire 463.

(8-i) Coating Thickness of Heating Wire 463*a*

Figure 82:
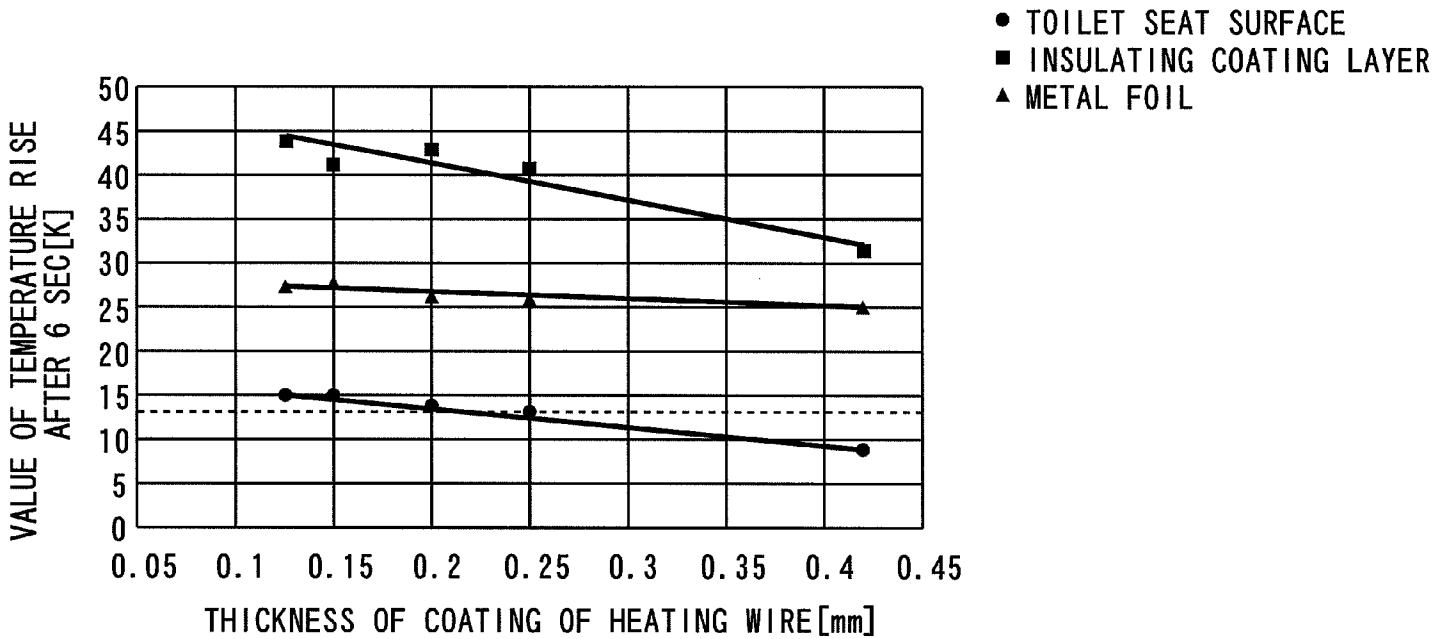
FIG. 82 is a diagram showing the results of measurement about the relation between the thickness of coating of the heating wire and temperature rise in components of the toilet seat.

FIG. 82 is a diagram showing measurements about the relation between the coating thickness of the heating wire 463*a* and the temperature rise of components of the toilet seat 400. In FIG. 82, the horizontal axis shows the coating thickness of the heating wire 463*a*, and the vertical axis shows the value of temperature rise [K] after 6 seconds from the beginning of electricity application.

The measurement used a toilet seat heater 450 having the structure of FIG. 81. The coating thickness of the heating wire 463*a* is the thickness between the heating wire 463*a* and the aluminum plate 413, and it is the total of the thicknesses of the enamel layer 463*b*, heat resisting insulating layer 455, adhesion layer 452*a* and coating film 414 in this example.

Here, for the temperature rise of the seat surface 410U of the toilet seat 400, a temperature rise of about 10 K in 6 seconds was regarded as practical temperature rise performance, and a temperature rise of about 13 K in 6 seconds was regarded as target temperature rise performance.

In FIG. 82, circles indicate the values of temperature rise of the seat surface 410U of the toilet seat 400, triangles indicate the values of temperature rise of the metal foil 451 made of aluminum, and squares indicate the values of temperature rise of the insulating coating layer 462.

It is seen from the results of FIG. 82 that the practical temperature rise performance is obtained when the coating thickness of the heating wire 463*a* is 0.4 mm or less. Also, it is seen that the target temperature rise performance is obtained when the coating thickness of the heating wire 463*a* is 0.2 mm or less. Thus, preferably, the coating thickness of the heating wire 463*a* is 0.4 mm or less, and more preferably, it is 0.2 mm or less.

(8-j) Material of Insulating Coating Layer 462

Next, a voltage of AC 100 V was applied to three kinds of toilet seat heaters 450 having the structure of FIG. 81, and the temperatures of the heating wires 463*a* were measured.

A first toilet seat heater 450 used PFA having a film thickness of 100 μm and a heat resistance temperature of 260° C. as the material of the insulating coating layer 462, and used PET having a film thickness of 25 μm and a heat resistance temperature of 150° C. as the material of the heat resisting insulating layers 455 and 456. A second toilet seat heater 450 used PI coating having a film thickness of 35 to 40 μm and a heat resistance temperature of 350° C. as the material of the insulating coating layer 462, and used PET having a film thickness of 25 μm and a heat resistance temperature of 150° C. as the material of the heat resisting insulating layers 455 and 456. A third toilet seat heater 450 used PI coating having a film thickness of 35 to 40 μm and a heat resistance temperature of 350° C. as the material of the insulating coating layer 462, and used acrylic resin having a film thickness of 3 to 6 μm and a heat resistance temperature of 90° C. as the material of the heat resisting insulating layers 455 and 456.

With the first toilet seat heater 450, the temperature of the heating wire 463*a* was 162.3° C. that is lower than the heat resistance temperature 260° C. of the insulating coating layer 462 made of PFA. With the second toilet seat heater 450, the temperature of the heating wire 463*a* was 155.4° C. that is lower than the heat resistance temperature 350° C. of the insulating coating layer 462 made of PI. With the third toilet seat heater 450, the temperature of the heating wire 463*a* was 125.7° C. that is lower than the heat resistance temperature 350° C. of the insulating coating layer 462 made of PI.

It was seen from these results that not only PFA but also other resins, such as PI, can be used as the material of the insulating coating layer 462.

As described above, by applying a voltage of AC 100 V to each toilet seat heater 450, the temperature of the heating wire 463*a* can be raised to a range of from about 120° C. to about 170° C. The time required to raise the heating wire 463*a* provided in each toilet seat heater 450 to the temperature range from about 120° C. to about 170° C. is about 1 second to 2 seconds.

Thus, when a short time (1 second to 2 seconds) passed after the beginning of heating by each toilet seat heater 450, the temperature gradient from the heating wire 463*a* to the seat surface 410U is about 100 K or more. When the temperature gradient from the heating wire 463*a* to the seat surface 410U is thus extremely large, the rate of movement of heat from the heating wire 463*a* to the seat surface 410U is sufficiently improved. As a result, the rate of temperature rise of the seat surface 410U is sufficiently high.

In the structure of each toilet seat heater 450, with a heating wire 463*a* whose temperature rapidly rises to high temperatures, a thin coating that ensures insulating properties to still higher temperatures is formed on the heating wire 463*a*.

(8-k) Method of Connection of Linear Heater 460 and Lead Wire 470

Figure 83:
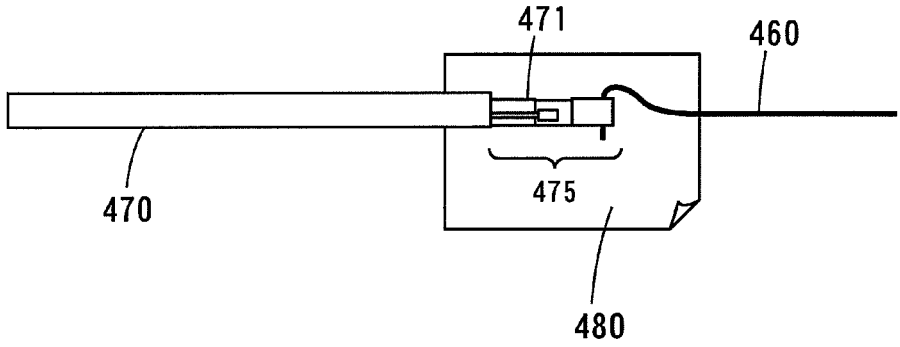
FIG. 83 is a diagram illustrating a method for connecting the linear heater and a lead wire.
Figure 84:
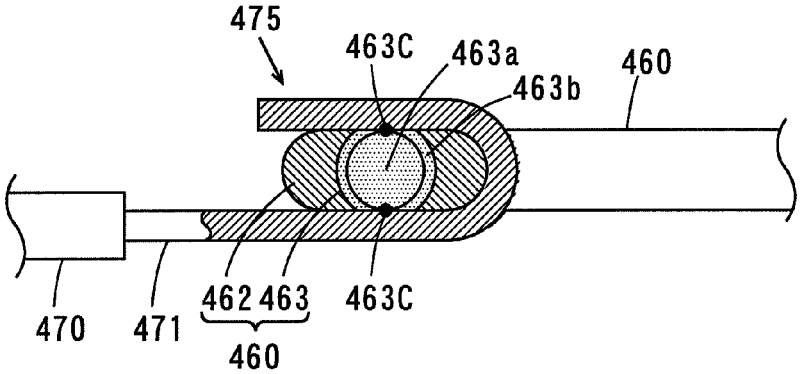
FIG. 84 is a cross-sectional view of the connection between the linear heater and lead wire.
Figure 85:
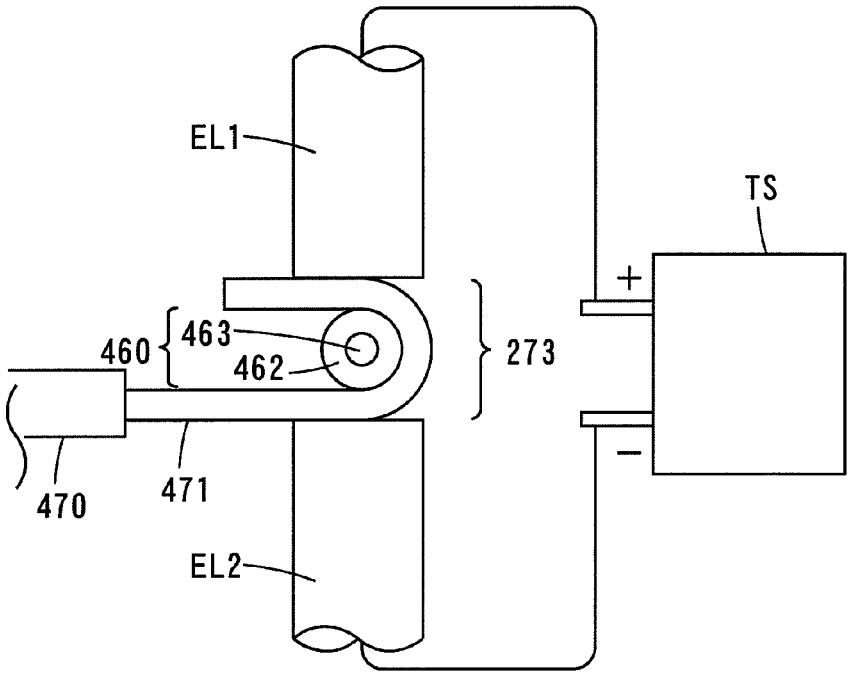
FIG. 85 is a diagram illustrating a method of thermal caulking.

FIG. 83 is a diagram illustrating a method for connecting a linear hater 460 and a lead wire 470. FIG. 84 is a cross-sectional view of the connection of the linear heater 460 and the lead wire 470. FIG. 85 is a diagram illustrating a method of thermal caulking.

As shown in FIG. 83 and FIG. 84, the core wire of the lead wire 470 is connected to a terminal 471. The terminal 471 is bent into a U shape, and a curved end of the linear heater 460 is inserted in the U shape of the bend of the terminal 471.

In this state, as shown in FIG. 85, the U-shaped bend of the terminal 471 is placed between a pair of electrodes EL1 and EL2. With the pair of electrodes EL1 and EL2 pressing the U-shaped bend of the terminal 471, current is supplied to the terminal 471 and the linear heater 460 from a transformer TS through the electrodes EL1 and EL2. Then, as shown in FIG. 84, the insulating coating layer 462 and the enamel layer 463*b* of the linear heater 460 melt. As a result, the heating wire 463*a* of the linear heater 460 come in contact with the terminal 471 at the contact points 463C.

As shown in FIG. 83, a heat resisting sheet 480 made of a thin film of polyimide having a thickness of 12 μm, for example, is wound two or three times around the connection 475 between the terminal 471 of the lead wire 470 and the linear heater 460. Also, the connection 475 of the terminal 471 of the lead wire 470 and the linear heater 460 is coated with silicone resin, and placed between the metal foils 451 and 453 of FIGS. 72 to 81.

Heat from the heating wire 463*a* of the linear heater 460 thus conducts to the metal foils 451 and 453 and the terminal 471 of the lead wire 470. Then, local overheat and disconnection of the heating wire 463*a* are prevented, and uniform heating of the toilet seat heater 450 is ensured.

Also, the connection 475 between the heating wire 463*a* of the linear heater 460 and the terminal 471 of the lead wire 470 has a double insulating structure of the heat resisting sheet 480 and silicone resin. In this case, the heat of the connection 475 conducts to the meal foils 451 and 453 of the toilet seat heater 450 through the heat resisting sheet 480 and silicone resin. Thus, local overheat and disconnection of the heating wire 463*a* are prevented, while ensuring sufficient insulating properties.

Also, a thin and ensured electric connection is realized by connecting the heating wire 463*a* of the linear heater 460 and the terminal 471 of the lead wire 470 by thermal caulking. Also, the heating wire 463*a* is prevented from lifting, and local overheat and disconnection of the heating wire 463*a* are prevented.

In order to ensure the safety of the toilet seat 400, two safety circuits are provided in the toilet seat apparatus 110. One safety circuit is connected between one lead wire 470 of the toilet seat heater 450 and a toilet seat heater dielectric breakdown detecting circuit in the printed board 230, and the other safety circuit is connected between both lead wires 470 of the toilet seat heater 450 and a toilet seat heater disconnection detecting circuit. Both safety circuits are used to prevent electric shock to the user when an abnormality occurs in the toilet seat heater 402.

The toilet seat heater dielectric breakdown detecting circuit detects a flow of current between the toilet seat heater 450 and the metal foil 451 when the toilet seat heater 450 abnormally heats and the insulating coating layer 462 melts. The toilet seat heater disconnection detecting circuit detects the absence of voltage waveform at both ends of the toilet seat heater 450 when the toilet seat heater 450 is disconnected. The heater driving section 402 passes electricity to the toilet seat heater 450 only when both of the two safety circuits are detecting normal state.

(8-l) Operations of Toilet Seat Heater 450

Next, the operations of the toilet seat heater 450 will be described. When a certain voltage is applied between the heater beginning 460*a* and the heater end 460*b* of the toilet seat heater 450, current flows through the internal heating wire 463*a* and the heating wire 463*a* generates heat. The heat thus generated from the heating wire 463*a* passes through the enamel layer 463*b* and the meal foils 451 and 453 to conduct to the seat surface 410U of the upper toilet seat casing 410.

In the linear heater 460, the insulating coating layer 462 is made of PFA having heat resistance of about 260° C., so that, even when the insulating coating layer 462 is as thin as 0.1 to 0.15 mm, for example, the enamel wire 463*b* is prevented from being broken when the temperature of the heating wire 463*a* rapidly rises to 100 to 150° C. Thus, the heat transfer from the linear heater 460 to the seat surface 410U rapidly progresses and the temperature of the seat surface 410U can be rapidly elevated.

In this case, a given optimum temperature is achieved in a short time as 5 to 6 seconds after the beginning of the application of electricity to the linear heater 460, which is shorter than, e.g. 7 to 8 seconds that users take to sit down on the seat surface 410U after entering the lavatory. Accordingly, even when the application of electricity to the linear heater 460 is started at the same time as the entrance detecting sensor 600 detects the entrance of a user into the lavatory, the seat surface 410U can be sufficiently brought to the optimum temperature before the user sits down on it.

Also, heat is dissipated more in the inner region G3 and the outer region G1 of the seat surface 410U of FIG. 74 than in the center region G2. In this embodiment, the linear heater 460 is more densely arranged in the inner region G3 and the outer region G1 than in the center region G2. Accordingly, the user will not feel temperature unevenness and coldness at the instant when the user sits down on the seat surface 410U.

The toilet seat 400 may be constructed as follows so that the user will not feel temperature unevenness and coldness at the instant when the user sits down on the seat surface 410U.

Figure 85A:
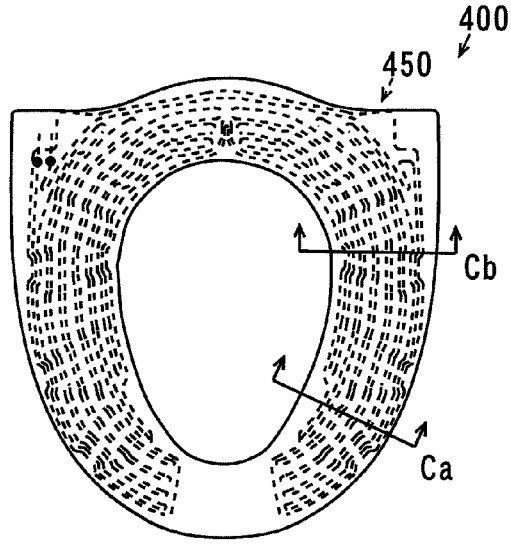
FIG. 85A is a diagram illustrating an example of the structure of the toilet seat on which the user does not feel temperature unevenness and coldness.
Figure 85A:
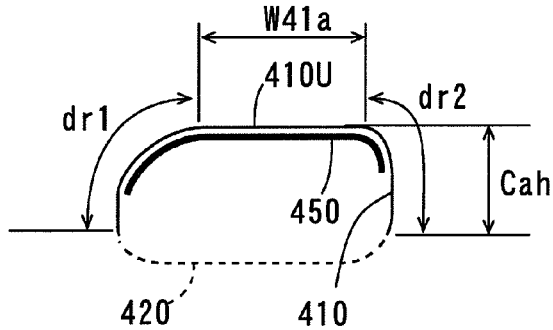
Figure 85A:
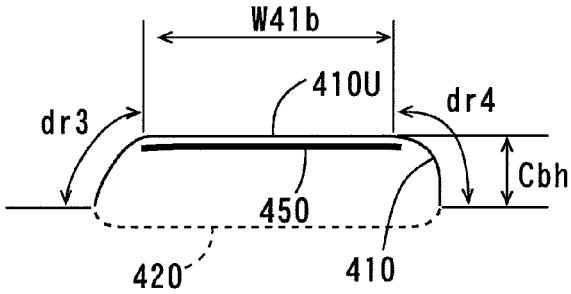

FIG. 85A is a diagram showing an example of the structure of the toilet seat 400 constructed so that the user will not feel temperature unevenness and coldness. FIG. 85A(a) shows a top view of the toilet seat 400. FIG. 85A(b) shows the cross-sectional view taken along line Ca-Ca in FIG. 85A(a), and FIG. 85A(c) shows the cross-sectional view taken along line Cb-Cb in FIG. 85A(a).

As shown in FIG. 85A(b) and FIG. 85A(c), the width W41*a* of a front part of the seat surface 410U is shorter than the width W41*b* of a rear part. Also, the height Cah of the front part of the seat surface 410U is larger than the height Cbh of the rear part.

With an upper toilet seat casing 410 thus shaped, a toilet seat heater 450 is generally formed to the same width as the width of the seat surface 410U and bonded to the inner side of the upper toilet seat casing 410.

In this case, in the Ca-Ca part, the width of the toilet seat heater 450 is formed approximately the same as the width W41*a* of the front part of the seat surface 410U. Also, in the Cb-Cb part, the width of the toilet seat heater 450 is formed approximately the same as the width W41*b* of the rear part of the seat surface 410U.

However, when the toilet seat heater 450 is formed in this way, it is actually not possible to uniformly raise the temperature of the entire seat surface 410U. This is because of the reason below.

When the upper toilet seat casing 410 thus has a varying cross-sectional shape, the distances from side ends of the seat surface 410U to lower ends of the upper toilet seat casing 410 also vary.

Specifically, the distances, shown with arrows dr1 and dr2 in FIG. 85A(a), from the side ends of the seat surface 410U to the lower ends of the upper toilet seat casing 410 are longer than the distances, shown with arrows dr3 and dr4 in FIG. 85A(b), from the side ends of the seat surface 410U to the lower ends of the upper toilet seat casing 410.

Accordingly, the area in which the toilet seat heater 450 is absent is larger in the Ca-Ca part than in the Cb-Cb part (hereinafter referred to as a non-heating area). Accordingly, the amount of heat transferred from the toilet seat heater 450 to the non-heating area is larger in the Ca-Ca part than in the Cb-Cb part. As a result, it is difficult to uniformly raise the temperature in the entire seat surface 410U.

Accordingly, in the toilet seat 400 of this example, the width of the toilet seat heater 450 in the Ca-Ca part is formed larger than the width of the toilet seat heater 450 in the Cb-Cb part so that the non-heating areas are nearly the same in the Ca-Ca part and the Cb-Cb part.

Then, the amount of heat transferred from the toilet seat heater 450 to the non-heating area in the Ca-Ca part, and the amount of heat transferred from the toilet seat heater 450 to the non-heating area in the Cb-Cb part, can be nearly equal to each other. That is to say, the heat capacity in the Ca-Ca part and the heat capacity in the Cb-Cb part can be nearly equal to each other. This makes it possible to uniformly raise the temperature in the entire seat surface 410U. This certainly prevents the inconvenience that the user feels temperature unevenness and coldness just when sitting down on the seat surface 410U.

Also, the linear heater 460 is long, having a total length of about 10 m, and it rapidly expands with rapid temperature rise of the heating wire 463 and it stretches in the length direction as a result. Also, when the application of electricity is stopped, the temperature of the heating wire 463*a* decreases and it shrinks to the original length. That is, in the heating wire 463*a*, thermal stress distortion is repeatedly generated due to thermal expansion and thermal shrinkage.

When the adhesion between the linear heater 460 and the metal foils 451 and 453 is weak, or when a gap is formed between the linear heater 460 and the seat surface 410U, the whole thermal stress distortion concentrates in a part where the linear heater 460 can move most easily. As a result, the linear heater 460 suffers relatively strong bending and stretching, and the stress fatigue is accumulated to break the linear heater 460, e.g. disconnect the heating wire 463*a*.

In this example, the linear heater 460 has a plurality of bent portions as thermal stress buffer portions, and the bent portions finely diffuse the entire thermal stress distortion, and the bent portions also function to absorb the thermal stress distortion. Accordingly, the thermal stresses in the bent portions are extremely small, and the bending and stretching can be limited very small. As a result, the heating wire 463*a* will not be disconnected, and the linear heater 460 offers longer life and higher durability.

In the inner region G3 and the outer region G1 of the seat surface 410U where heat radiation is relatively large, the intervals of the linear heater 460 can be larger than in the center region G2 and the number of bent portions can be smaller.

As described above, the total length of the linear heater 460 is as long as about 10 m, and the bent portions are formed in the linear heater 460. Accordingly, the arrangement of the linear heater 460 has to be kept and fixed at the time of installation of the linear heater 460 to the seat surface 410U. The toile seat heater 450 is structured as a unit by placing the linear heater 460 between the metal foils 451 and 453 and keeping the linear heater 460 in tight contact with the metal foils 451 and 453. Thus, it is possible to bond the linear heater 460 to the seat surface 410U while firmly keeping the arrangement of the linear heater 460.

Also, since the linear heater 460 is sandwiched between the metal foils 451 and 453, the metal foils 451 and 453 enable uniform heat diffusion. This prevents the linear heater 460 from going up to high temperatures. Also, the seat surface 410U is uniformly heated, and damage to the toilet seat heater 450 is prevented.

(8-m) Electricity Application Sequence of Toilet Seat Apparatus 110

The driving of the toilet seat heater 450 is controlled by varying the power for driving the toilet seat heater 450 generally in three levels.

For example, when the temperature of the toilet seat 400 is raised at a first temperature gradient, the heater driving section 402 of FIG. 70 drives the toilet seat heater 450 with power of about 1200 W (1200 W driving).

As mentioned earlier, the resistance value of the toilet seat heater 450 is 0.833 Ω/m, and its total length is 10 m. Accordingly, the resistance value of the toilet seat heater 450 is 8.33Ω. When AC 100 V is applied to the toilet seat heater 450 having this resistance value, power of (100V×100V) ÷8.33Ω=1200 W is generated. That is, power of 1200 W is generated when current is passed to the toilet seat heater 450 over the whole period of the AC power supply.

Figure 85B:
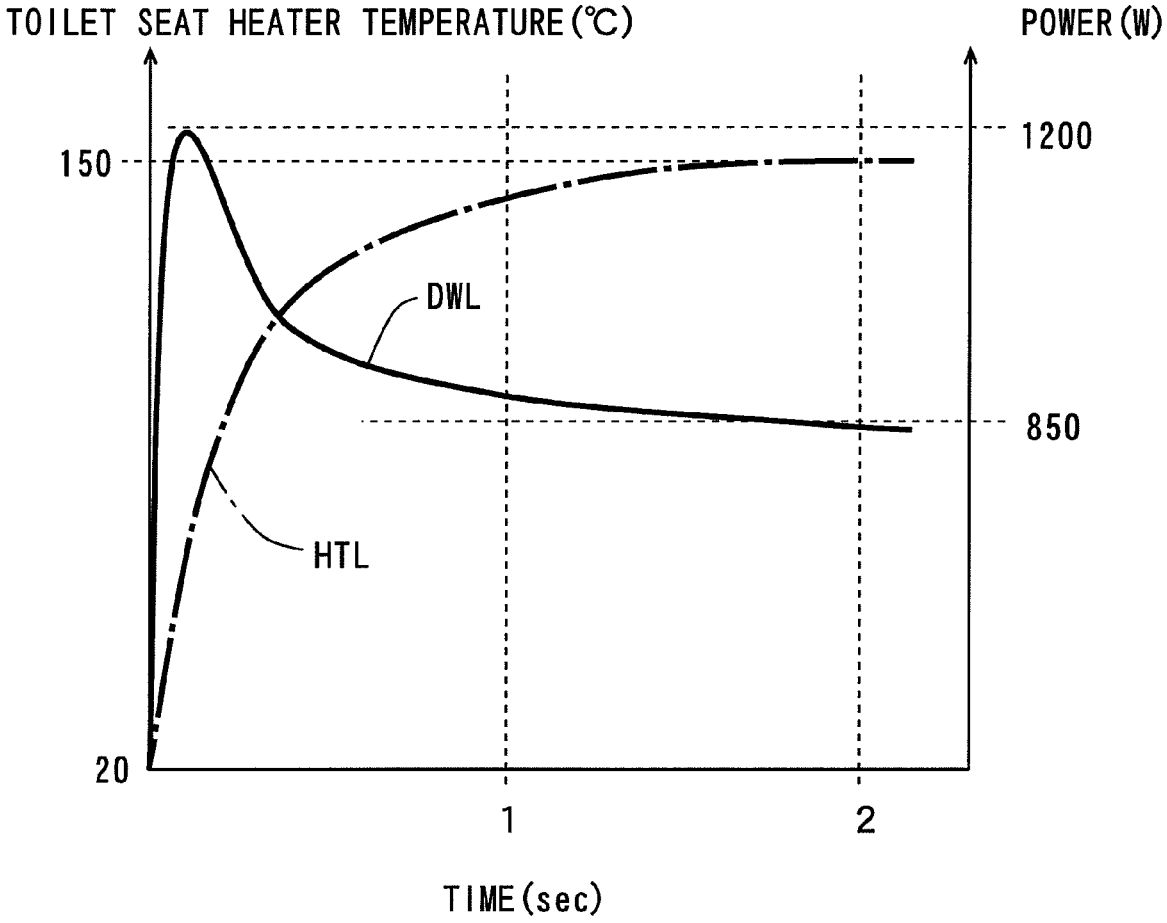
FIG. 85B is a graph illustrating a relation between the temperature of the toilet seat heater and power generated in the toilet seat heater, where the temperature of the toilet seat is raised at a first temperature gradient.

FIG. 85B is a graph illustrating a relation between the temperature of the toilet seat heater 450 (FIG. 79) and the power generated in the toilet seat heater 450, where the temperature of the toilet seat 400 is raised at the first temperature gradient. In FIG. 85B, the vertical axis shows the temperature of the toilet seat heater 450 and the power generated in the toilet seat heater 450, and the horizontal axis shows time.

As shown by thick solid line DWL in FIG. 85B, in the toilet seat heater 450, power of 1200 W is generated with application of AC 100 V.

Then, as shown by thick one-dot chain line HTL, the temperature of the toilet seat heater 450 rapidly rises. Then, in the range of from about 1 second to about 2 seconds after the beginning of the supply of power, the temperature of the toilet seat heater 450 rises to about 150° C. After that, the temperature of the toilet seat heater 450 is maintained at about 150° C.

The resistance value of the toilet seat heater 450 increases to about 12 Ω/m at about 150° C. Accordingly, when the temperature of the toilet seat heater 450 rises to about 150° C., the power generated in the toilet seat heater 450 decreases to about 850 W.

In this way, when the temperature of the toilet seat 400 is raised at the first temperature gradient, large power is generated in the toilet seat heater 450 at the beginning of the supply of power, so that the temperature of the toilet seat heater 450 can be raised rapidly.

On the other hand, as mentioned above, the toilet seat heater 450 is maintained at a certain temperature after a short time and saturated. The power generated in the toilet seat heater 450 then becomes smaller. As a result, the controllability of the toilet seat heater 450 is improved.

Also, When the temperature of the toilet seat 400 is raised at a second temperature gradient that is somewhat gentler than the first temperature gradient, the heater driving section 402 drives the toilet seat heater 450 with power of about 600 W (600 W driving). Furthermore, when keeping constant the temperature of the toilet seat 400, the heater driving section 402 drives the toilet seat heater 450 with power of about 50 W (low power driving). Low power driving means driving the toilet seat heater 450 with power that is sufficiently lower than the 1200 W driving and the 600 W driving (power in the range of 0 W to 50 W, for example).

The 1200 W driving, 600 W driving and low power driving are switched by a duty factor switching circuit in the controller 90 that controls the application of electricity from the heater driving section 402 to the toilet seat heater 450.

The heater driving section 402 is supplied with alternating current from a power-supply circuit not shown. Then, the heater driving section 402 passes the supplied alternating current to the toilet seat heater 450 on the basis of an electricity application control signal given from the duty factor switching circuit.

Figure 86:
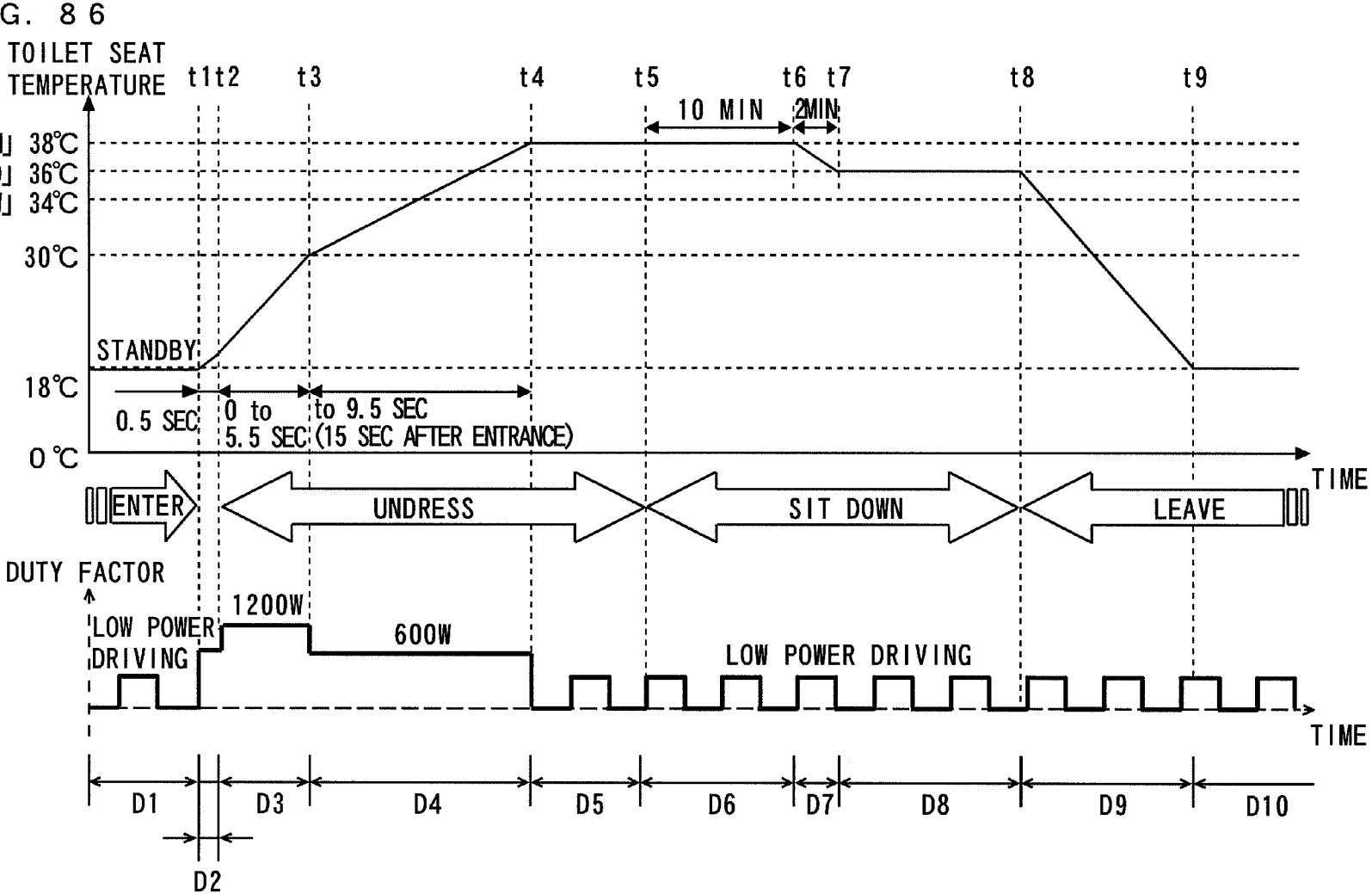
FIG. 86 is a diagram illustrating an example of driving operation of the toilet seat heater and a variation of the surface temperature of the toilet seat.

FIG. 86 is a diagram showing an example of the driving operation of the toilet seat heater 450 and a variation of the surface temperature of the toilet seat 400.

FIG. 86 shows a graph illustrating the relation between the surface temperature of the toilet seat 400 and time, and a graph illustrating the duty factor for driving the toilet seat heater 450 and time. The horizontal axis of the two graphs is a common time base.

This example assumes that a user previously turned on the heating function and set the toilet seat temperature high (38° C.).

When, e.g. in winter, the room temperature is lower than the standby temperature of 18° C., the controller 90 (FIG. 70) adjusts the temperature of the toilet seat 400 to 18° C. Thus, in a standby period D1 before the entrance detecting sensor 600 detects the entrance of a user, the controller 90 applies low power driving to the toilet seat heater 450 such that the surface temperature of the toilet seat 400 stays constant at 18° C.

When the entrance detecting sensor 600 detects the entrance of a user at time t1, the controller 90 performs 600 W driving during a rush current reduction period D2. The 600 W driving is performed to sufficiently reduce rush current. In this case, the surface temperature of the toilet seat 400 is raised at the somewhat gentle second temperature gradient.

After that, at time t2 after the passage of the rush current reduction period D2, the controller 90 starts applying 1200 W driving to the toilet seat heater 450, and continues the 1200 W driving of the toilet seat heater 450 for a first temperature rise period D3. In this case, the surface temperature of the toilet seat 400 is raised at the above-mentioned first temperature gradient.

Now, the surface temperature of the toilet seat 400 is rapidly raised. The 1200 W driving of the toilet seat heater 450 is performed until the surface temperature of the toilet seat 400 reaches a given temperature (e.g. 30° C.). Of course, this given temperature can be the temperature set as the heating temperature, but this given temperature can be lower than that, can be not sufficiently raised to the heating temperature, and it can be a lowest limit temperature (limit temperature) at which the user will not feel discomfort of coldness when sitting down on the seat. Experiments with test subjects conducted by the inventors and others have revealed that this limit temperature is about 29° C.

In this way, in the first temperature rise period D3, the surface temperature of the toilet seat 400 is rapidly raised to a given temperature by 1200 W driving. This allows the user to sit down on the toilet seat 400 without feeling cold.

When the surface temperature of the toilet seat 400 is thus rapidly raised, the temperature variation may overshoot. However, in this example, the 1200 W driving of the toilet seat heater 450 is switched to 600 W driving when the surface temperature of the toilet seat 400 reached the given temperature. Accordingly, even when the variation of the surface temperature of the toilet seat 400 overshoots, the surface temperature does not exceed the toilet seat setting temperature. As a result, the user will not feel the toilet seat 400 too hot when sitting down on it.

Next, at time t3 after the passage of the first temperature rise period D3, the controller 90 starts 600 W driving of the toilet seat heater 450, and continues the 600 W driving of the toilet seat heater 450 during a second temperature rise period D4. In this case, the surface temperature of the toilet seat 400 is raised at the above-mentioned second temperature gradient.

The 600 W driving of the toilet seat heater 450 is performed until the surface temperature of the toilet seat 400 reaches the toilet seat setting temperature (38° C.).

The second temperature gradient is gentler than the first temperature gradient. This prevents significant overshoot of the variation of the surface temperature of the toilet seat 400.

At time t4 after the passage of the second temperature rise period D4, the controller 90 starts low power driving of the toilet seat heater 450, and continues the low power driving of the toilet seat heater 450 for a first maintaining period D5. This keeps the surface temperature of the toilet seat 400 constant at the toilet seat setting temperature.

At time t5, when the sitting sensor 290 detects that the user sat down on the toilet seat 400, the controller 90 lowers the duty factor of the low power driving, and continues the low power driving of the toilet seat heater 450 such that the surface temperature of the toilet seat 400 keeps the toilet seat setting temperature during a first sitting period D6. In this example, the first sitting period D6 is set to about 10 minutes.

At time t6 after the passage of the first sitting period D6, the controller 90 further lowers the duty factor of the low power driving, and continues the low power driving of the toilet seat heater 450 for a second sitting period D7 such that the surface temperature of the toilet seat 400 decreases to a temperature (36° C.) somewhat lower than the toilet seat setting temperature. In this example, the second sitting period D7 is set to about 2 minutes.

At time t7 after the passage of the second sitting period D7, the controller 90 further lowers the duty factor of the low power driving, and continues the low power driving of the toilet seat heater 450 for a second maintaining period D8 such that the surface temperature of the toilet seat 400 is constant at the temperature (36° C.) somewhat lower than the toilet seat setting temperature. In the description below, the surface temperature of the toilet seat 400 that is maintained constant in the second maintaining period D8, i.e., a temperature somewhat lower than the toilet seat setting temperature, is referred to as a maintaining temperature.

In this way, in this example, after the user sat down on the toilet seat 400, the controller 90 gradually lowers the surface temperature of the toilet seat 400. This prevents the user from getting burned at low temperatures.

At time t8, when the sitting sensor 290 detects the user leaving the toilet seat 400, the controller 90 stops the driving of the toilet seat heater 450 for a stop period D9. The surface temperature of the toilet seat 400 thus decreases.

At time t9 at which the surface temperature of the toilet seat 400 reaches 18° C., the controller 90 again starts low power driving of the toilet seat heater 450, and continues the low power driving of the toilet seat heater 450 for a standby period D10 such that the surface temperature of the toilet seat 400 is constant at 18° C.

When the temperature gradient thus becomes gradually gentler, the overshoot of the temperature variation of the toilet seat 400 can be kept sufficiently small.

In this example, after the user sat down on the toilet seat 400, the surface temperature of the toilet seat 400 is gradually lowered by adjusting the power used to drive the toilet seat heater 450, but the driving of the toilet seat heater 450 may be stopped when the user sits down on the toilet seat 400. The user can be prevented from getting burned at low temperatures also in this case.

As described above, in this example, the driving of the toilet seat heater 450 is stopped when the leaving of the user from the toilet seat 400 is detected at time t8, but the driving of the toilet seat heater 450 may be stopped after a given time (e.g. one minute) has passed after time t8 at which the leaving of the user from the toilet seat 400 was detected. In this case, if the user feels like evacuating after once leaving the toilet seat 400 and sits down on the toilet seat 400 again, the surface temperature of the toilet seat 400 is not decreased. This allows the user to sit down on the toilet seat 400 comfortably.

The passage of electricity to the toilet seat heater 450 in the 1200 W driving, 600 W driving and low power driving will be described together with an electricity application control signal from the duty factor switching circuit.

In the description below, "duty factor" means the ratio of the time for which alternating current is passed to the toilet seat heater 450, with respect to one cycle of the alternating current.

Figure 87:
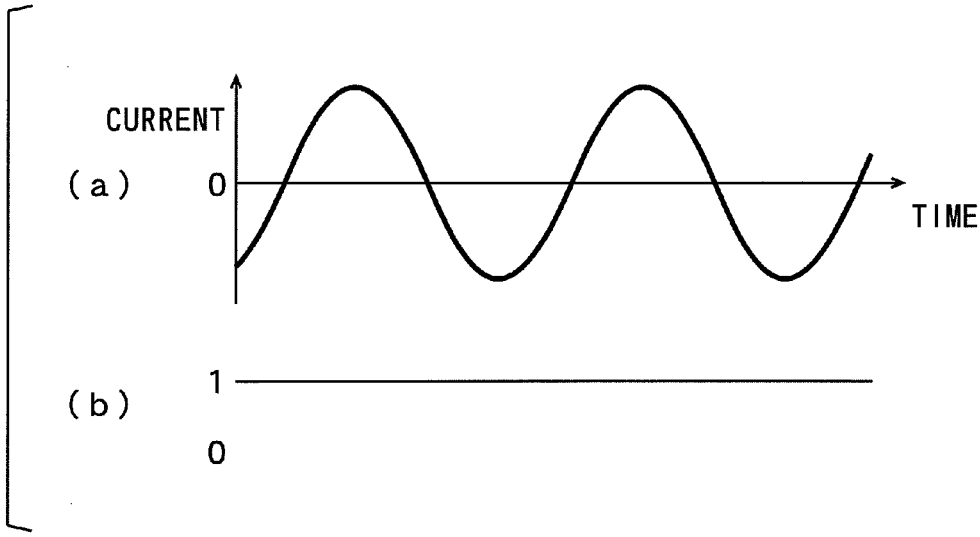
FIG. 87(*a*) is a waveform diagram of current flowing in the toilet seat heater when driven at 1200 W, and (b) is a waveform diagram of an electricity application control signal given from a duty factor switching circuit to a heater driving section when driving at 1200 W.

FIG. 87(*a*) is a waveform diagram of the current flowing in the toilet seat heater 450 during 1200 W driving, and FIG. 87(*b*) is a waveform diagram of the electricity application control signal given from the duty factor switching circuit to the heater driving section 402 during 1200 W driving.

As shown in FIG. 87(*b*), the electricity application control signal in 1200 W driving is always at logical "1". When the electricity application control signal is logical "1", the heater driving section 402 passes the alternating current supplied from the power-supply circuit to the toilet seat heater 450 (thick line in FIG. 87(*a*)). As a result, the alternating current flows in the toilet seat heater 450 throughout the period of whole cycles. As a result, the toilet seat heater 450 is driven with power of about 1200 W.

Figure 88:
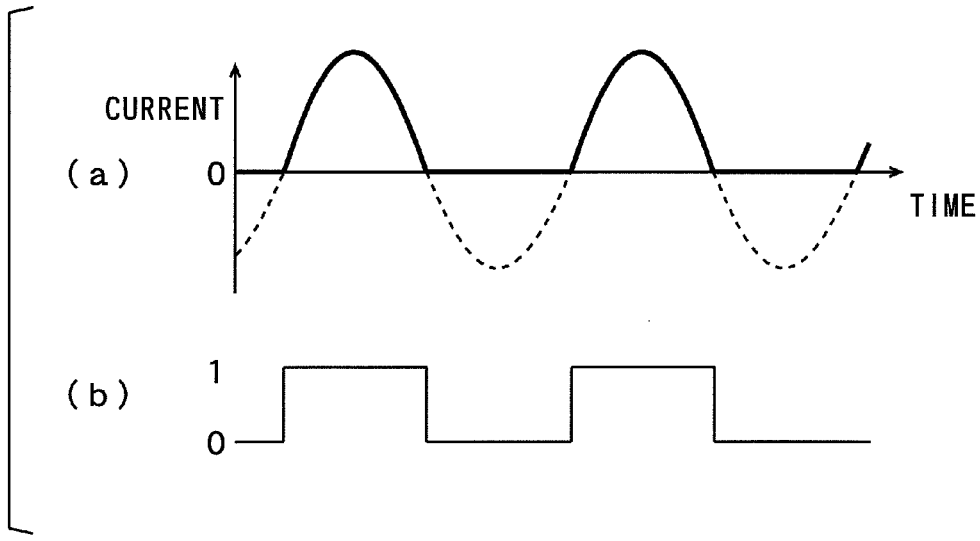
FIG. 88(*a*) is a waveform diagram of current flowing in the toilet seat heater when driven at 600 W, and (b) is a waveform diagram of an electricity application control signal given from the duty factor switching circuit to the heater driving section driving at 600 W.

FIG. 88(*a*) is a waveform diagram of the current flowing in the toilet seat heater 450 during 600 W driving, and FIG. 88(*b*) is a waveform diagram of the electricity application control signal given from the duty factor switching circuit to the heater driving section 402 during 600 W driving.

As shown in FIG. 88(*b*), the electricity application control signal in 600 W driving exhibits pulses having the same cycles as the alternating current supplied to the heater driving section 402. The duty ratio of the pulses is set at 50%.

When the electricity application control signal is logical "1", the heater driving section 402 passes the alternating current supplied from the power-supply circuit to the toilet seat heater 450 (thick line in FIG. 88(*a*)). Then, alternating current flows to the toilet seat heater 450 in half cycles. As a result, the toilet seat heater 450 is driven with power of 600 W.

Figure 89:
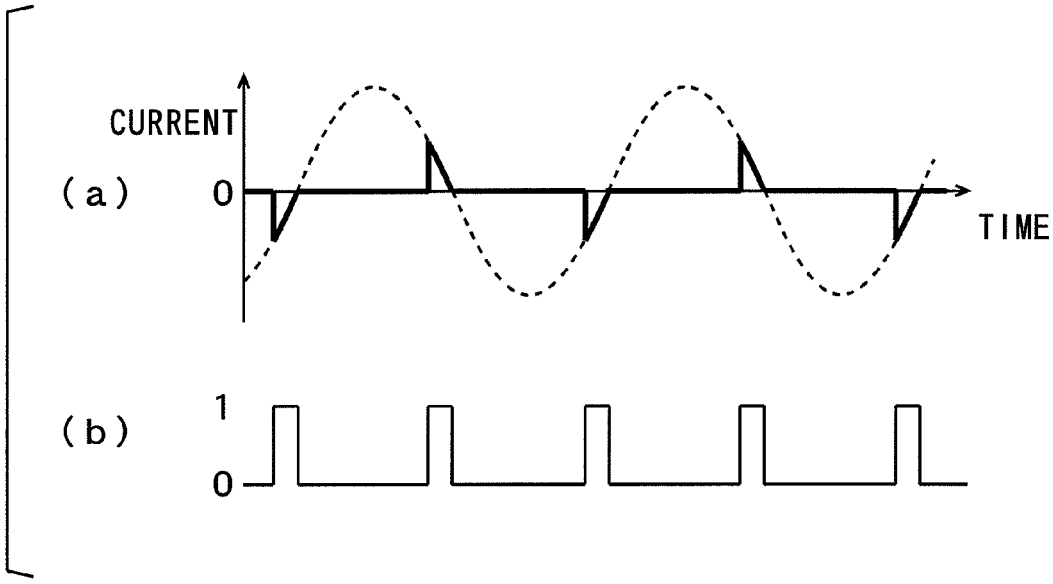
FIG. 89(*a*) is a waveform diagram of current flowing in the toilet seat heater when driven at low power, and (b) is a waveform diagram of an electricity application control signal given from the duty factor switching circuit to the heater driving section when driving at low power.

FIG. 89(*a*) is a waveform diagram of the current flowing in the toilet seat heater 450 during low power driving, and FIG. 89(*b*) is a waveform diagram of the electricity application control signal given from the duty factor switching circuit to the heater driving section 402 during low power driving.

As shown in FIG. 89(*b*), the electricity application control signal in low power driving exhibits pulses having the same cycles as the alternating current supplied to the heater driving section 402. The duty ratio of the pulses is set smaller than 50% (e.g. about several percent).

When the electricity application control signal is logical "1", the heater driving section 402 passes the alternating current supplied from the power-supply circuit to the toilet seat heater 450 (thick line in FIG. 89(*a*)). Then, in each cycle, alternating current flows to the toilet seat heater 450 in periods corresponding to the pulse width. As a result, the toilet seat heater 450 is driven with power of, e.g. about 50 W.

In other cases, for example when lowering the temperature of the toilet seat 400, or when the heating function of the toilet seat apparatus 110 is off, the duty factor switching circuit does not give electricity application control signal to the heater driving section 402 (sets the electricity application control signal at logical "0"). Thus, the heater driving section 402 does not drive the toilet seat heater 450.

Now, in general, noise is generated when current supplied to an electronic appliance contains harmonic content. In this example, when the toilet seat heater 450 is 1200 W driven or 600 W driven, the current supplied to the toilet seat heater 450 varies drawing a sine curve, so that the generation of noise is sufficiently reduced even when the magnitude of current is large.

When the toilet seat heater 450 is low power driven, the current supplied to the toilet seat heater 450 contains harmonic content, but the generation of noise is sufficiently reduced because the magnitude of current is much smaller than in 1200 W driving and 600 W driving.

As described above, in this embodiment, the toilet seat heater 450 is driven with power of 1200 W, 600 W and about 50 W, but the toilet seat heater 450 may be driven with power of other values.

For example, when alternating current is passed to the toilet seat heater 450 in half cycles, the timing for passing the alternating current is set at intervals of given cycles, such as 2 cycles or 3 cycles. Then, the toilet seat heater 450 can be driven with power having values other than 1200 W, 600 W, and about 50 W, while sufficiently preventing the generation of noise.

In this example, the controller 90 supplies current to the toilet seat heater 450 when the electricity application control signal is logical "1", and stops the supply of current to the toilet seat heater 450 when the electricity application control signal is logical "0", but the controller 90 may stop the supply of current to the toilet seat heater 450 when the electricity application control signal is logical "1", and supply current to the toilet seat heater 450 when the electricity application control signal is logical "0".

Now, since turning on/off of the toilet seat heater 450 is controlled according to time, the temperature of the toilet seat 400 might exceed given values or fall short of given values if the time is erroneously measured. Accordingly, to avoid erroneous time measurement, the controller 90 measures the time of ON of the toilet seat 400 with two measuring sources. For one measuring source, the time of ON of the toilet seat heater 450 is measured with an oscillator that defines the effective speed of programs for the controller 90, and for another measuring source, the time of ON of the toilet seat heater 450 is measured on the basis of the cycles of alternating-current voltage. The electricity application pattern is shifted to the next when at least one of the measured values exceeds a given time.

Especially, excessive temperature rise is certainly prevented by accurately measuring the time for which the toilet seat is energized at 1200 W. This further improves the safety of the apparatus. A method for improving the measuring accuracy by providing a plurality of measuring sources has been described, but the same effects can be obtained by a method in which the time of full energization of the toilet seat heater 450 is measured and then the electricity application to the heater is forcedly shut off or limited.

(8-n) Effects Related to Toilet Seat Apparatus 110

In the toilet seat apparatus 110 of this example, the heat generated in the heating wire 463*a* of the linear heater 460 is transferred to the upper toilet seat casing 410 through the enamel layer 463*b* and the insulating coating layer 462. The temperature of the seat surface 410U thus rises.

The enamel layer 463*b* has sufficient electric insulating properties. Accordingly, even when the thickness of the enamel layer 463*b* is small, the heating wire 463*a* and the upper toilet seat casing 410 can be sufficiently insulated. This allows the insulating coating layer 462 also to be formed thinner.

Accordingly, in this toilet seat apparatus 110, it is possible to reduce the thicknesses of the enamel layer 463*b* and the insulating coating layer 462 while certainly insulating the heating wire 463*a* and the aluminum plate 413 of the upper toilet seat casing 410. In this case, the heat capacities of the enamel layer 463*b* and the insulating coating layer 462 can be small, and the heat generated in the heating wire 463*a* can be efficiently transferred to the seat surface 410U.

Also, in the toilet seat apparatus 110, the aluminum plate 413 is used in the upper toilet seat casing 410. Accordingly, the heat generated in the heating wire 463*a* can be further efficiently transferred to the seat surface 410U.

As a result, it is possible to quickly raise the temperature of the seat surface 410U, while certainly insulating the heating wire 463*a* and the aluminum plate 413 of the upper toilet seat casing 410.

Also, since the heat of the heating wire 463*a* can be efficiently transferred to the seat surface 410U, the amount of heat generation of the heating wire 463*a* can be reduced. This enhances the durability of the enamel layer 463*b* and the insulating coating layer 462. This improves the reliability of the toilet seat apparatus 110.

Also, the thicknesses of the enamel layer 463*b* and the insulating coating layer 462, for insulating the heating wire 463*a* and the aluminum plate 413 of the upper toilet seat casing 410, can be small, so that the weight of the toilet seat apparatus 110 can be reduced.

Also, because the heating wire 463*a* is coated with the enamel layer 463*b* having sufficient heat resistance, material having low heat resistance can be used as the insulating coating layer 462. This certainly reduces the product costs of the toilet seat apparatus 110.

Also, when the enamel layer 463*b* is formed of polyester imide or polyamide imide having excellent electric insulating properties and excellent heat resistance, it is possible to quickly raise the temperature of the seat surface 410U while certainly insulating the heating wire 463*a* and the aluminum plate 413 of the upper toilet seat casing 410.

Also, when the total of the thickness of the enamel layer 463*b* and the thickness of the insulating coating layer 462 is 0.4 mm or less, it is possible to further quickly raise the temperature of the seat surface 410U while certainly insulating the heating wire 463*a* and the aluminum plate 413 of the upper toilet seat casing 410.

Particularly, when the total of the thickness of the enamel layer 463*b* and the thickness of the insulating coating layer 462 is 0.2 mm or less, it is possible to still further quickly raise the temperature of the seat surface 410U.

Also, since the insulating coating layer 462 is formed of material having lower heat resistance than the enamel layer 463*b*, the product costs of the toilet seat apparatus 110 can be sufficiently reduced.

Also, since the linear heater 460 is sandwiched between the meal foil 451 and the metal foil 453 provided on the back side of the upper toilet seat casing 410, the heat generated in the heating wire 463*a* is efficiently transferred to the metal foils 451 and 453. Also, one surface of the meal foil 451 is bonded to the back side of the upper toilet seat casing 410 and one surface of the metal foil 453 is bonded to the other surface of the metal foil 451. Accordingly, the heat transferred from the heating wire 463*a* to the metal foils 451 and 453 can be efficiently transferred to the entire back surface of the upper toilet seat casing 410. This makes it possible to uniformly raise the temperature of the entire seat surface 410U.

Particularly, when the metal foils 451 and 453 are made of aluminum, the heat generated in the heating wire 463*a* can be further quickly transferred to the upper toilet seat casing 410.

Also, when the heat resisting insulating layer 455 is provided between the metal foil 451 on the back surface of the upper toilet seat casing 410 and the insulating coating layer 462, the heat resisting insulating layer 455 more certainly insulates the heating wire 463*a* and the aluminum plate 413 of the upper toilet seat casing 410.

Also, since the connection 475 between the lead wire 470 and the linear heater 460 is placed between the metal foil 451 and the metal foil 453, the heat generated in the connection 475 of the lead wire 470 and the linear heater 460 is transferred to the metal foils 451 and 453. This makes it possible to further quickly raise the temperature of the seat surface 410U.

Also, since the connection 475 is coated with the heat resisting sheet 480, the connection 475 and the upper toilet seat casing 410 can be certainly insulated.

Also, because the connection 475 is coated with silicone resin, the connection 475 can be certainly waterproofed.

A high-tensile type heater wire made of Ag—Cu alloy is used as the heating wire 463*a* of the linear heater 460, and so the diameter of the heating wire 463*a* can be small while ensuring the strength of the heating wire 463*a*. This makes it possible to densely arrange the long heating wire 463*a* in a small space. This enhances the rate of temperature rise of the seat surface 410U.

<9> Operation Sequence of Components of Sanitary Washing Apparatus 100

Figure 90:
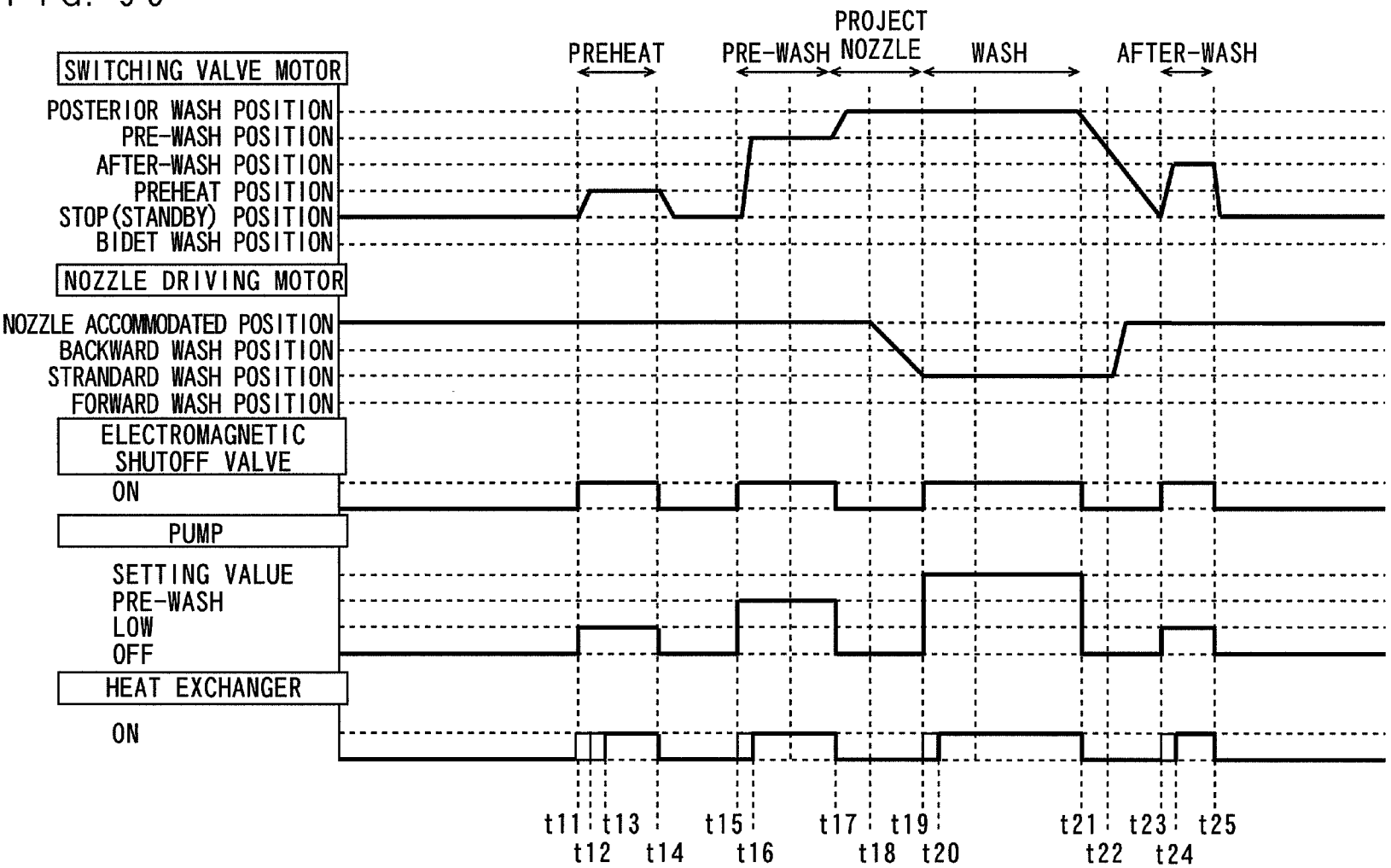
FIG. 90 is a timing chart illustrating an operation sequence of components of the sanitary washing apparatus.

FIG. 90 is a timing chart illustrating an operation sequence of components of the sanitary washing apparatus 100.

Now, the switching valve for human body, 13, of FIG. 3 switches the path of supply of washing water as the switching valve motor 13*m* rotates.

Now, the position of rotation of the switching valve motor 13*m* for releasing washing water from the posterior nozzle 21 is referred to as a posterior washing position, and the position of rotation of the switching valve motor 13*m* for releasing washing water from the bidet nozzle 22 is referred to as a bidet washing position. Also, the position of rotation of the switching valve motor 13*m* for releasing washing water from the nozzle washing nozzle 23 before human body wash is referred to as a pre-wash position, and the position of rotation of the switching valve motor 13*m* for releasing washing water from the nozzle washing nozzle 23 after human body wash is referred to as an after-wash position, and the position of rotation of the switching valve motor 13*m* for preheating washing water while discharging washing water from the nozzle washing nozzle 23 is referred to as a preheating position. Also, the position of rotation of the switching valve motor 13*m* at which washing water is not supplied to the posterior nozzle 21, bidet nozzle 22 and nozzle washing nozzle 23 is referred to as a stop (standby) position. In this example, the pre-wash position, the after-wash position, and the preheating position are the same.

At time t11, when a user sits down on the toilet seat 400, the controller 90 rotates the switching valve motor 13*m* to the preheating position, opens the electromagnetic shutoff valve 7, and operates the pump 11 with weak driving power. Then, washing water is discharged from the nozzle washing nozzle 23 through the heat exchanger 9, pump 11, and switching valve for human body 13.

When water has possibly not passed to the water circuit, as when electricity is applied to the main body 200 for the first time, no electricity is applied to the heat exchanger 9 for a time (about 3 seconds) until the water circuit becomes full, between time t11 and time t12.

The period between time t12 and time t13 is provided to prevent the heat exchanger 9 from heating when it is empty. After that, at time t13, when the flow rate measured by the flow rate sensor 8 reaches a given value, the controller 90 turns on the heat exchanger 9. Washing water is thus heated.

When the temperature of washing water has been elevated, at time t14, the controller 90 rotates the switching valve motor 13*m* to the stop position, closes the electromagnetic shutoff valve 7, and turns off the pump 11 and the heat exchanger 9.

At time t15, when the user presses the posterior switch 312, the controller 90 rotates the switching valve motor 13*m* to the pre-wash position, opens the electromagnetic shutoff valve 7, and operates the pump 11 with given pre-wash driving power. Then, washing water is released from the nozzle washing nozzle 23 through the heat exchanger 9, pump 11, and switching valve for human body 13. At time t16, when the flow rate measured by the flow rate sensor 8 reaches a given value, the controller 90 turns on the heat exchanger 9. Washing water is thus heated.

At time t17, the controller 90 rotates the switching valve motor 13*m* to the posterior washing position, closes the electromagnetic shutoff valve 7, and turns off the pump 11 and heat exchanger 9.

At time t18, the controller 90 starts projecting the posterior nozzle 21 from the stop position with the nozzle driving motor 20*m*. At time t19, when the posterior nozzle 21 has been moved to the standard position by the nozzle driving motor 20*m*, the controller 90 opens the electromagnetic shutoff valve 7 and operates the pump 11 with driving power (set value) corresponding to the setting of washing strength.

At time t20, when the flow rate measured by the flow rate sensor 8 reaches a given value, the controller 90 turns on the heat exchanger 9. Then, washing water is heated, and the heated washing water is released to the local areas of the user. The period from time t21 to time t22 is provided to remove the water pressure inside the nozzle unit 20 after the electromagnetic shutoff valve 7 was closed. This period is set to about 0.5 second, for example.

At time t21, when the user presses the stop switch 311, the controller 90 rotates the switching valve motor 13*m* toward the stop position, closes the electromagnetic shutoff valve 7, and turns off the pump 11 and heat exchanger 9. The wash of human body thus ends.

At time t22, the controller 90 operates the nozzle driving motor 20*m* to move the posterior nozzle 21 from the standard position to the stop position.

At time t23, when the switching valve motor 13*m* has rotated to the stop position, the controller 90 rotates the switching valve motor 13*m* to the after-wash position, opens the electromagnetic shutoff valve 7, and operates the pump 11 with weak driving power. Then, washing water is released from the nozzle washing nozzle 23 through the heat exchanger 9, pump 11, and switching valve for human body 13.

At time t24, when the flow rate measured by the flow rate sensor 8 reaches a given value, the controller 90 turns on the heat exchanger 9. Then, washing water is heated, and the posterior nozzle 21 and the bidet nozzle 22 are washed by the heated washing water.

At time t25, the controller 90 rotates the switching valve motor 13*m* to the stop position, closes the electromagnetic shutoff valve 7, and turns off the pump 11 and heat exchanger 9.

<10> Operation Sequence of Toilet Apparatus 1000 in Use (10-a) Entrance to Lavatory When a user enters the lavatory, the entrance detecting sensor 600 detects the user. Then, the entrance detecting sensor 600 sends an infrared entrance detect signal to the controller 90 of the main body 200.

The entrance detecting sensor 600 may continue sending the infrared entrance detect signal to the controller 90 of the main body 200 while it is detecting the user, but, for longer life of the battery, the entrance detecting sensor 600 may stop sending the entrance detect signal for a certain time period after once sending the entrance detect signal.

The controller 90 receives the entrance detect signal from the entrance detecting sensor 600, and it brings the lid 500 from the closed state to the opened state with the toilet seat and lid opening/closing device.

The controller 90 operates the heater driving section 402 to raise the temperature of the toilet seat 400 with the pattern shown in FIG. 86. Also, the controller 90 causes the toilet nozzle 40 to discharge water to the toilet surface, called "toilet pre-wash", to prevent the adhesion of wastes to the toilet surface.

Also, during the toilet pre-wash, the controller 90 illuminates the radially released washing water with a male urination target display LED (Light Emitting Diode), in order to produce visual effects.

The entrance detecting sensor 600 used herein is provided to certainly and quickly detect the entrance of a user into the lavatory so that the temperature rise of the toilet seat 400 can be started. Accordingly, even when a user enters there without turning on the main light fixture of the lavatory at night, for example, the lid 500 of the sanitary washing apparatus 100 opens with a very quick timing.

Then, the male urination target display LED is lit up at the instant when the entrance detecting sensor 600 detects a human body. Thus, the light in the toilet 700 and the light leaking from the toilet 700 dimly illuminate the vicinity of the toilet 700. This allows the user, who was sleeping, to stay sleepy without awaking. Also, this provides very safe indirect lighting of the lavatory.

(10-b) Male Urination

When the user operates the toilet seat opening/closing switch (not shown) of the remote controller 300, the controller 90 causes the toilet seat and lid opening/closing device to bring the toilet seat 400 from the closed state to the opened state. Also, the controller 90 stops the application of electricity to the toilet seat heater 450, and turns off the toilet seat temperature adjustment lamp RA1. This further improves energy saving. Also, the male urination target display LED is lit up. The male urination target display LED emits light to the target area for male urination in the toilet 700.

When the entrance detect signal from the entrance detecting sensor 600 is not received for 5 minutes with the toilet seat 400 and the lid 500 opened, the controller 90 causes the toilet seat and lid opening/closing device to bring the toilet seat 400 and the lid 500 from the opened state to the closed state.

(10-c) Sitting and Defecation

On the basis of a sitting detect signal from the sitting sensor 610, the controller 90 measures the time passing after the user sat down on the toilet seat 400. Then, it causes the heater driving section 402 to raise the temperature of the toilet seat 400 with the pattern shown in FIG. 86.

Also, when the user sits down on the toilet seat 400, it performs preheating shown in FIG. 90 to warm the water circuit including the heat exchanger 9. As explained earlier, when washing water is not supplied to the heat exchanger 9, the controller 90 turns off the heater provided in the heat exchanger (e.g. the sheathed heaters 91 and 92). The flow rate sensor 8 detects whether washing water is supplied in the heat exchanger 9. When the sheathed heaters 91 and 92 are turned on for the first time, water has not been passed to the water circuit, and therefore no electricity is passed to the sheathed heaters 91 and 92 until the water circuit becomes full (about 3 seconds), even when a given flow rate is detected by the flow rate sensor 8.

Also, when the user sits down on the toilet seat 400, the controller 90 starts the deodorizing unit 220. While the user is staying on the toilet seat 400, the deodorizing unit 220 keeps operating for 30 minutes at the maximum. The amount of airflow of the deodorizing unit 220 can be switched at three levels. The amount of airflow is set at "mid" from when the user sat down on the seat to when wash is started, and it is set at "low" during the wash, and is set at "high" for one minute after the user left the seat.

(10-d) Wash of Human Body

When the user presses the posterior switch 312 or the bidet switch 313 of the remote controller 300, the controller 90 performs pre-wash as described above, in order to warm the water circuit. This prevents the release of cold water to the user.

When the temperature detected by the exit water temperature sensor 98 of the heat exchanger 9 has continuously indicated a given temperature (32° C.) over a given time (3 seconds), the controller 90 ends the pre-wash. After the finish of the pre-wash, the controller 90 operates the nozzle driving motor 20*m* to project the posterior nozzle 21 or the bidet nozzle 22, with the electromagnetic shutoff valve 7 closed. This prevents washing water from being released to the user when the posterior nozzle 21 or the bidet nozzle 22 projects.

After the posterior nozzle 21 or the bidet nozzle 22 has reached the standard position, the controller 90 controls the pump 11 to wash the human body with the water intensity (the amount of water) set by the user with the remote controller 300. The maximum washing time is five minutes, for example.

When the user presses the stop switch 311 of the remote controller 300, the controller 90 closes the electromagnetic shutoff valve 7, and operates the nozzle driving motor 20*m* to accommodate the posterior nozzle 21 or the bidet nozzle 22 into the nozzle unit 20.

After that, the controller 90 performs after-wash with the nozzle washing nozzle 23 to clean the nozzle unit 20.

During the wash by the nozzle unit 20, the controller 90 operates the deodorizing unit 220 at low level. The lavatory is thus deodorized.

(10-e) Leaving from Seat

When the sitting sensor 610 ceases detecting the user sitting, the controller 90 cleans the nozzle unit 20 with the nozzle washing nozzle 23, while operating the nozzle driving motor 20*m* to move the posterior nozzle 21 and the bidet nozzle 22 forward and backward, in order to produce visual effects. At this time, the controller 90 lights up the male urination target display LED to emphasize the nozzle washing operation.

Also, the controller 90 operates the deodorizing unit 220 at high level for one minute after the user left the seat. The lavatory is thus strongly deodorized.

Also, when the sitting sensor 610 ceased detecting the user sitting and the entrance detecting sensor 600 did not detect the user for three minutes, the controller 90 operates the toilet seat and lid opening/closing device to bring the lid 500 from the opened state to the closed state.

(10-f) Exit from Lavatory

After the entrance detecting sensor 600 detected no user for a given time period, the controller 90 operates the toilet seat and lid opening/closing device to close the toilet seat 400 and the lid 500. Also, after one minute has passed after the entrance detecting sensor 600 ceased detecting the user, the controller 90 shuts down the passage of electricity to the toilet seat heater 450 by the heater driving section 402. The series of operation sequences of the toilet apparatus 1000 thus end.

<11> Correspondences Between Elements Recited in Claims and Elements of Embodiments In the following two paragraphs, non-limiting examples of correspondences between various elements recited in the claims below and those described above with respect to various preferred embodiments of the present invention are explained.

In the embodiments described above, the seat surface 410U is an example of a seat surface, the heating wire 463*a* is an example of a heating wire, the enamel layer 463*b* is an example of an enamel layer, the upper toilet seat casing 410 is an example of a toilet seat, the insulating coating layer 462 is an example of an insulating layer or an insulating coating layer, the insulating coating layer 462 and the heat resisting insulating layer 455 are examples of an insulating layer, and the heat resisting insulating layer 455 is an example of an insulating layer or a heat resisting insulating layer.

Also, the metal foils 451 and 453 are examples of first and second metal foils, the lead wire 470 is an example of a lead wire, the connection 475 is an example of a connection, the heat resisting sheet 480 is an example of an insulator, and silicone resin is an example of resin material.

Other various elements having configurations or functions recited in the claims can also be used as various elements of the claims.

INDUSTRIAL APPLICABILITY

The present invention is applicable to sanitary washing apparatuses that wash the local areas of human bodies, for example.

The invention claimed is:

1. A toilet seat apparatus comprising:

a toilet seat having a seat surface and including metal material;

a linear heater provided on a back side of said seat surface of said toilet seat and including an enamel layer that is provided to coat a heating wire and a periphery of said heating wire;

an insulating layer provided between said toilet seat and said enamel layer;

first and second metal foils provided on said back side of said toilet seat; and an adhesive having a characteristic of an adhesive strength of the adhesive becoming stronger at a lower temperature and becoming weaker as the temperature rises, said adhesive bonding said first metal foil and said second metal foil, said insulating layer being made of material having lower heat resistance than said enamel layer, one side of said first metal foil being bonded to said back side of said toilet seat, one side of said second metal foil being bonded to another side of said first metal foil such that said linear heater is sandwiched between said first metal foil and said second metal foil, said adhesive is charged into a gap formed between said linear heater and said first and second metal foils, and said linear heater, said first metal foil, said second metal foil and said adhesive are configured such that with the adhesive strength of said adhesive in a vicinity of said heater being lowered due to heat generation of said heating wire, said linear heater floats between said first metal foil and said second metal foil within an area in which said adhesive surrounds said linear heater, and the adhesive strength is maintained in an area separated away from said linear heater.

2. The toilet seat apparatus according to claim 1, wherein said enamel layer contains at least one of polyester imide and polyamide imide.

3. The toilet seat apparatus according to claim 1, wherein a total of a thickness of said enamel layer and a thickness of said insulating layer is not more than 0.4 mm.

4. The toilet seat apparatus according to claim 3, wherein said total is not more than 0.2 mm.

5. The toilet seat apparatus according to claim 1, wherein said linear heater includes an insulating coating layer that is provided to coat a periphery of said enamel layer.

6. The toilet seat apparatus according to claim 5, wherein said insulating coating layer includes fluororesin.

7. The toilet seat apparatus according to claim 5, wherein said insulating coating layer includes polyimide.

8. The toilet seat apparatus according to claim 1, wherein said first and second metal foils are made of aluminum.

9. The toilet seat apparatus according to claim 5, wherein said insulating layer includes a heat resisting insulating layer provided between said first metal foil on said back side of said toilet seat and said insulating coating layer.

10. The toilet seat apparatus according to claim 1, further comprising a lead wire connected to said heating wire, wherein a connection between said lead wire and said heating wire is provided between said first metal foil and said second metal foil.

11. The toilet seat apparatus according to claim 10, wherein said connection is coated with an insulator.

12. The toilet seat apparatus according to claim 10, wherein said connection is coated with resin material.

13. The toilet seat apparatus according to claim 1, wherein said heating wire is made of alloy material.

14. The toilet seat apparatus according to claim 13, wherein said alloy material includes silver and copper.

15. The toilet seat apparatus according to claim 1, wherein said toilet seat is made of material including at least one of aluminum, copper, stainless, aluminum plated steel and zinc aluminum plated steel.

* * * * *